US006797411B2

(12) United States Patent
Sodani et al.

(10) Patent No.: US 6,797,411 B2
(45) Date of Patent: Sep. 28, 2004

(54) GALVANIZED STEEL SHEET, METHOD FOR MANUFACTURING THE SAME, AND METHOD FOR MANUFACTURING PRESS-FORMED PRODUCT

(75) Inventors: Yasuhiro Sodani, Fukuyama (JP); Yukio Kimura, Fukuyama (JP); Masayasu Ueno, Fukuyama (JP); Shogo Tomita, Kawasaki (JP); Hisato Noro, Fukuyama (JP); Kaoru Sato, Yokohama (JP); Yoshiharu Sugimoto, Fukuyama (JP); Satoru Ando, Fukuyama (JP); Masaki Tada, Fukuyama (JP); Junichi Inagaki, Fukuyama (JP); Masaaki Yamashita, Fukuyama (JP); Yuji Yamasaki, Fukuyama (JP)

(73) Assignee: NKK Corporation, Tokyo (JP)

( * ) Notice: Subject to any disclaimer, the term of this patent is extended or adjusted under 35 U.S.C. 154(b) by 0 days.

(21) Appl. No.: 10/465,461

(22) Filed: Jun. 18, 2003

(65) Prior Publication Data

US 2003/0219621 A1 Nov. 27, 2003

Related U.S. Application Data

(63) Continuation of application No. 10/174,441, filed on Jun. 17, 2002, now abandoned, which is a continuation of application No. PCT/JP01/09144, filed on Oct. 18, 2001.

(30) Foreign Application Priority Data

| | | |
|---|---|---|
| Oct. 19, 2000 | (JP) | 2000-318713 |
| Oct. 19, 2000 | (JP) | 2000-318715 |
| Mar. 27, 2001 | (JP) | 2001-091005 |
| Jul. 12, 2001 | (JP) | 2001-211612 |

(51) Int. Cl.[7] ..... B21D 22/02; B21D 22/20; B24C 1/06; C22C 2/26; C22C 22/07

(52) U.S. Cl. ..... 428/659; 428/687; 428/632; 427/433; 427/349

(58) Field of Search ..... 428/659, 687, 428/612, 639, 632, 633; 427/433, 367, 349; 148/533

(56) References Cited

U.S. PATENT DOCUMENTS

| | | | |
|---|---|---|---|
| 3,787,191 | A | 1/1974 | Duncan |
| 4,326,388 | A | 4/1982 | McFee |
| 5,125,362 | A | 6/1992 | Erickson et al. |
| 5,203,930 | A | 4/1993 | Blumlhuber et al. |
| 5,641,543 | A | 6/1997 | Brooks |

FOREIGN PATENT DOCUMENTS

| | | | |
|---|---|---|---|
| CH | 658472 | A5 | 11/1986 |
| JP | 56-36318 | A | 4/1981 |
| JP | 56-144777 | | 11/1981 |
| JP | 57-114611 | | 7/1982 |

(List continued on next page.)

OTHER PUBLICATIONS

English language translation of Japanese Kokai Patent Application No. Sho 63[1988]–166953, published Jul. 11, 1988, translation is 9 pages.*

JIS B 0601, "Definitions and Designation of Surface Roughness" (English language version), pp. 91–101 (1982).

SAE 911 Standard, "10 Ferrous and Nonferrous—General", pp. 10.01 and 10.02 and contents page of 1978 SAE Handbood Contents Part 1.

W. Zimnick et al, "Pretex–Ein neues Verfahren zur Erzeugung texturierter Feinbleche . . . ", Stahl and Eisen 118, Nr. 3, pp. 75–80 (1998).

*Primary Examiner*—John J. Zimmerman
(74) *Attorney, Agent, or Firm*—Frishauf, Holtz, Goodman & Chick, P.C.

(57) ABSTRACT

The method for manufacturing galvanized steel sheet has a step of adjusting the surface texture thereof by blasting solid particles against the surface thereof. The surface texture is defined by at least one parameter selected from the group of parameters consisting of mean roughness Ra on the surface of steel sheet, peak count PPI on the surface of steel sheet, and filtered centerline waviness Wca on the surface of steel sheet. The galvanized steel sheet has a surface in dimple-pattern texture.

34 Claims, 62 Drawing Sheets

FOREIGN PATENT DOCUMENTS

| | | | |
|---|---|---|---|
| JP | 62-253780 | | 11/1987 |
| JP | 63-166953 | | 7/1988 |
| JP | 4-83860 | A | 3/1992 |
| JP | 5-15901 | A | 1/1993 |
| JP | 6-75728 | A | 9/1994 |
| JP | 7-124604 | A | 5/1995 |
| JP | 7-136701 | A | 5/1995 |
| JP | 10-130803 | A | 5/1998 |
| JP | 11-302816 | A | 11/1999 |
| JP | 2000-160354 | A | 6/2000 |
| JP | 2001-234314 | A | 8/2001 |

* cited by examiner

PARTICLE:B1
Ra=1.46 μm
PPI=431

100 μm

PARTICLE:D2
Ra=1.82 μm
PPI=243

100 μm

PARTICLE:A1

100 μm

Ra:1.26 μm

PPI:400

PARTICLE:B1

100 μm

Ra:1.18 μm

PPI:440

(a)

(b)

Ra=1.82 μm
PPI=243

100 μm

Ra=1.46 μm
PPI=431

100 μm (a)

(b)

GALVANIZED STEEL SHEET, METHOD FOR MANUFACTURING THE SAME, AND METHOD FOR MANUFACTURING PRESS-FORMED PRODUCT

This is a continuation of application Ser. No. 10/174,441 filed Jun. 17, 2002 (now abandoned), which is a Continuation Application of International Application PCT/JP01/09144 filed Oct. 18, 2001.

FIELD OF THE INVENTION

The present invention relates to a galvanized steel sheet, a method for manufacturing the same, and a method for press-formed product.

BACKGROUND OF THE INVENTION

Demand of galvanized steel sheets having superior rust-preventive performance increases as thin steel sheets for automobiles, household electric appliances, and building materials. Galvanized steel sheets used for press-forming are required to have an adequate level of surface roughness, or of microscopic roughness profile on the surface thereof because the microscopic roughness increases the retainability of lubrication oil between the work (galvanized steel sheet) and a press-mold, decreases the sliding resistance of the work, and prevents the occurrence of die-galling.

Generally a mean roughness Ra defined in JIS B0601 is adopted as an index of the texture of microscopic roughness on the surface of steel sheet. For galvanized steel sheets used in press-forming, generally the oil-retainability between the work and the mold during the press-forming is assured by regulating the mean roughness Ra within a specified range.

Other indexes, however, such as the maximum height of roughness profile, Rmax, and the ten-point height of roughness profile may also be applied. Alternatively, JP-A-7-136701, (the term "JP-A" referred herein signifies the "Unexamined Japanese patent publication"), defines the sum of the volumes of profile valley portions per unit are as the index, and gives evaluation of excellent press-formability for the index larger than a specified value thereof. In any case, the press-formability cannot be assured unless the surface of target galvanized steel sheet has a certain level of microscopic roughness profile.

Particularly for galvanized steel sheets that have a coating film consisting mainly of η phase, the film is soft and has low melting point compared with the surface of alloyed hot-dip galvanized steel sheets, so they likely induce adhesion to the press-mold and may degrade the press-formability. Consequently, that type of galvanized steel sheets has to assure increased oil-retainability. With these reasons, that type of galvanized steel sheets are often requested to have relatively large values of height of roughness profile on the surface, or mean roughness Ra, necessary to assure the press-formability compared with alloyed hot-dip galvanized steel sheets.

On the other hand, the galvanized steel sheets used in exterior plates of automobiles and the like are requested to have press-formability and also excellent image clarity after painting. Therefore, to improve only the image clarity after coating, the surface of galvanized steel sheet is finished to a bright face. However, improvement in the press-formability needs to establish a certain level of surface roughness. The two requirements conflict with each other.

The relation between the image sharpness after painting and the microscopic texture of surface of steel sheet is described in, for example, JP-B-6-75728, (the term "JP-B" referred herein signifies the "Examined Japanese patent publication"). According to the disclosure, since the coating film itself acts as a low pass filter to the microscopic roughness profile on the surface of steel sheet, the short-period roughness profile is covered by the coating film, thus the short-period roughness profile does not give influence on the image sharpness after coating. On the other hand, the long-period roughness profile portions having wavelengths of several hundreds of micrometers or larger are not covered by the coating, thus degrading the image sharpness.

A countermeasures to the phenomenon is to regulate the filtered centerline waviness Wca which is an index for expressing the microscopic roughness profile on the surface of steel sheet before coating to not exceed a certain level, thus improving the image sharpness after coating. The term "filtered centerline waviness Wca" is a parameter that is defined by JIS B0610, and represents the mean height of roughness profile on the surface after treated by high-pass cut-off.

Other than the filtered centerline waviness Wca, peak count PPI is applied as an index of influence on the image sharpness after coating. As specified in SAE 911 Standard, the peak count PPI is the number of peaks of roughness profile per one inch length. Large peak count means the large number of short-period roughness profile in the microscopic roughness profile on the surface, or, when compared on the same mean roughness Ra, the long-period wave length components are relatively decreased. That is, if the mean roughness Ra is the same, larger peak count PPI should give superior image sharpness after coating.

Consequently, the galvanized steel sheets for press-forming use need to have a surface roughness with a certain level of microscopic roughness profile, and, when the image sharpness after coating is required, the long-period components are necessary to be decreased. In particular, different from the alloyed hot-dip galvanized steel sheets that form microscopic roughness profile on the surface thereof during alloying stage, the galvanized steel sheets that have a coating film consisting mainly of η phase give smooth surface thereof after coating, so there is a strong need of giving surface roughness by some means.

Temper rolling is applied as a means to give microscopic roughness profile on the surface of galvanized steel sheets used for press-forming. The temper rolling is a means that uses a rolling roll having microscopic roughness profile on the surface thereof, and that applies a plastic extension in an approximate range of from 0.5 to 2.0% to the steel sheet, thus inducing a pressure on the roll byte to transfer the roughness profile on the surface of the rolling roll to the surface of the steel sheet. Therefore, the texture of microscopic roughness profile formed on the surface of galvanized steel sheet depends on the texture of roughness profile on the surface of the rolling roll.

The applicable method to form microscopic roughness profile on the surface of temper rolling roll includes shot-blasting, electrical discharge machining, laser beam machining, and electron beam machining. For example, JP-A-7-136701 and JP-B-6-75728 disclose a method that uses a temper rolling roll finished by laser dull treatment, and JP-A-11-302816 discloses a method that uses a temper rolling roll finished on the surface thereof by electron beam machining.

Zinmnik et al. (Stahl und Eisen, Vol.118, No.3, pp.75–80, 1998) reports a method to increase the peak count PPI on the surface of steel sheet using a temper rolling roll, which method is called the "Pretex process". According to the report, hard metallic chromium is electrically deposited to form microscopic roughness profile on the surface of rolling roll. Zinmnik et al. describe that the method can create short pitch and dense roughness profile compared with the rolling-roll surface machining by shot-blasting.

According to the report, a rolling roll with shot-blast finish creates around 120 of peak count PPI on the surface of steel sheet, and the Pretex process can increase the peak count PPI to around 230. The threshold of the peak count PPI given in the report is ±0.5 μm, (in contrast, the threshold of the peak count PPI referred in the descriptions is ±0.635 μm).

The related art applying temper rolling, which is used as a method to provide a certain level of surface roughness on the surface of galvanized steel sheet for press-forming, has problems described below.

First, the degree of transferring the microscopic roughness profile on the surface of a rolling roll by the temper rolling onto the surface of a galvanized steel sheet has a limitation. Thus, even when the surface of rolling roll has fine roughness profile, all of the profile cannot be transferred onto the surface of steel sheet, and the peak count PPI on the surface of the steel sheet cannot be increased.

The temper rolling transfers the microscopic roughness profile on the surface of rolling roll onto the surface of steel sheet while applying a certain level of plastic extension onto the steel sheet utilizing the pressure induced in the roll byte. The main function of the temper rolling is, however, to adjust the mechanical properties of the steel sheet after annealing, so the maximum extension to achieve the objective has a limitation. Therefore, to almost completely transfer the microscopic roughness profile on the surface of rolling roll onto the surface of steel sheet, the pressure induced in the roll byte may be significantly increased. In that case, however, the bulk deformation of the steel sheet becomes excessive, and the mechanical properties of the steel sheet degrade.

For instance, with an objective of adjusting the mechanical properties of a steel sheet, when the extension that can be given by the temper rolling is in a range of from 0.5 to 2.0%, the mean roughness Ra on the surface of rolling roll is necessary be regulated to a range of approximately from 2.5 to 3.5 μm to obtain the mean roughness Ra on the surface of steel sheet in a range of from 1.0 to 1.5 μm. In that case, to increase the peak count PPI on the surface of the rolling roll, even when the rolling roll is machined using electrical discharge machining, electron beam machining, or the like, the attainable peak count PPI on the surface of the rolling roll is around 300 at the maximum. Since the degree of transfer of the peak count PPI by the temper rolling in that case is in an approximate range of from 60 to 70%, the peak count PPI of the microscopic roughness profile transferred onto the surface of steel sheet is around 200 at the maximum.

For example, the above-referred JP-A-11-302816 discloses a technology of applying the electron beam machining onto the surface of rolling roll. The embodiments of the disclosure describe the pitch of peaks and valleys of surface roughness profile of a galvanized steel sheet of about 0.11 mm, which suggests the number of peaks and valleys of roughness profile per one inch length of about 230. The above-described Pretex method also provides around 230 of the peak count PPI on the surface of steel sheet. Thus, the existing technologies cannot give further dense short-wave length roughness profile on the surface of steel sheet.

Particularly the galvanized steel sheets with a coating film consisting mainly of η phase often increase the mean roughness Ra compared with the alloyed hot-dip galvanized steel sheets, so the mean roughness to be given on the surface of the rolling roll has to be increased responding thereto. Since, however, the above-described various types of roll-surface finishing methods decrease the peak count PPI in the case of increasing the mean roughness on the surface of rolling roll, which results in difficulty in increasing both the mean roughness Ra and the peak count PPI at a time.

In the case that that type of galvanized steel sheets are used for press-forming, the oil retainability between the steel sheet and the press-mold is not sufficient, and the sliding resistance between them increases, thus inducing problems of likely generating break of the steel sheet at punch face or break of the steel sheet near the mold bead portion.

Secondly, a roll byte applied in the temper rolling gives very high contact pressure between the rolling roll and the steel sheet, so the microscopic roughness profile on the surface (surface roughness) of the rolling roll varies with time owing to wear, thus the texture of microscopic roughness profile being transferred onto the surface of steel sheet cannot be kept uniformly.

For example, when a rolling roll having a surface mean roughness Ra of 3.5 μm is used, the temper rolling of about 6 km in rolling length degrades the mean roughness Ra on the surface of rolling roll to around 3.0 μm. As a result, the mean roughness Ra on the surface of galvanized steel sheet also decreases from 1.5 μm to around 1.3 μm. The influence of the wear of the surface of rolling roll becomes significant with the increase in the rolling length. The resulting variations in the microscopic roughness texture on the surface of individual products induce differences in press-formability, which raises a problem of unstable quality.

Therefore, for keeping stable press-formability of steel sheets, the rolling roll is necessary to be replaced before the wear on the surface thereof significantly proceeds. The frequent replacement of the rolling roll degrades the production efficiency.

For the case of galvanized steel sheets having a coating film consisting mainly of η phase, larger Ra is often requested than the Ra of alloyed hot-dip galvanized steel sheets. Consequently, the surface mean roughness Ra on the rolling roll has to be larger, and the influence of the wear on the surface of rolling roll with time becomes significant. Furthermore, adding to the wear, the apparent surface roughness of the roll is decreased by adhering zinc powder separated from the steel sheet to the profile valley portions of the microscopic roughness profile on the surface of rolling roll (what is called the clogging), thus inducing variations in microscopic roughness profile on the surface of the producing galvanized steel sheets with time.

Thirdly, with the manufacturing methods of galvanized steel sheets in related art, when the grades or the like of the treating galvanized steel sheets change to vary the hardness of substrate sheets, it is difficult to attain consistent level of surface roughness.

The problem is described referring to FIG. 36. FIG. 36 shows a result of temper rolling on galvanized steel sheets using a rolling roll which was finished in the surface thereof to give a mean roughness Ra of 3.0 μm by the electrical discharge machining.

The temper rolling was applied to a hard material (high strength steel of the substrate sheet) and to a soft material (soft very low carbon steel), both were treated by hot-dip galvanizing in advance. During the temper rolling, the applied extension was varied stepwise, and the mean roughness on the surface of each of the galvanized steel sheets was determined. The figure shows that the hard material gives larger mean roughness on the surface of the galvanized steel sheet resulting from the temper rolling than that of the hard material. The reason of the difference is that the contact pressure between the rolling roll and the steel sheet, generated during attaining a specified extension, increases more in hard material than in soft material, and higher contact pressure more likely induces the deformation of the galvanized film layer, which results in easy for transferring the microscopic roughness profile on the surface of rolling roll.

In some cases, both the hard material and the soft material have to regulate the surface mean roughness Ra to a range of from 1.0 to 1.2 μm, and the extension during the temper rolling to a range of from 0.8 to 1.0% for adjusting the mechanical properties in view of assuring the press-formability of the steel sheet. In that case, the result given in FIG. 36 suggests that the soft material can manufacture a galvanized steel sheet that satisfies the requirements, and, however, the hard material fails in attaining the objectives even when the same rolling roll as that used for the soft material is applied.

Consequently, for the case of applying temper rolling to a soft material, the surface mean roughness Ra of the rolling roll has to be decreased below the above-given 3.0 μm. That is, the objectives cannot be attained unless the rolling roll is replaced. In other words, within a range of extension limited by the target material, the same rolling roll cannot give the same surface roughness on galvanized steel sheets with different steel grades.

SUMMARY OF THE INVENTION

It is an object of the present invention to provide a galvanized steel sheet having excellent press-formability and a method for manufacturing the same.

To attain the object, the present invention provides a method for manufacturing a galvanized steel sheet, in which solid particles are blasted against the surface of the galvanized steel sheet to adjust the surface texture thereof.

The surface texture is preferably defined by at least one parameter selected from the group consisting of mean roughness Ra on the surface of steel sheet, peak count PPI on the surface of the steel sheet, and filtered centerline waviness Wca on the surface of the steel sheet.

The mean roughness Ra on the surface of steel sheet, the peak count PPI on the surface of steel sheet, and the filtered centerline waviness Wca on the surface of the steel sheet are preferably adjusted in a range given below.

(a) The mean roughness on the surface of steel sheet, Ra: 0.3 to 3 μm (b) The peak count on the surface of steel sheet, PPI: 250 or more (c) The filtered centerline waviness on the surface of steel sheet, Wca: 0.8 μm or less The solid particles blasted against the surface of galvanized steel sheet preferably have mean particle sizes of from 10 to 300 μm. The solid particles are preferably a metallic material. The solid particles are preferably in near-spherical shape.

The step of adjusting the surface texture is preferably conducted by blasting solid particles against the surface of galvanized steel sheet at blasting speeds of from 30 to 300 m/sec, thus adjusting the surface texture of the steel sheet. It is preferable that the solid particles are blasted against the surface of galvanized steel sheet at blasting densities of from 0.2 to 40 kg/m$^2$, thus adjusting the surface texture of the steel sheet. Prior to the step for adjusting the surface texture, a step for temper rolling may be applied to adjust the centerline waviness Wca on the surface of galvanized steel sheet to 0.7 μm or less.

The adjustment of the surface texture is preferably done using a wheel blast machine. The distance between the center of rotating wheel and the steel strip is preferably 700 mm or less. The solid particles blasted against the surface of galvanized steel sheet preferably have mean particle sizes of from 30 to 300 μm.

When the mean particle size is signified by d, the solid particles preferably have 85% or higher weight percentage of the solid particles having sizes of from 0.5d to 2d to the total weight of the solid particles. The solid particles preferably have the densities of 2 g/cm$^3$ or more.

Furthermore, the present invention provides a galvanized steel sheet having a surface of dimple-pattern texture.

The term "dimple-pattern" referred herein designates a texture where the profile valley portions on the surface consist mainly of curved surfaces, or, for example, the texture having large number of crater-shape concavities formed by colliding near-spherical shape objects against the surface. With the large number of dimple-shape concavities, the concavities play a role of pockets for oil of press-forming, thus improving the oil-retainability between the mold and the steel sheet.

The surface preferably has mean roughness Ra in a range of from 0.3 to 3 μm. The term "mean roughness" referred herein designates the "centerline mean roughness" specified in JIS B0601.

The surface preferably has peak count PPI expressed by the formula:

$$-50\times Ra(\mu m)+300<PPI<600$$

The term "peak count" referred herein designates the number of peak portions of roughness profile on the surface per one inch length. The above-given peak count PPI is expressed by a value at ±0.635 μm of the threshold.

The surface preferably has at least 250 of peak count PPI.

The surface has filtered centerline waviness Wca of 0.8 μm or less. The term "filtered centerline waviness" referred herein designates the "centerline waviness" specified in JIS B0610, and represents the mean height of roughness profile after treated by high-pass cutoff.

The galvanized steel sheet preferably has a coating film consisting essentially of η phase.

The galvanized steel sheet preferably has number densities of concavities of $3.1\times10^2$ counts/mm$^2$ or more at a depth level corresponding to 80% bearing area ratio.

The surface of the galvanized steel sheet preferably has a surface texture giving core fluid retaining indexes Sci of 1.2 or more.

The galvanized steel sheet preferably further has a solid lubrication film having thicknesses of from 0.001 to 2 μm on the surface thereof. The solid lubrication film is preferably a film selected from the group consisting of an inorganic solid lubrication film, an organic solid lubrication film, and an organic-inorganic composite solid lubrication film.

The solid lubrication film is preferably a phosphorous-base oxide film prepared by applying and drying an aqueous solution containing phosphoric acid and at least one cationic component selected from the group consisting of Fe, Al, Mn, Ni, and $NH_4^+$.

The above-described solid lubrication film is more preferably the one described below.

(1) The solid lubrication film contains a P component and an N component, and at least one component selected from the group consisting of Fe, Al, Mn, and Ni. The solid lubricating film has a molar ratio (a)/(b) in a range of from 0.2 to 6, where (a) designates the amount of P component, and (b) designates the total amount of N component, Fe, Al, Mn, and Ni; the amount of P component is expressed by the $P_2O_5$ converted value, and the amount of N component is expressed by the ammonium converted value.

(2) The solid lubrication film contains the P component and the N component as the solid lubrication film components in a form of chemical compound selected from the group consisting of a nitrogen compound, a phosphorus-base compound, and a nitrogen-phosphorus-base compound.

(3) The solid lubrication film contains at least Fe as the solid lubrication film component.

The galvanized steel sheet having the above-described solid lubrication film is manufactured by the steps of: applying an aqueous solution containing a cationic component ($\alpha$) and a phosphoric acid component ($\beta$) on the surface of plated layer of a galvanized steel sheet; and drying the applied film without washing thereof with water, thus forming a coating film. The cationic component ($\alpha$) consists substantially of at least one metallic ion or cation selected from the group consisting of Mg, Al, Ca, Ti, Fe, Co, Ni, Cu, Mo, and $NH_4^+$. The aqueous solution has a molar concentration ratio ($\alpha$)/($\beta$) ranging from 0.2 to 6, where ($\alpha$) designates the total amount of cations, and ($\beta$) designates the amount of phosphoric acid component. The phosphoric acid is expressed by the value converted to $P_2O_5$ molar concentration.

Furthermore, the present invention provides a method for manufacturing press-formed product, which contains the first step of preparing a galvanized steel sheet member having a surface in dimple-pattern texture, and the second step of applying press-forming to the member to obtain designed shape of press-formed product.

EMBODIMENT FOR CARRYING OUT THE INVENTION

Embodiment 1

Figure 1:
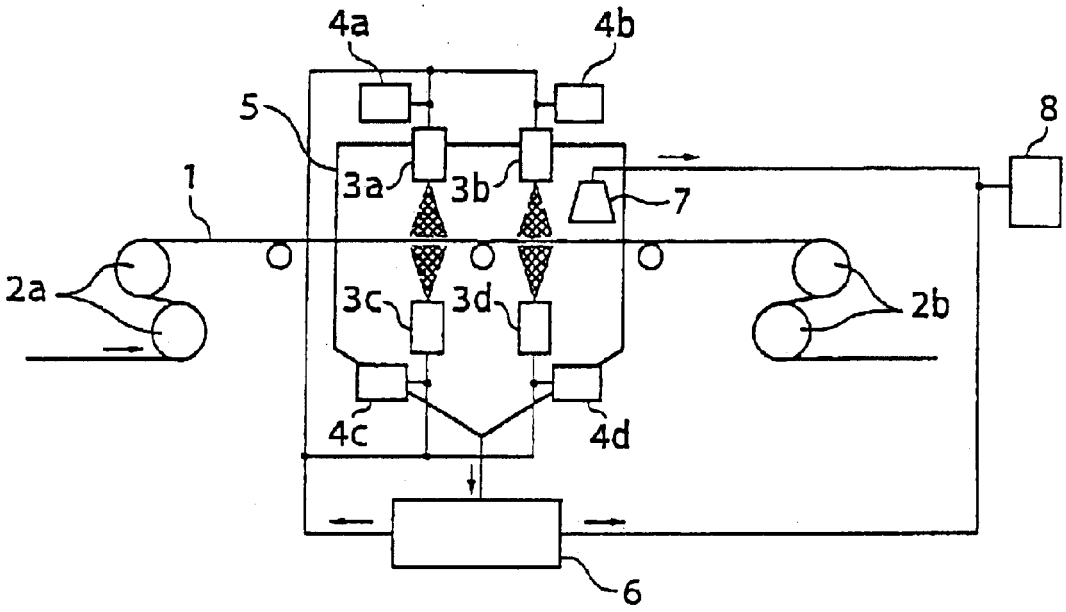
FIG. 1 illustrates outline of an apparatus for carrying out the first example of the Embodiment 1.

The Embodiment 1 provides a method for manufacturing galvanized steel sheet that is more suitable for press-forming by giving dense microscopic roughness profile on the surface thereof than the galvanized steel sheet obtained by temper rolling method. In particular, the Embodiment 1 aims to provide a method for manufacturing galvanized steel sheet having also superior image sharpness after coating by realizing high peak count and reduced waviness which has a long period of roughness profile on the surface, while providing relatively large mean roughness Ra on the surface thereof. Furthermore, the Embodiment 1 aims to provide a method for creating a novel surface texture that decreases frequent replacement of roll, which is a problem in the temper rolling method, thus improving the productivity, and that widens the range of adjusting the surface roughness.

The Embodiment 1-1 is a method for manufacturing galvanized steel sheet having excellent press-formability, which method contains the step of blasting solid particles against the surface of the galvanized steel sheet to adjust the surface texture thereof.

In the Embodiment 1-1, individual solid particles blasted against the surface of galvanized steel sheet collide with the zinc-coating film on the surface thereof to create dents on the surface of the coating film. By the collision of large number of solid particles against the surface of galvanized steel sheet, large number of peaks and valleys appear on the surface thereof, thus providing a certain texture of microscopic roughness profile on the surface. The height and width of the peaks and valleys and the pitch of adjacent peaks and valleys of roughness profile depend on the kinetic energy of solid particles, the particle size, and the blasting quantity of the solid particles per unit area, and on the hardness of the zinc-coating film. Therefore, the surface texture can be adjusted by controlling these variables.

A feature of the microscopic roughness profile formed by blasting the solid particles against a galvanized steel sheet, in terms of texture of the surface, is the creation of dents mainly in a shape of concavity on the surface of the galvanized steel sheet. That type of surface texture provides an effect to improve the oil-retainability between the mold and the galvanized steel sheet during press-forming stage.

To the contrary, the temper rolling method which is a related art needs to give the rolling roll a surface texture consisting mainly of microscopic profile peak portions for creating a concavity texture on the surface thereof. Forming microscopic profile peak portions densely on the surface of rolling roll is, however, difficult in normal practice. Thus, all of the shot-blasting, the electrical discharge machining, the laser machining, and the electron beam machining, applied to the surface of rolling roll, have to form mainly concavity shape on the surface, in principle.

Consequently, when indexes such as mean roughness Ra and peak count PPI, which are the parameters representing the microscopic roughness profile surface texture, are applied, the galvanized steel sheet prepared by the Embodiment 1-1 provides superior press-formability even if these parameters are the same values as those of the galvanized steel sheet according to the related art. On that point, the method according to the Embodiment 1-1 should be intrinsically different one from the related art of the method for surface texture adjustment on a galvanized steel sheet using the temper rolling method. In this regard, the term "surface texture" referred herein covers wide concept including the mean roughness Ra on the surface of galvanized steel sheet, the peak count PPI on the surface of steel sheet, the filtered centerline waviness Wca on the surface of steel sheet, the shape and depth of individual profile valley portions, and the pitch between adjacent profile valley portions.

In the Embodiment 1-1, the surface texture formed on the galvanized steel sheet can be controlled by varying the blasting conditions of solid particles. For example, the microscopic roughness profile on surface formed on a galvanized steel sheet can be varied by changing the material of solid particles, the mean particle size thereof, the distribution of particle size thereof, the shape and density of individual solid particles, or the blasting speed and blasting density (weight of solid particles blasted per unit area) of solid particles. That is, it is easy to prepare optimum surface texture responding to the specification and use of the target galvanized steel sheet. In addition, since there occurs no problem of change in the surface texture with time owing to wear of the surface of temper rolling roll, which appears in the related art, a wanted surface texture is stably attained independent of the manufacturing lots.

The dents created by the collision of solid particles appear in a limited zone near the zinc-coating layer, so they are not significantly affected by the hardness of the substrate steel grade applied. Consequently, the size of concavities created on the surface of coating film is mainly depending on the hardness of the coating film and is not so depending on the substrate steel grade. As a result, there occurs no problem of "unable to provide the same surface roughness profile onto galvanized steel sheets having different grade of substrate steel with each other, using the same rolling roll and within a range of extension limited by the material applied", which problem arises in the related art which uses the temper rolling to transfer a surface roughness profile of the rolling roll.

The Embodiment 1-2 is a modified mode of the Embodiment 1-1, in which the adjusted surface texture is defined by at least one parameter selected from the group consisting of the mean roughness Ra on the surface of steel sheet, the peak count PPI on the surface of steel sheet, and the filtered centerline waviness Wca on the surface of the steel sheet.

In the Embodiment 1-1, the surface texture being adjusted is defined by parameters including several ones as described above, and no specific limitation is given. Nevertheless, the adjusted surface texture is preferably defined by at least one parameter of the mean roughness Ra, the peak count PPI, and the waviness Wca. The reason is that, although the surface texture formed by the solid particle blasting has inherent effect of improving the press-formability of the galvanized steel sheet, a certain index is required to apply for controlling the product quality and for assuring the stability of the product quality.

Adjustment of mean roughness Ra corresponds to varying the oil-retainability between the mold and the steel sheet during press-forming a galvanized steel sheet, and to adjusting the lubrication and the die-galling resistance during the press-forming stage. In addition, the peak count PPI varies the oil-retainability during the press-forming stage and gives influence on the image sharpness after coating. Furthermore, the waviness Wca is a parameter that gives influence on the image sharpness after coating. By separately or jointly adjusting these parameters, it becomes possible to establish optimum levels of the characteristics such as the press-formability and the image sharpness after coating, responding to the use of the steel sheet.

Generally, increased particle size, density, and blasting speed of the solid particles create large concavities on the surface of the zinc-coating film, so that the mean roughness Ra on the surface becomes large. On the other hand, for the peak count PPI on the surface, by using small size of solid particles being blasted, dense dents are created on the surface of steel sheet, which increases the peak count PPI. In addition, the size and density of solid particles, and the blasting speed and blasting density of the solid particles give influence on the waviness on the surface of steel sheet. Thus, by using the solid particles having small mean particle size and uniform particle size distribution, the waviness Wca on the surface of steel sheet can be decreased.

The Embodiment 1-3 is a modified Embodiment 1-2, in which the mean roughness Ra on the surface of steel sheet is adjusted in a range of from 0.3 to 3 μm.

If the mean roughness Ra on the surface of galvanized steel sheet becomes lower than 0.3 μm, the oil-retainability between the mold and the steel sheet during the press-forming stage becomes insufficient, thus the sliding resistance between the steel sheet and the mold increases to likely induce break of the steel sheet. If the mean roughness Ra exceeds 3 μm, the amount of oil retained in the interface between the mold and the steel sheet saturates, and, by contacting the mold with locally high peak portions in the microscopic roughness profile on the surface of steel sheet, die-galling likely occurs. Consequently, the Embodiment 1-3 adjusts the mean roughness Ra on the surface of steel sheet to a range of from 0.3 to 3 μm.

The related art normally provides mean roughness Ra on the surface of galvanized steel sheet in an approximate range of from 0.5 to 2 μm. The galvanized steel sheet prepared by the Embodiment 1-3, however, gives superior press-formability to the galvanized steel sheet prepared by the related art, even with the same mean roughness Ra on the surface, thus the one prepared by the Embodiment 1-3 attains equal or superior characteristics even when the surface mean roughness is adjusted in a wider range than that of related art.

The Embodiment 1-4 is a modification of the Embodiment 1-2 or the Embodiment 1-3, in which the peak count PPI on the surface of steel sheet is adjusted to 250 or more.

For a galvanized steel sheet prepared by the related art, it is difficult to increase the peak count PPI on the surface thereof to 230 or more because of the limitation of available extension by the temper rolling. On the other hand, for the case that the surface texture of a galvanized steel sheet is adjusted by blasting solid particles against the surface thereof, the surface texture can be adjusted without giving plastic extension to the substrate steel sheet. In addition, by adjusting the blasting conditions such as the blasting density of solid particles, dents can be created densely over the whole surface area of the galvanized steel sheet. As a result, the peak count PPI on the surface of galvanized steel sheet is readily adjusted to 250 or higher level.

By achieving 250 or higher peak count PPI, which cannot be attained by the related art, the sliding characteristics between the mold and the steel sheet during the press-forming stage further improve, and the long-period components of the microscopic roughness profile on the surface decrease, thus providing excellent image sharpness after coating.

The Embodiment 1-5 is a modification of any one of the Embodiment 1-2 through the Embodiment 1-4, in which the filtered centerline waviness Wca on the surface of steel sheet is adjusted to 0.8 μm or less.

When the waviness Wca on the surface of steel sheet exceeds 0.8 μm, the long-period components of the microscopic roughness profile on the surface increase, which components remain on the surface after coating to degrade the image sharpness. In particular, the remained long-period components are not suitable for the galvanized steel sheet used as the external plate members of automobiles. Therefore, the Embodiment 1-5 improves the image sharpness after coating by adjusting the waviness Wca on the surface of steel sheet to 0.8 μm or less, as well as improving the press-formability by blasting solid particles against the surface of galvanized steel sheet.

The Embodiment 1-6 is a modification of either one of the Embodiment 1-1 through the Embodiment 1-5, in which the solid particles being blasted against the surface of galvanized steel sheet adopt those having mean particle sizes of from 10 to 300 μm.

The size of dents created on the surface of galvanized steel sheet increases with the increase in the mean particle size of the solid particles blasted against the surface thereof. If the mean particle size exceeds 300 μm, however, the size of concavities created on the surface of galvanized steel sheet becomes large, it becomes impossible to provide dense microscopic roughness profile on the surface. As a result, the peak count PPI on the surface of galvanized steel sheet cannot be increased, and the sliding resistance between the mold and the steel sheet increases during the press-forming stage, further the waviness Wca on the surface thereof likely increases, which is unfavorable also in view of image sharpness after coating.

Consequently, the mean particle size of the solid particles used in the Embodiment 1-6 is specified to 300 μm or less. More preferably, the mean particle size thereof is 200 μm or less. That range of size of the solid particles provides high level of peak count PPI that cannot be attained in the related art.

On the other hand, smaller mean particle size of the solid particles is able to form dense roughness profile on the surface of galvanized steel sheet, in principle. Since, however, when the mean particle size is below 10 μm, the speed of the blasted solid particles decreases in air, the effective creation of surface roughness cannot be attained unless the blasting speed is increased to a very high level.

In particular, commercially available solid particles have a certain particle size distribution, thus, even when the mean particle size is 10 μm, the solid particles include very fine ones as small as several micrometers and coarse ones of around 30 μm. Accordingly, the fine particles decrease in their speed in air, which decreases the kinetic energy at collision against the surface of galvanized steel sheet.

Even when the quantity of blasting solid particles is increased to compensate the decreasing kinetic energy, only relatively coarse particles contribute to the creation of microscopic roughness profile on the surface, and small particles do not contribute to the adjustment of surface texture. Furthermore, the cost of particles having mean particle size of 10 μm or less is high, and they are not economical for the manufacture of galvanized steel sheets.

Therefore, from the point of providing dense roughness profile on the surface of galvanized steel sheet, smaller particles are preferred. Nevertheless, in the Embodiment 1-6, the lower limit of the mean particle size is specified to 10 $\mu$m from the economical point of view.

A sharp distribution of particle size is preferred for the blasting solid particles because those having a sharp distribution uniformize the size of dents created on the surface of galvanized steel sheet. When, however, the particle size distribution is regulated to a sharp one, the yield of particles preparation decreases, which results in increased particle cost. According to a finding of the inventors of the present invention, for the particle size distribution of the solid particles used in the Embodiment 1-6, if only the weight percentages of particles within a range of from 0.5d to 2d of the particle size, (where d signifies the mean particle size), is 85% or more to the total weight of the solid particles, satisfactory performance in practical applications is available, and uniformity of dents created on the surface of steel sheet is assured, so the manufactured products have excellent image sharpness.

The Embodiment 1-7 is a modification of either one of the Embodiment 1-1 through the Embodiment 1-6, in which the solid particles blasted against the surface of galvanized steel sheet are made of a metallic material.

When the density of solid particle is small, the mass of thereof becomes small, thus, it is difficult to increase the mean roughness Ra on the surface of galvanized steel sheet to above a certain level unless the blasting speed is very high. Therefore, plastics solid particles are not suitable. Usually, metal-base or ceramic-base solid particles having 2 g/cm$^3$ or higher density are applied. Examples of these solid particles include those of steel ball, steel grit, stainless steel, high-speed steel, alumina, silicon oxide, diamond, zirconia oxide, and tungsten carbide.

Since the solid particles blasted against galvanized steel sheet are scattered in air after creating dents on the surface thereof, a system to recover and recycle them for blasting is required. Accordingly, the solid particles are required to have a strength not to be broken on colliding against the surface of galvanized steel sheet. To this point, metal-base solid particles are preferable, and materials likely to be crushed, such as glass beads, are not suitable.

As of the metal-base materials, carbon steel, stainless steel, and high-speed steel are particularly preferred. Blasting of these materials is known to provide superior press-formability to the blasting of ceramic-base materials such as alumina. The reason of the superiority is not fully analyzed. A presumable reason is that the solid particle deforms on colliding against the surface of galvanized steel sheet, which induces change in the dent texture created on the surface, and the resulted dent texture becomes suitable one for improving the oil-retainability between the press-mold and the steel sheet.

The Embodiment 1-8 is a modification of either one of the Embodiment 1-1 through the Embodiment 1-7, in which the blasting speed of solid particles is in a range of from 30 to 300 m/s.

When the speed of solid particles is below 30 m/s, the kinetic energy necessary to create dents cannot be attained. Particularly when the solid particles having a small mean particle size are used, the mean roughness Ra on the surface of galvanized steel sheet fails to attain 0.3 $\mu$m or more. Therefore, the lower limit of the blasting speed is specified to 30 m/s.

If the blasting speed of solid particle exceeds 300 m/s, the kinetic energy of the particles colliding against the surface of galvanized steel sheet becomes excessively large, and the solid particles creating the dents may damage the zinc-coating film. Consequently, the upper limit of the blasting speed is specified to 300 m/s.

As for the accelerator that blasts solid particles, there is a generally known air type or mechanical type accelerator. The mechanical accelerator blasts the particles by applying centrifugal force thereto using a rotor. Since the mechanical accelerator is suitable for blasting relatively coarse particles, and can blast a large quantity of solid particles over a wide area, that type of accelerator is suitable for treating the surface of galvanized steel sheet in a high speed production line. The maximum blasting speed of currently commercially available centrifugal blasting unit is around 100 m/s, and higher blasting speed cannot be achieved. If, however, a centrifugal blasting unit that can blast solid particles at higher than 100 m/s level is available, the type is a preferable blasting unit.

The air accelerator applies compressed air to accelerate the solid particles utilizing the particle drug force induced when the air is ejected from a nozzle. The air accelerator is particularly suitable for blasting small solid particles having sizes of 200 $\mu$m or less. The blasting speed of solid particles can be varied by adjusting the pressure of compressed air, and the blasting speed of as high as around 300 m/s is attained. Since, however, the range of blasting per single nozzle is relatively narrow, and since the quantity of blasting particles per unit time is limited, an application in a high speed production line for a wide width sheet adopts a plurality of blasting nozzles.

The method for blasting solid particles may be selected to either one or combination of the mechanical accelerator or air accelerator, evaluating the advantages of each of them, responding to the width of target sheet, the line speed of the sheet, the required surface texture, the density and size of the blasting particle, and other variables. Nevertheless, the method for blasting solid particles may not be limited to the above-described means, and may be other means that accelerates solid particles to a certain speed to blast them against galvanized steel sheet.

The Embodiment 1-9 is a modification of either one of the Embodiment 1-1 through the Embodiment 1-8, in which the shape of the solid particle is nearly spherical.

There are known blasting methods for solid particles: shot blasting which uses nearly spherical particles; and grit blasting which uses squarish particles. Generally, the former is applied for attaining shot-peening effect that hardens the work surface, and the latter is applied for shot blasting, or grinding the surface.

For the adjustment of surface texture of galvanized steel sheet targeted in the present invention, the shot particles having nearly spherical shape is preferred from the point of press-formability of steel sheet. When particles in nearly spherical shape are used, the created dents on the surface of steel sheet are fine dimples, which improve the oil-retainability between the press-mold and the steel sheet. As a result, the sliding resistance during the press-forming stage is decreased and the effect of preventing die-galling is further enhanced.

The term "dimple" referred herein designates a surface concavity formed mainly by a curved face. Thus, for example, large number of concavities in a shape of crater is created when spherical objects collide against the surface.

When grit-shape solid particles are used, some blasting condition may induce a scraping action of the coating layer on the galvanized steel sheet. That kind of problem is avoided when nearly spherical solid particles are applied.

The term "nearly spherical" referred in the Embodiment 1-9 means that the shape includes not only completely spherical but also a shape that is accepted as a sphere in common sense, and that is an elliptical shape having the difference between the mean diameter and the major axis length and between the mean diameter and the minor axis length are within 20% of the mean diameter, respectively.

The Embodiment 1-10 which solves the above-described problems is a modification of either one of the Embodiment 1-1 through the Embodiment 1-9, in which the solid particles are blasted against the surface of galvanized steel sheet at a blasting density ranging from 0.2 to 40 kg/m$^2$.

The term "blasting density" referred herein designates the weight of solid particles blasted per unit area of the surface of steel sheet. Strictly, the blasting density has a certain distribution with the blasted area. The term used herein designates the total weight of particles blasted on a surface area where the microscopic roughness profile on the surface is provided.

When the blasting density is below 0.2 kg/m$^2$, the solid particles blasted against the surface of galvanized steel sheet are scattered so that the pitch of peaks and valleys of microscopic roughness profile created on the surface increases, which makes the increase in the peak count difficult. Accordingly, the Embodiment 1-10 specifies the lower limit of blasting density to 0.2 kg/m$^2$. Nevertheless, since the blasting density of 2 kg/m$^2$ or more gives dents on the surface of steel sheet almost leaving no space between them, normally it is preferred to select the blasting density of 2 kg/m$^2$ or more.

If the blasting density of solid particles exceeds 40 kg/m$^2$, the blasted solid particles exceed a necessary quantity, and the once-created roughness profile is demolished by succeeding colliding solid particles. In addition, repeated collisions of solid particles against the coating film on the galvanized steel sheet damage the coating film, and the coating film may be partially peeled off. Consequently, the Embodiment 1-10 specifies the blasting density of solid particles to a range of from 0.2 to 40 kg/m$^2$.

When, however, the blasting speed is 100 m/s or lower, the collision energy of solid particles is small, and very little damage occurs on the coating film, so the upper limit of the blasting density may be raised to around 100 kg/m$^2$. When the coating film of galvanized steel sheet is soft, (for example, a galvanized steel sheet having a coating film consisting mainly of $\eta$ phase), the coating film is subjected only to plastic deformation, and to very little scraping action, so, also in that case, the blasting density may be raised to around 100 kg/m$^2$.

When the blasting density is large, the quantity of the solid particles to be blasted against the galvanized steel sheet which runs at a constant line speed becomes large. In that case, less blasting density allows smaller size of peripheral facilities such as solid particle transfer unit. Therefore, it is preferable that the blasting density of solid particle is selected to a necessary level and not excessive level. Thus, to attain around 1.0 $\mu$m of the mean roughness Ra on the surface of galvanized steel sheet, 20 kg/m$^2$ or lower blasting density is sufficient.

The Embodiment 1-11 is a modification of either one of the Embodiment 1-1 through the Embodiment 1-10, in which the galvanized steel sheet has a coating film consisting mainly of $\eta$ phase.

For the case of galvanized steel sheet having a coating film consisting mainly of $\eta$ phase, the creation of surface roughness profile is easily done because the coating film itself is soft so that the blasted solid particles readily create dents. That type of galvanized steel sheet is generally requested to have a high mean roughness Ra on the surface as the product compared with the alloyed hot-dip galvanized steel sheet. For this reason, the related art has to increase the mean roughness of the surface of rolling roll, which induces a problem of failing to give dense microscopic roughness on the surface of steel sheet. That is, the Embodiment 1-11 enhances the effect of the present invention compared with the related art that adjust the surface texture on a galvanized steel sheet having a coating film consisting mainly of $\eta$ phase using temper rolling.

The Embodiment 1-12 is a modification of either one of the Embodiment 1-1 through the Embodiment 1-11, in which, prior to the step of adjusting the surface texture of galvanized steel sheet by blasting solid particles against the surface thereof, applying a temper rolling step in which the centerline waviness Wca of the galvanized steel sheet is adjusted to 0.7 $\mu$m or less.

The surface of a zinc-coated steel sheet normally has a waviness Wca, which is a long-period roughness profile, caused by roughness profile on the surface of the substrate sheet itself, by variations in thickness of the coating film, and the like. According to the related art, the temper rolling is applied to adjust the surface texture of galvanized steel sheet, so a temper rolling roll has to have a certain level of mean roughness Ra on the surface thereof. In this case, when a rolling roll having a large roughness on the surface thereof is used against a steel sheet having large surface waviness to transfer the texture of the large roughness on the surface of the rolling roll, the long-period roughness profile (waviness Wca) that exists on the original sheet cannot be decreased, and, inversely, the roughness profile is given to increase also the long-period roughness profile on the surface of steel sheet, which may degrade the image sharpness after coating.

According to the present invention that adjusts the surface texture by blasting solid particles, on applying temper rolling, a certain level of extension may be given to adjust the mechanical properties of steel sheet, and a rolling roll that is smoothly finished on the surface thereof may be applied. Consequently, the Embodiment 1-12 uses a smooth surface roll as the rolling roll for the temper rolling to once smoothening the long-period roughness profile existing on the surface of steel sheet after zinc-coating, and the waviness Wca on the surface before blasting the solid particles against the surface is adjusted to a certain level or below. Through the treatment, the waviness Wca of the steel sheet after blasting solid particles can be adjusted to a low level.

If the waviness Wca on the surface of steel sheet after temper rolling using a smooth surface roll is adjusted to 0.7 $\mu$m or less, the surface waviness Wca can be regulated to 0.8 $\mu$m or less even after adjusting the surface texture by blasting solid particles. (The significance of regulating the surface waviness Wca to 0.8 $\mu$m or less after adjusting the surface texture by blasting solid particles is given in the description of the Embodiment 1-5.)

If, however, further excellent image sharpness after coating is requested, the surface waviness Wca before blasting the solid particles is preferably adjusted to 0.3 $\mu$m or less. In concrete terms, by using a bright roll having a mean roughness Ra on the surface of 0.3 $\mu$m or less as the rolling roll, the waviness Wca on the surface of steel sheet after temper rolling can be reached to 0.3 $\mu$m or less. Thus, even after blasting the solid particles, the waviness Wca on the surface of galvanized steel sheet can be lowered to 0.5 $\mu$m or less.

FIG. 1 illustrates outline of an apparatus for carrying out the first example of the Embodiment 1 according to the present invention. In FIG. 1, the reference number 1 designates a galvanized steel sheet, 2*a* and 2*b* designate bridle rolls, 3*a* through 3*d* designate blasting nozzles for solid particles, 4*a* through 4*d* designate air compressors, 5 designates a chamber, 6 designates a solid particle feeder, 7 designates a cleaner blower, and 8 designates a dust collector.

FIG. 1 shows a state that the galvanized steel sheet 1 is subjected to a certain level of tension by the bridle rolls 2*a* and 2*b*, illustrating the state that the galvanized steel sheet 1 passes through the solid particle blasting chamber 5. The step shown in FIG. 1 may be a part of the continuous coating process or may be a separate treatment line. The case that an inspection step is given at downstream side may be included in the state.

The galvanized steel sheet 1 is a steel sheet on which a coating film is formed by an adequate means such as hot-dip galvanizing and electro-zinc plating. The steel sheet may be or may not be subjected to temper rolling in advance. The steel sheet may be a galvanized steel sheet that was treated by chemical conversion such as chromate treatment.

Inside of the chamber 5, there are arranged the blasting nozzles 3*a* through 3*d* for blasting solid particles against the front surface and the rear surface of the steel sheet. A predetermined quantity of solid particles is supplied from the solid particle feeder 6 to the blasting nozzles 3*a* through 3*d*. In that case, the speed of solid particles is accelerated when the air compressed by the air compressors 4*a* through 4*d* passes through respective nozzles, and the solid particles are blasted against the surface of steel sheet 1.

Figure 2:
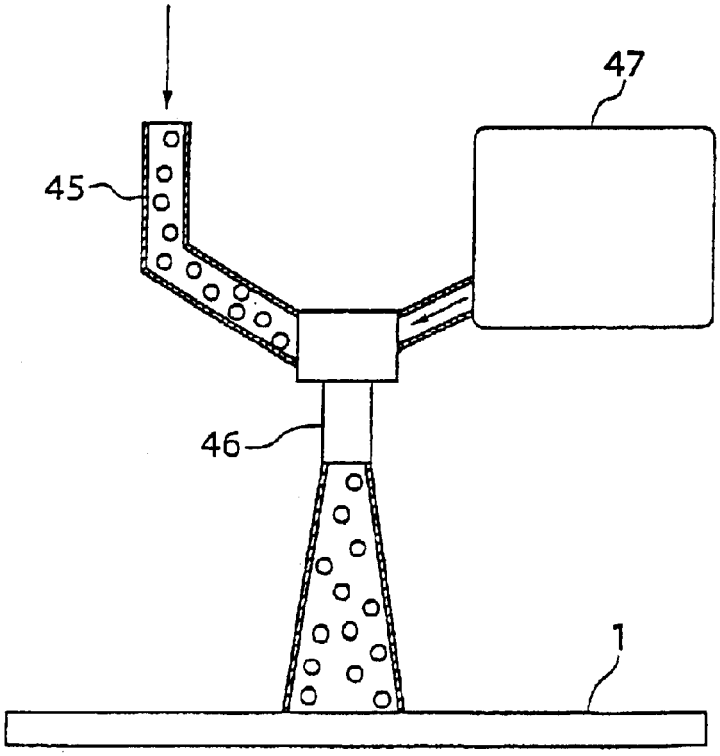
FIG. 2 illustrates outline of an air blasting unit used in the apparatus shown in FIG. 1.

FIG. 2 illustrates outline of the air blasting unit used in the apparatus shown in FIG. 1. As illustrated in FIG. 2, compressed air is supplied from an air compressor 47 and is accelerated in an injection nozzle 46, where the solid particles supplied from a particle feed pipe 45 are accelerated in their speed. To the particle feed pipe 45, the solid particles are fed from the feeder 6 shown in FIG. 1. The inner diameter of the ejection nozzle 46 is normally in a range of from about 5 to about 20 mm. The pressure of the compressed air is normally in a range of from about 0.1 to about 0.9 MPa.

Although the quantity of blasting solid particles from the ejection nozzle 46 varies with the size and specific gravity of the solid particle, the pressure of the compressed air, and other variables, normally the quantity is not more than 10 kg/min. By varying the pressure of compressed air, the speed of solid particles blasted from the ejection nozzle 46 can be varied. Smaller size of solid particles allows higher blasting speed. For the case of metallic particles having mean particle sizes of from about 10 to about 300 $\mu$m, the blasting speeds of about 80 to about 300 m/s can be attained.

For treating a wide width galvanized steel sheet, plurality of blasting nozzles 3*a* through 3*d* are arranged in the width direction of the steel sheet. The number of arranged blasting nozzles in the width direction of the steel sheet is determined by the width of target galvanized steel sheet and the adjustable range of surface texture by a single blasting nozzle. In some cases, the area of blasting the solid particles for each of the adjacent nozzles is overlapped with each other, or the nozzles are arranged in staggered pattern to uniformize the microscopic roughness on the surface of galvanized steel sheet in the width direction thereof.

FIG. 1 shows an arrangement of blasting nozzles of two rows in staggered pattern along the lengthwise direction of the steel sheet. The number of the blasting nozzles, however, may be determined responding to the quantity of solid particles that can be blasted by a single nozzle and to the line speed of the production line. FIG. 1 shows an arrangement of blasting nozzles on each of the front surface and the rear surface of the steel sheet. The solid particles are not necessarily blasted to both the front surface and the rear surface, and, responding to the use object, only one side may be subjected to the blasting.

The solid particles blasted in the chamber 5 scatter in surrounding air, and drop to the lower section of the chamber 5. The dropped solid particles are recycled to the feeder 6 for re-blasting against the steel sheet. Normally, a classifier (separator) is located before the solid particle feeder 6, where the zinc powder mixed in the solid particles and the crushed fine solid particles are separated to be sent to the dust collector 8.

Through the operation described above, the variations in particle size and shape of the solid particles with time are prevented, and the state of the solid particles is maintained in a stable state. On the other hand, fine particles that are not dropped and are suspending in the chamber are collected by the cleaner blower 7, which are then treated by the dust collector 8.

According to the present invention, for adjusting the surface texture of galvanized steel sheet, an instrument for measuring the surface texture may be positioned at downstream side of the bridle roll 2*b*, and the blasting speed and the blasting density of the solid particles may be corrected based on thus measured values. The instrument for measuring the surface texture may be an instrument for determining mean roughness Ra or peak count PPI, or a device that takes photograph of the surface of steel sheet using a CCD camera or the like and that determines the size of dents created by the solid particles using image processing means.

Figure 3:
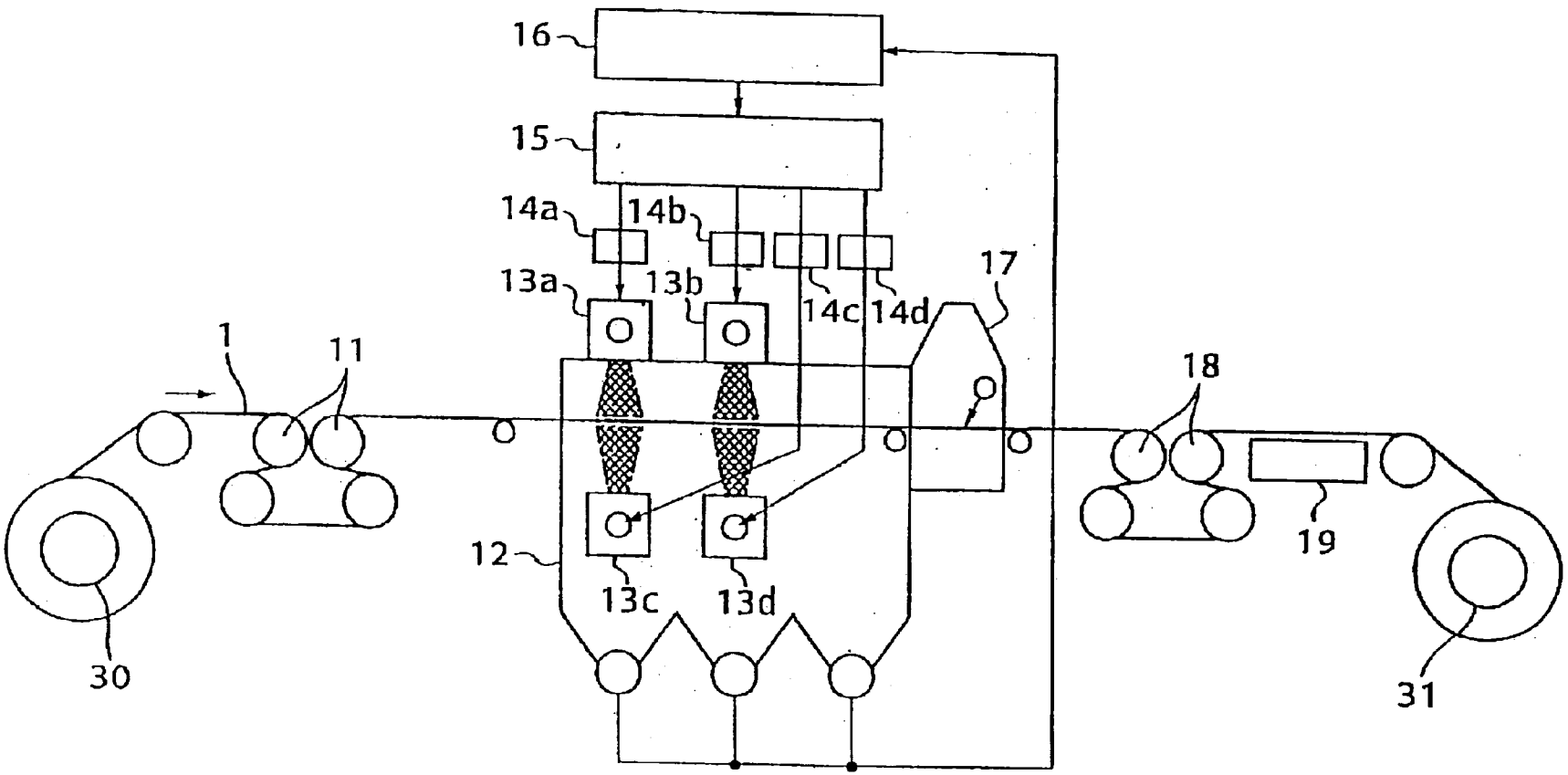
FIG. 3 illustrates outline of an apparatus for conducting a method for manufacturing galvanized steel sheet, as the second example of the Embodiment 1.

FIG. 3 illustrates outline of an apparatus for conducting a method for manufacturing galvanized steel sheet, as the second example of the Embodiment 1 according to the present invention. FIG. 3 shows an apparatus for adjusting the microscopic roughness on the surface of galvanized steel sheet using plurality of centrifugal blasting units 13*a* through 13*d* while continuously transferring the galvanized steel sheet 1. A suitable galvanized steel sheet 1 is the one subjected to cold-rolling, annealing, and zinc-coating, and treated by temper rolling using a bright roll which was ground to finish the surface to 0.3 $\mu$m or less of mean roughness Ra.

As shown in FIG. 3, the galvanized steel sheet 1 is fed to a pay-off reel 30, then is coiled by a tension reel 31. The galvanized steel sheet 1 is continuously transferred while being applied with a tension thereto between an inlet side bridle roll 11 and an outlet side bridle roll 18.

The centrifugal blasting units 13*a* through 13*d* are located in a blast chamber 12 which is enclosed by a chamber. A specified quantity of solid particles is supplied to the centrifugal blasting units 13*a* though 13*d* from respective solid particle measuring feeders 14*a* through 14*d*. The solid particles blasted from the centrifugal blasting units 13*a* through 13*d* are recovered in the blast chamber 12, and then are sent to a classifier 16. The particles classified in the classifier 16 pass through a storage tank 15, and enter the measuring feeders 14*a* through 14*d*. Although the figure does not show, the dust separated in the classifier is sent to a dust collector to receive the dust treatment. The solid particles remained on or attached to the galvanized steel sheet 1 are purged by a cleaner blower 17.

The number of centrifugal blasting units applied in the Embodiment 1 is more than one located along the width direction of the galvanized steel sheet 1, thus allowing each blasting unit to adjust the surface texture on individual covering areas of the surface. In that case, partial overlap arrangement of blasting areas for the adjacent blasting units with each other assures uniform surface texture over the whole width of the sheet. If necessary, plurality of centrifugal blasting units may be arranged also in longitudinal direction of the sheet to ensure sufficient blasting density over the whole surface of galvanized steel sheet even at a high line speed operation.

Figure 4:
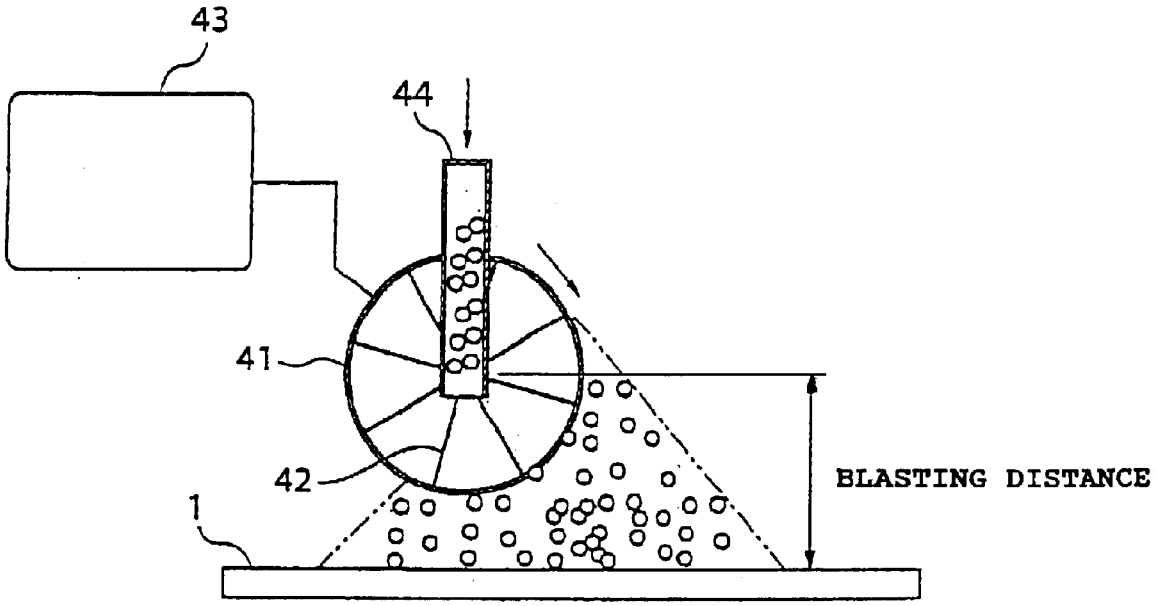
FIG. 4 is a schematic drawing of a wheel blast machine.

FIG. 4 is a schematic drawing of the centrifugal blasting unit. The solid particles are blasted by centrifugal force from a vane 42 mounted to a rotor 41 driven by a motor 43. The solid particles are fed from the measuring feeders 14*a* through 14*d*, shown in FIG. 3, to near the rotational shaft of the centrifugal rotor via a particle feed pipe 44. The rotor diameter of ordinary centrifugal blasting unit is in an approximate range of from 200 to 550 mm, with vane widths of from about 20 to about 150 mm, and the rotor is operated at about 2,000 to about 4,000 rpm of rotational speed.

Although a driving motor having maximum output of around 55 kW is available, a motor generating lower output may be sufficient for the case of blasting fine solid particles, having approximate mean particle sizes of from 10 to 300 $\mu$m. The upper limit of the rotor rotational speed is limited by looseness resulting from the wear of vane and from the increase in vibration of the centrifugal blasting unit caused by possible offset load. Accordingly, the blasting speed of commercially available centrifugal blasting units has an upper limit of about 100 m/s.

The rotational direction of the rotor of centrifugal blasting unit may be in the horizontal or vertical direction of the rotary shaft thereof to the running direction of the target galvanized steel sheet, if only the solid particles are blasted at a predetermined speed over a specified area on the surface of the galvanized steel sheet.

On carrying out the present invention, if the blasted solid particles are very fine ones ranging from 10 to 300 $\mu$m of individual particle sizes, long distance until the blasted solid particles collide with the galvanized steel sheet cannot create satisfactory dents on the surface of galvanized steel sheet owing to the deceleration of the speed of solid particles under air resistance. Accordingly, the blasting distance is required to be shortened compared with the shot-blast method applied in descaling or the like of stainless steels.

The term "blasting distance" referred herein designates the distance between the rotational center of the rotor and the steel sheet. The shot-blast method applied for descaling and the like of stainless steels adopts around 1,000 mm of blasting distance. On carrying out the present invention, however, the blasting distance is selected to 700 mm or less, preferably to a range of from about 250 to about 500 mm, thus allowing even the fine particles to form satisfactory surface roughness because they collide against the surface of steel sheet without decelerating in air. If, however, a unit is able to blast solid particles at higher speed than the centrifugal blasting units commercially available, the blasting distance may be increased.

Preferred mean particle size of the solid particles blasted is in a range of from 10 to 300 $\mu$m, and more preferably 200 $\mu$m or smaller. The solid particles are preferably metallic shot particles such as those of stainless steel, carbon steel, and high-speed steel, having near-spherical shape. The distribution of the particle size is preferably adjusted to give 85% or larger weight percentages of the particles in a range of from 0.5d to 2d, where d designates the mean particle size.

FIG. 3 illustrates an apparatus that uses solid particles described above in recycle mode. The classifier 16 can control the size distribution of the solid particles in a certain range. The classifier may be a vibrating screen, a cyclone, or an air classifier. They may be separately used or may be combined to provide optimum classification performance.

The blasting density of the solid particles against the galvanized steel sheet 1 according to the Embodiment 1 is preferably in a range of from 0.2 to 40 kg/m$^2$. In the case that the mechanical blasting unit shown in FIG. 4 is applied, however, the blasting speed of the solid particles is lower than that of the air blasting unit shown in FIG. 2, so the blasting speed is preferably increased to a higher level than that of the air blasting unit to form a certain texture on the surface of the galvanized steel sheet 1. From that point of view, the mechanical blasting unit preferably adopts the blasting density of 1 kg/m$^2$ or more, more preferably in a range of from about 5 to about 20 kg/m$^2$.

To control the blasting density on the surface of galvanized steel sheet, a specified quantity of solid particles is supplied to the centrifugal blasting unit via the measuring feeders 14*a* trough 14*d*, responding to the line speed of the steel sheet. Each of the measuring feeders controls the blasting weight within a specific period using an adequate means such as the one adjusting opening of a valve located in the feeding route. Specifically, when the surface texture of the galvanized steel sheet is adjusted while fixing the value of blasting density, doubled line speed is responded by widening the opening of the valve to double the quantity of solid particles supplied from the measuring feeder.

In FIG. 3, for the galvanized steel sheet 1 to which the solid particles are blasted to give a surface roughness, the surface roughness is measured on an inspection table 19. The mean roughness Ra, the peak count PPI, and the waviness Wca are determined to judge if they are within a specified range or not. If necessary, the surface texture of the galvanized steel sheet is adjusted by varying the rotational speed of the centrifugal rotor, the blasting density, and other variables.

Instruments that measure the mean roughness Ra, the peak count PPI, and other variables may be located at downstream side of the bridle roll 18, and the blasting speed and the blasting quantity of the solid particles may be changed based on thus measured variables. The surface roughness meter may be a contact type instrument. However, the surface roughness is preferably determined by non-contact method using an optical instrument. A CCD camera may further be applied to take photographs of the surface texture of the steel sheet, and to conduct image processing to determine the size of dents created by the solid particles.

Figure 5:
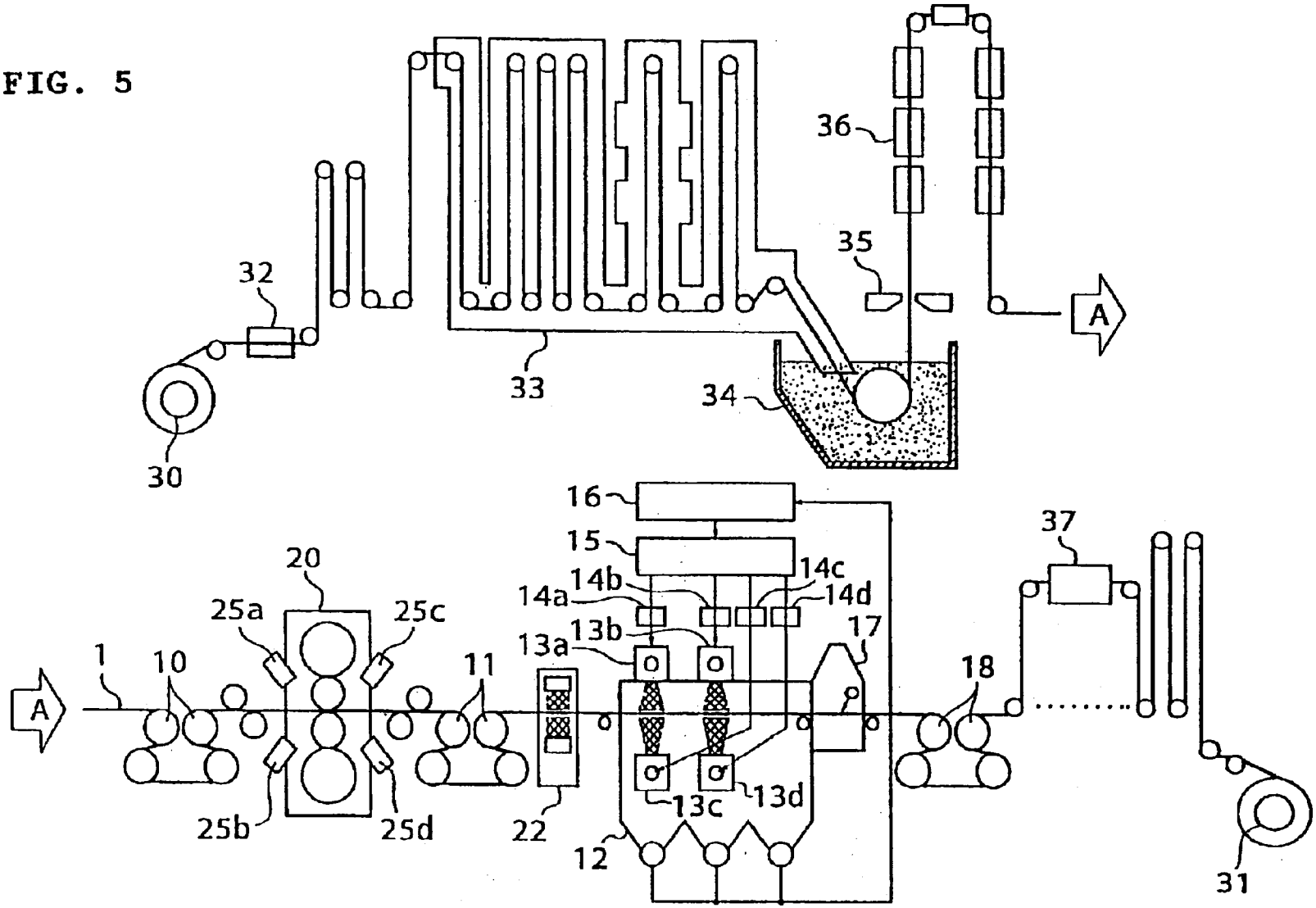
FIG. 5 shows an example of apparatus for conducting a method for manufacturing galvanized steel sheet as the third example of the Embodiment 1.

FIG. 5 shows an example of apparatus for conducting a method for manufacturing galvanized steel sheet as the third example of the Embodiment 1 according to the present invention. The apparatus shown in FIG. 5 has similar arrangement of facilities as in the continuous hot-dip galvanizing line of FIG. 3. For the same configuration element with that of FIG. 3, the same reference symbol is given.

The apparatus has a temper rolling mill 20 at downstream side of a plating bath 34 of the hot-dip galvanizing line, and has a forced drying unit 22 and a blasting chamber 12 at further downstream side of the temper rolling mill 20.

In the hot-dip galvanizing line, the steel sheet after completing cold-rolling is supplied to a payoff reel 30, and is guided to an electrolytic cleaning unit 32, then is subjected to recrystallization annealing in an annealing furnace 33. After that, the zinc-coating film is formed on the steel sheet in the plating bath 34. Then, an air wiper 35 is applied to give film thickness adjustment. When an alloyed hot-dip galvanized steel sheet is to be produced, an alloying furnace 36 is operated to give the alloying treatment to the steel sheet. A galvanized steel sheet having the coating film consisting mainly of η phase is manufactured in the same line as above without using the alloying furnace 36.

Usual hot-dip galvanizing line has cases of: temper rolling in the temper rolling mill 20 followed by chemical conversion film forming in a chemical conversion unit 37; and applying rust-preventive oil followed by coiling without giving further treatment.

On the apparatus shown in FIG. 5, nozzles 25*a* through 25*d* that eject water or a temper rolling liquid are arranged at inlet or exit of the temper rolling mill, and the forced drying unit 22 is positioned further downstream side therefrom to let the solid particles blast after dried the water attached to the surface of galvanized steel sheet 1. If the amount of water attached to the surface of galvanized steel sheet 1 is small, or if the water is naturally dried, the drying unit 22 may not necessarily be located.

With the above-described arrangement of the facilities, the temper rolling mill 20 conducts temper rolling using a bright roll for adjusting the mechanical properties of the work material to adjust the surface waviness Wca of the galvanized steel sheet to 0.7 μm or less, then the centrifugal blasting units 13*a* through 13*d* located at downstream side therefrom adjust the surface texture of galvanized steel sheet 1.

EXAMPLE 1

The first example of the Embodiment 1 shows that the surface texture formed on a galvanized steel sheet by blasting solid particles thereto significantly differs from that of related art, and that the adjustable range of the surface texture is widened from that formed in related art.

The galvanized steel sheet used in the first example is the one using a cold-rolled steel sheet having 0.8 mm in thickness as the substrate sheet, and has a coating weight of coating film consisting mainly of η phase is 70 g/m$^2$ on one side thereof.

Temper rolling to give an extension of 0.8% was applied to the galvanized steel sheet for adjusting the mechanical properties. The temper rolling mill adopted a bright roll having a mean roughness Ra of 0.28 μm on the rolling roll. After the temper rolling, the galvanized steel sheet had mean roughness Rs, peak count PPI, and waviness Wca of 0.25 μm, 48, and 0.3 μm, respectively.

To thus temper-rolled galvanized steel sheet, the air blasting unit shown in FIG. 2 was used to adjust the surface texture thereof. The applied nozzle had an opening of 9 mm, and the pressure of compressed air was varied in a range of from 0.1 to 0.7 MPa. The distance between the tip of the nozzle and the galvanized steel sheet was varied in a range of from 100 to 200 mm, and the solid particles were blasted against the surface thereof for 0.03 to 10 seconds of period. The blasting density was selected to a range of from 0.4 to 86 kg/m$^2$, mainly not higher than 20 kg/m$^2$.

Table 1 shows the solid particles used for adjusting the surface texture of the galvanized steel sheet. These solid particles were prepared by the atomizing method, giving the difference between the mean diameter and the major axis length and between the mean diameter and the minor axis length within 20% of the mean diameter, respectively, or giving nearly spherical particles.

TABLE 1

| Symbol | Material | Mean particle size |
|---|---|---|
| A1 | SUS304 | 60 μm |
| A2 | SUS304 | 85 μm |
| A3 | SUS304 | 100 μm |
| A4 | SUS304 | 200 μm |
| B1 | High-speed steel | 65 μm |
| B2 | High-speed steel | 111 μm |
| C1 | High carbon steel | 75 μm |
| D1 | Alumina | 54 μm |
| D2 | Alumina | 128 μm |

For investigating the features of the surface texture of galvanized steel sheet after blasting the solid particles, photographs were taken by a light microscope, and a surface roughness meter (E35A, Tokyo Seimitsu Co., Ltd.) was used to determine the mean roughness Ra and the peak count PPI on the surface of the galvanized steel sheet.

As a comparative example, a rolling roll provided with microscopic roughness profile on the surface thereof using conventional technology was applied to transfer the surface texture onto the surface of a galvanized steel sheet by temper rolling. The comparative example used a steel sheet prepared from the same substrate sheet with that of the example 1 and treated under the same condition with that of the first example. The surface of the temper rolling roll was adjusted to give the surface texture grades given in Table 2.

TABLE 2

| Symbol | Ra (μm) | PPI |
|---|---|---|
| R1 | 2.62 | 254 |
| R2 | 3.16 | 203 |
| R3 | 2.41 | 286 |

In the comparative example, the extension during the temper rolling stage was varied in a range of from 0.5 to 2%, and the microscopic roughness profile on the surface of rolling roll was transferred onto the surface of the galvanized steel sheet. The surface was observed under a light microscope, further the mean roughness Ra and the peak count PPI on the surface were determined using a surface roughness meter.

Figure 6:
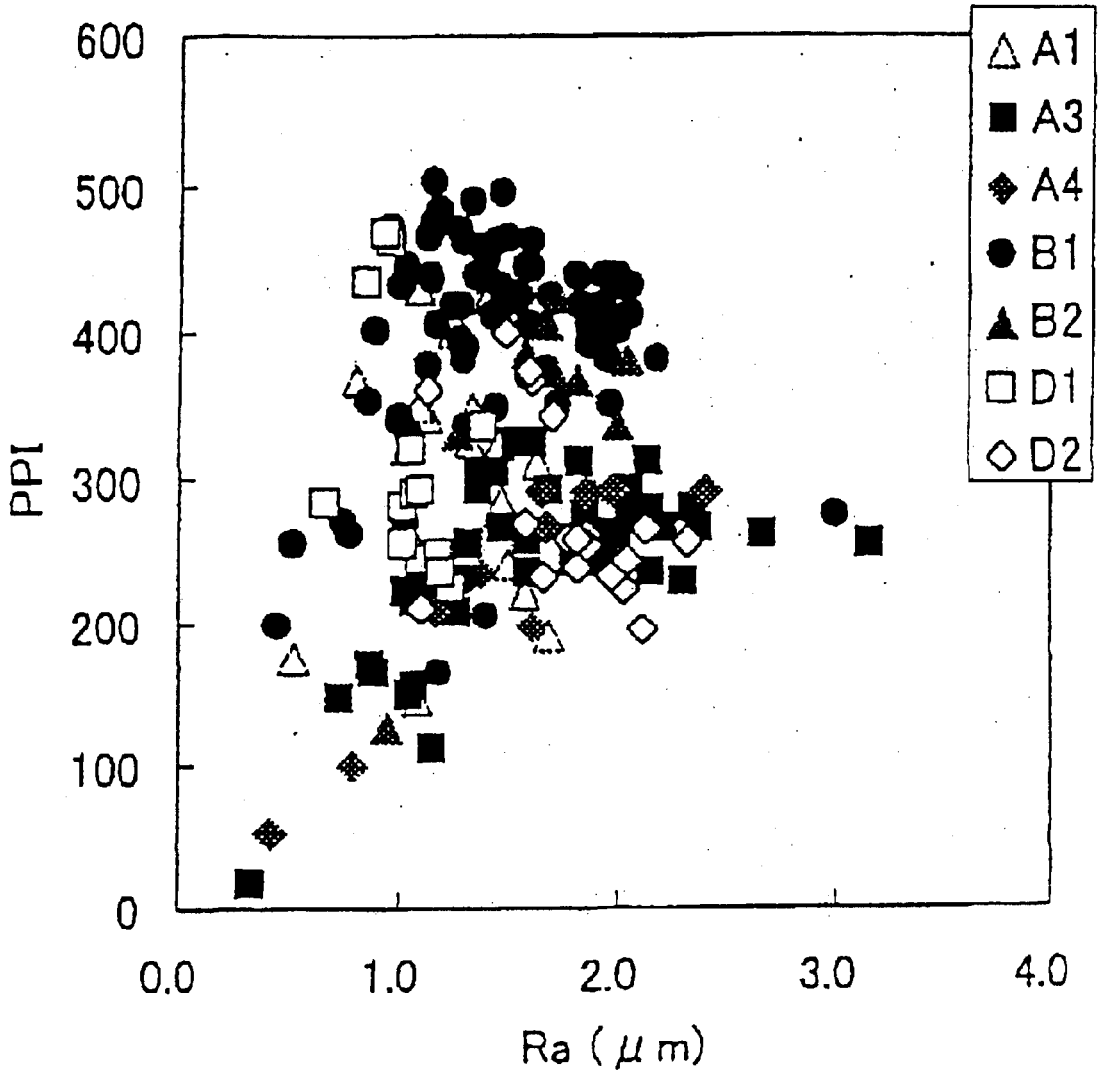
FIG. 6 shows an adjusting range of the mean roughness Ra and the peak count PPI on the surface of galvanized steel sheet in the first example of the Embodiment 1.
Figure 7:
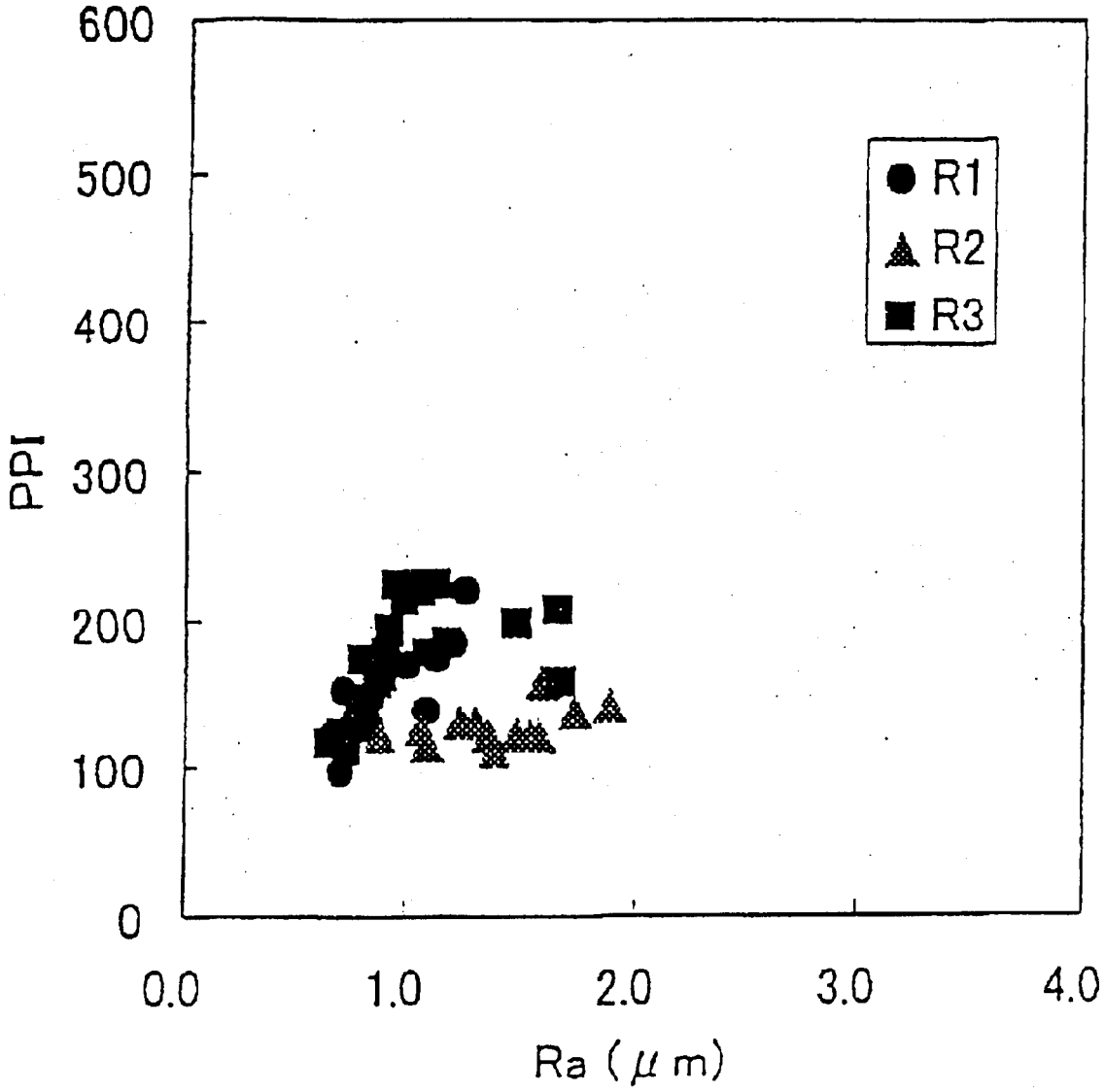
FIG. 7 shows an adjusting range of the mean roughness Ra and the peak count PPI on the surface of galvanized steel sheet in a comparative example to the first example of the Embodiment 1.

FIG. 6 shows the adjusting range of the mean roughness Ra and the peak count PPI on the surface of galvanized steel sheet in the first example. FIG. 7 shows the adjusting range of the mean roughness Ra and the peak count PPI on the surface of galvanized steel sheet in the comparative example. Comparison of FIG. 6 with FIG. 7 shows that the adjusting range of the surface texture of galvanized steel sheet is significantly widened compared with that of related art.

Particularly for the peak count PPI, the conventional temper rolling method had an upper limit at around 230, and the first example provides as high as around 500. Since the peak count is a parameter indicating the number of microscopic peaks and valleys on the surface per one inch length, the surface of the galvanized steel sheet according to the first example has very short distance between adjacent microscopic peaks and valleys, compared with that of the related art, or has dense surface texture.

Figure 8:
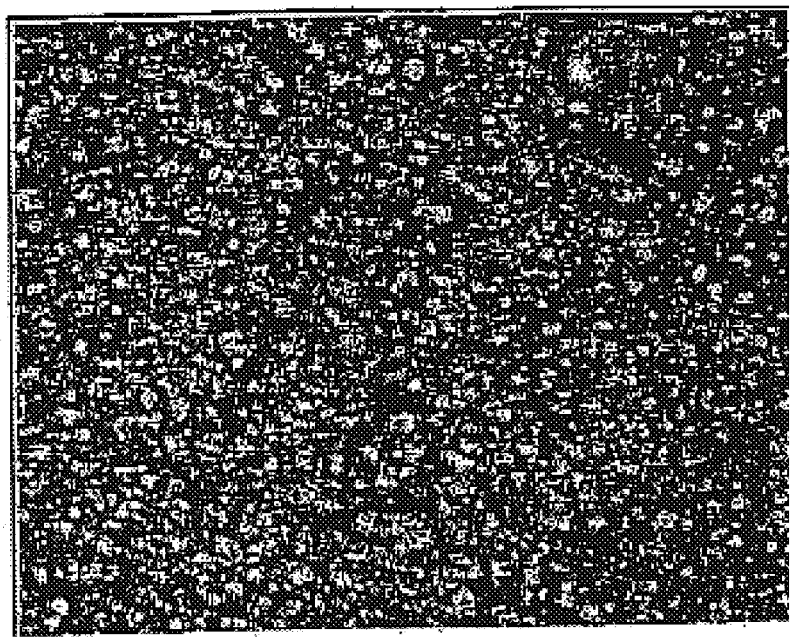
FIG. 8 shows a light microscope photograph on the surface of galvanized steel sheet in the first example of the Embodiment 1.
Figure 8:
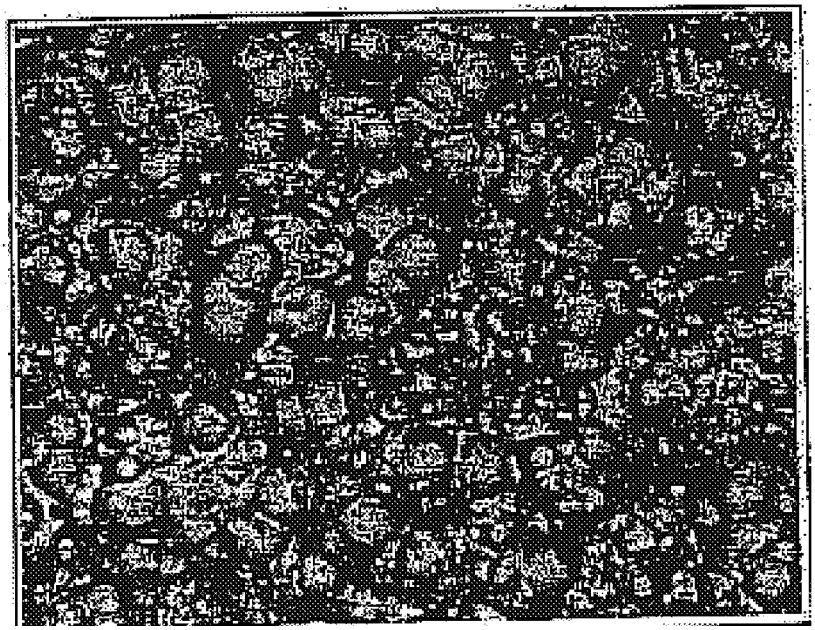
Figure 9:
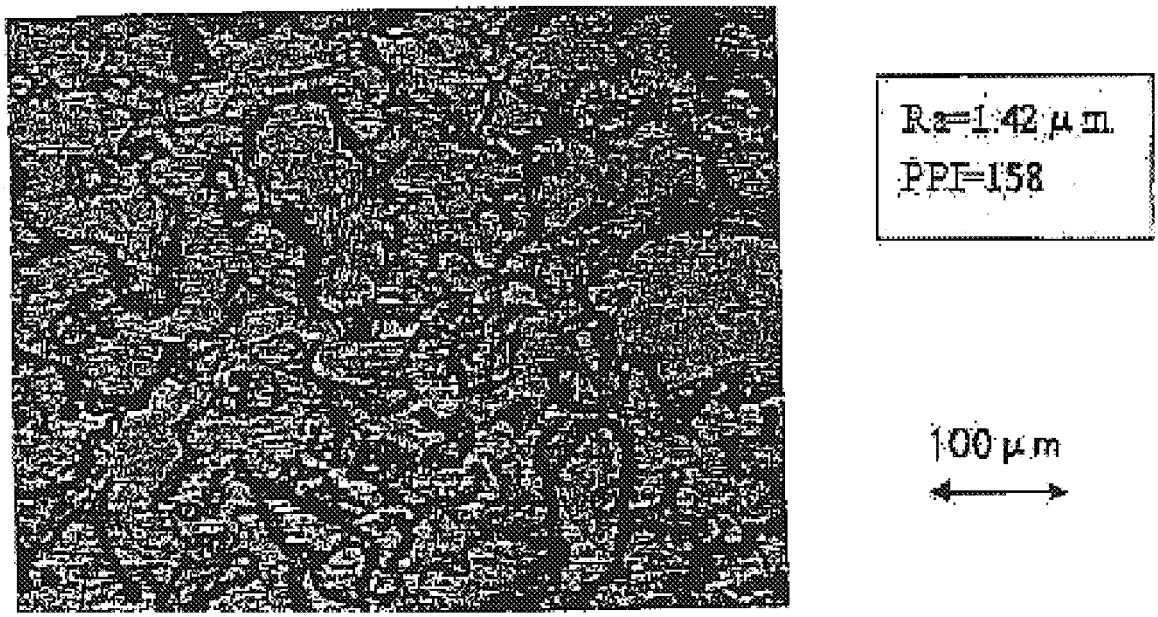
FIG. 9 shows a light microscope photograph on the surface of galvanized steel sheet in a comparative example to the first example of the Embodiment 1.

FIG. 8 shows a light microscope photograph on the surface of galvanized steel sheet in the first example. FIG. 9 shows a light microscope photograph on the surface of galvanized steel sheet in the comparative example. The surface of galvanized steel sheet in the comparative example gives a texture in which relatively large profile valley portions and profile peak portions are connected to each other in an insular pattern. Since temper rolling does not transfer all of the roughness profile on the surface of rolling roll onto the surface of steel sheet, the portions left un-transferred on the surface of substrate sheet are observed as convex portions.

To the contrary, the surface texture of galvanized steel sheet according to the first example shows dimple-pattern texture formed by the collision of large number of spherical solid particles. As described above, the texture of microscopic roughness profile on the surface of the galvanized steel sheet observed in the first example significantly differs from that of the related art, and the difference gives significant influence on the press-formability.

EXAMPLE 2

The second example describes a flat sheet sliding test, given on a galvanized steel sheet after adjusted the surface texture thereof by blasting solid particles thereto, for evaluating the press-formability.

The method described in the first example was applied to adjust the surface texture of a galvanized steel sheet using three kinds of solid particles, A1, B1, and D2. The applied galvanized steel sheet was the same as that applied in the first example. As a comparative example, the galvanized steel sheet prepared by the related art, described in the first example, was used for the flat sheet sliding test.

The flat sheet sliding test is conducted by moving a slide table on which the galvanized steel sheet is fixed, while pressing a bead tool against the surface of the galvanized steel sheet at a specified pressing load, thus providing a slide between the bead and the galvanized steel sheet. A load cell is applied to determine the bead-pressing load N under the movement of the slide table and to determine the force F to move the slide table. The friction factor in sliding state is calculated from the observed ratio (F/N).

The sliding test used galvanized steel sheets applied with a cleaning oil (PRETON R352L, manufactured by Sugimura Chemical Co., Ltd.) on the surface thereof, in advance. The test used different sizes of beads under two conditions ("A" condition and "B" condition) shown in Table 3. The "A" condition that is a high speed and high face pressure condition represents the sliding characteristics at the bead contact section in the press-forming stage, and the "B" condition that is a low speed and low face pressure condition represents the sliding characteristics on the punch face. For both conditions, smaller friction factor provides superior press-formability because the sliding resistance between the work and the mold in press forming stage reduces to prevent break of steel sheet.

TABLE 3

| | "A" condition | "B" condition |
|---|---|---|
| Tool contact section | W10 mm × L3 mm | W10 mm × L50 mm |
| Pressing load N | 4 kN | 4 kN |
| Sliding speed | 1 m/min | 0.2 m/min |
| Sliding distance | 120 mm | 120 mm |

Figure 10:
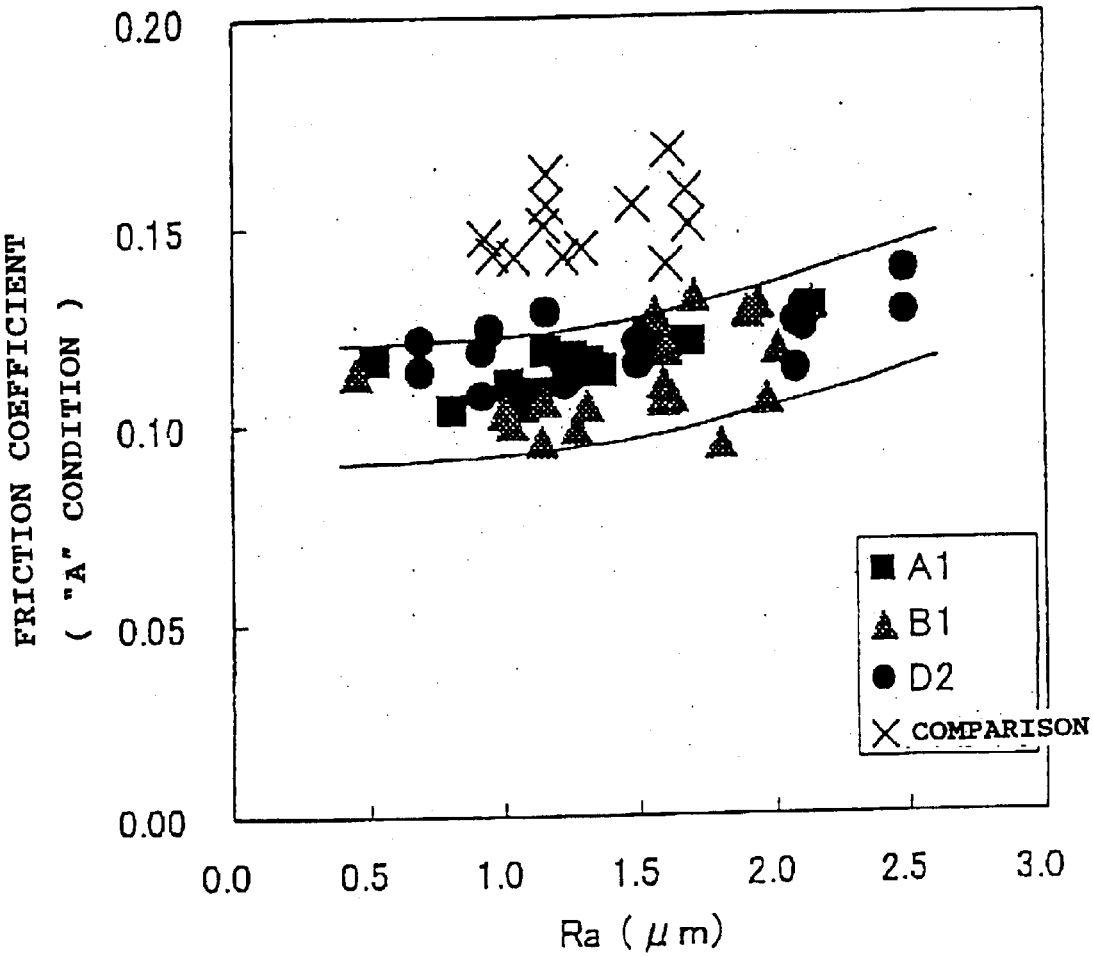
FIG. 10 shows the relation between the mean roughness Ra on the surface of galvanized steel sheet and the friction factor observed during a sliding test under a high speed and high face pressure condition, in the second example of the Embodiment 1.

FIG. 10 shows the relation between the mean roughness Ra on the surface of galvanized steel sheet and the friction factor observed during the sliding test under the high speed and high face pressure condition ("A" condition). The friction factor under the high speed and high face pressure condition ("A" condition) stays at almost constant level independent of the kinds of blasted solid particles, and, when the surface roughness Ra of the galvanized steel sheet increases, the friction factor increases to some extent. The galvanized steel sheets prepared by the related art, shown in the comparative example, however, give higher friction factor than that of the second example. That is, the galvanized steel sheet according to the second example shows superior sliding characteristics (press-formability) to that of the related art, even when the mean roughness Ra which is an index representing the microscopic roughness on the surface is the same to each other.

Figure 11:
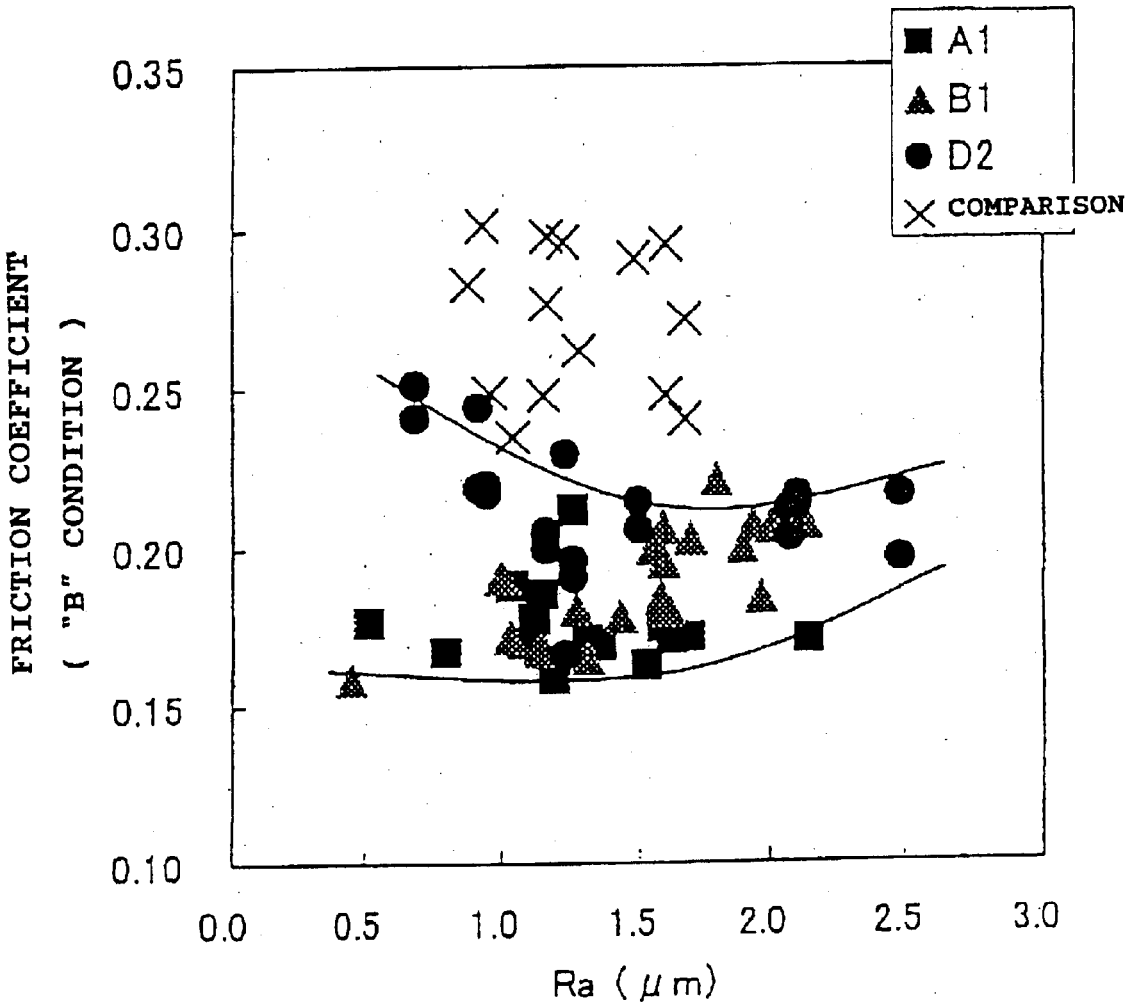
FIG. 11 shows the relation between the mean roughness Ra on the surface of galvanized steel sheet and the friction factor observed during a sliding test under a low speed and low face pressure condition, in the second example of the Embodiment 1.

FIG. 11 shows the friction factor under the low speed and low face pressure condition (B condition). Also in this case, the friction factor is lower than that of the comparative example. The figure shows that alumina (D2) solid particles give somewhat higher friction factor than that of metallic particles (A1, B1), which suggests that the metallic particles as the solid particles give superior sliding characteristics.

Figure 12:
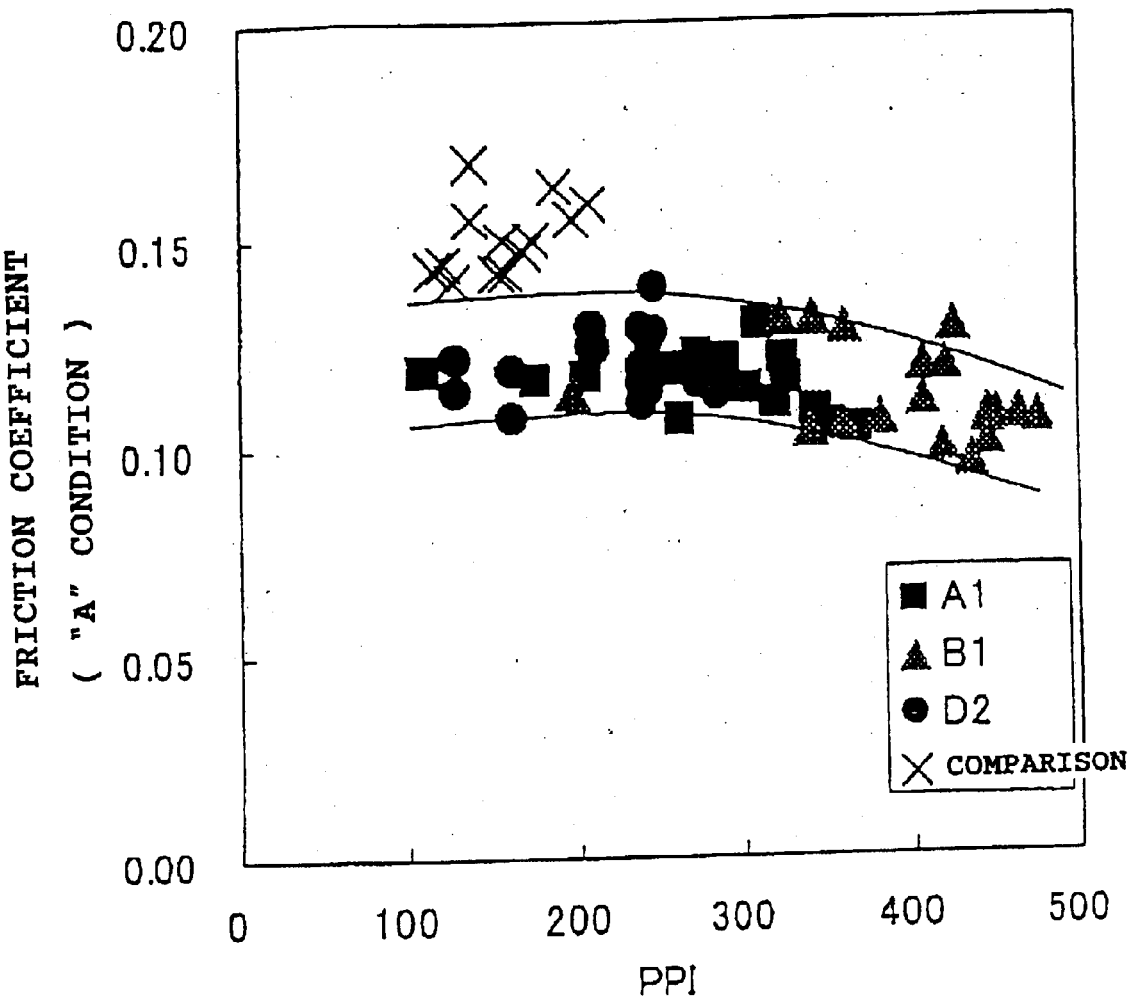
FIG. 12 shows the relation between the mean roughness Ra on the surface of galvanized steel sheet and the peak count PPI on the galvanized steel sheet observed during a sliding test under a high speed and high face pressure condition, in the first example of the Embodiment 1.
Figure 13:
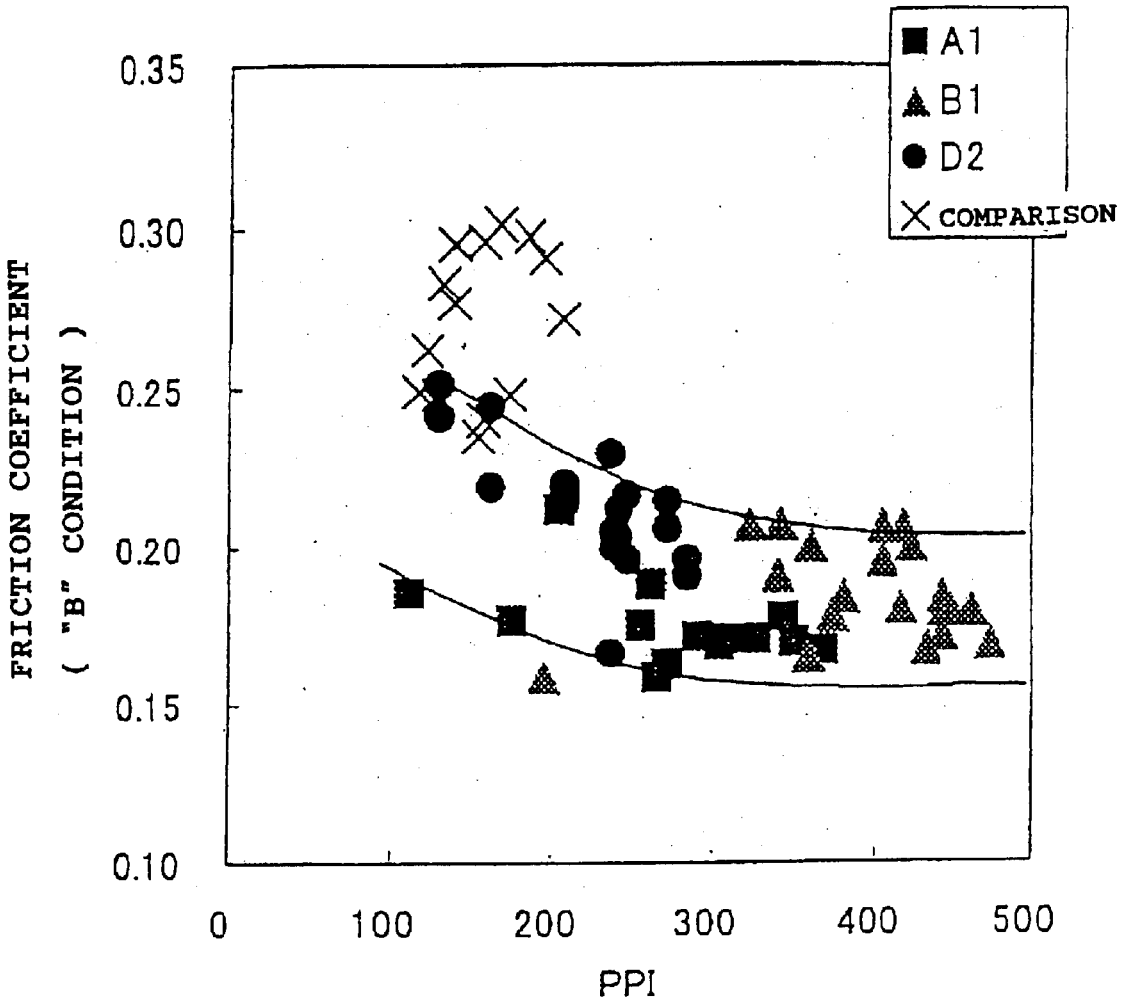
FIG. 13 shows the relation between the mean roughness Ra on the surface of galvanized steel sheet and the peak count PPI on the galvanized steel sheet observed during a sliding test under a low speed and low face pressure condition, in the second example of the Embodiment 1.

FIG. 12 and FIG. 13 show the relation between the friction factor and the peak count PPI on galvanized steel sheets derived from the same sliding test result as above. As seen in FIG. 12, under the high speed and high face pressure condition ("A" condition), a certain correlation is observed independent of the kind of blasting solid particle, and there appears a tendency of decreasing the friction factor in a region where the peak count PPI increases to exceed 250 on the surface of the galvanized steel sheet. Also under the low speed and low face pressure condition ("B" condition) shown in FIG. 13, the friction factor decreases with the increase in the peak count PPI, and the friction factor reaches a constant level in a region where the peak count PPI exceeds 250. Under the low speed and low face pressure condition (B condition), the metallic particles (A1, B1) of the solid particles provide lower friction factor than the alumina (D2) particles even in a region of low peak count PPI. Thus, the metallic particles provide superior sliding characteristics.

EXAMPLE 3

The third example describes the validation of an effect of solid particle blasting to adjust the surface texture of a galvanized steel sheet using a press-forming testing machine.

Also the third example used the same hot-dip galvanized steel sheet with that in the first example, and the same method therewith was applied to adjust the surface texture of the galvanized steel sheet. Table 4 shows the blasting conditions of the solid particles. The reference symbols signifying the solid particles given in the table are the same as those in Table 1.

Table 5 shows the surface roughness of the galvanized steel sheet which was treated by surface texture adjustment under these conditions, and the result of sliding test (friction factor under the B condition) conducted using the same method as in the second example. Table 5 also gives the result observed on a surface of galvanized steel sheet which was adjusted on the surface thereof by temper rolling, as a comparative example. The galvanized steel sheet in the comparative example was subjected to temper rolling giving an extension of 1.5% using a temper rolling roll treated by electrical discharge dull machining.

TABLE 4

| Symbol | Particle | Blasting density | Blasting air pressure |
|---|---|---|---|
| S1 | A3 | 4 kg/m$^2$ | 0.3 MPa |
| S2 | B1 | 4 kg/m$^2$ | 0.3 MPa |

TABLE 5

| | Surface roughness after blasting | | Friction factor |
|---|---|---|---|
| Symbol | Mean roughness | Peak count PPI | ("B" condition) |
| S1 | 1.19 $\mu$m | 266 | 0.158 |
| S2 | 1.43 $\mu$m | 373 | 0.178 |
| Comparative example | 1.44 $\mu$m | 189 | 0.258 |

The third example conducted cupping deep drawing and hemi-spherical punch stretching using the above-given galvanized steel sheets. The cupping deep drawing was given by forming a blank having a diameter of 100 mm, followed by deep drawing using a tool having a punch diameter of 50 mm and a die diameter of 53 mm. The applied blank-holding force was 20 KN, and the same cleaning oil with that used in the second example was applied to the galvanized steel sheet in advance. The evaluation of formability adopted the maximum load applied during the forming as the index. Lower maximum load indicates superior formability.

The hemi-spherical punch stretching formed a 100 mm square blank, and the punch stretching was given by a hemi-spherical punch having a diameter of 50 mm. Also in this case, the galvanized steel sheet was applied with the same cleaning oil as above, in advance. The evaluation of formability was done by conducting forming until crack appears on the punched surface of the galvanized steel sheet, and the reduction in sheet thickness was measured in the vicinity of punched surface where the crack was generated. The reduction in sheet thickness is defined as the percentage of sheet thickness reduction between before and after the stretch forming. Larger percentage of reduction in sheet thickness allows for giving larger stretch, or shows superior press-formability.

Figure 14:
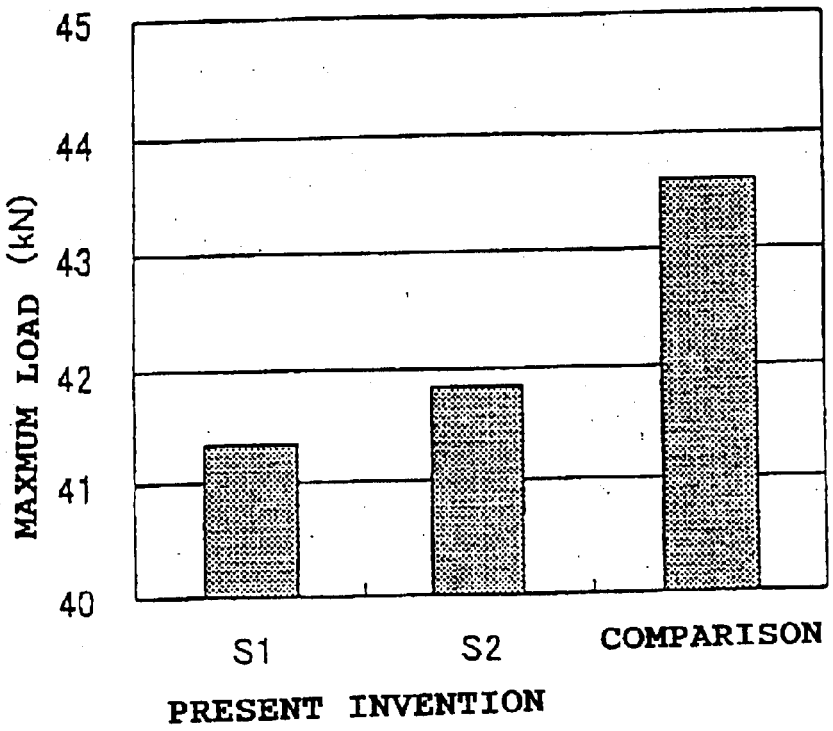
FIG. 14 shows the maximum loads observed during cupping deep drawing and forming test for the galvanized steel sheets in the third example and a comparative example to the third example of the Embodiment 1.

FIG. 14 shows the result of cupping deep drawing. The maximum load during the deep drawing according to the third example is less than that of the comparative example, and shows superior formability.

Figure 15:
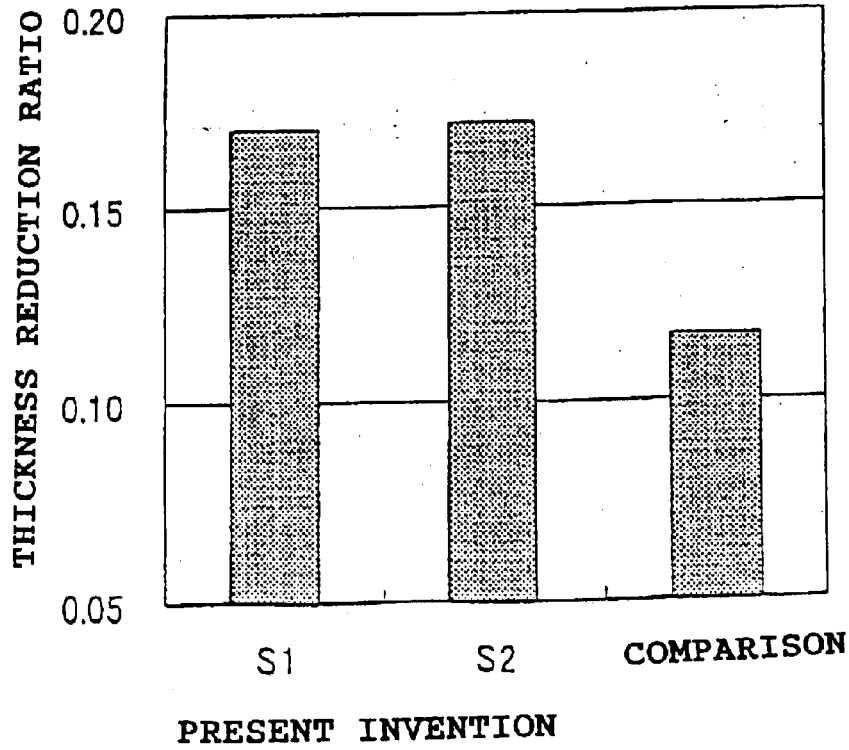
FIG. 15 shows the reduction percentage of sheet thickness observed in a hemi-spherical punch stretch forming test for galvanized steel sheet in the third example and a comparative example to the third example of the Embodiment 1.

FIG. 15 shows the result of the hemi-spherical punch stretch forming. The percentage of thickness reduction of the galvanized steel sheet at the stretch punch surface according to the third example is larger than that of the comparative example, and shows superior stretch formability.

As described above, the galvanized steel sheet obtained by the third example shows superior characteristics under both forming conditions of deep drawing and of stretch drawing to those of related art, thus proving the superior characteristics in actual press-forming, as well as superior evaluation of sliding characteristics.

EXAMPLE 4

The fourth example describes the availability of not only improved press-formability of galvanized steel sheet by blasting solid particles thereto, but also manufacturing galvanized steel sheet having superior image sharpness after coating.

In some cases, the surface of steel sheet coated by hot-dip galvanization has long-period waviness caused by the variations in coating film thickness and the waviness on the surface of substrate sheet before coating. According to the fourth example, the temper rolling with a bright roll was applied to a steel sheet that had relatively large waviness after zinc coating. The bright roll was finished on the surface thereof to a mean roughness Ra of 0.25 $\mu$m. The temper rolling was conducted to give an extension of 0.8%. After that, the solid particles A1 and B1, shown in Table 1, were used, respectively, to adjust the surface texture of the galvanized steel sheet using the air blasting unit shown in FIG. 2.

The applied blasting condition was: 0.4 and 0.7 MPa of pressure of compressed air; varying the blasting density in a range of from 1 to 50 kg/m$^2$ by changing the blasting period. The waviness Wca on the surface of the galvanized steel sheet was determined by a surface roughness meter (SE-30D, manufactured by Kosaka Laboratory Ltd.)

Figure 16:
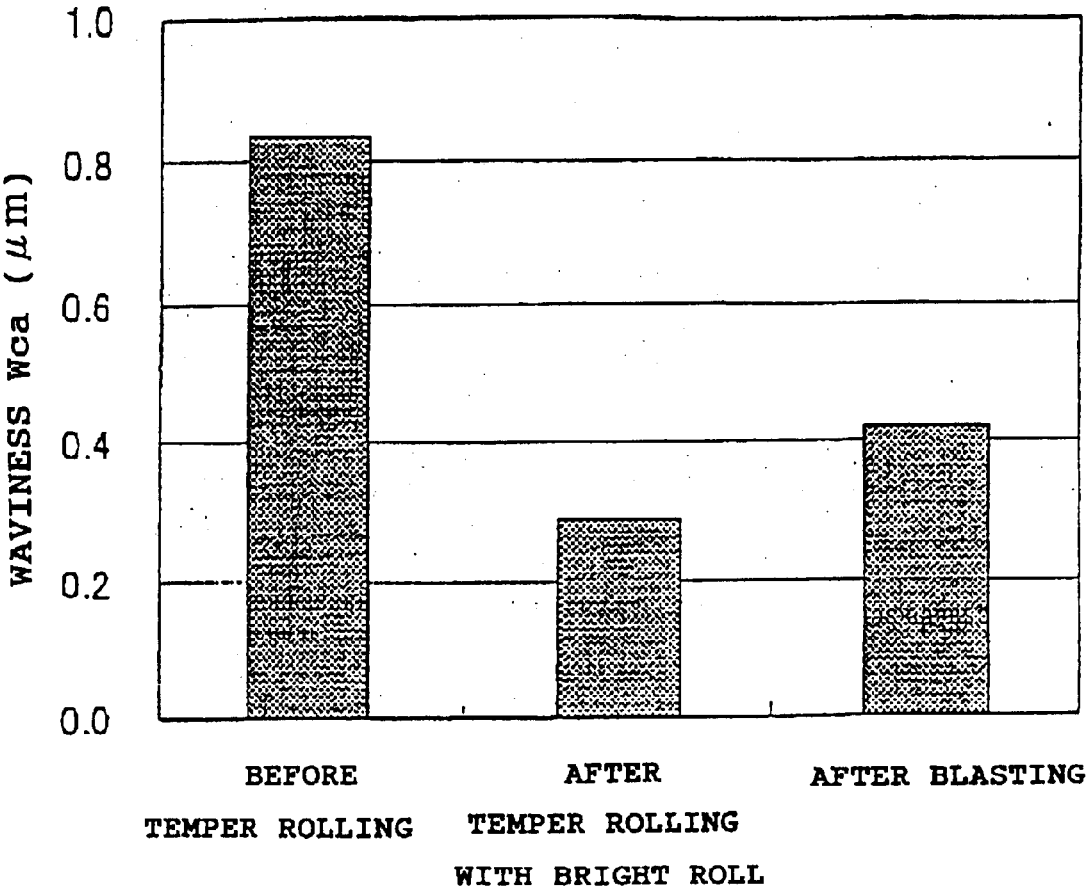
FIG. 16 shows waviness Wca in each step of manufacturing galvanized steel sheet in the fourth example of the Embodiment 1.

FIG. 16 shows examples of waviness Wca in each step of manufacturing galvanized steel sheet. These values are the result of surface texture adjustment using high-speed steel particles (B1) having a mean particle size of 60 $\mu$m. The resulted mean roughness Ra and the peak count PPI after blasting solid particles were 1.18 $\mu$m and 440, respectively.

FIG. 16 shows that the temper rolling with a bright roll significantly decreases the waviness Wca on the surface of galvanized steel sheet, even when the waviness of the steel sheet before temper rolling is very large. After blasting the solid particles, the waviness Wca of the surface of galvanized steel sheet was 0.42 $\mu$m, which shows that, even after blasting the solid particles, the waviness of long-period roughness profile can be maintained to low level.

Figure 17:
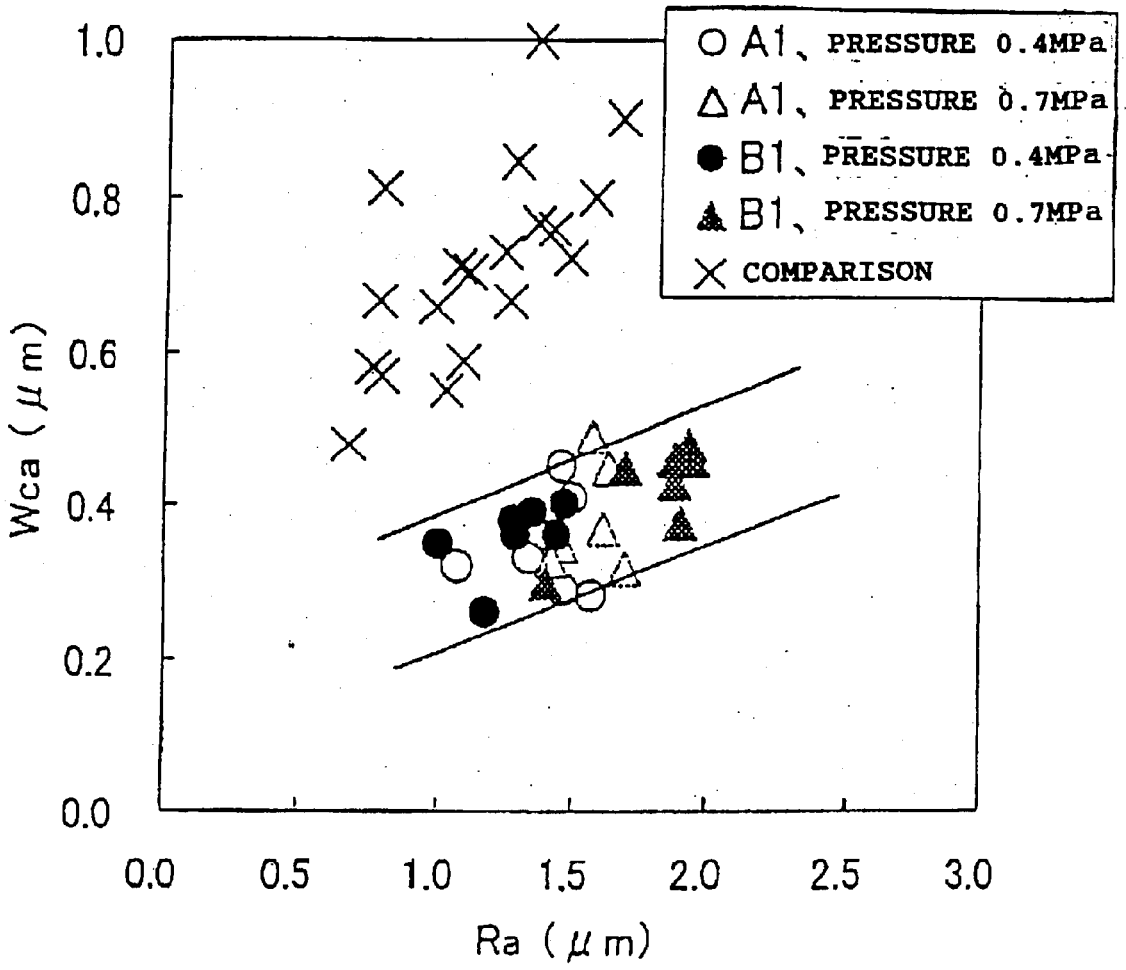
FIG. 17 shows the relation between the mean roughness Ra and the waviness Wca on the surface of galvanized steel sheet in the fourth example and a comparative example to the fourth example of the Embodiment 1.

FIG. 17 shows the result of determination of waviness Wca on the surface of galvanized steel sheet prepared by the fourth example, along with that obtained by a comparative example using temper rolling. Since the galvanized steel sheet according to the fourth example was treated by the temper rolling using a bright roll, the waviness Wca on the surface was maintained to a low level even the solid particles were blasted thereto. In particular, even when the mean roughness Ra on the surface of galvanized steel sheet increased, the increase in the waviness Wca was not significant, and the appearance of long-period roughness profile was suppressed.

On the other hand, according to the method for adjusting surface roughness by the temper rolling of related art if the waviness Wca on the surface of steel sheet before temper rolling is large, the waviness Wca on the surface after the temper rolling remained at a high level. Even for the temper rolling of related art, it is possible to reduce the waviness to some extent, after reducing the waviness of the surface of galvanized steel sheet, by applying again the temper rolling using a rolling roll that has surface roughness profile formed by electrical discharge machining.

With that type of manufacturing steps, however, two passes of temper rolling are necessary, which increases the number of manufacturing steps. Furthermore, since the total extension is necessarily be stayed within a certain range for adjusting the mechanical properties, there occurs a problem of failing in sufficiently transferring the microscopic roughness profile on the surface of rolling roll onto the steel sheet.

According to the fourth example, the adjustment of mechanical properties by the temper rolling is separated from the function to give surface roughness. Thus, it is possible to regulate the waviness on the surface of galvanized steel sheet to a low level while providing sufficient extension for adjusting the mechanical properties using the bright roll in the temper rolling. There is an advantage that, succeedingly the surface texture can be adjusted with very little change of mechanical properties of the substrate sheet. Furthermore, there is an effect that mainly the short-period roughness profile is formed on the surface, and the growth of long-period roughness profile is suppressed, because the peak count PPI on the surface of the galvanized steel sheet can be significantly increased compared with that of related art.

In the fourth example, the surface of the galvanized steel sheet was coated, and the image sharpness after coating was determined. The coating method was: using "PB-L3080" manufactured by Nihon Parkerizing Co., Ltd. to conduct the chemical conversion treatment to a specimen; then using "EI-2000", "TP-37 Gray", and "TM-13(RC)" manufactured by Kansai Paint Co., Ltd. to apply three layer coating consisting of ED coating, intermediate coating, and top coating, respectively. The NSIC value of thus coated specimen was determined by the "Image Sharpness Tester NSIC Model" manufactured by Suga Test Instrument Co., Ltd. to evaluate the image sharpness after coating. The NISC value has an index of 100 on a black polished glass plate, and the value nearer to 100 means more preferable image sharpness.

Figure 18:
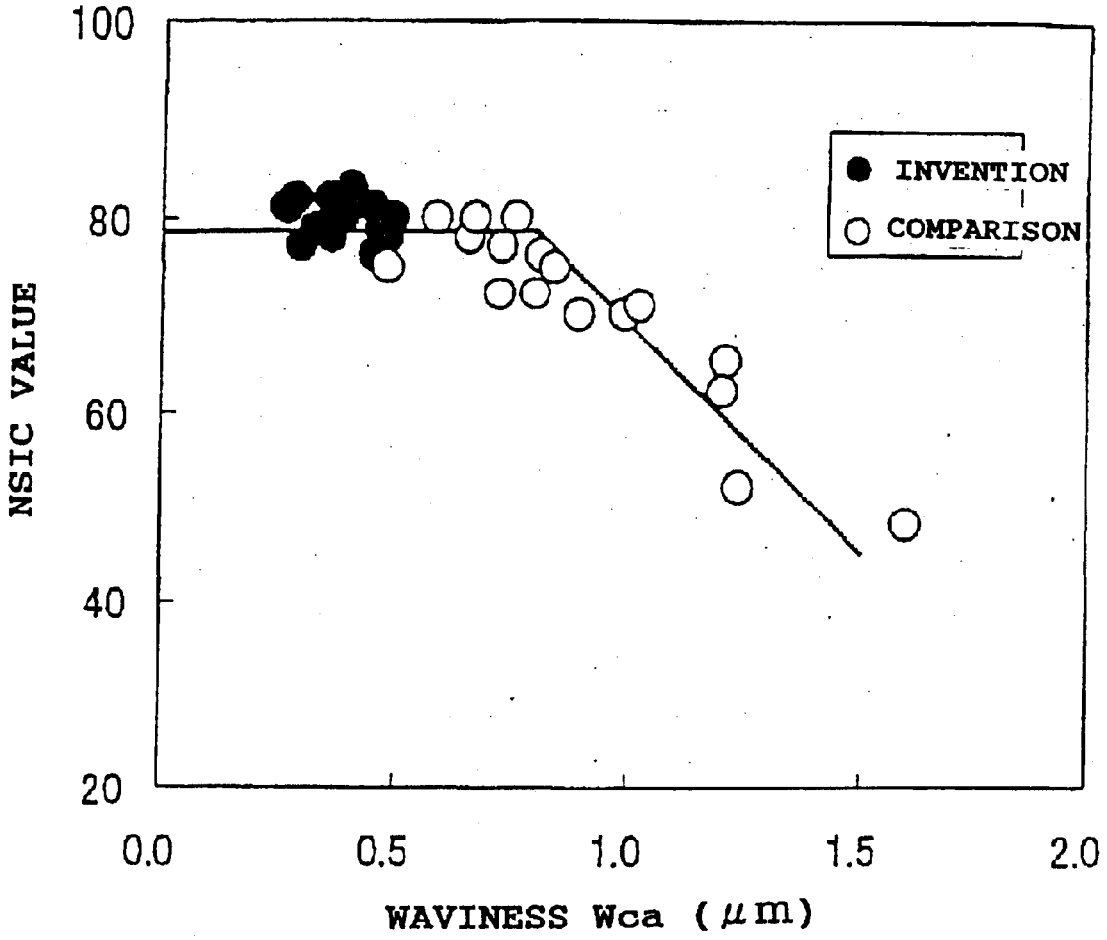
FIG. 18 shows the relation between the waviness Wca and the NSIC values on the surface of galvanized steel sheet in the fourth example and a comparative example to the fourth example of the Embodiment 1.

FIG. 18 shows the result of observation of image sharpness after coating. The figure also gives the image sharpness after coating observed on a sample of related art as a comparative example. As seen in the figure, if only the waviness Wca of the surface of galvanized steel sheet before coating is 0.8 $\mu$m or less, the NSIC values become almost stable level suggesting favorable image sharpness after coating.

Within a range of from 0.6 to 0.8 $\mu$m of the waviness Wca, however, the NSIC values give wide dispersion. Accordingly, to attain a stable and favorable image sharpness after coating, it is preferable that the waviness Wca on the surface of galvanized steel sheet before coating is regulated to 0.6 $\mu$m or less. In this respect, the image sharpness after coating according to the fourth example gives small dispersion, and stable and high values compared with those of comparative example.

Figure 19:
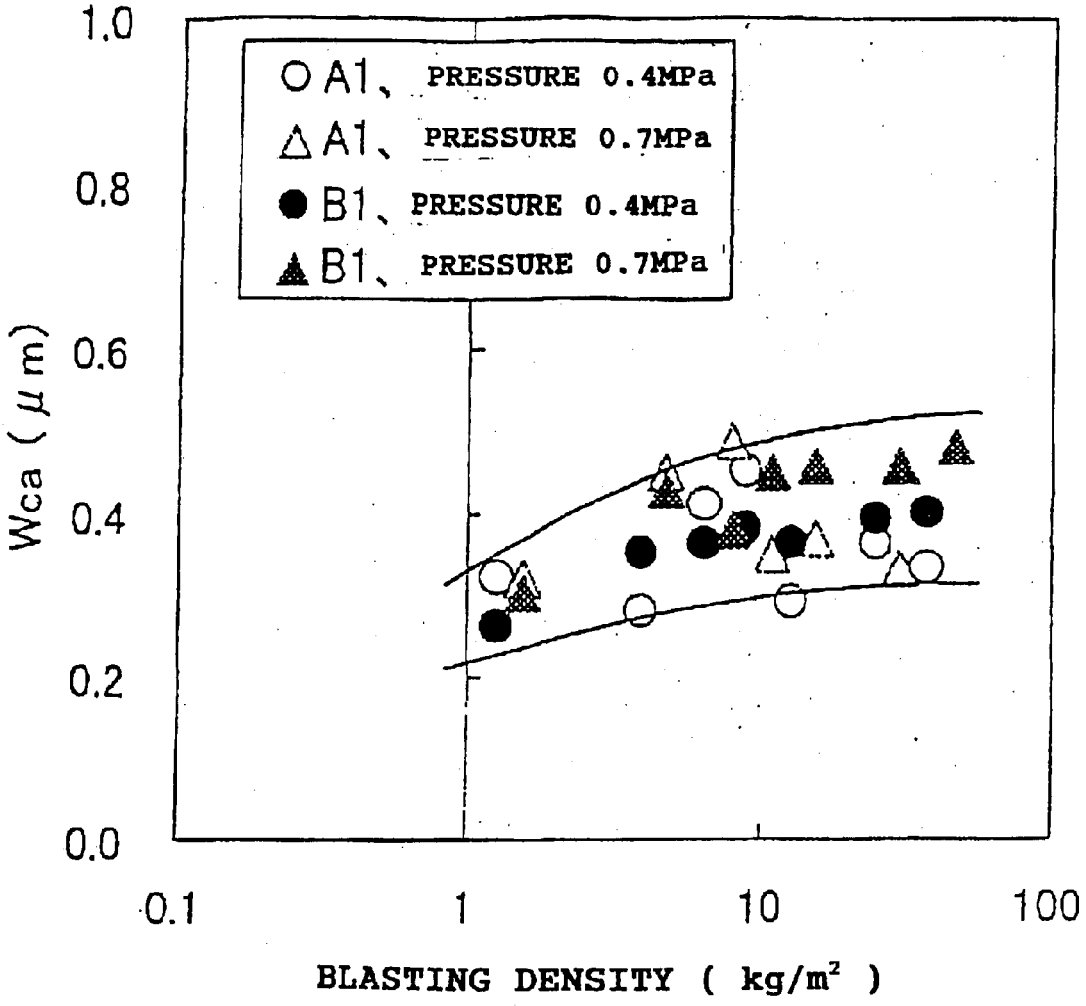
FIG. 19 shows the relation between the waviness Wca and the blasting density on the surface of galvanized steel sheet in the fourth example of the Embodiment 1.

When solid particles are blasted against the surface of galvanized steel sheet, some blasting conditions may increase the surface waviness. To this point, the relation between the blasting density of the solid particles and the waviness Wca on the surface of the galvanized steel sheet was investigated. FIG. 19 shows the result. The figure shows a tendency of slight increase in the waviness Wca on the surface of galvanized steel sheet with the increase in blasting density. Nevertheless, since the magnitude of Wca before the solid particle blasting is around 0.3 $\mu$m, the increase in Wca values can be suppressed to about 0.1 $\mu$m even at around 50 kg/m$^2$ of blasting density.

Consequently, for the aim of attaining a certain level of the image sharpness after coating, and to regulate the waviness Wca on the surface of galvanized steel sheet after blasting solid particles to 0.8 $\mu$m or less, the waviness Wca of the surface of galvanized steel sheet before blasting solid particles may be adjusted to 0.7 $\mu$m or less. Nevertheless, as described in the fourth example, by combining the temper rolling step using a bright roll with the manufacturing steps, the Wca value can be reduced to 0.3 $\mu$m level, thus providing further significant effect.

EXAMPLE 5

The fifth example describes the conditions on adjusting the surface texture of galvanized steel sheet using the air blasting unit shown in FIG. 2.

Figure 20:
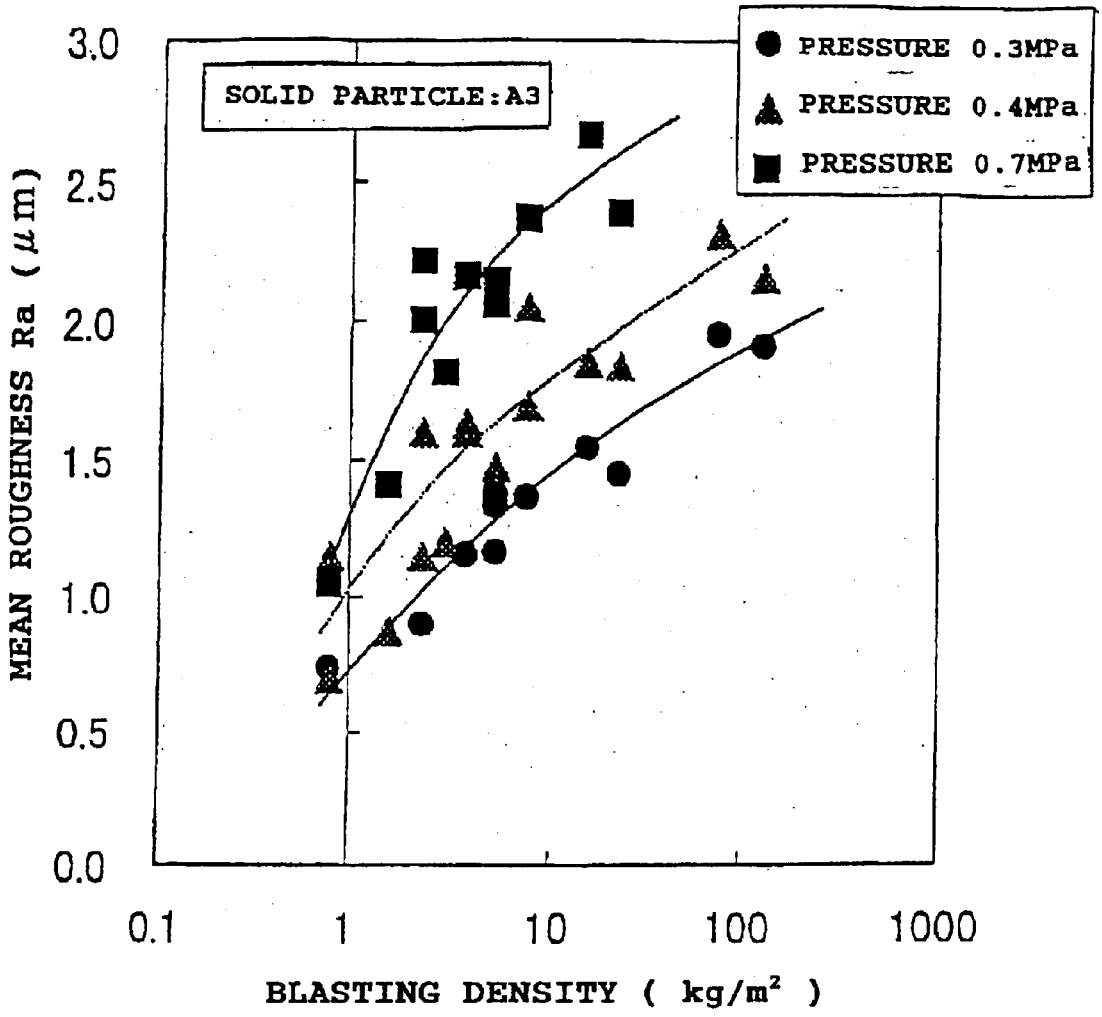
FIG. 20 shows an example of the relation between the mean roughness Ra and the blasting density on the surface of galvanized steel sheet in the fifth example of the Embodiment 1.
Figure 21:
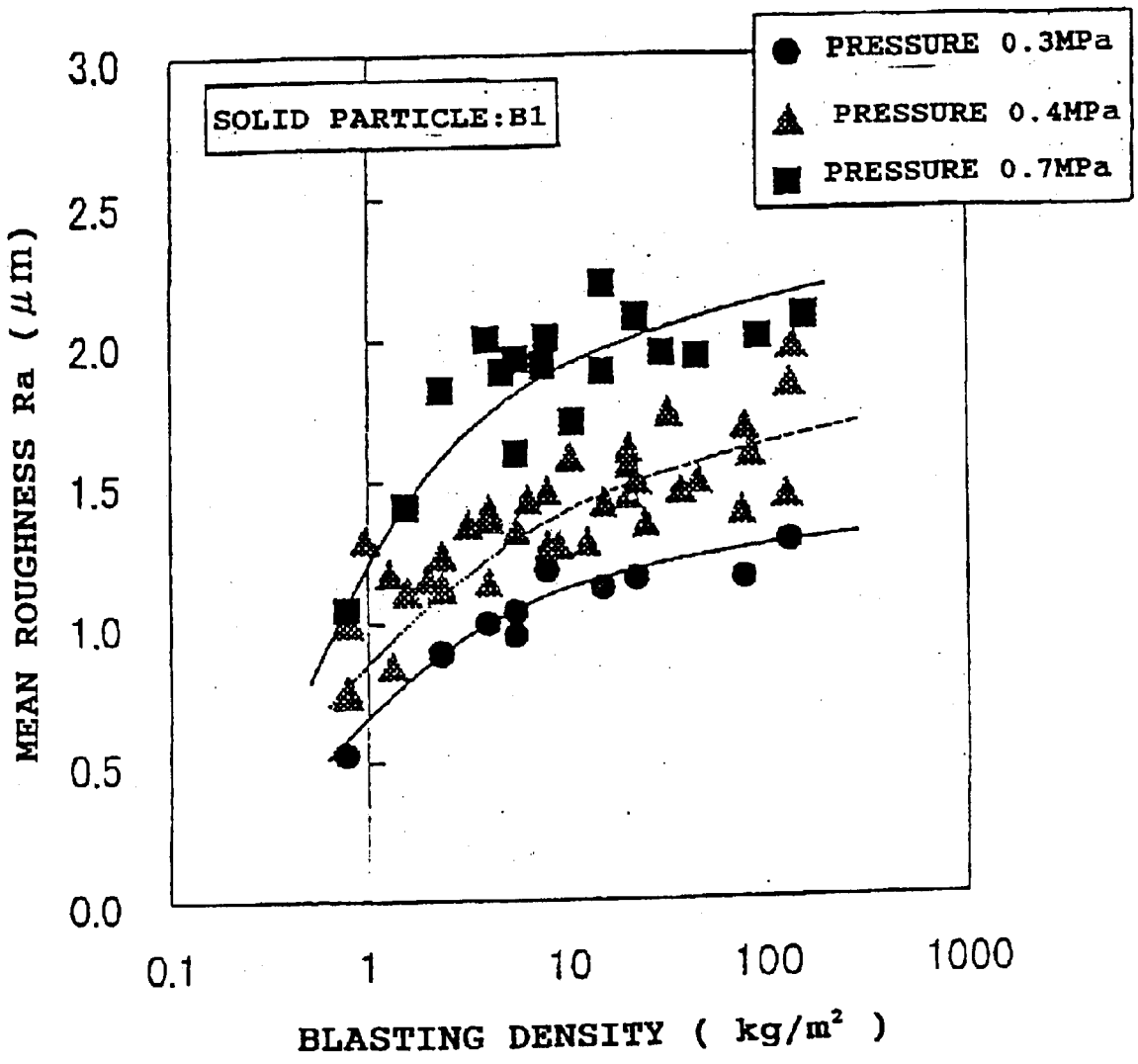
FIG. 21 shows another example of the relation between the mean roughness Ra and the blasting density on the surface of galvanized steel sheet in the fifth example of the Embodiment 1.

FIG. 20 and FIG. 21 show the results of investigation on the relation between the mean roughness Ra and the blasting density. FIG. 20 is the case that used the solid particles of SUS304, having a mean particle size of 100 $\mu$m, (A3). FIG. 21 is the case that used the solid particles of high-speed steel, having a mean particle size of 60 $\mu$m, (B1). For both cases, the pressure of compressed air was varied in three grades, 0.3, 0.4, and 0.7 MPa, and the blasting density was varied in the time of blasting the solid particles against the surface of galvanized steel sheet in a range of from 0.03 to 5 seconds. The distance between the tip of the nozzle and the galvanized steel sheet was selected to 100 mm.

FIG. 20 shows that the mean roughness Ra on the surface of galvanized steel sheet has an increasing tendency along with the increase in the blasting density. Furthermore, increase in the pressure of compressed air increases the mean roughness. Accordingly, the mean roughness Ra can be controlled by adjusting the blasting density and the pressure of compressed air.

FIG. 21 shows similar tendency as in FIG. 20, indicating the increase in the mean roughness Ra with the increase in the blasting density. Since, however, the mean particle size of the solid particles is smaller than that in FIG. 20, the dents created on the surface of galvanized steel sheet become small, and the increasing rate of the mean roughness relative to the blasting density is moderate.

Figure 22:
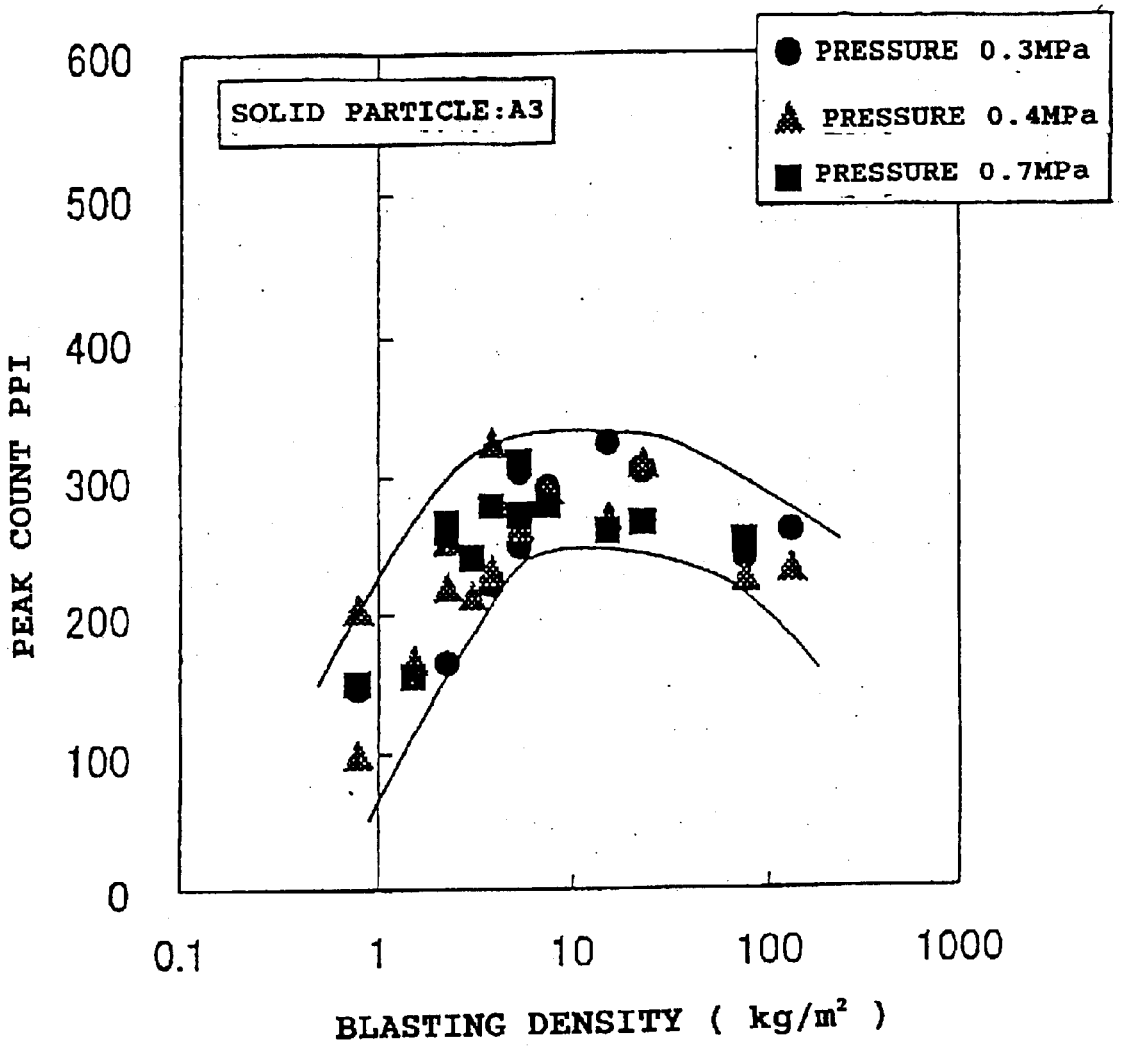
FIG. 22 shows an example of the relation between the peak count PPI and the blasting density on the surface of galvanized steel sheet in the fifth example of the Embodiment 1.
Figure 23:
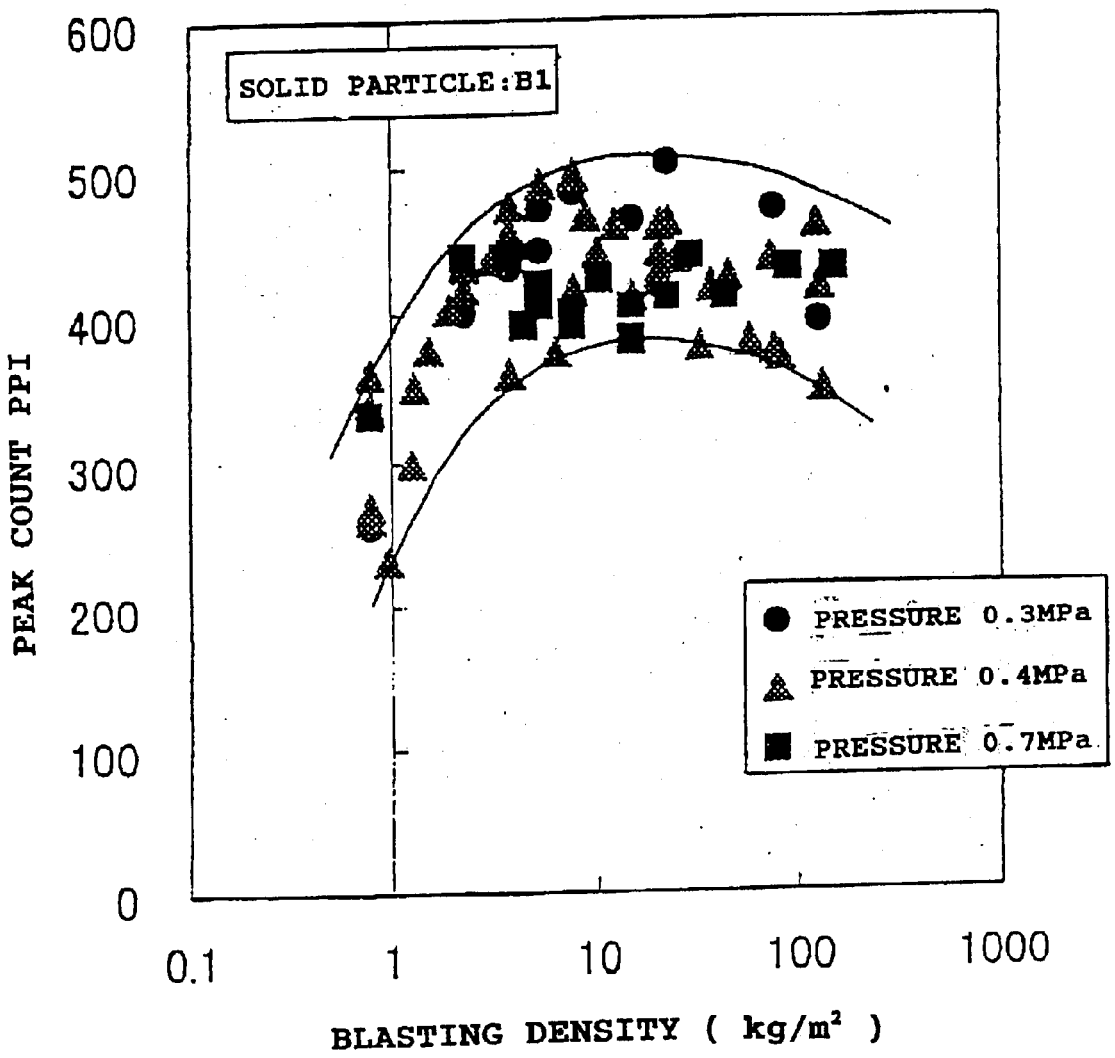
FIG. 23 shows another example of the relation between the peak count PPI and the blasting density on the surface of galvanized steel sheet in the fifth example of the Embodiment 1.

FIG. 22 and FIG. 23 show the peak count PPI corresponding to that in FIG. 20 and FIG. 21. According to FIG. 22, the peak count PPI once increases with the increase in the blasting density, and becomes nearly constant level at a blasting density range of from 5 to 40 kg/m$^2$. Further increase in the blasting density induces a tendency of slight reduction in the peak count PPI.

The data of FIG. 23 show that denser roughness profile on the surface of galvanized steel sheet is formed owing to the small mean particle size of the solid particles, so the peak count PPI values become large compared with those of FIG. 22. There is observed a similar feature that the increase in the blasting density once increases the peak count PPI, and reaches to a nearly constant level at a blasting density range of from 2 to 40 kg/m$^2$, followed by slightly reducing the values.

The phenomenon of increasing in the peak count PPI in a region that the blasting density is small, in FIGS. 22 and 23, presumably indicates the process of increasing in the number of dents formed on the surface of galvanized steel sheet. The reason that the peak count stays at nearly constant level in the succeeding region of increasing in the blasting density is that the dents formed by collision of solid particles exist almost all area of the surface of galvanized steel sheet, and that the microscopic roughness texture does not significantly vary even when the blasting density further increases. A presumable reason of reduction in the peak count PPI under further increase in the blasting density is that also the microscopic surface roughness profile once formed over the whole area is demolished centering on the profile peak portions by the further blasting of solid particles.

Based on the above-described point of view, it is not favorable to select a blasting density at or above a certain level for providing short-period roughness profile on the surface of galvanized steel sheet. According to the range of the fifth example, 40 kg/m$^2$ or smaller blasting density is an appropriate range.

According to the fifth example, the minimum value of the blasting density is selected to 0.7 kg/m$^2$. FIG. 20 shows that, even when the blasting density is 0.7 kg/m$^2$, the obtained mean roughness Ra exceeds 1 μm, and, even if the blasting density decreases to 0.2 kg/m$^2$, the mean roughness Ra is estimated to reach around 0.5 μm.

FIG. 23 suggests that, even when the blasting density is around 0.2 kg/m$^2$, the peak count PPI is expected to be able to reach 200 or more. The second example shows that, even when the mean roughness Ra is around 0.5 μm and the peak count PPI is around 200, the galvanized steel sheet on which the surface texture was adjusted by blasting of solid particles shows superior press-formability to that formed by related art. Therefore, the press-formability should be superior to that in the related art even if the blasting density is around 0.2 kg/m$^2$.

Figure 24:
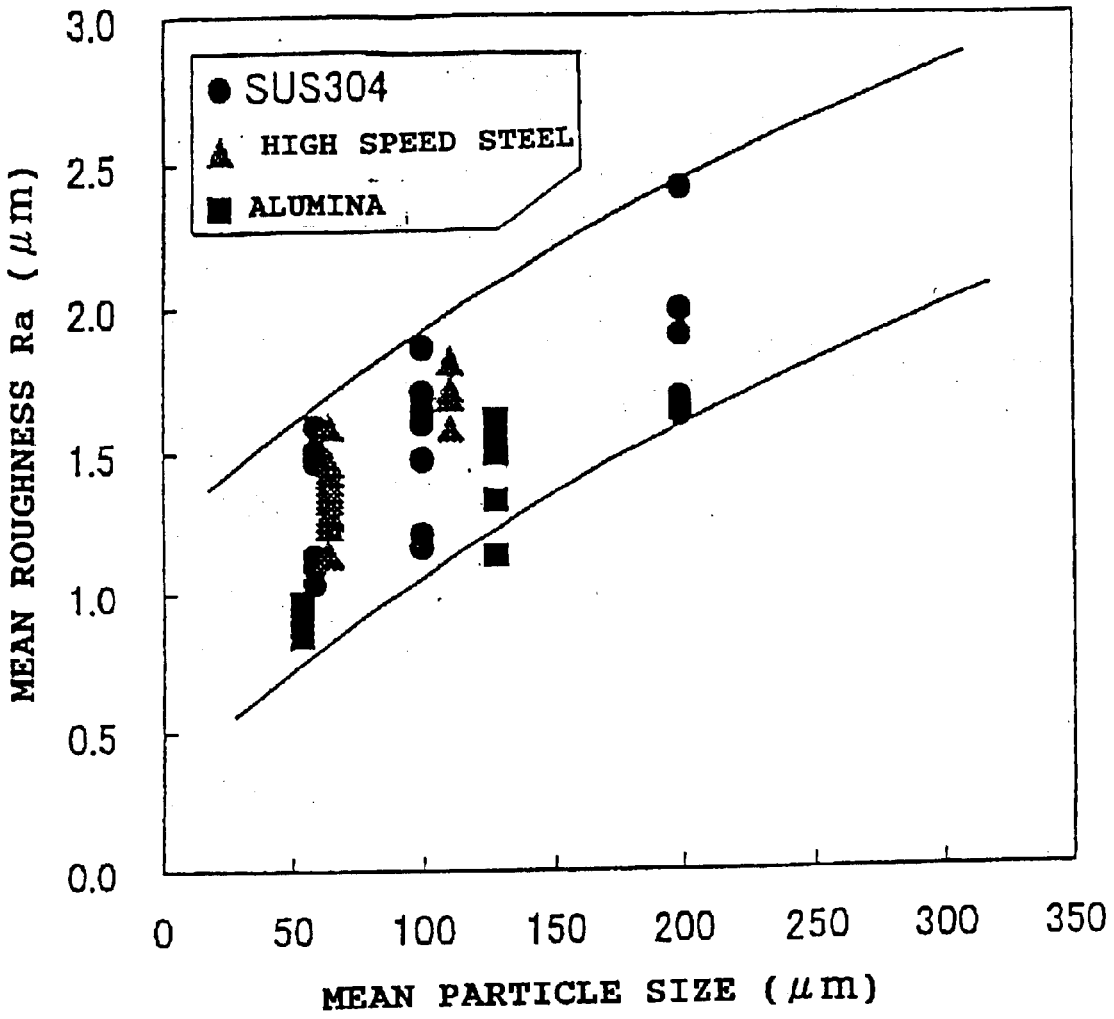
FIG. 24 shows the relation between the mean roughness Ra on the surface of galvanized steel sheet and the mean particle size in the fifth example of the Embodiment 1.
Figure 25:
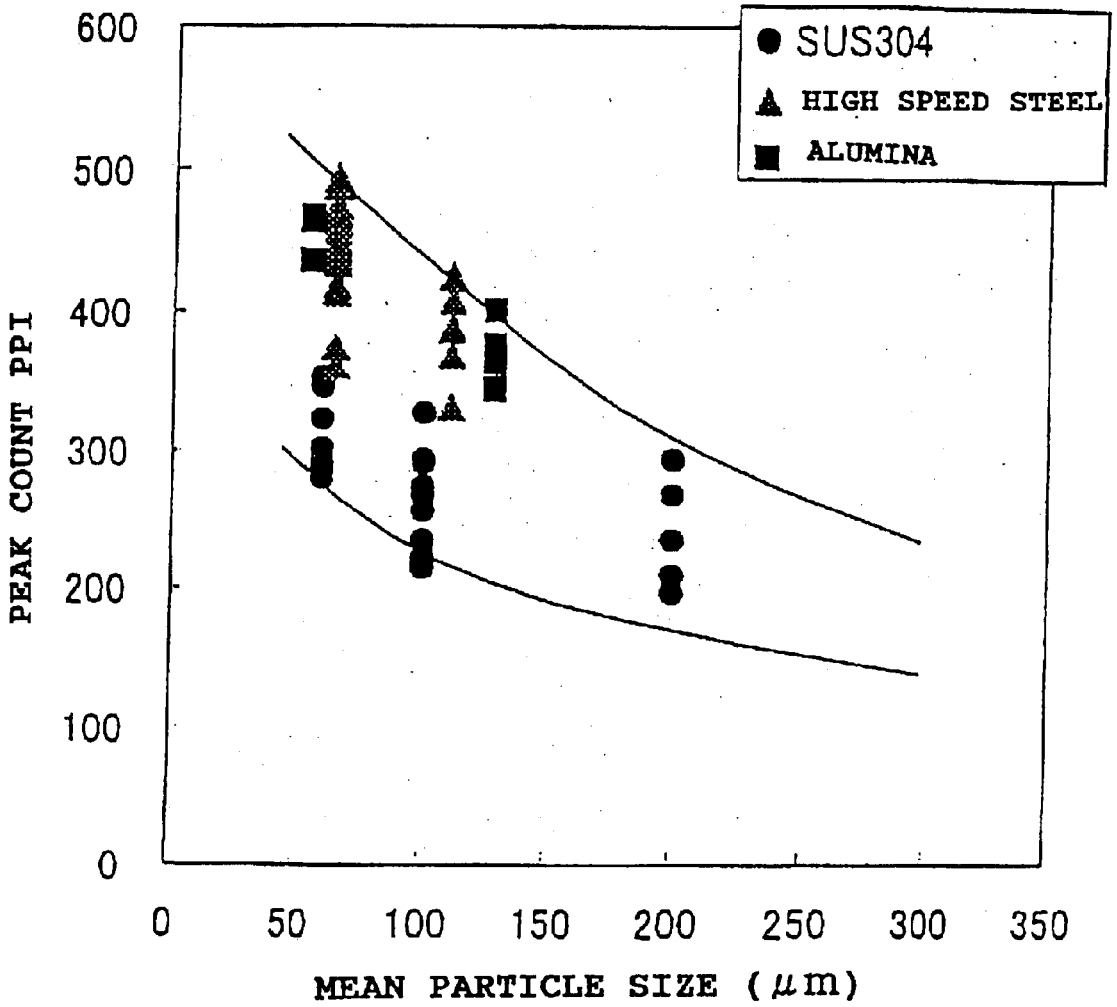
FIG. 25 shows the relation between the mean peak count PPI on the surface of galvanized steel sheet and the mean particle size in the fifth example of the Embodiment 1.

FIG. 24 and FIG. 25 show the relation between the mean particle size of the blasted solid particles, the mean roughness Ra on the surface of galvanized steel sheet, and the peak count PPI. These figures were prepared for the case that the applied solid particles were A1, A3, A4, B1, B2, D1, and D2 shown in Table 1, that the pressure of compressed air was 0.4 MPa, and that the blasting density was in a range of from 4 to 20 kg/m$^2$. FIG. 24 shows that increased mean particle size increases the mean roughness Ra on the surface of galvanized steel sheet. Compared with alumina which has small solid particle density, the metallic particles having large density increase the mean roughness Ra.

FIG. 25 shows that larger mean particle size of solid particles decreases more the peak count PPI on the surface of galvanized steel sheet. The reason is that increased mean particle size increases the size of dents formed on the surface of galvanized steel sheet, thus increasing the pitch of adjacent peaks and valleys of microscopic roughness profile.

According to FIG. 24, the largest mean roughness Ra formed is about 1.5 μm even with a mean particle size of 60 μm, thus the attainable mean roughness Ra is expectedly 0.5 μm even with a mean particle size of about 10 μm. In that case, FIG. 25 shows that the obtained peak count PPI is very large. Based on this point of view, the result of the second example shows that superior press-formability to that of related art is attained even with around 10 μm of mean particle size of solid particles.

On the other hand, FIG. 25 suggests that it is possible to adjust the peak count PPI to 200 or higher level even with around 300 μm of mean particle size of the solid particles. In particular, increase in the peak count PPI is available by decreasing the size of a dent formed by the collision of a single particle through the reduction in the pressure of compressed air further than that in the condition of the fifth example, or by using ceramics solid particles having small density. Therefore, with the consideration that the maximum value of peak count PPI obtained by related art is around 230, the method according to the present invention provides superior press-formability, even with around 300 μm of mean particle size of solid particles, to that of related art within a mean particle size range of the solid particles of from 10 to 300 μm.

Figure 26:
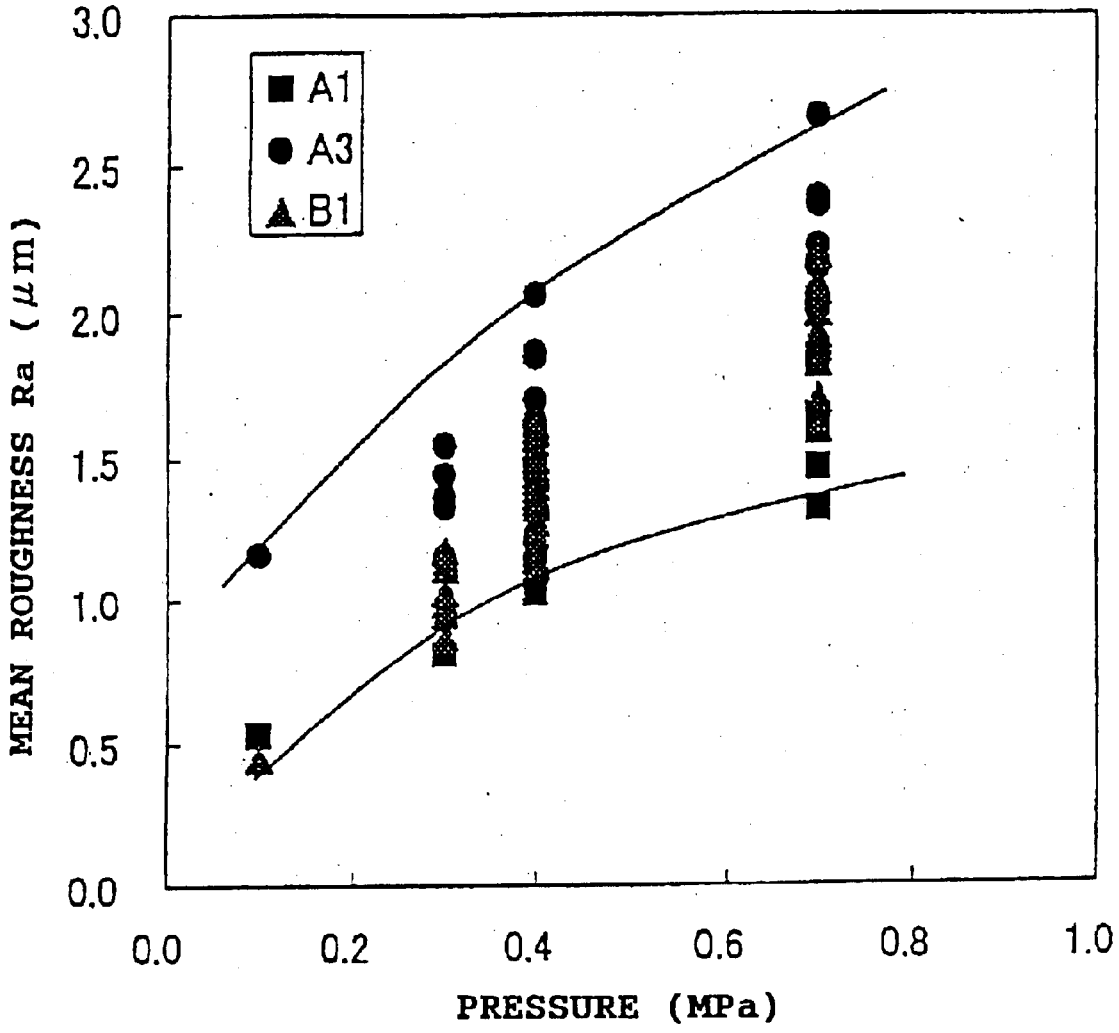
FIG. 26 shows the relation between the mean roughness Ra on the surface of galvanized steel sheet and the pressure of compressed air in the fifth example of the Embodiment 1.
Figure 27:
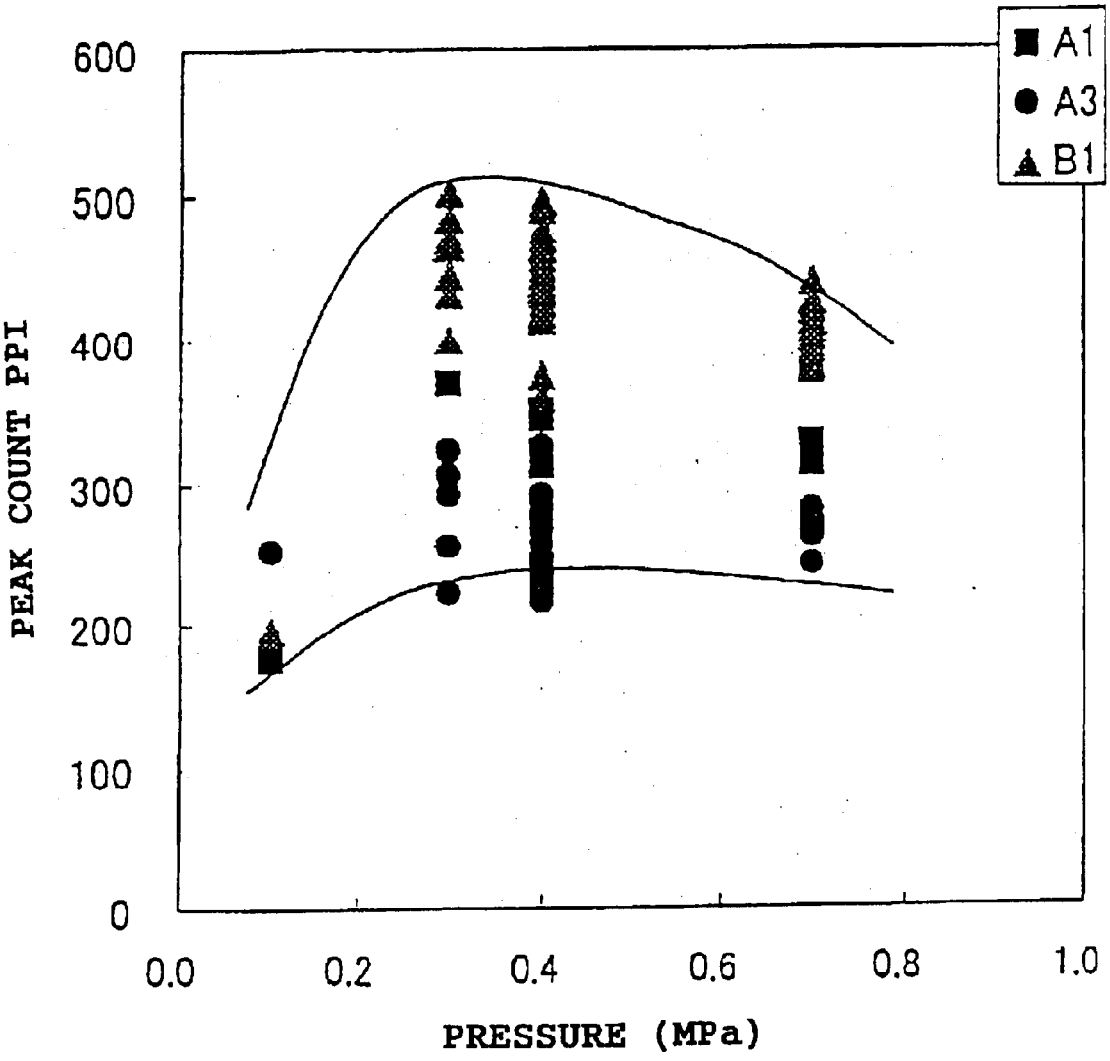
FIG. 27 shows the relation between the peak count PPI on the surface of galvanized steel sheet and the pressure of compressed air in the fifth example of the Embodiment 1.

Furthermore, in the fifth example, the relation between the pressure of compressed air and the surface texture of the galvanized steel sheet was investigated in the case of using air-blasting unit. FIG. 26 shows the relation between the pressure of compressed air and the mean roughness Ra. FIG. 26 shows that higher pressure of compressed air provides increased mean roughness Ra. FIG. 27 shows the relation between the pressure of compressed air and the peak count PPI on the surface of galvanized steel sheet. FIG. 27 shows that the peak count PPI becomes the maximum at an approximate range of the pressure of compressed air of from 0.3 to 0.4 MPa. In other words, when the pressure is low at around 0.1 MPa, the blasting speed of the solid particles decreases, which fails in forming sufficient size of dents on the surface of galvanized steel sheet, and, when the pressure is as high as 0.7 MPa, the size of dents formed by the solid particles become large so that the pitch of adjacent peaks and valleys of microscopic roughness profile increases.

As for the blasting of solid particles using an air-blasting unit, it is difficult to directly measure the blasting speed of solid particles, so the accurate blasting speed cannot be determined. However, an analysis given by Takeshita et al. (Proceedings for the 48th Congress Lecture Meeting, Tokai Branch of the Japan Society of Mechanical Engineers, No.933-1, 1999/3/19–20) derived the relation between the particle size of solid particles, the pressure of compressed air, and the blasting speed. A figure given in the paper of Takeshita et al. shows around 90 to 270 m/s of the speed of solid particles in a pressure range of compressed air of from 0.2 to 0.6 MPa. Smaller size of solid particles should further increase the blasting speed, and the maximum value of blasting speed of the solid particles in the fifth example is presumably around 300 m/s.

EXAMPLE 6

The sixth example describes the result of adjustment of surface texture of galvanized steel sheet using a centrifugal blasting unit, different from the method applied in the first through fifth examples.

Also in the sixth example, the adopted hot-dip galvanized steel sheet was prepared from a cold-rolled steel sheet having a thickness of 0.8 mm and having a coating film consisting mainly of η phase. Similar with the first through fifth examples, the temper rolling to provide 0.8% of extension was applied using a bright roll having 0.28 μm of mean roughness Ra on the surface of rolling roll.

The applied centrifugal blasting unit is the one having 330 mm of rotor diameter and 100 m/s of the maximum blasting speed. The distance between the rotational center of the centrifugal rotor and the galvanized steel sheet, (blasting distance), was set to a range of from 250 to 500 mm. The reason of the set level is that, when solid particles as fine as 300 μm or smaller mean particle size are blasted, increased blasting distance decreases the colliding speed of the particles against the surface of steel sheet owing to the deceleration in air, thus failing in forming sufficient roughness profile on the surface of galvanized steel sheet, which means that reduction in the blasting distance within a possible range is effective.

Figure 28:
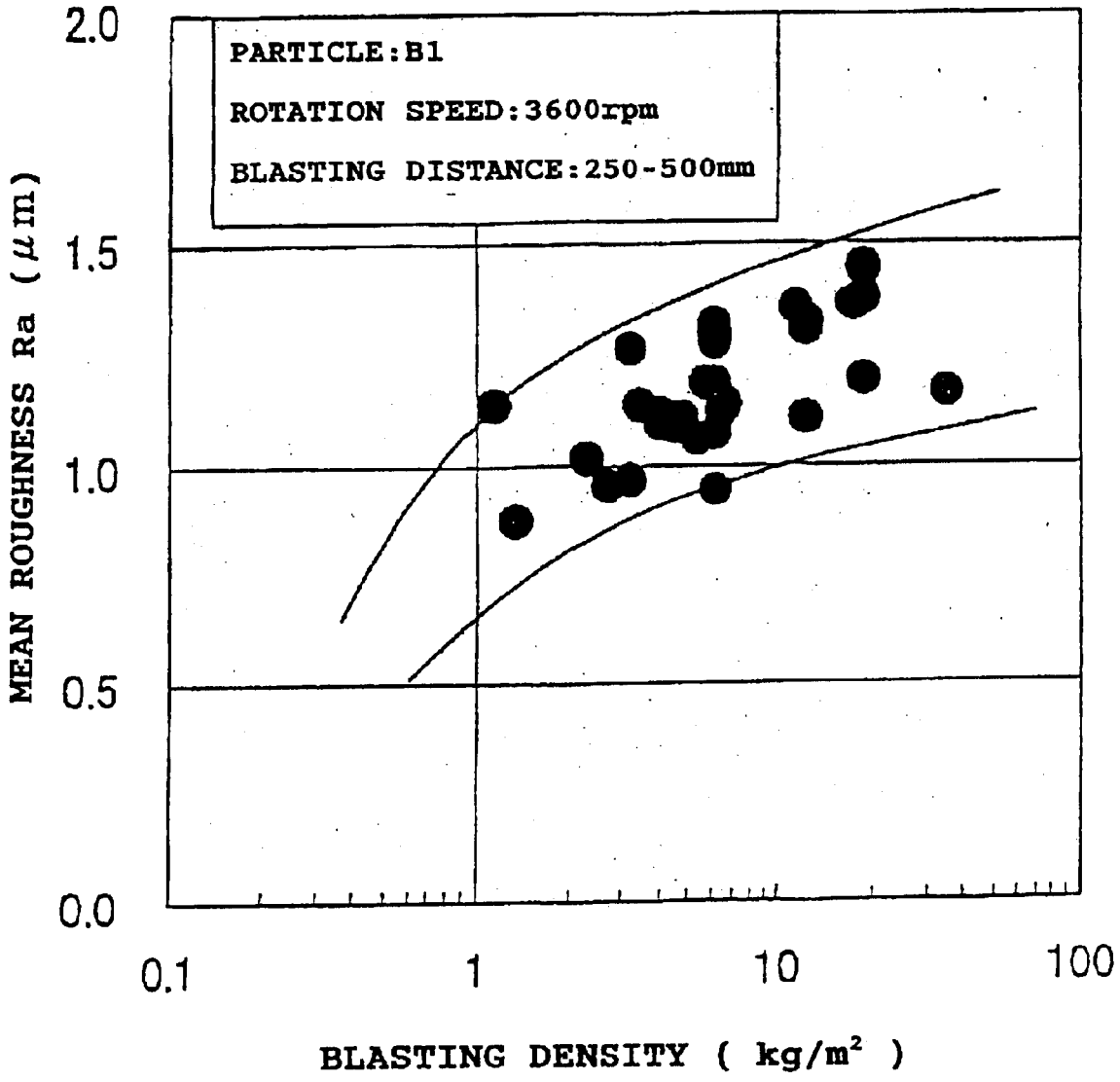
FIG. 28 shows the relation between the mean roughness Ra on the surface of galvanized steel sheet and the blasting density in the sixth example of the Embodiment 1 according to the present invention.
Figure 29:
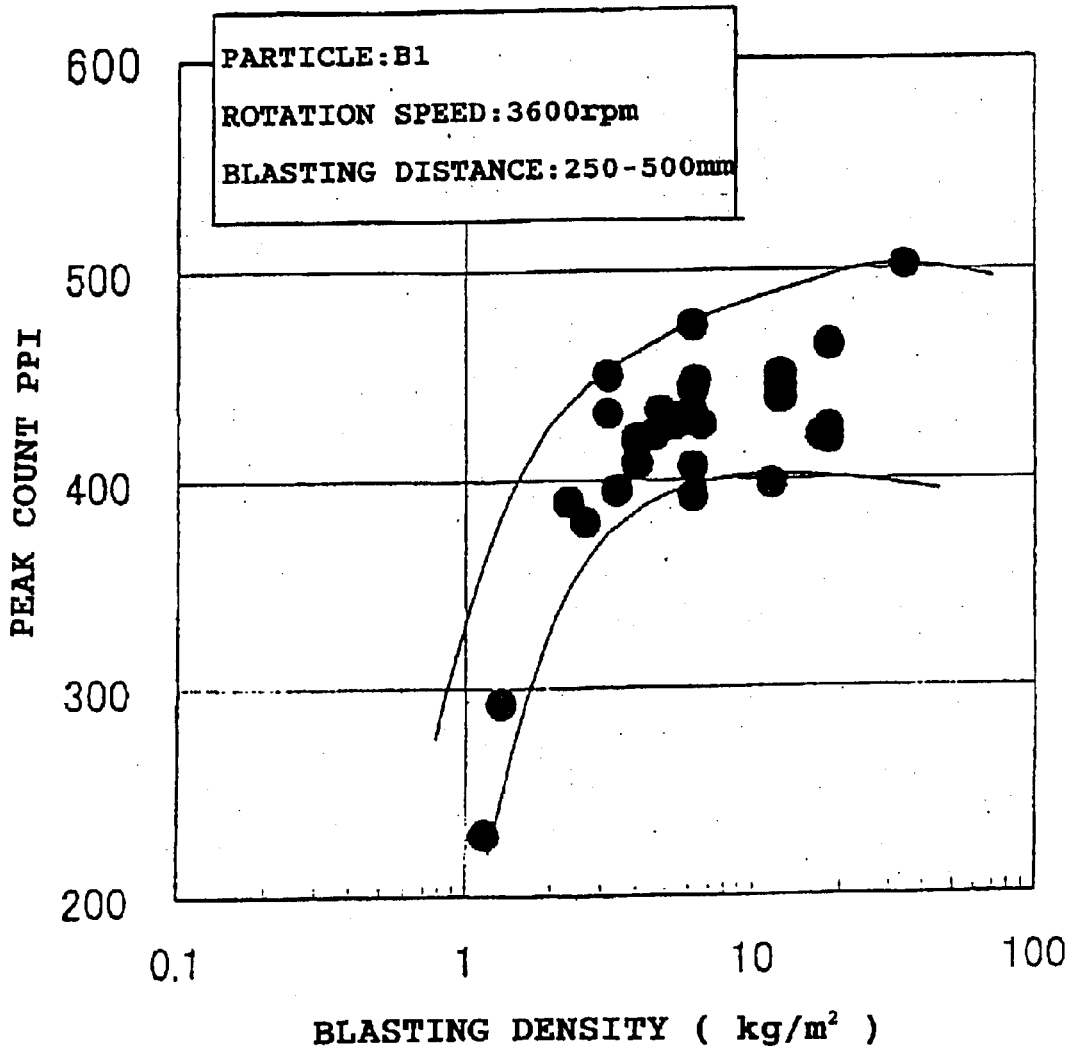
FIG. 29 shows the relation between the peak count PPI on the surface of galvanized steel sheet and the blasting density in the sixth example of the Embodiment 1.

FIG. 28 and FIG. 29 show the result of blasting high-speed steel (B1) as the solid particles against the surface of galvanized steel sheet with 3,600 rpm of rotational speed of the centrifugal rotor. The blasting density was adjusted by varying the supply quantity of the solid particles. The blasting density was determined as the ratio of the total quantity of blasted solid particles to the area where the solid particles were blasted thereto.

FIG. 28 shows the relation between the blasting density and the mean roughness Ra on the surface of galvanized steel sheet. Similar with the result of the fifth example, there is a tendency of increase in the mean roughness Ra along with the increase in the blasting density. FIG. 29 shows the relation between the peak count PPI and the blasting density. FIG. 29 shows a tendency that the peak count PPI increases with the increase in the blasting density and that the peak count PPI reaches a nearly constant level within the succeeding range of blasting density of from 4 to 40 kg/m$^2$, which tendency is similar with that of the air-blasting unit.

Figure 30:
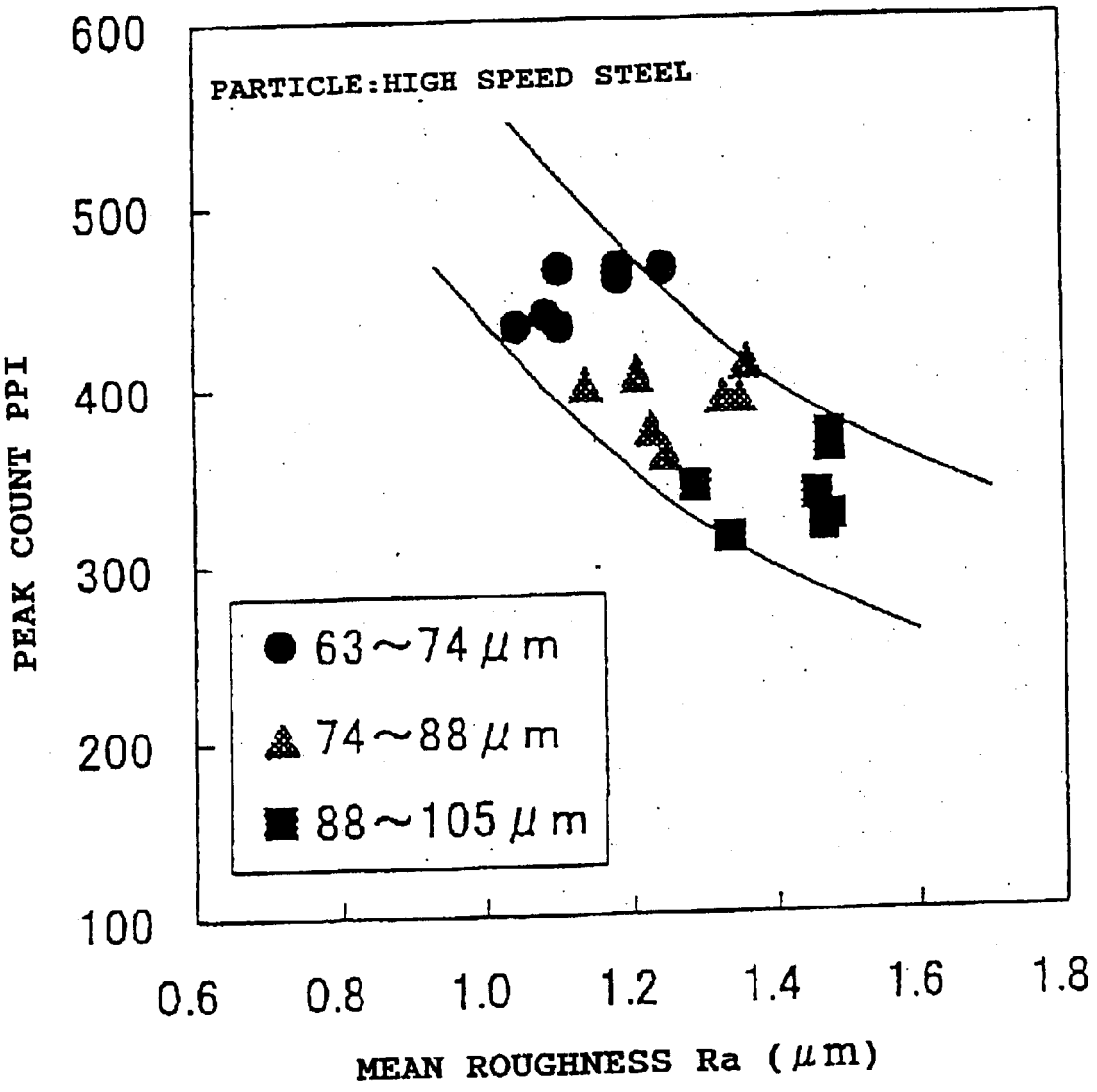
FIG. 30 shows an example of the relation between the mean roughness Ra and the peak count PPI on the surface of galvanized steel sheet in the sixth example of the Embodiment 1.
Figure 31:
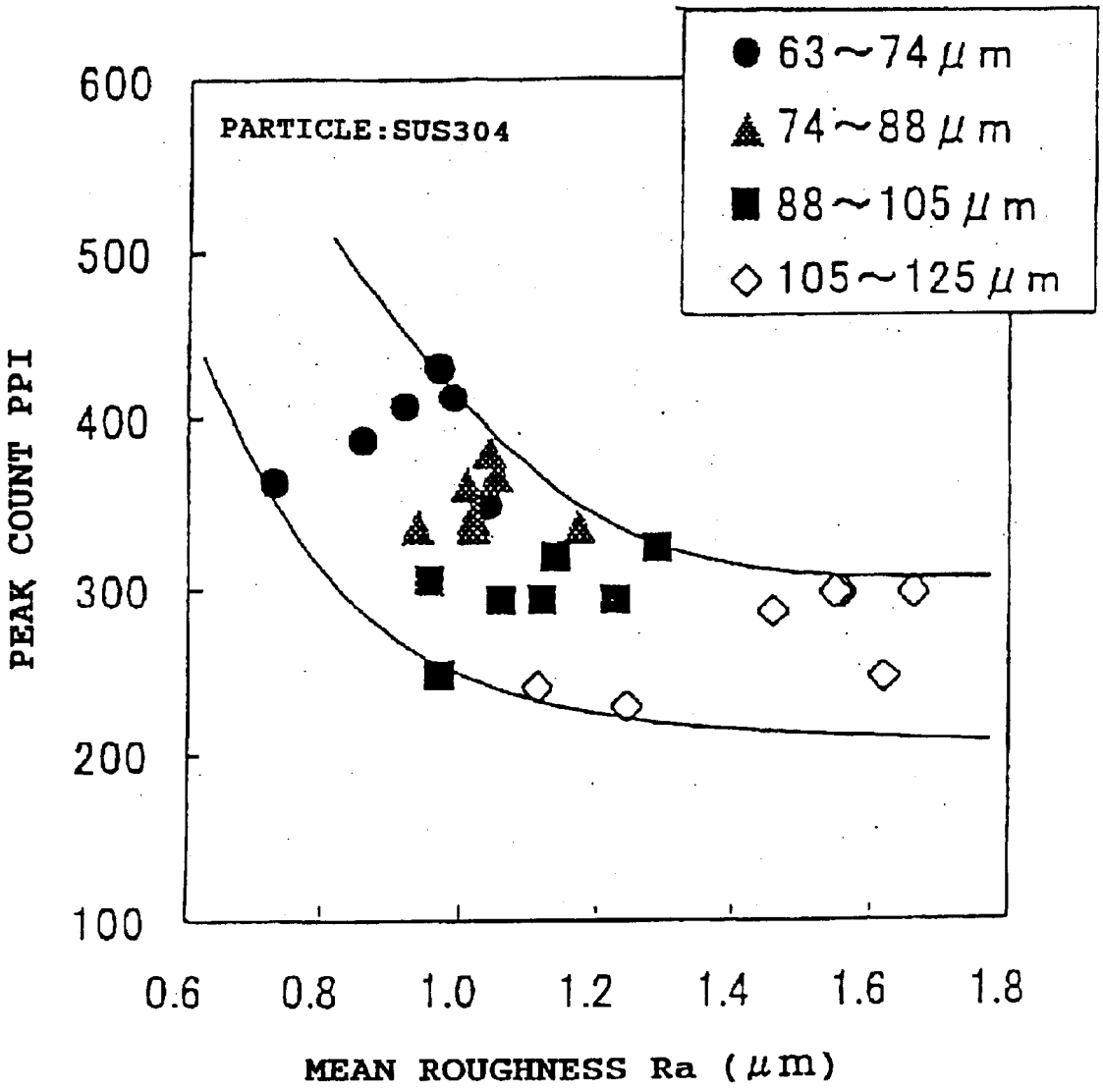
FIG. 31 shows another example of the relation between the mean roughness Ra and the peak count PPI on the surface of galvanized steel sheet in the sixth example of the Embodiment 1.
Figure 32:
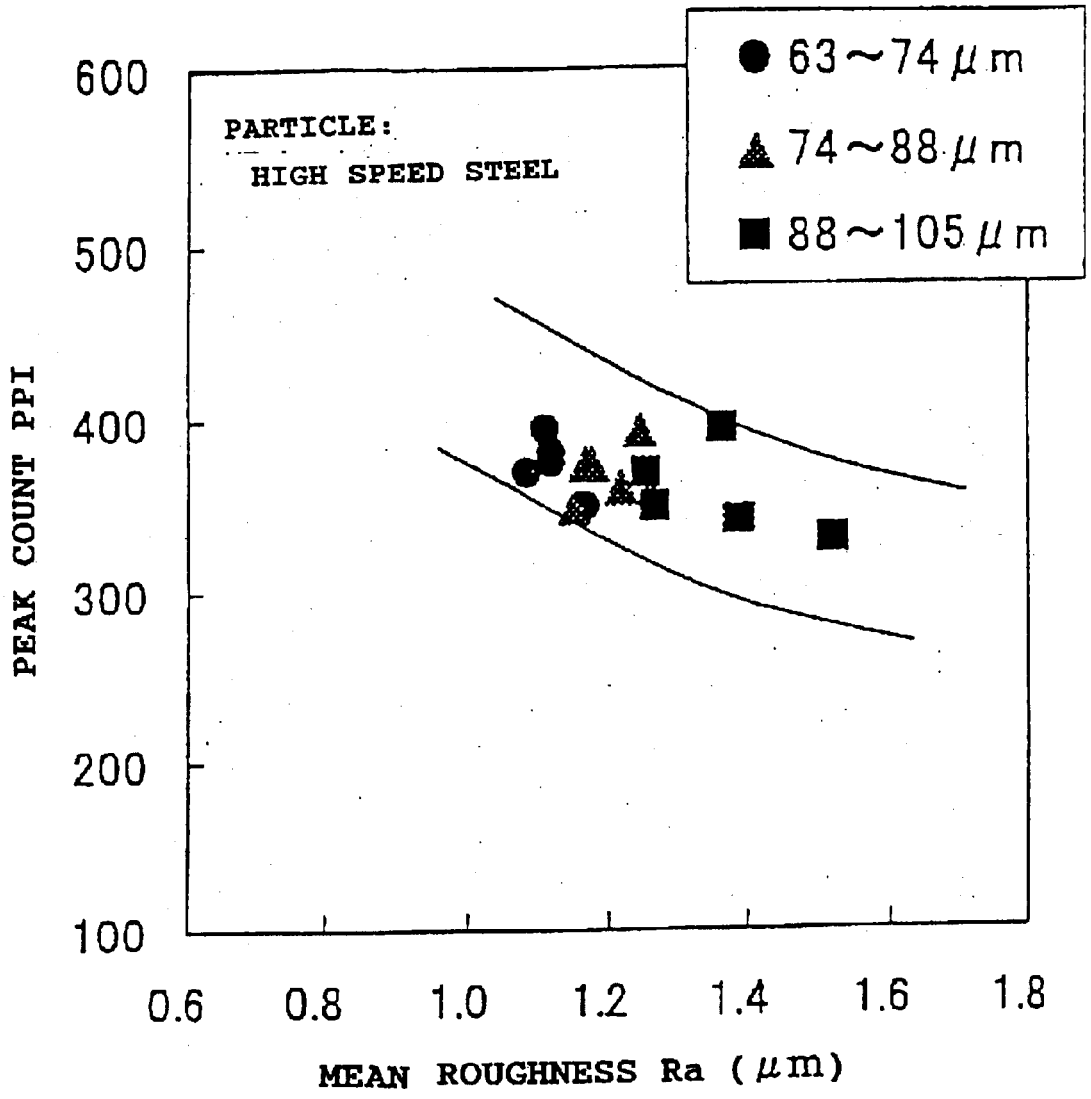
FIG. 32 shows further example of the relation between the mean roughness Ra and the peak count PPI on the surface of galvanized steel sheet in the sixth example of the Embodiment 1.

FIG. 30 through FIG. 32 show the result of blasting solid particles against the surface of galvanized steel sheet using a centrifugal blasting unit, which solid particles are high speed steel, SUS304, and high carbon steel, respectively, which are classified by sieves in advance. The blasting condition was 3,600 rpm of the rotational speed of the centrifugal rotor and 6 kg/m$^2$ of the blasting density. FIG. 30 through FIG. 32 show the relation between the mean roughness Ra and the peak count PPI, both of which were given on the surface of galvanized steel sheet under the above-described condition.

For all cases of above-given figures, there is a tendency of increasing the mean roughness Ra and decreasing the peak count PPI with increase in the particle size of solid particles. The tendency comes from that, similar with the air-blasting unit applied in the fifth example, large particle size of solid particles leads to the deep dents created on the surface of galvanized steel sheet, thus to increase in the mean roughness Ra, and increase in the pitch of adjacent peaks and valleys of microscopic roughness profile, thus to decrease in the peak count PPI.

Figure 33:
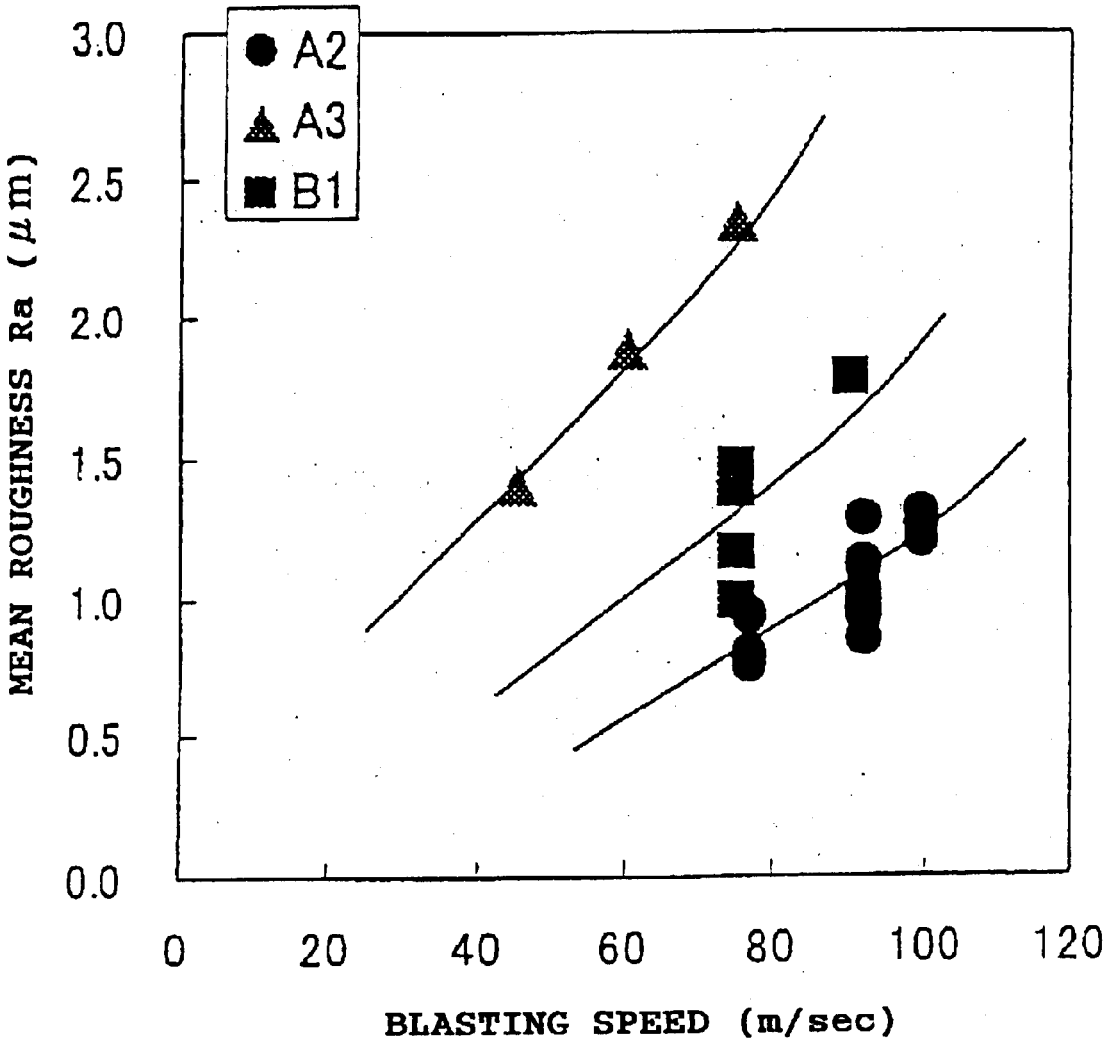
FIG. 33 shows the relation between the mean roughness Ra on the surface of galvanized steel sheet and the blasting speed in the sixth example of the Embodiment 1.

Furthermore, the influence of the change in the rotational speed of the centrifugal rotor on the blasting speed of solid particles was investigated in the sixth example. The applied solid particles were made of SUS304 (A2, A3) and high-speed steel (B1), respectively. The blasting density was in a range of from 5 to 10 kg/m$^2$. FIG. 33 shows the relation between the mean roughness Ra on the surface of galvanized steel sheet and the blasting speed. The term "blasting speed" referred herein signifies the original blasting speed of the particle leaving the centrifugal rotor. The figure shows that the mean roughness Ra increases with the increase in the blasting speed.

Figure 34:
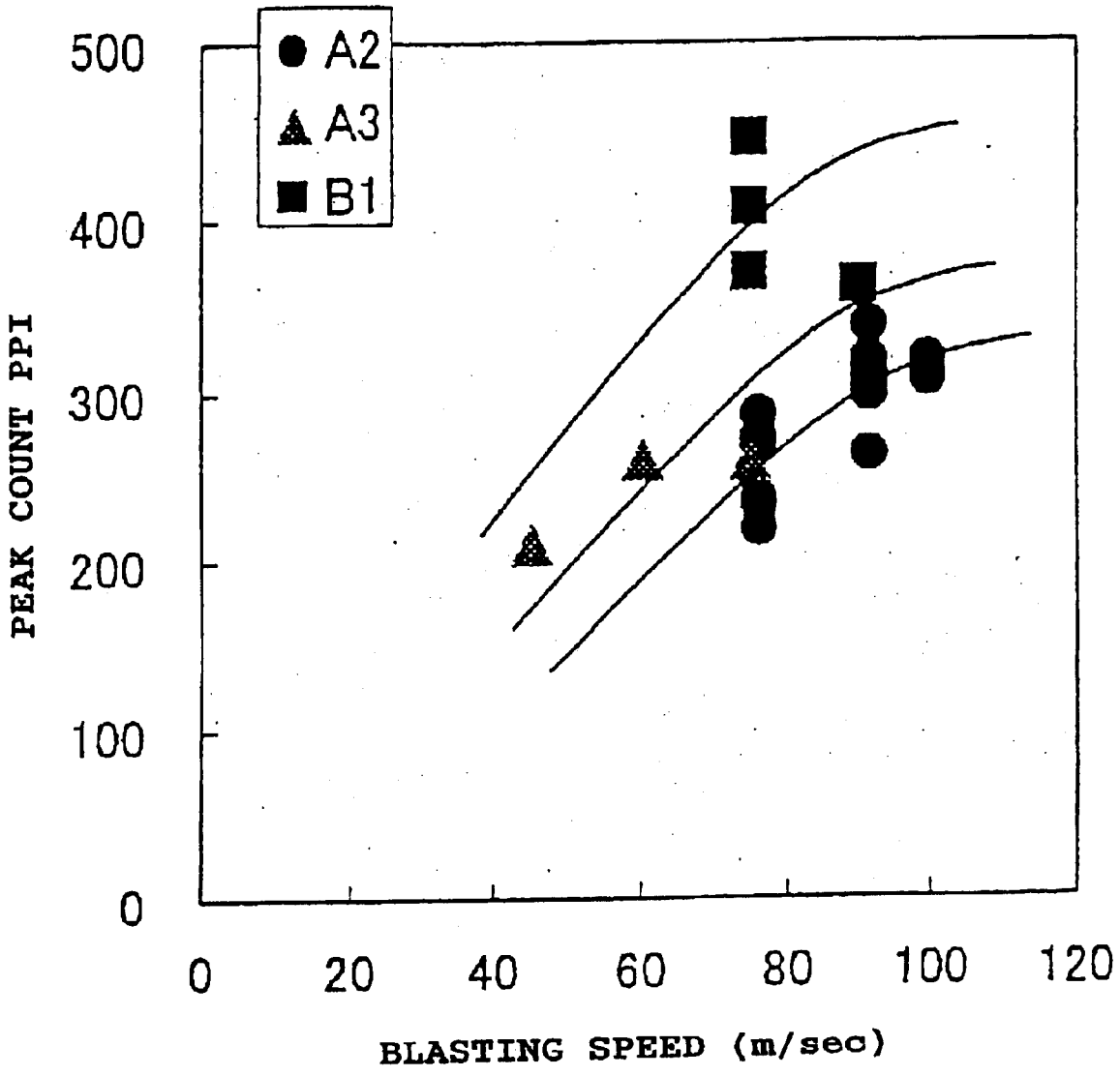
FIG. 34 shows the relation between the peak count PPI on the surface of galvanized steel sheet and the blasting speed in the sixth example of the Embodiment 1.

FIG. 34 shows the relation between the peak count PPI and the blasting speed. FIG. 34 shows a tendency that increased blasting speed leads to the increase in the peak count PPI. The tendency comes from that, in a region of low blasting speed, the size of dent created on the surface of galvanized steel sheet caused by the collision of a single particle thereto becomes small, thus, to form microscopic roughness profile densely on the whole surface area of the galvanized steel sheet, further large blasting density is required. Accordingly, the peak count PPI can be increased by increasing the blasting density even when the blasting speed is small.

According to FIG. 33, with the SUS304 particles (A3) having 100 $\mu$m of mean particle size, a 1.4 $\mu$m level of mean roughness Ra is attained even when the blasting speed is 45 m/s. Accordingly, it is possible to adjust the mean roughness Ra to 1 $\mu$m level even at a 30 m/s level of blasting speed. In addition, the high-speed steel (B1) particles having 65 $\mu$m of mean particle size also allow to adjust the mean roughness Ra to 0.5 $\mu$m level at 30 m/s of blasting speed.

FIG. 34 suggests that it is possible to adjust the peak count PPI to around 200 even when the blasting speed is about 30 m/s. With the consideration that the sliding characteristics shown in the second example are superior to those of the related art even when the mean roughness Ra on the surface of galvanized steel sheet is about 0.5 $\mu$m and the peak count PPI is about 200, a galvanized steel sheet having excellent press-formability can be manufactured if only the blasting speed of the solid particles is 30 m/s or more.

EXAMPLE 7

The seventh example describes the press-formability and other characteristics of galvanized steel sheet which was adjusted in the surface texture thereof using the centrifugal blasting unit described in the sixth example.

Figure 35:
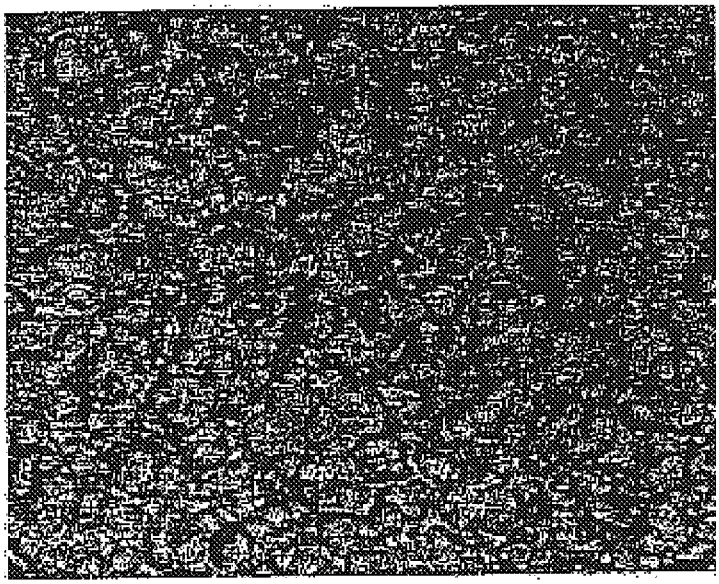
FIG. 35 shows photographs of the surface of galvanized steel sheet in the seventh example of the Embodiment 1.
Figure 35:
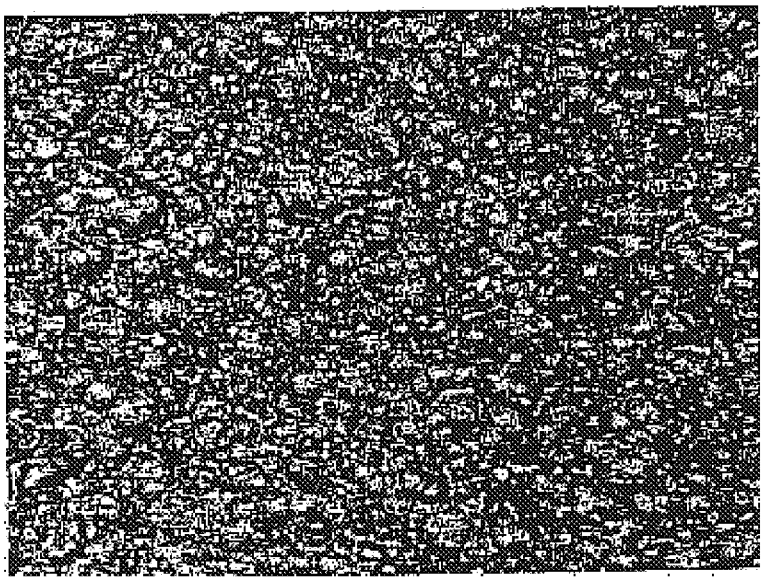
Figure 36:
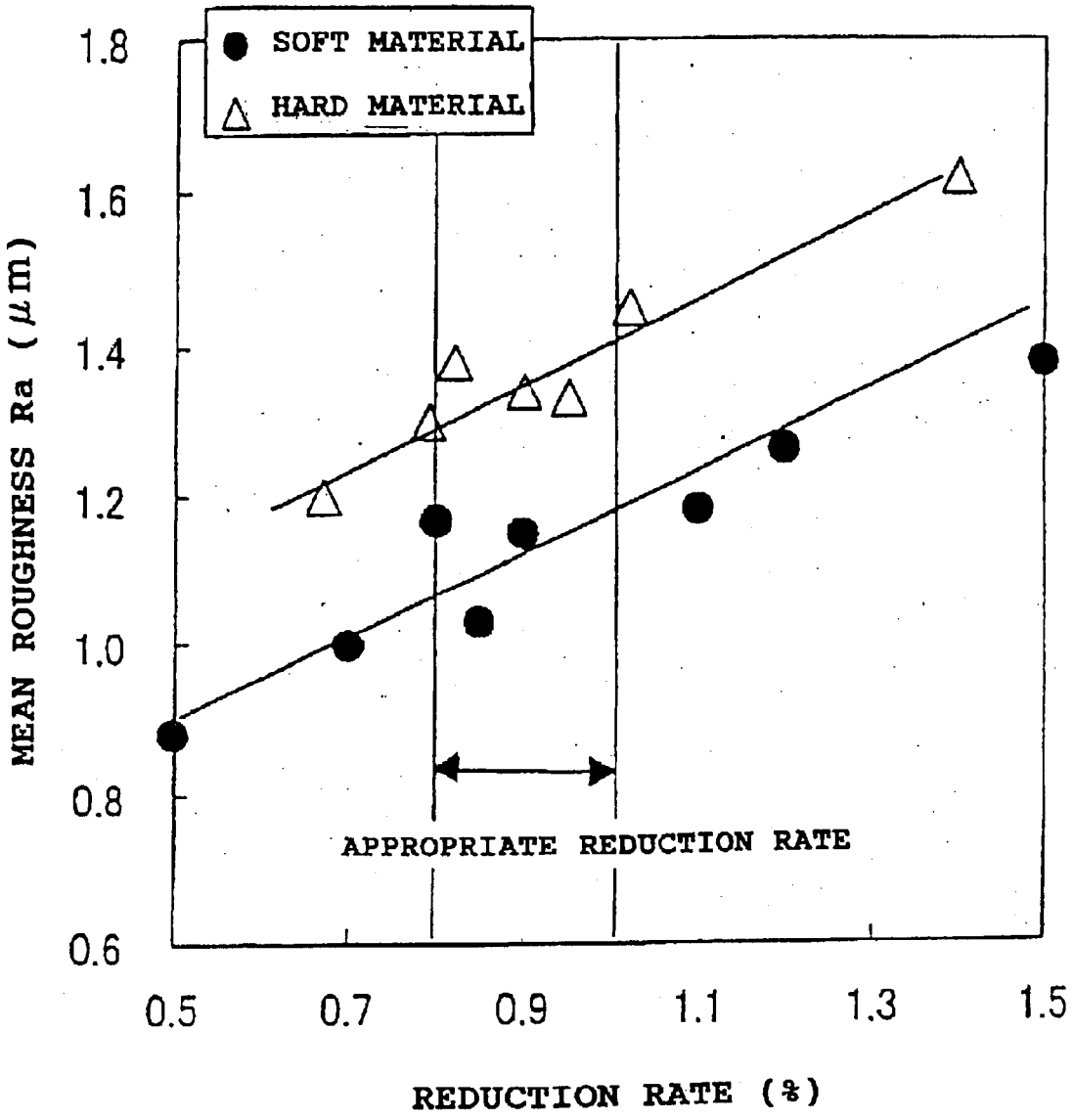
FIG. 36 illustrates the characteristics of a method for adjusting the surface texture by temper rolling according to the related art.

FIG. 35 shows light microscope photographs of the surface of galvanized steel sheet, which surface texture was adjusted by a similar method given in the sixth example, using SUS304 (A1) particles and high-speed steel (B1) particles, respectively. For both cases, fine dimple-shape concavities are formed on the surface, and the texture is similar with that formed by the air-blasting unit.

Table 6 shows the sliding characteristics observed on the galvanized steel sheet adjusted in the surface texture thereof by blasting slid particles against the surface thereof using the centrifugal blasting unit. The data were acquired from the galvanized steel sheet after being blasted with the solid particles at 3,600 rpm of the rotational speed of the centrifugal rotor, 6 kg/m$^2$ of blasting density, and 300 mm of blasting distance. The waviness Wca on the surface of the galvanized steel sheet before blasting the solid particles was 0.25 $\mu$m.

TABLE 6

| | Surface roughness after blasting | | | Friction factor |
|---|---|---|---|---|
| Symbol | Ra | PPI | Wca | ("B" condition) |
| S3 | 1.1 | 390 | 0.40 | 0.172 |
| S4 | 1.1 | 425 | 0.39 | 0.181 |

The values of friction factor given in Table 6 showed equivalent level with those obtained on the galvanized steel sheet using the air-blasting unit, given in the second example. Accordingly, with the consideration that the friction factor on the galvanized steel sheet in the related art, ("B" condition), is in a range of from 0.24 to 0.3, the galvanized steel sheets shown in Table 6 give excellent press-formability. Furthermore, the waviness Wca on the surface of steel sheet after blasting the solid particles is 0.4 $\mu$m or less, which proves the excellent image sharpness after coating having equivalent level with that of the result given in the fourth example.

As described above, for adjusting the surface texture of a galvanized steel sheet by blasting solid particles thereto, the mechanical blasting method is lower in the blasting speed than that of the air-blasting unit, so the mean roughness Ra cannot significantly be increased, but the press-formability and the image sharpness after coating of the obtained galvanized steel sheet are almost equal to those obtained by the air-blasting unit. Therefore, a concrete means to blast solid particles according to the present invention does not give substantial influence on the improvement of press-formability of the galvanized steel sheet, and, if only relatively fine solid particles can be blasted against the surface of galvanized steel sheet at a certain blasting speed, even other means to blasting the solid particles against the steel sheet can manufacture the galvanized steel sheet having excellent press-formability and image sharpness after coating.

EXAMPLE 8

The eighth example describes the result of blasting solid particles against an electro-zinc plating steel sheet as the galvanized steel sheet.

In the eighth example, the solid particles were blasted against the surface of a galvanized steel sheet which was cold-rolled, annealed, and electro-zinc plated, using an air-blasting unit similar with that used in the first example. The coating weight of the zinc coating was 46 kg/m$^2$, and the condition of solid particle blasting is given in Table 7.

Table 8 shows the surface texture after blasting the solid particles and the friction factor observed in the sliding test. The evaluation method for both of them is similar with that described in the first through fourth examples. Table 8 also gives a comparative example result of the evaluation on the electro-zinc plating steel sheet before blasting solid particles.

The result given in Table 8 shows that, similar with the case of adjustment of the surface texture of hot-dip galvanized steel sheet, for the sliding tests under the high speed and high face pressure condition, (A condition), and under the low speed and low face pressure condition, (B condition), both conditions provide superior characteristics to those of galvanized steel sheet without subjected to the solid particle blasting.

As described above, when the solid particles are blasted against the surface of galvanized steel sheet to adjust the surface texture, excellent press-formability is attained from either the hot-dip galvanized steel sheet or the electro-zinc plating steel sheet. That is, providing fine dimple-pattern surface texture leads to the improvement in the press-formability, and, the method gives similar effect to other galvanized steel sheets.

TABLE 7

| Symbol | Particle | Blasting density | Blasting air pressure |
|---|---|---|---|
| E1 | A3 | 6 kg/m$^2$ | 0.3 MPa |
| E2 | B1 | 6 kg/m$^2$ | 0.4 MPa |

TABLE 8

| | Surface roughness after blasting | | Friction factor |
|---|---|---|---|
| Symbol | Mean roughness | Peak count PPI | ("B" condition) |
| E1 | 1.34 $\mu$m | 266 | 0.187 |
| E2 | 1.31 $\mu$m | 342 | 0.196 |
| Comparative example | 0.83 $\mu$m | 108 | 0.259 |

Embodiment 2

Embodiment 2-1 is a method for manufacturing galvanized steel sheet, containing the steps of: temper-rolling a steel sheet treated by zinc-coating; and blasting solid particles having mean particle sizes of from 30 to 300 $\mu$m against one or both surfaces of the galvanized steel sheet using a centrifugal blasting unit at 700 mm of distance between the rotational center of rotor of the centrifugal blasting unit and the metal strip, thus adjusting the mean roughness Ra on the surface thereof to a range of from 0.5 to 5 $\mu$m, the peak count PPI to 100 or more, and the centerline waviness Wca to 0.8 $\mu$m or less.

The Embodiment 2-1 is conducted on a basic principle that dents are created on the coating film of the galvanized steel sheet by blasting and letting the solid particles colliding thereto, thus forming roughness on the surface. Large number of solid particles colliding against the surface of the galvanized steel sheet forms large number of peaks and valleys thereon, which provides surface roughness. The texture such as height and width of profile peak portions and valley portions depends on the kinetic energy and size of blasting solid particles, blasting quantity of solid particle per unit area, hardness of coating film on the galvanized steel sheet, and other variables.

According to the Embodiment 2-1, to attain a galvanized steel sheet having excellent press-formability and image sharpness after coating, the surface roughness formed by blasting solid particles is adjusted to give the mean roughness Ra in a range of from 0.5 to 5 $\mu$m and the peak count PPI to 100 or more. If the mean roughness Ra is less than 0.5 $\mu$m, the oil-retainability between the work and the mold cannot satisfactorily be assured during the press-forming stage. If the mean roughness exceeds 5 $\mu$m, a local contact between the microscopic profile peak portions on the surface and the mold occurs, and seizing may occur at and propagate from the local contact area. The peak count PPI is specified to 100 or more because higher PPI value forms denser roughness profile on the surface, which improves the oil-retainability during the press-forming stage, and decreases the long-period roughness profile to improve the image sharpness after coating. Higher peak count on the steel sheet gives superior press-formability and image sharpness after coating.

Since the method for forming surface roughness using temper rolling according to related art adopts an indirect means of transferring roughness profile formed on the surface of rolling roll to the galvanized steel sheet, the peak count given to the steel sheet cannot be increased to a large value. In particular, when the mean roughness of the rolling roll is increased, the peak count PPI cannot be increased to a large value, so the peak count PPI that can be given to steel sheet is about 200 at the maximum.

To the contrary, with the method for manufacturing galvanized steel sheet according to the present invention, the solid particles are directly blasted against the steel sheet to form surface roughness so that 400 or higher peak count PPI is attained by adjusting the particle size and the blasting speed.

The dents created by blasting solid particles have a dimple-pattern texture, thus they function to improve the oil-retainability during press-forming stage, and have advantage of providing superior press-formability to that of a steel sheet which is adjusted in the surface roughness by ordinary temper rolling. Therefore, even with the same mean roughness Ra and peak count PPI equal to those of a galvanized steel sheet on which surface roughness is given by temper rolling, the friction factor during sliding becomes less to provide favorable press-formability.

According to the Embodiment 2-1, high peak count PPI is attained by blasting solid particles having mean particle sizes of from 30 to 300 $\mu$m. If the mean particle size exceeds 300 $\mu$m, the profile peak portions formed on the surface of galvanized steel sheet become large, and dense roughness profile on the surface cannot be formed. In that case, the pitch of peaks and valleys of microscopic surface roughness profile increases, which is unfavorable in view of press-formability, and the long-period roughness profile, or the waviness on the surface of steel sheet, increases to degrade the image sharpness after coating. Consequently, the solid particles being blasted have to have 300 $\mu$m or smaller size, and preferably 150 $\mu$m or less for attaining larger effect. On the other hand, if the mean particle size of the solid particles becomes to 30 $\mu$m or less, the speed of solid particles in air decreases, and necessary roughness on the surface of galvanized steel sheet cannot be attained.

As a means for blasting above-described solid particles against a steel strip, the Embodiment 2-1 adopts a centrifugal blasting unit. Compared with the air-blasting unit, the centrifugal blasting unit gives high energy efficiency, and spreads the blasted solid particles in a fan-shape, so the blasted solid particles cover wide area on the target surface.

Conventional centrifugal blasting unit, however, limited the blasting distance to a range of from about 1 to about 1.5 m for covering a wide area, so, if the solid particles have 300 μm or smaller size, the kinetic energy thereof on colliding against the steel sheet significantly decreases owing to the attenuation of the energy in air, thus that type of blasting unit was accepted as failing in attaining satisfactory result.

To this point, the inventors of the present invention found a method for adjusting the surface roughness on a steel strip by blasting above-described fine solid particles efficiently. That is, by significantly decreasing the blasting distance (the minimum distance between the rotational center of rotor of the centrifugal blasting unit and the steel belt) to 700 mm or less, the area that is effectively provided with a surface roughness can be widened, contrary to the existed common understanding. In addition, the inventors of the present invention found that shorter blasting distance forms denser roughness profile on the surface of steel sheet, and furthermore, the blasting density necessary for creating surface roughness is decreased compared with that of related art.

Commercially available solid particles have a certain particle size distribution. For example, metallic shot particles having around 60 μm of mean particle size normally include the particles of about 30 μm to that of about 100 μm. In that case, if the blasting distance is around 1 m, fine particles are decelerated to fail in forming concavities on the surface of steel sheet even they collide against the surface, and coarse particles contribute to creating the concavities on the surface of steel sheet. Therefore, fine particles among the blasted solid particles do not contribute to the creation of surface roughness, and only coarse particles function to form the surface roughness.

By significantly reducing the blasting distance compared with that in the related art, fine particles collide against the surface of steel sheet without decelerating the speed thereof, thus forming dense roughness profile on the surface. Since the percentage of particles that contribute to the creation of surface roughness significantly increases, there is no need of blasting large quantity of solid particles. Furthermore, the area where the particle colliding speed is high widens in the whole blasted area on the surface of steel sheet. Even at edge portions of the blasted area, the surface roughness is effectively created, so the area having a specified surface roughness is widened.

By reducing the blasting distance to 700 mm or less, even fine particles of 300 μm or less contribute to the creation of surface roughness. As a result, with a small blasting density, dense roughness profile on the surface can be formed over a wide area. The currently applied centrifugal blasting units have about 200 to about 550 mm of rotor diameter. Accordingly, strong effect is attained by adopting the blasting distance larger than the rotor radius, preferably equal or smaller than the rotor diameter.

The blasting speed of the solid particles in the Embodiment 2-1 is preferably 60 m/s or more. If the blasting speed is small, the kinetic energy of solid particles colliding against the galvanized steel sheet is small, which becomes difficult to form surface roughness. The existing centrifugal blasting units give around 100 m/s of blasting speed at the maximum with the rotor diameters of from 200 to 550 mm and the rotational speed of the rotor of 4,000 rpm. Although the blasting speed is less than that of the air-blasting unit, even with the initial blasting speed of around 60 m/s, sufficient surface roughness can be obtained by selecting the blasting distance of 700 mm or less.

The Best Moe 2-1 is for adjusting the final surface roughness of galvanized steel sheet, and it is preferable that the solid particle blasting is done after applying temper rolling to the galvanized steel sheet to adjust the mechanical properties thereof. In that case, the temper rolling may or may not form surface roughness because, even when the temper rolling is carried out using a rolling roll having relatively large surface roughness thereon, the blasting of solid particles deforms almost all the peak portions and valley portions of roughness profile, thus vanishing the short-period roughness profile. By, however, using a rolling roll such as a bright roll having small surface roughness for temper rolling, the roughness profile on the surface of the galvanized steel sheet becomes flat in advance, thus flattening also the long-period roughness profile. By forming short pitch peaks and valleys of surface roughness profile under the blast of solid particles in that state, the long-period roughness profile can be diminished.

The galvanized steel sheet targeted by the Embodiment 1-2 includes an alloyed hot-dip galvanized steel sheet, a galvanized steel sheet consisting mainly of η phase, and an electro-zinc plated steel sheet. The reason of the selection of these types of steel sheets is that the uses centering on the automobiles request good press-formability and image sharpness after coating, which in turn needs to have fine and dense roughness profile on the surface thereof. The present invention, however, is not limited to that kind of selection, and is applicable also to a zinc-aluminum alloy coated steel sheet to form dense roughness profile on the surface, thus eliminating the grain boundaries in the coated film portion to attain a glossy coating steel sheet.

Different from the method for forming surface roughness by temper rolling, the Embodiment 1-2 limits the region of inducing plastic deformation to the surface and peripheral zone, and smaller particle size gives less influence on the internal zone of the steel sheet, so the roughness profile can be formed only in the coating film zone, and the surface roughness is formed while avoiding influence on the substrate zone. This is the difference from the formation of surface texture by temper rolling. Consequently, there induces an effect of improving the sliding characteristics through simultaneously forming roughness profile only in the coating film zone and locally hardening only the zone with the roughness profile.

The Embodiment 2-2 is a modification of the Embodiment 2-1, in which the above-described temper rolling adopts adjustment of the centerline waviness Wca of the steel sheet to 0.7 μm or less.

If only the centerline waviness Wca of the steel sheet is adjusted to 0.7 μm or less in the temper rolling stage, the centerline waviness Wca of the galvanized steel sheet can be regulated to 0.8 μm or less even when the solid particles are blasted to form short-period roughness profile. If the centerline waviness Wca of the product is 0.8 μm or less, the image sharpness after coating for the uses of external plates of automobiles and the like is satisfied.

The Embodiment 2-3 is a modification of the Embodiment 2-1 or the Embodiment 2-2, in which the above-described mean blasting density of the above-described solid particles is in a range of from 0.2 to 40 $kg/m^2$.

By selecting the blasting distance of 700 mm or less, preferably of equal to the rotor diameter or less, the percentage of effective particles for forming the surface roughness in the total quantity of blasted particles increases, so the blasting density can be reduced compared with that in the related art. In the case of use of a centrifugal blasting unit, the blasted particles are spread in fan shape to collide against the steel sheet. Strictly, however, the blasting density differs with the position on the steel sheet. The mean blasting density is adopted herein as an average of blasting densities at individual positions.

If the mean blasting density is less than 0.2 kg/m$^2$, the number of particles colliding against the steel sheet is small, and satisfactorily dense roughness profile on the surface cannot be attained. On the other hand, if the mean blasting density exceeds 40 kg/m$^2$, unnecessarily large quantity of particles is blasted, once created roughness profile is demolished by the succeedingly blasted particles. That is, excessively large blasting density decreases the peak count PPI on the galvanized steel sheet. When various sizes of particles collide against the steel sheet, and when the frequency of the collision increases, the long-period roughness profile increases.

As a result, the centerline waviness Wca of the galvanized steel sheet increases, which fails to assure the image sharpness after coating. When the blasting density becomes excessively large, the solid particles grind the surface of the steel sheet to induce mass loss thereof. When the condition is given with high blasting speed, a sudden temperature rise in the surface layer occurs, which may induce changes in structure of the steel. Therefore, the Embodiment 2-3 specifies the mean blasting density to a range of from 0.2 to 40 kg/m$^2$.

Since the Embodiment 2-3 can give favorable surface roughness even at a low blasting density, the Mode has a feature of small variations in the centerline waviness Wca between before and after the solid particle blasting. In other words, even the centerline waviness Wca before the solid particle blasting is limited not so small level, the centerline waviness Wca after the solid particle blasting is not so worsened.

The Embodiment 2-4 is a modification of either one of the Embodiment 2-1 through the Embodiment 2-3, in which the weight percentage of particles within a size range of from 0.5 to 2d, as the solid particles, is 85% or more, (d designates the mean particle size).

If the particles contain large number of particles having a particle size exceeding 2d (double the mean particle size), the reduction in blasting speed in air is small, so that large profile valley portions are formed on the surface of steel sheet, and the formation of fine pitch of peaks and valleys of roughness profile becomes difficult. If the particles contain large number of particles having less than 0.5d of size, these particles stop to contribute to the formation of surface roughness, which results in increase of the quantity of blasting particles necessary to attain a specified surface roughness.

According to a result of test conducted by the inventors of the present invention, if only the weight percentage of particles in a particle size range of from 0.5d to 2d is 85% or more, it was found that dense roughness profile on the surface can be formed without substantially increasing the blasting quantity. Only from the viewpoint of forming dense roughness profile, it is ideal that the particle size distribution is sharp and that all the particles have the mean particle size d. That type of classified particles, however, significantly decreases the yield of particle manufacture, which is uneconomical because the particle cost increases.

The Embodiment 2-5 is a modification of either one of the Embodiment 2-1 through the Embodiment 2-4, in which the solid particles are nearly spherical shape.

There are known blasting methods for solid particles using a centrifugal blasting unit: shot-blasting which uses spherical particles; and grit-blasting which uses squarish particles. Generally, the former is applied for attaining shot-peening effect that hardens the work surface, and the latter is applied for what is called the shot blasting, or grinding the surface. For creating surface roughness targeted in the present invention, the shot particles having nearly spherical shape is preferred from the point of press-formability of steel sheet. When particles in near-spherical shape are used, the created dents on the surface of steel sheet are large number of fine dimples. When that type of steel sheet is press-formed, the fine dimples improve the oil-retainability between the press-mold and the steel sheet. As a result, the sliding resistance during the press-forming stage and the effect of preventing die-galling are further enhanced.

The term "near-spherical shape" referred in the Embodiment 2-5 means that the shape includes not only completely spherical but also a shape that is accepted as a sphere in common sense, and that is an elliptical shape having the difference between the mean diameter and the major axis length and between the mean diameter and the minor axis length are within 20% of the mean diameter, respectively.

The Embodiment 2-6 is a modification of either one of the Embodiment 2-1 through the Embodiment 2-5, in which the density of the above-described solid particles is 2 g/cm$^3$ or more.

If the density of a solid particle is below 2 g/cm$^3$, the mass of the solid particle becomes small, and the speed reduction in air decreases, and the kinetic energy of the particle at colliding against the steel sheet itself decreases. Accordingly, the density of the solid particle is preferably 2 g/cm$^3$ or more. Examples of preferred solid particles are metallic fine particles such as those of carbon steel, stainless steel, and high-speed steel. Cemented carbide such as tungsten carbide may be applied. Nevertheless, particles having relatively low specific gravity, such as alumina, zirconia, and glass bead can create surface roughness Ra at or below 1.0 $\mu$m.

The Embodiment 2-7 is a modification of either one of the Embodiment 2-1 through the Embodiment 2-6, in which the galvanized steel sheet is the one having a coating film consisting mainly of $\eta$ phase.

The galvanized steel sheet having a coating film consisting mainly of $\eta$ phase has softer coating film and lower melting point than those of the coating film of alloyed hot-dip galvanized steel sheet, so the steel sheet more likely induces adhesion. Consequently, with the same mean roughness, the steel sheet is inferior in press-formability. Therefore, the effect of applying the first means through the fourth means described above is particularly significant. In the case of the galvanized steel sheet having a coating film consisting mainly of $\eta$ phase, the coating film itself is soft so that the dents are readily created under the blast of solid particles, thus making the formation of surface roughness easy.

Figure 37:
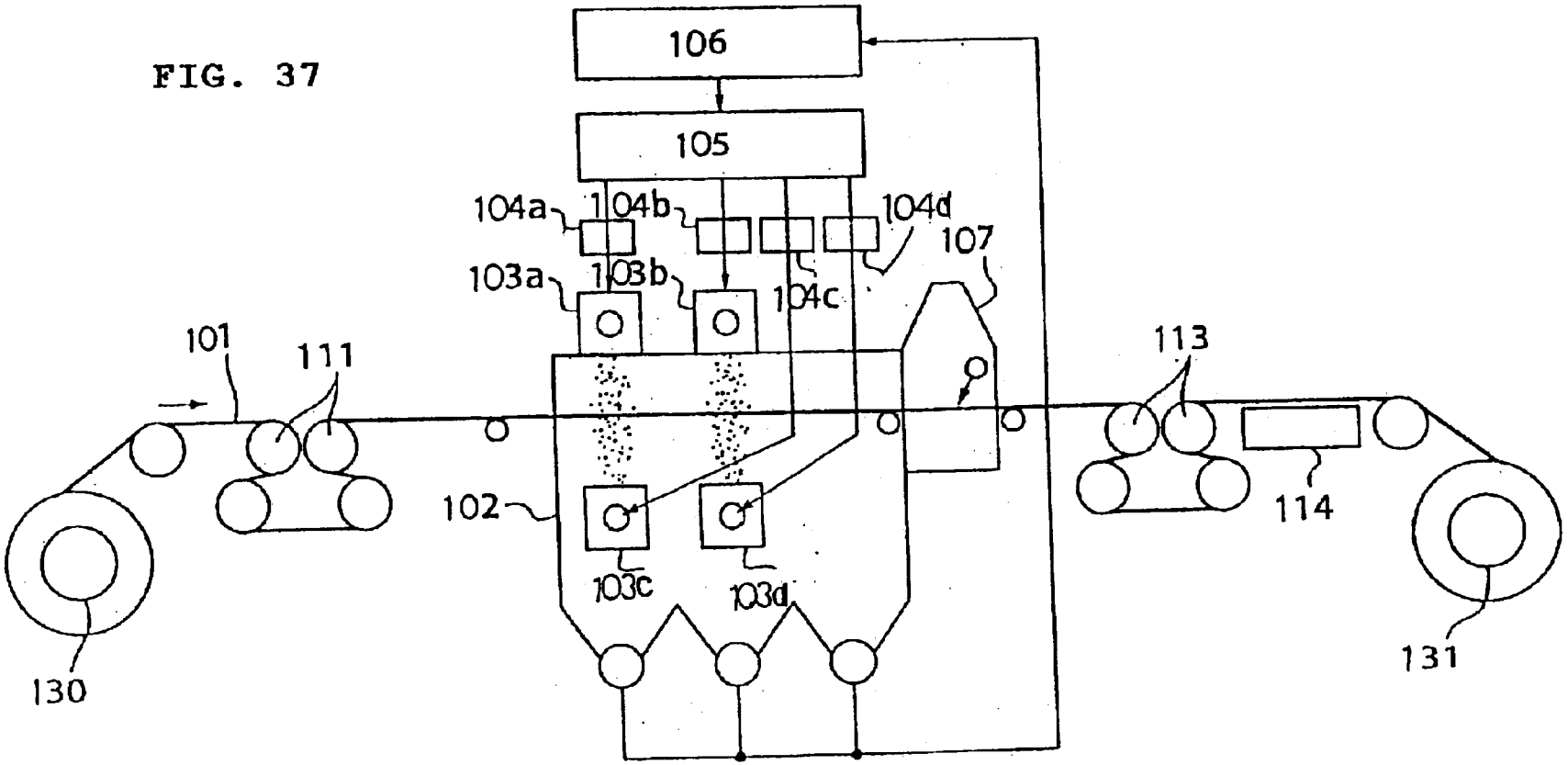
FIG. 37 shows the outline of an example of an apparatus for conducting the method for manufacturing galvanized steel sheet in the Embodiment 2.

FIG. 37 shows the outline of an example of an apparatus for conducting the method for manufacturing galvanized steel sheet in the Embodiment 2-7. FIG. 37 illustrates the apparatus for adjusting the surface roughness of a galvanized steel sheet 101 using plurality of centrifugal blasting units 103*a* through 103*d*, while feeding the galvanized steel sheet 101 continuously. Suitable galvanized steel sheet 101 is the one subjected to cold-rolling, annealing, and zinc-coating, followed by temper rolling using a bright roll. The bright roll is a roll on which the surface is smoothly finished to 0.3 $\mu$m or less of Ra.

In FIG. 37, the galvanized steel sheet 101 is fed to a pay-off reel 130, and is coiled by a tension reel 131. At that moment, the galvanized steel sheet 101 is continuously fed under tension given by an inlet bridle roll 111 and an exit bridle roll 113.

The centrifugal blasting units 103*a* through 103*d* are arranged in a blast chamber enclosed by a chamber. To the centrifugal blasting units 103*a* through 103*d*, a specified quantity of solid particles is supplied from respective solid particle measuring feeders 104*a* through 104*d*. The particles blasted from the centrifugal blasting units 103*a* through 103*d* are collected in a blast chamber 102, then are transferred to a classifier 106. The particles classified in the classifier 106 are sent to the solid particle measuring feeders 104*a* through 104*d* via a storage tank 105. The dust generated in the classifier is sent to a dust collector (not shown) to be treated. The solid particles remained on or attached to the surface of the galvanized steel sheet 101 are purged by a cleaner blower 107 to be removed from the surface of the steel sheet.

Figure 38:
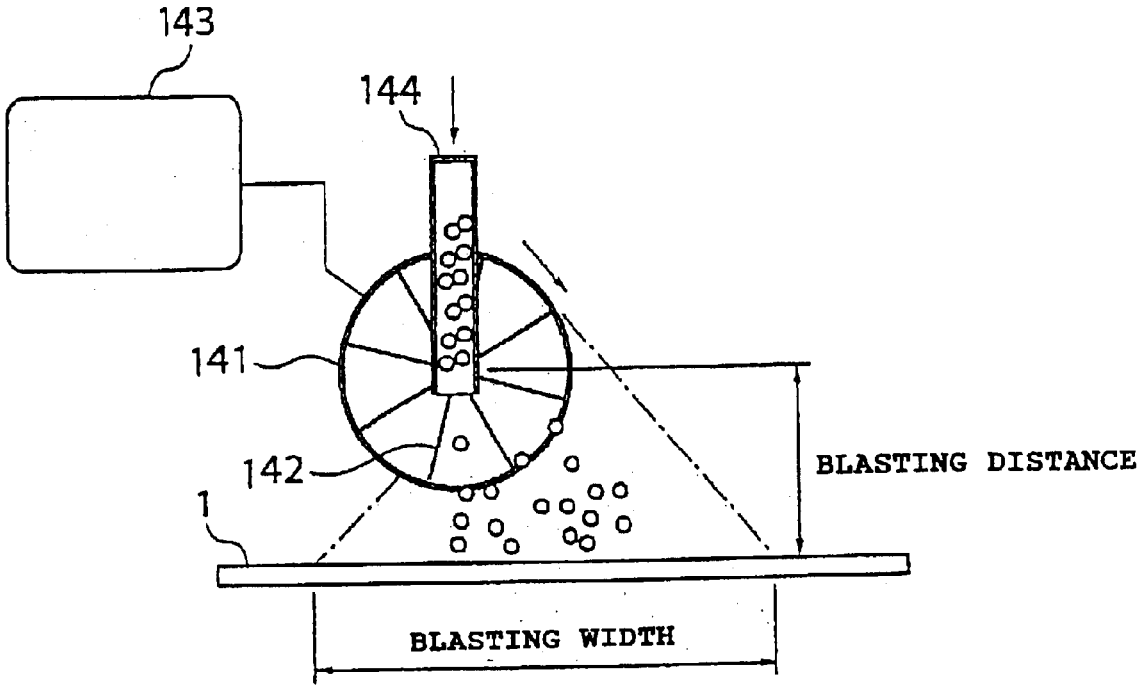
FIG. 38 is a schematic drawing of a centrifugal blasting unit of the Embodiment 2.

FIG. 38 is a schematic drawing of the centrifugal blasting unit. The solid particles are blasted by the centrifugal force of a blade 142 mounted to a rotor 141 which is driven by a motor 143. The solid particles are supplied from the measuring feeders 104*a* through 104*d* to the rotor via a particle feed pipe 144. General centrifugal blasting units have the rotor diameters of from about 200 to about 550 mm, the blade widths of from about 20 to about 150 mm, and the rotational speeds of the rotor of from about 2,000 to about 4,000 rpm. Available driving motor is about 55 kW at the maximum. According to the present invention, however, a low output motor can be used because a low blasting density of the solid particles can be applied. The upper limit of the rotational speed of the rotor exists because looseness and offset load caused from the wear of blade increases the vibration of the centrifugal blasting unit, and the blasting speed has an upper limit of around 100 m/s.

According to the Embodiment 2-5, the distance between the rotational center of the rotor 141 of that type of centrifugal blasting unit and the steel sheet 101, (the distance given in FIG. 38), is selected to 700 mm or less, preferably larger than the radius of the rotor 141 and equal to or near to the diameter of the rotor 141. By varying the rotational speed of the rotor, the blasting speed of the solid particles can be adjusted. The Embodiment 2-5 adopts the blasting speed of 60 m/s or more. The blasting speed of solid particles referred herein designates the speed of particle leaving the tip of the blade mounted to the rotor, which speed is the synthesized value of the tangential velocity component and the vertical velocity component of the rotor.

The applied solid particles have mean particle sizes of from 30 to 300 $\mu$m. Particularly, it is preferable to use spherical shot particles that have the mean particle size of 150 $\mu$m or less and the density of 2 g/m$^3$ or more. It is also preferable that the particle size distribution is adjusted to give 85% or larger weight percentage of the particles within a size range of from 0.5d to 2d, (d designates the mean particle size).

FIG. 37 shows the outline of an apparatus for recycle use of these solid particles. The classifier 106 is able to control the distribution of the size of the solid particles in a specified range. Applicable classifier includes vibrating screen, cyclone, and air classifier, and they may be applied separately or, in some cases, in combination to attain optimum classification capacity.

The blasting density of the solid particles against the galvanized steel sheet 1 according to the present invention is preferably in a range of from 1 to 40 kg/m$^2$. To do this, a fixed quantity of solid particles is supplied from the measuring feeders 104*a* through 104*d* to the centrifugal blasting unit responding to the line speed of steel strip. The measuring feeder controls the weight of blasting solid particles within a specified period by mounting a valve in the pipeline and by adjusting the opening of the valve, or other adequate means.

The galvanized steel sheet 101 on which the solid particles are blasted and a surface roughness is formed passes through an inspection table 114, where the mean roughness Ra and the peak count PPI are determined to evaluate if they are at each predetermined level or not. If necessary, these variables are adjusted by varying the rotational speed of the rotor 141 of each of the centrifugal blasting units 103*a* through 103*d*, and the blasting density. Alternatively, instruments to measure the surface roughness and other variables may be positioned at downstream side of the bridle roll 113 to change the blasting speed and blasting quantity based on thus measured values. Furthermore, an instrument to confirm that the centerline waviness Wca before blasting the solid particles is at or below a predetermined value may be located. The above-described instruments may be a contact type, and preferably non-contact type using an optical instrument. In addition, CCD camera or the like may be applied to take photographs of the surface texture of steel sheet, and image processing may be applied to determine the size of dents created by the collision of solid particles, thus determining the mean roughness and the peak count.

Figure 39:
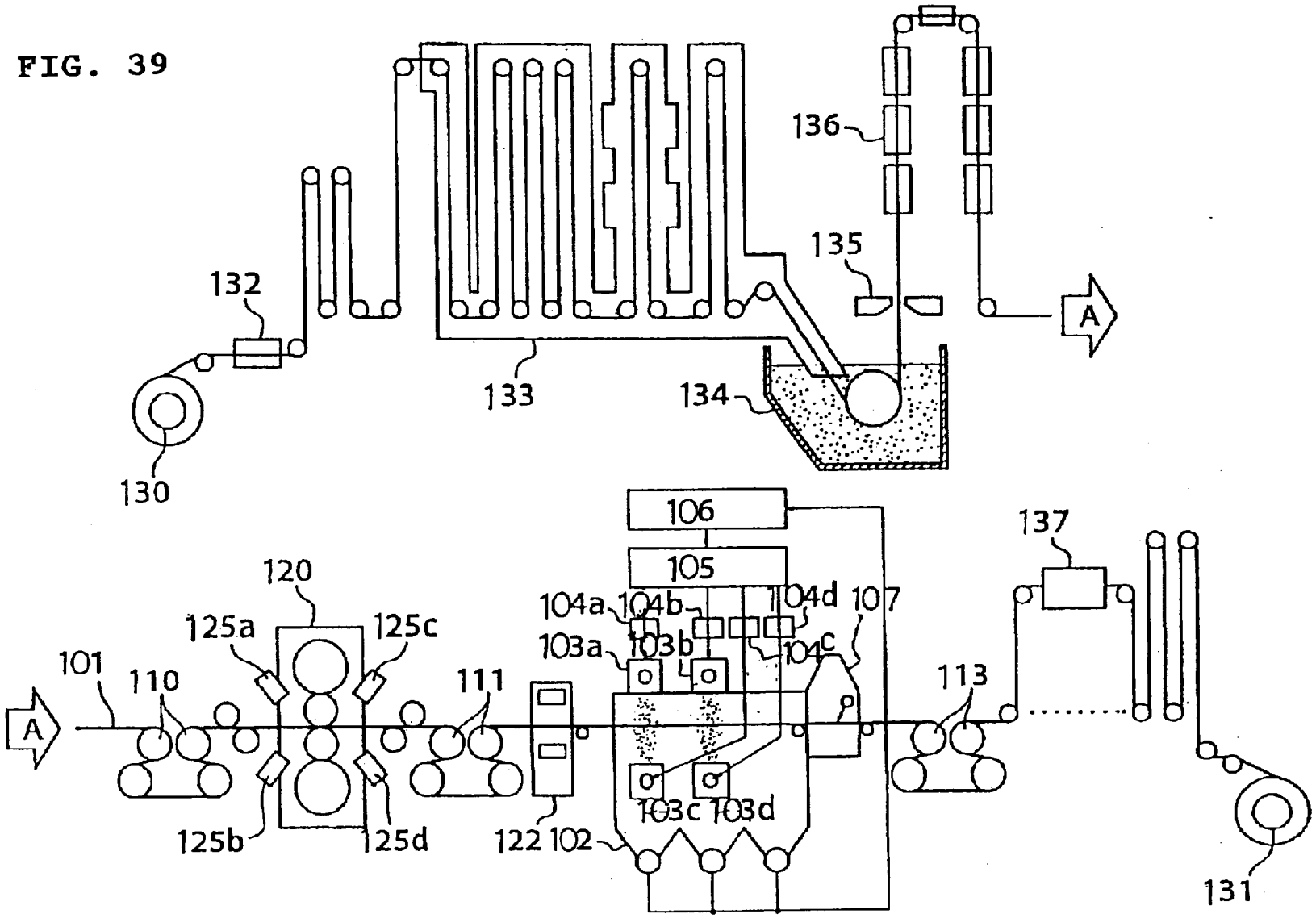
FIG. 39 shows an apparatus for conducting a method for manufacturing galvanized steel sheet as another example of the Embodiment 2.

FIG. 39 shows an example of apparatus for conducting a method for manufacturing galvanized steel sheet as another example of the Embodiment 2 according to the present invention. The apparatus shown in FIG. 39 is an arrangement of apparatus shown in FIG. 37 in a continuous hot-dip galvanizing line. The element same with that in FIG. 37 has the same reference symbol to each other.

A temper rolling mill 120 is located at downstream side of a plating bath 134 in the hot-dip galvanizing line, and a forced drying unit 122 and the blast chamber 102 are located at further downstream side. In the hot-dip galvanizing line, the steel sheet which was cold-rolled enter a pay-off reel 130, and passes through an electrolytic cleaning unit 132, then is subjected to recrystallization annealing in an annealing furnace 133.

After that, the zinc coating film is formed in the plating bath 134. Then, an air wiper 135 is applied to adjust the film thickness adjustment. When an alloyed hot-dip galvanized steel sheet is produced, an alloying furnace 136 is operated to give the alloying treatment to the steel sheet. A galvanized steel sheet having a coating film consisting mainly of $\eta$ phase is manufactured in the same line as above without using the alloying furnace 136.

Usual hot-dip galvanizing line has cases of: temper rolling in the temper rolling mill 120 followed by forming a chemical conversion film in a chemical conversion unit 137; and applying rust-preventive oil followed by coiling without giving further treatment. In a mode shown in FIG. 39, nozzles 125*a* through 125*d* that eject water or a temper rolling liquid are arranged at inlet or exit of the temper rolling mill, and the forced drying unit 122 is positioned further downstream side therefrom to let blast the solid particles after dried the water attached to the surface of galvanized steel sheet 101. If the amount of water attached to the surface of galvanized steel sheet 101 is small, or if the water is naturally dried, the drying unit 122 may not necessarily be located.

With the above-described arrangement of the facilities, the temper rolling mill 120 conducts temper rolling using a bright roll for adjusting the mechanical properties of the work material to adjust the surface waviness Wca of the galvanized steel sheet to 0.7 $\mu$m or less, then the centrifugal blasting units 103*a* through 103*d* located at downstream side therefrom adjust the surface roughness of galvanized steel sheet 101. Since the method for adjusting the surface roughness in the Embodiment 2 can decrease the blasting density compared with that in the related art, the quantity of solid particles to be recycled is small, and, even if the line speed is at 100 ppm level, the surface roughness can be formed in the same line of hot-dip galvanizing or succeeding temper rolling mill.

EXAMPLE 1

The first example describes the result of surface roughness creation on a hot-dip galvanized steel sheet using a cold-rolled steel sheet of 0.8 mm in thickness and providing a coating film consisting mainly of η phase, as the substrate, applying the centrifugal blasting unit shown in FIG. 38.

The steel sheet before blasting solid particles was treated by hot-dip galvanizing, followed by temper rolling to give an extension of 0.8%. The extension by the temper rolling is given for adjusting material. A bright roll finished to 0.28 μm of Ra was used. The mean roughness Ra, the peak count PPI, and the centerline waviness Wca after the temper rolling were 0.25 μm, 48, and 0.4 μm, respectively.

The applied centrifugal blasting unit had a rotor diameter of 330 mm and the maximum blasting speed of 92 m/s. The SUS304 particles having a mean particle size of 60 μm and a particle size distribution given in FIG. 39 were used. These particles were nearly spherical shape, or contained 95% or more of the particles giving the difference between the mean diameter and the major axis length and between the mean diameter and the minor axis length within 20% of the mean diameter, respectively. According to the first example, the blasting speed of solid particles was set to 92 m/s, and the rotational speed of rotor was set to 3600 rpm. The blasting was conducted using a single centrifugal blasting unit to the galvanized steel sheet that was continuously running. The centrifugal blasting unit rotated a rotor in a plane vertical to the running direction of the steel strip. That is, the centrifugal blasting unit was positioned to blast the solid particles in width direction of the surface of steel strip.

According to the first example, the line speed of the steel sheet was set to 90 mpm, and the blasting rate of the solid particles was set to 225 kg/min. For the samples of galvanized steel sheet after the solid particle blasting, the distribution of mean roughness Ra and of peak count PPI was determined in the width direction of the steel sheet.

Figure 40:
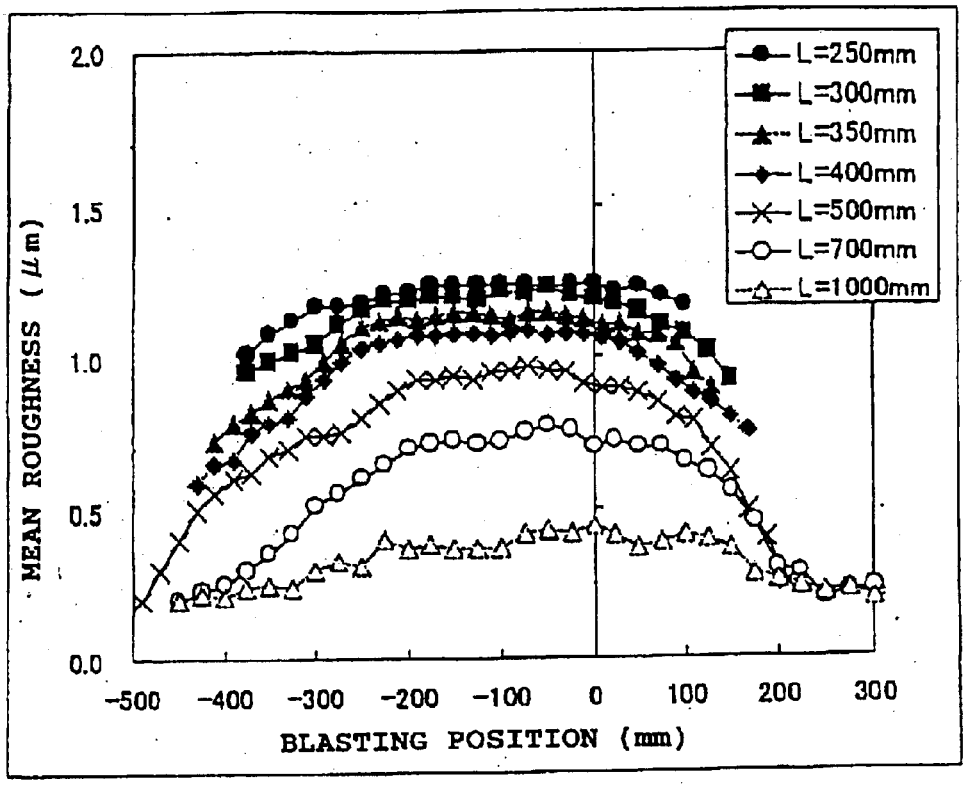
FIG. 40 is a graph showing the distribution of mean roughness Ra and of peak count PPI in the sheet width direction under the variations of blasting distance in a range of from 250 to 1,000 mm in the Embodiment 2.
Figure 40:
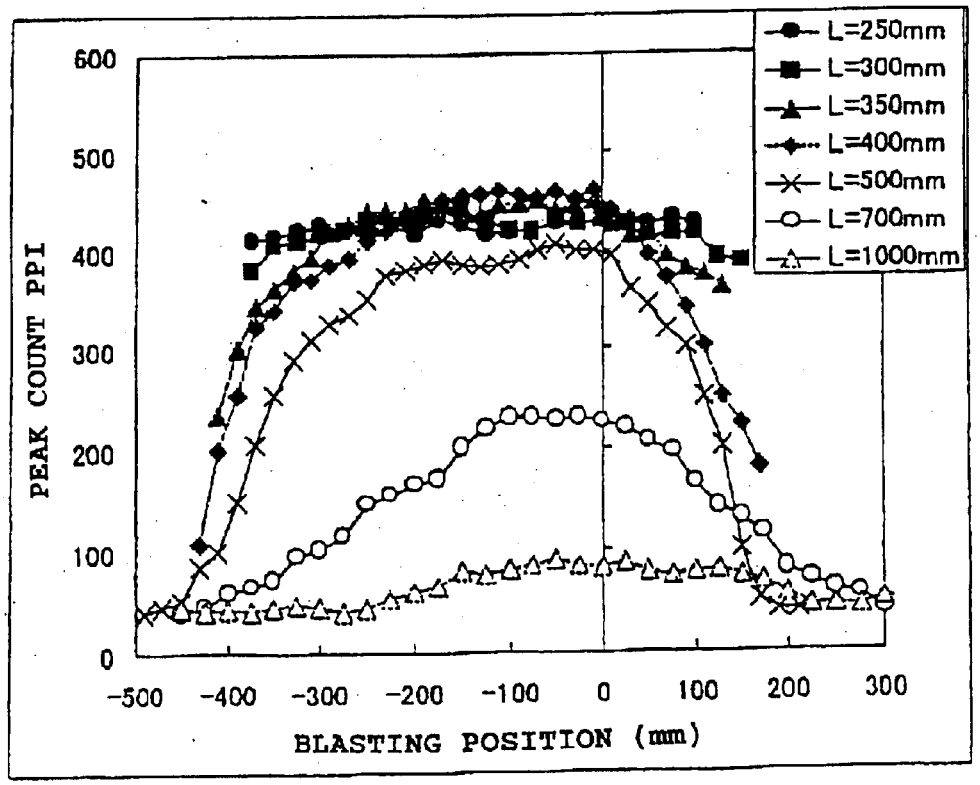

FIG. 40 is a graph showing the distribution of mean roughness Ra and of peak count PPI in the width direction of the steel sheet under the variations of blasting distance in a range of from 250 to 1,000 mm. The horizontal axis of the graph is defined as positive side for the right side from the origin at directly beneath the rotational center of the rotor 141 in FIG. 38. The figure shows that, in the case of 1,000 mm of blasting distance, both Ra and PPI give no significant difference from the surface roughness before the solid particles blasting, and that, in the case of 700 mm or less distance of blasting, however, the peak count PPI becomes to 100 or more at 0.5 μm or larger mean roughness Ra. If the blasting distance is not more than 500 mm, the peak count PPI can reach 300 or more over a wide area, thus obtaining a galvanized steel sheet having high peak count that could not be attained in conventional temper rolling.

FIG. 40 suggests that shorter blasting distance gives wider range that gives larger mean roughness and peak count. This is because shorter blasting distance allows for the solid particles to avoid deceleration before colliding against the steel sheet, thus creating dense roughness profile on the surface. The centrifugal blasting unit blasts solid particles in fan shape pattern from the rotor, so the longer blasting distance gives wider area being blasted on the steel sheet.

Usual practice of the related art is to use a single centrifugal blasting unit and increase the blasting distance as far as possible for blasting over a wider area, or assuring about 1 m of blasting distance. To the contrary, when fine particles are blasted to create a certain level of surface roughness as in the case of present invention, it is shown that shorter blasting distance is more effective.

With similar method, the blasting rate of solid particles was varied in a range of from 90 to 450 kg/m$^2$ to create surface roughness on the surface of galvanized steel sheet, and thus created surface roughness was measured. On the surface of steel sheet after blasted the solid particles, there are left indentations made by the collision of the solid particles. The width of the area existing dents is called the blasting width. As of the blasting width, the width where a specified surface roughness was created is defined as the effective blasting width. For convenience, the effective blasting width is herein defined as the area where the mean roughness Ra exceeds 1.0 μm and the peak count PPI exceeds 400.

Figure 41:
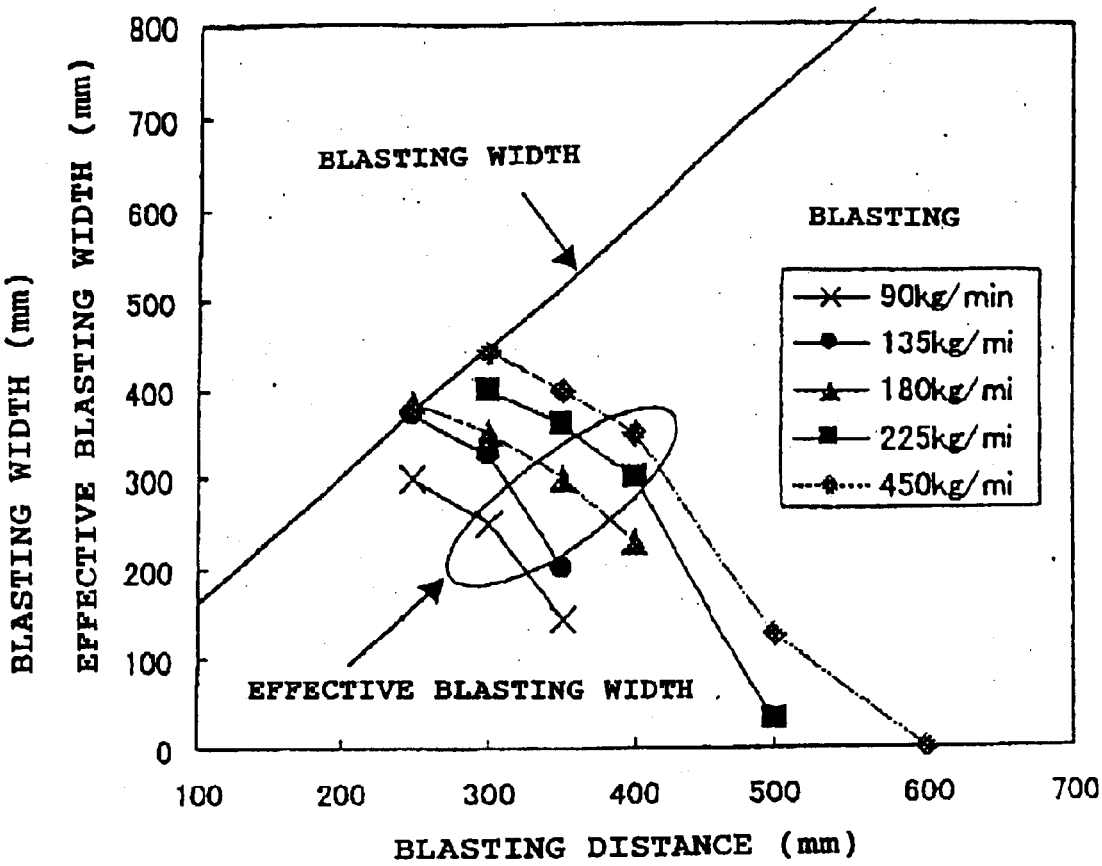
FIG. 41 is a graph showing the effective blasting range under the variations of blasting distance in a range of from 250 to 1,000 mm in the Embodiment 2.

FIG. 41 is a graph showing the effective blasting width under the variations of blasting distance in a range of from 250 to 1000 mm. The graph also gives the blasting width as a straight line at upper right section thereof. The result suggests that increased blasting distance increases the blasting width, and that decreased blasting distance increases the effective blasting width that effectively creates surface roughness. Furthermore, it is possible that, even the quantity of blasting solid particles is not increased, shorter blasting distance allows increasing the effective blasting area. If the blasting distance becomes a certain level, increased quantity of solid particles cannot create effective surface roughness.

FIG. 41 shows that an excessively short blasting distance reduces the blasting width where geometric blasting is done, so the upper limit of the effective blasting width is also limited thereby. That is, there is an optimum blasting distance for widening the effective blasting width. The optimum blasting distance depends on the quantity of blasting solid particles. According to the first example that uses a rotor diameter of 330 mm, the maximum effective blasting width is attained at around 300 mm of blasting distance, which suggests that the effective blasting width becomes maximum at a region where the blasting distance is equal to or slightly shorter than the rotor diameter.

EXAMPLE 2

In the second example, test similar with that in the first example was conducted, and the availability of reduced blasting density by decreasing the blasting distance was proved. The surface texture under varied blasting density was investigated within a range of blasting distance from 250 to 350 mm, where favorable results were obtained in the first example. The blasting density was changed by adjusting the quantity of blasted solid particles per unit time, while unchanging the rotational speed of rotor of the centrifugal blasting unit and the kind of blasting solid particles.

Figure 42:
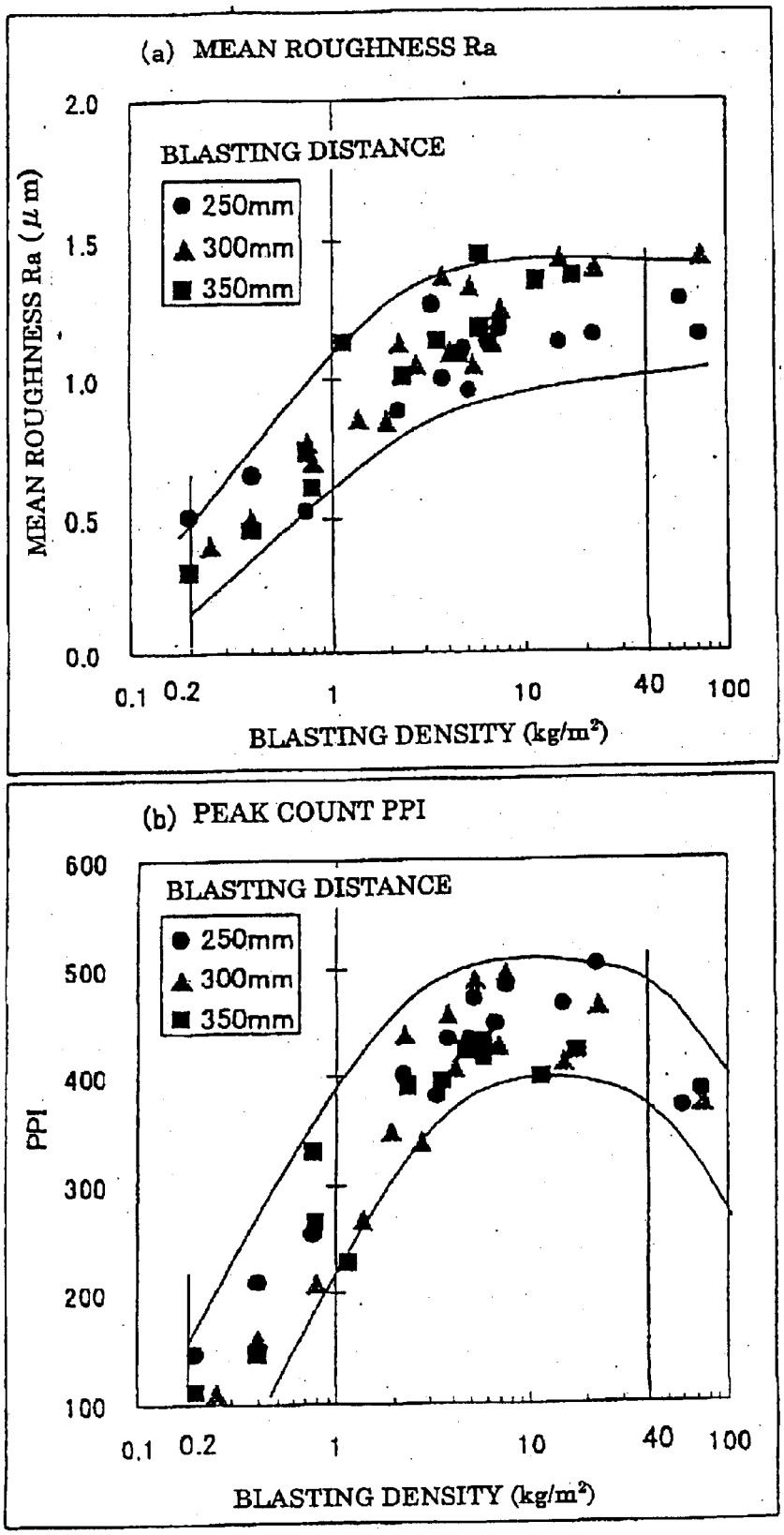
FIG. 42 shows the relation between the mean roughness Ra, the peak count PPI, and the blasting density within an effective blasting width in the Embodiment 2.

FIG. 42 shows the relation between the mean roughness Ra, the peak count PPI, and the blasting density within an effective blasting width. The mean roughness Ra increases with the increase in the blasting density. When the blasting density exceeds 1 kg/m$^2$, the mean roughness Ra can reach the level of 0.5 μm or more, (in some cases, when the blasting density becomes to 0.2 kg/m$^2$ or above, the mean roughness Ra becomes to 0.5 μm or more.) The peak count PPI increases with the increase in the blasting density, and reaches 100 at 0.2 kg/m$^2$ or higher blasting density. However, the peak count PPI decreases when the blasting density exceeds 40 kg/m$^2$. The phenomenon of decreasing the peak count is caused by demolishing once created roughness profile by succeedingly blasted solid particles. Therefore, from the point of giving high peak count to galvanized steel sheet, excessively large blasting density gives inverse effect.

According to the present invention, the area for creating surface roughness is widened by shortening the blasting distance, and the speed of solid particles on colliding against the steel sheet is not reduced even for small sold particles. Accordingly, small quantity of solid particles can effectively create surface roughness. As a result, the present invention has an effect that very large quantity of blasting, as needed in related art, is not necessary.

For example, to give a surface roughness on the surface of galvanized steel sheet to provide 400 or higher peak count, a steel strip having 1,250 mm of width can be treated by arranging three centrifugal blasting units in the width direction of the strip each on front side and rear side thereof. If, in that case, the line speed is 100 mm and the blasting density is 2.5 kg/m$^2$, then, the capacity of the particles circulation unit of 625 kg/min is satisfactory. Consequently, there is no need of unit to circulate large quantity of solid particles, which is required in ordinary shot-blasting method.

EXAMPLE 3

As the third example, the influence of mean particle size of the solid particles on the surface roughness of galvanized steel sheet was investigated using similar method as in the first example, with the blasting distance of 280 mm and the quantity of blasting to give the blasting density of 5 kg/m$^2$. The solid particles were spherical shot particles of high speed steel, which were classified by a vibration screen to adjust the weight percentage of particles within a size range of from 0.5d to 2d, as the solid particles, to 85% or more, (d designates the mean particle size). The blasting speed leaving the centrifugal blasting unit was fixed to 92 m/s.

Figure 43:
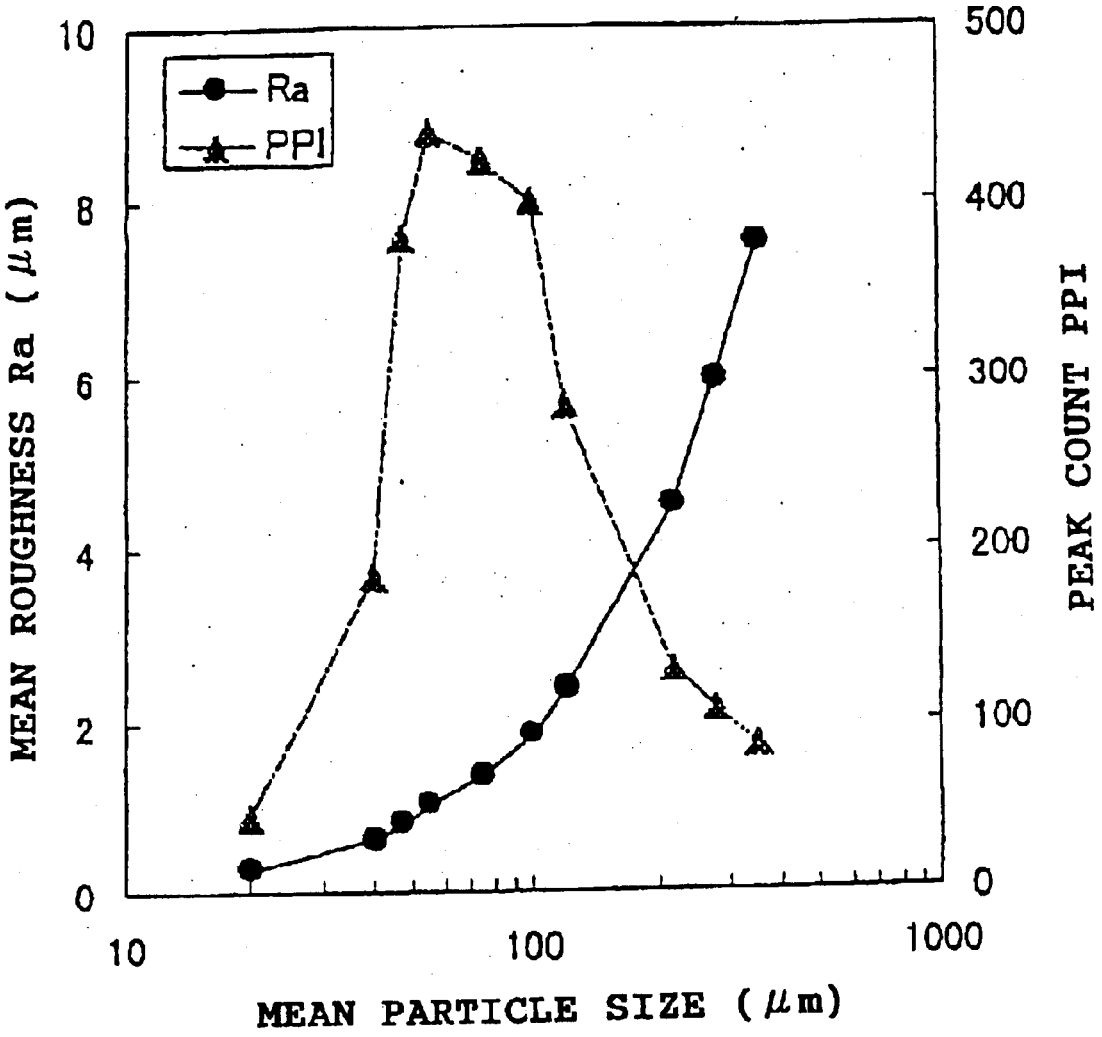
FIG. 43 shows the relation between the mean particle size, the mean roughness Ra, and the peak count PPI in the Embodiment 2.

FIG. 43 shows the relation between the mean particle size, the mean roughness Ra, and the peak count PPI. Increase in the mean particle size increases the mean roughness Ra, and the mean particle size that gives 0.3 to 3 μm of mean roughness Ra is approximately from 30 to 280 μm. Nevertheless, reduction in the blasting speed can establish 3 μm or lower Ra even when the mean particle size exceeds 280 μm. On the other hand, the peak count PPI once shows abrupt increase along with the increase in the particle size. The reason is that, when the particles are small in their size, although fine roughness profile is formed on the surface to some extent, small mean roughness Ra causes to include significant number of peaks and valleys of roughness profile having lower than the countable level for the observed peak counts, which finally indicates small value for the PPI. When the mean particle size exceeds 100 μm, the peak count PPI decreases, and when the mean particle size exceeds 300 μm, the peak count PPI becomes below 100.

The above-described tendency of the relation between the mean roughness Ra and the peak count PPI varies with the blasting speed, the blasting distance, and the blasting density, and also the mean particle size to give an extreme value varies. For example, increased value of blasting speed induces shift of mean particle size to give the maximum peak count toward small particle size. The mean particle size also varies with the density of blasting solid particles, moving toward larger mean particle size with smaller density thereof.

EXAMPLE 4

Figure 50:
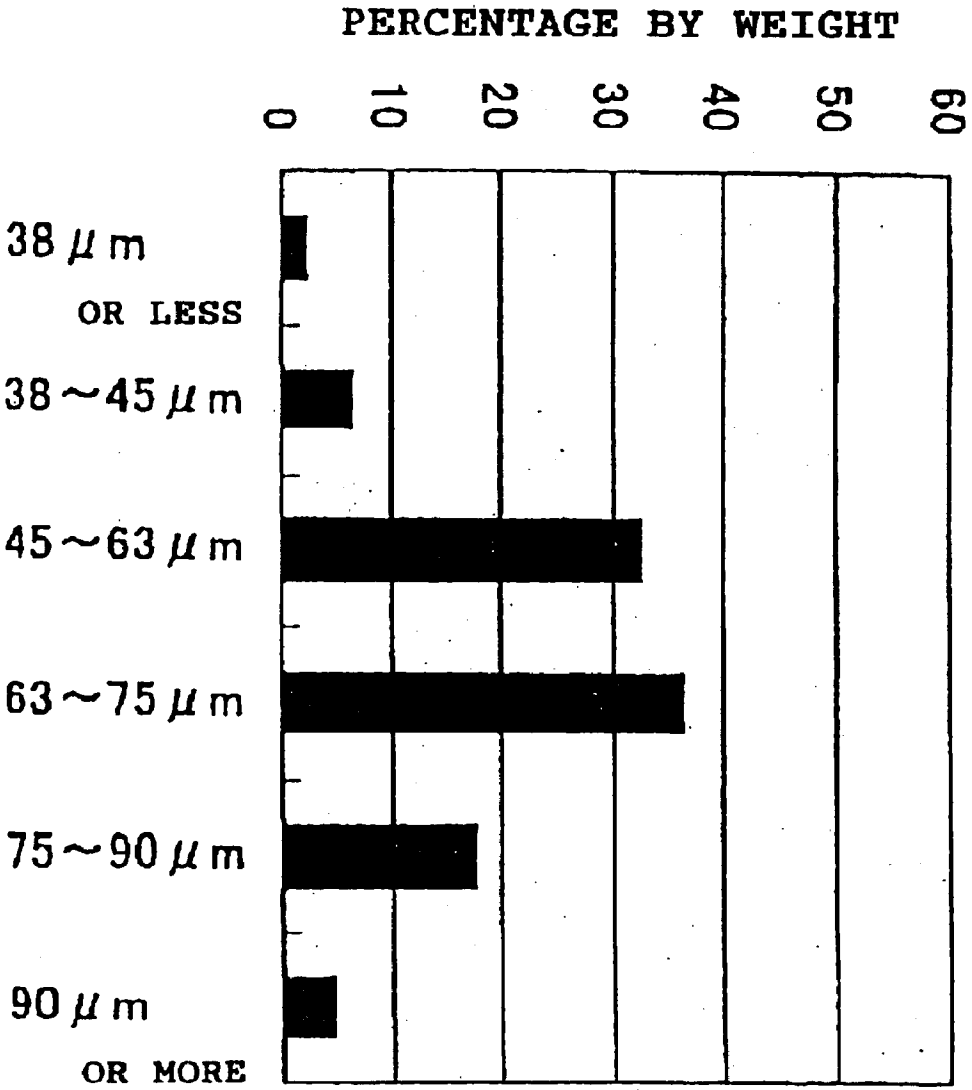
FIG. 50 shows the particle size distribution of the solid particles used in the centrifugal blasting unit in the fourth example of the Embodiment 2.

The fourth example investigated the influence of the blasting speed of solid particles on the surface roughness of galvanized steel sheet, using similar method as in the first example, with the blasting distance of 280 mm and the quantity of blasting to give the blasting density of 5 kg/m$^2$. The solid particles were spherical shot particles of high-speed steel, having 65 μm of mean particle size, shown in FIG. 50. The blasting speed was adjusted by varying the rotational speed of the rotor.

Figure 44:
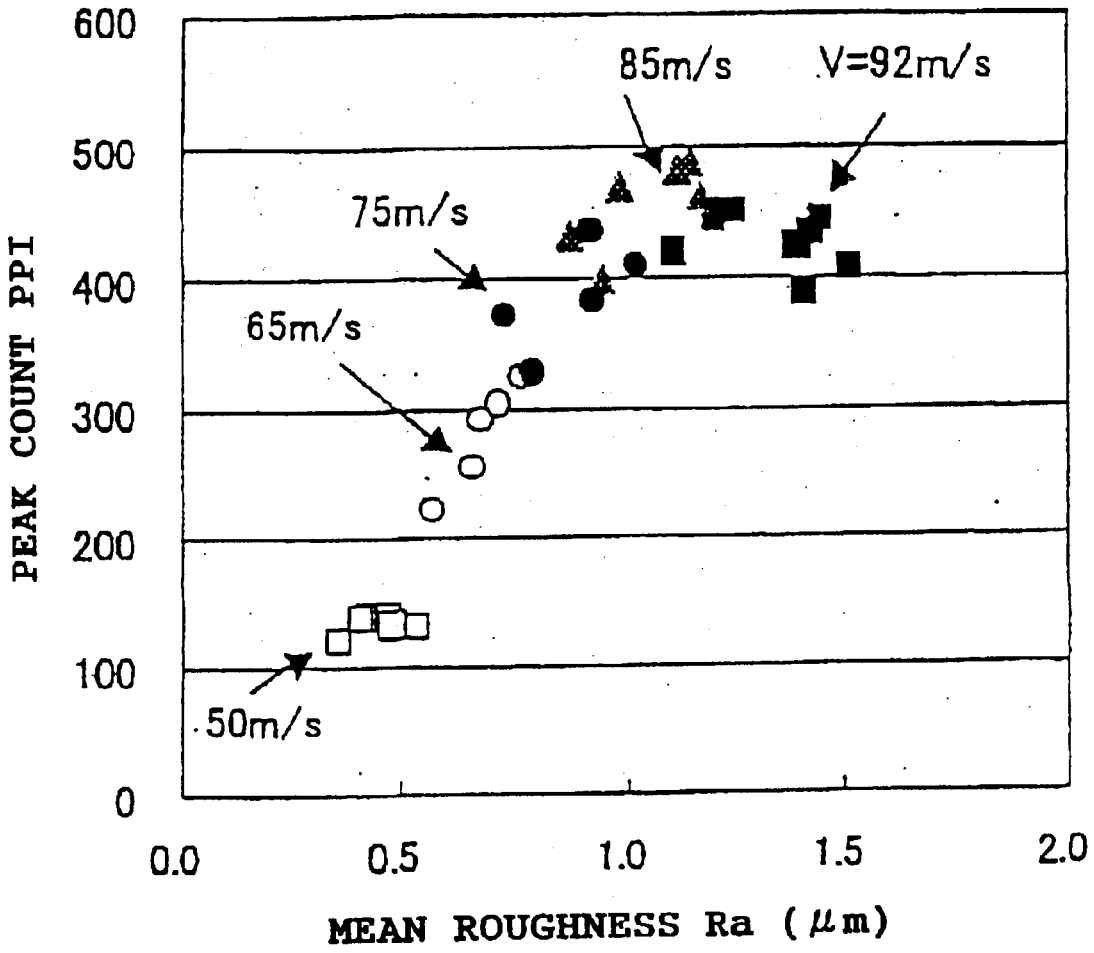
FIG. 44 shows the influence of the blasting speed on the mean roughness Ra and on the peak count PPI in the Embodiment 2.

FIG. 44 shows the influence of the blasting speed on the mean roughness Ra and on the peak count PPI. FIG. 44 shows both the mean roughness and the peak count increase with the increase in the blasting speed, giving once the maximum value to the peak count, then letting thereof decrease to some degree. When the blasting speed is low, the kinetic energy of the solid particles is small, so the satisfactory dents cannot be formed on colliding the solid particles against the galvanized steel sheet, thus both the mean roughness and the peak count show low values. When the blasting speed is very high, the concavities created by the blasted particles becomes large to increase the mean roughness Ra. In that case, however, the peak count slightly decreases because the pitch of peaks and valleys of roughness profile slightly increases.

EXAMPLE 5

The fifth example is the preparation of galvanized steel sheet using the high-speed steel solid particles applied in the third example, while varying the blasting distance and the rotational speed of the rotor to adjust the mean roughness Ra to a range of from 1.0 to 1.6 μm, thus significantly varying the peak count PPI.

To study the press-formability of thus prepared galvanized steel sheet, a flat sheet sliding test was applied to determine the friction factor. That is, the galvanized steel sheet was clamped between sliding tools, and the galvanized steel sheet was withdrawn at a speed of 1,000 mm/min under a contact face pressure of 7 MPa, thus determining the friction factor. As a comparative example, a steel sheet which was treated by temper rolling to give a surface roughness, according to related art, was tested for determining the friction factor under the same condition as the fifth example. The temper rolling was done using a rolling roll which was treated by electrical discharge machining to give 2.4 to 3.4 μm of mean roughness and 240 to 320 of peak count PPI.

Figure 45:
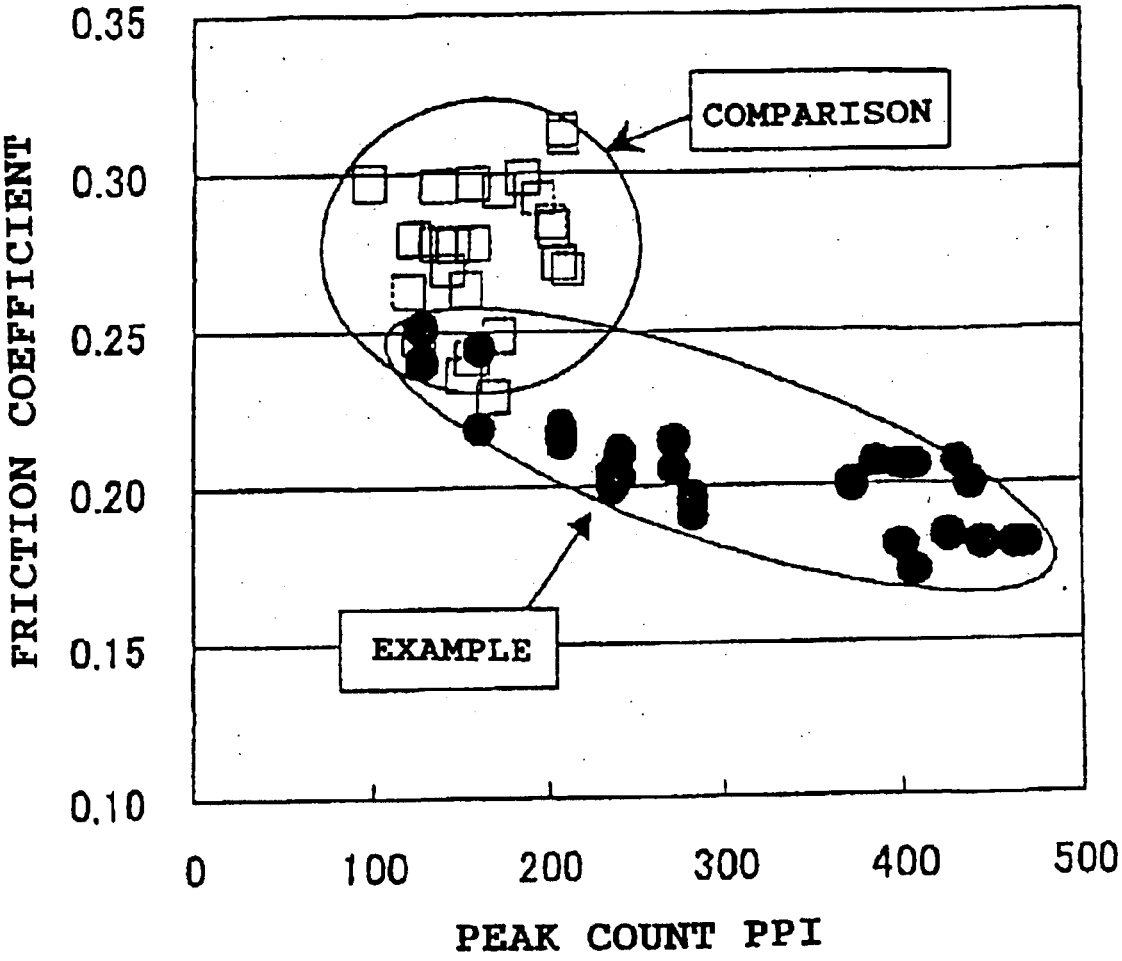
FIG. 45 shows the relation between the peak count PPI on the galvanized steel sheet and the friction factor observed in a sliding test in the Embodiment 2.

FIG. 45 shows the relation between the peak count PPI on the galvanized steel sheet and the friction factor observed in the sliding test. FIG. 45 shows that the galvanized steel sheet according to the present invention gives lower friction factor than that of the galvanized steel sheet prepared by related art. That is, the oil retainability between the steel sheet and the sliding tool improves to increase the volume of oil introduced to the interface. FIG. 45 also shows that the friction factor decreases with the increase in the peak count PPI. This is because the dense and short pitch roughness profile are created, thus inducing the influence of improving the oil retainability at interface and the influence of hardening the coating film itself by the collision of solid particles.

The above-described findings proved that the galvanized steel sheet according to the present invention performs favorable sliding characteristics even when the peak count PPI is equivalent level with that in the related art, and that the galvanized steel sheet according to the present invention shows further high sliding characteristics particularly in a region of high peak count PPI, where the temper rolling method cannot achieve that high sliding characteristics.

Figure 48:
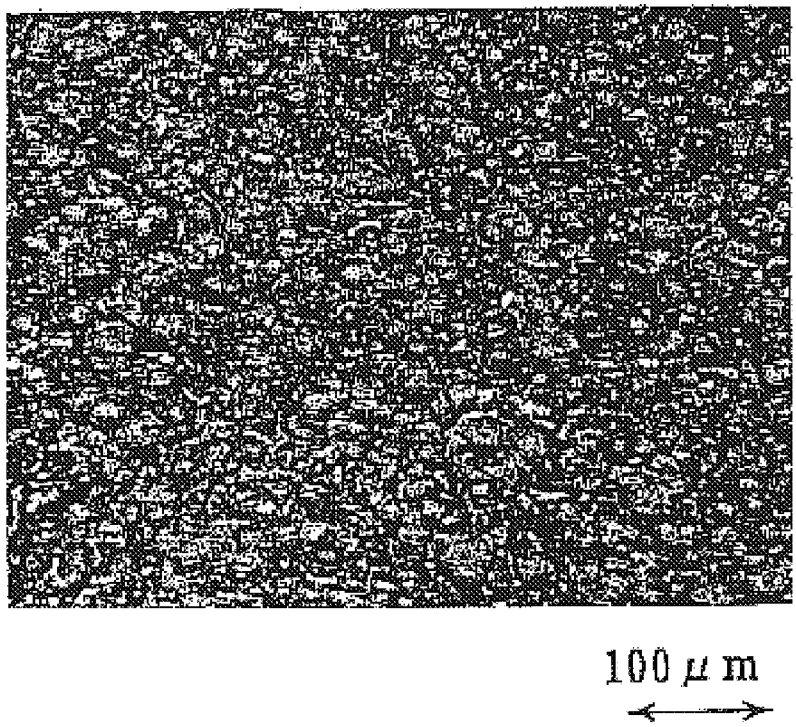
FIG. 48 shows photographs of surface of galvanized steel sheet in the example and in a comparative example of the Embodiment 2.
Figure 48:
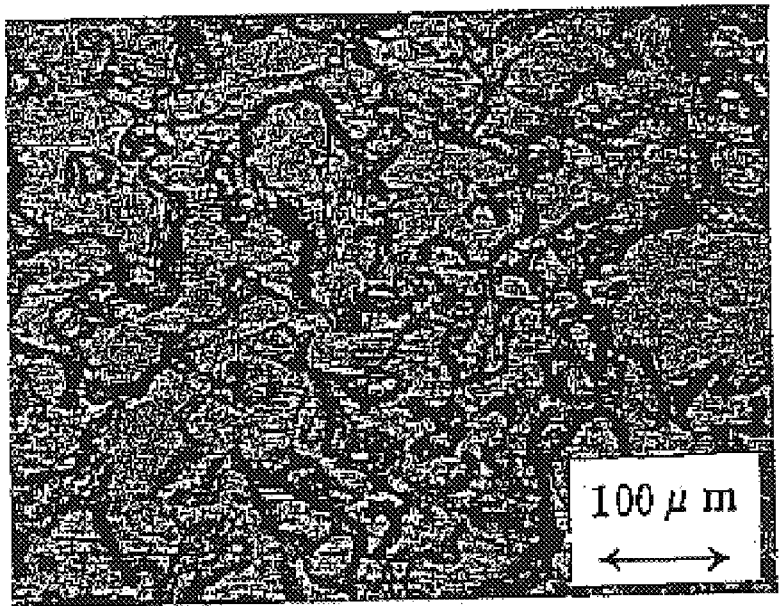
Figure 49:
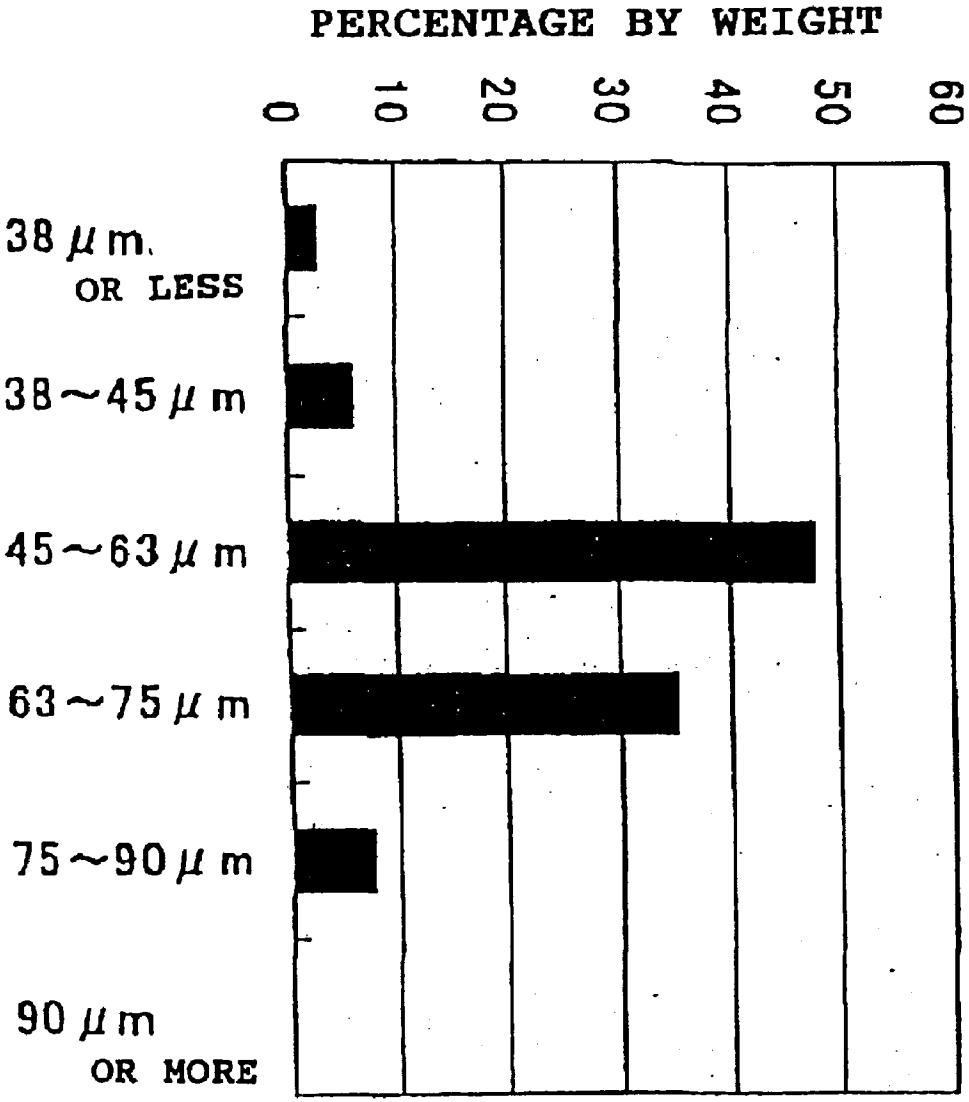
FIG. 49 shows the particle size distribution of the solid particles used in the centrifugal blasting unit in the first example of the Embodiment 2.

FIG. 48(*a*) shows a photograph of surface of galvanized steel sheet in the fifth example. FIG. 48(*b*) shows a photograph of surface of galvanized steel sheet prepared by conventional temper rolling, as a comparative example. The galvanized steel sheet prepared by the method according to the present invention has dents created by blasting spherical solid particles, so the dense dimple-shape concavities are created on the surface. That type of dimple-shape concavities provide the effect of favorable oil retainability between the press-working tool and the steel sheet.

EXAMPLE 6

The sixth example investigated the effect of preliminarily decreasing the centerline waviness Wca by applying temper rolling before blasting solid particles. In some cases, there exists long-period waviness caused from the variations of coating thickness on the surface of steel sheet on which hot-dip galvanizing is applied in advance. For the sixth example, a steel sheet having relatively large waviness after galvanizing was selected, and the temper rolling with a bright roll was given. The bright roll was finished to give the surface 0.25 μm of mean roughness Ra, and 0.8% of extension. After that, surface roughness was given using high-speed steel particles having 65 μm of mean particle size, thus obtained a galvanized steel sheet having 1.18 μm of mean roughness Ra and 440 of peak count PPI.

Figure 46:
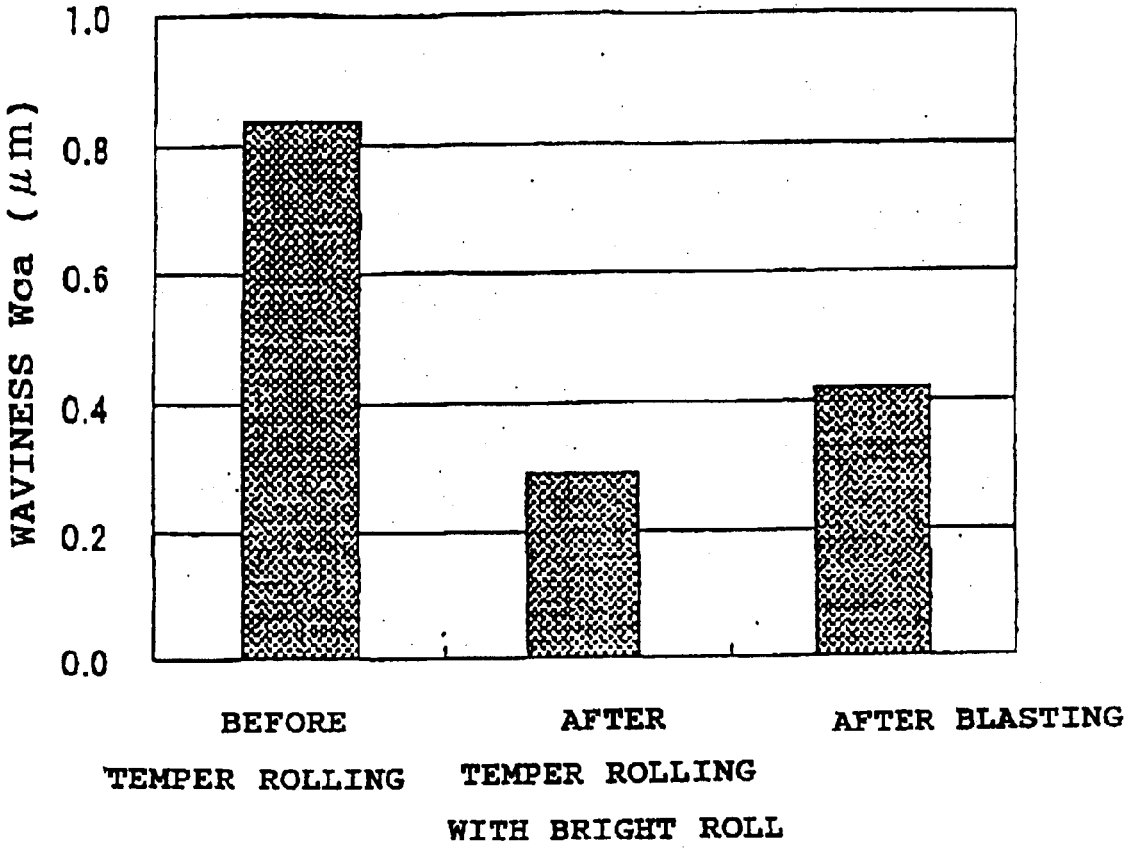
FIG. 46 shows the observed result of centerline waviness Wca on the steel sheet at each step of the manufacturing thereof in the Embodiment 2.

FIG. 46 shows the observed result of centerline waviness Wca on the steel sheet at each step of the manufacturing thereof. FIG. 46 shows that the centerline waviness Wca can significantly be reduced by applying temper rolling with a bright roll even when the waviness of the steel sheet before the temper rolling is very large. Furthermore, even after the solid particles are blasted, the centerline waviness Wca of the product is 0.42 μm, and the long-period roughness profile can be suppressed to a low level even when roughness profile is created on the surface thereof. On the other hand, when surface roughness is given by conventional temper rolling, if the centerline waviness Wca before the temper rolling is large, the Wca of microscopic roughness profile after the temper rolling is left behind in a high level state. According to the present invention, a bright roll can be used in the temper rolling, and the waviness of the product can be reduced even when the centerline waviness of the base material is large.

In addition, a galvanized steel sheet which was adjusted to 0.7 μm or less of centerline waviness Wca by the temper rolling was treated by blasting stainless steel particles having 50 to 120 μm of mean particle size. Samples were prepared from the treated steel sheet. To determine the image sharpness after coating on the steel sheet, "PB-L3080" manufactured by Nihon Parkerizing Co., Ltd. was applied to give chemical conversion treatment to the samples, followed by applying three-layer coating: ED coating, intermediate coating, and top coating, using "EL-2000", "TP-37 Gray", and "TM-13(RC)", manufactured by Kansai Paint Co., Ltd., respectively. The "Image Sharpness Tester NSIC Model" manufactured by Suga Test Instrument Co., Ltd. was used to evaluate the image sharpness after coating. The NISC value has an index of 100 on a black polished glass plate, and the value nearer to 100 means more preferable image sharpness.

Figure 47:
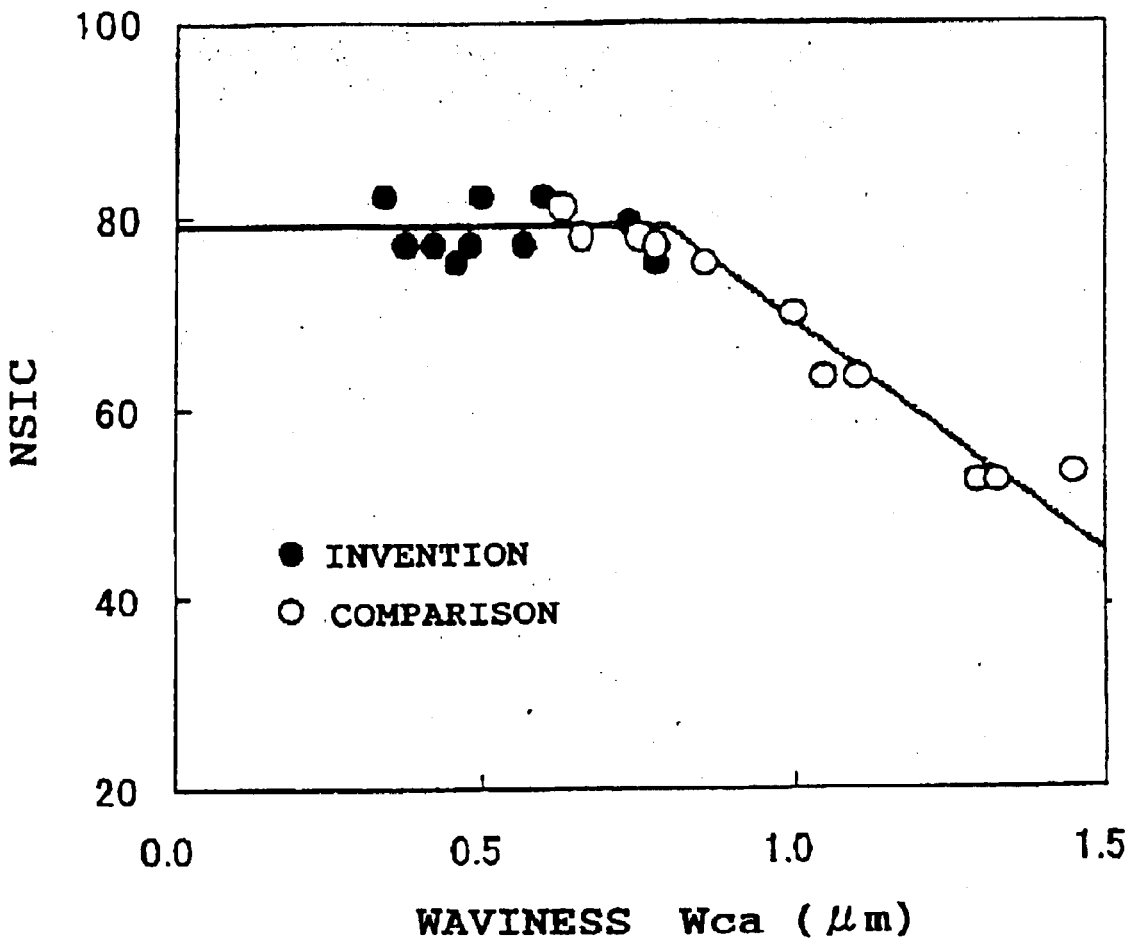
FIG. 47 shows Wca and NSIC in an example and a comparative example in the Embodiment 2.

FIG. 47 shows the observed result. FIG. 47 also shows comparative examples which were obtained by temper rolling using shot dull roll and electrical discharge dull roll. As seen in the figure, the galvanized steel sheet which was adjusted to 0.7 μm or smaller centerline waviness Wca by the temper rolling gives small value of centerline waviness Wca, 0.8 μm or less, even after blasting the solid particles, and the NSIC value which represents the image sharpness after coating becomes high.

EXAMPLE 7

The seventh example applied a galvanized steel sheet after treated by alloying treatment, and created surface roughness by blasting high speed steel particles having 65 μm of mean particle size under the condition of 92 m/s of blasting speed, 280 mm of blasting distance, and 10 kg/m$^2$ of blasting density. The resulted steel sheet had 1.2 μm of mean roughness Ra and 350 of peak count PPI.

Samples were cut from the steel sheet, and the sliding test similar with that in the fifth example was conducted. The friction factor of an alloyed hot-dip galvanized steel sheet prepared by the method of related art, before the solid particle blasting, was 0.20. The friction factor after blasting the solid particles according to the present invention, however, was 0.18. Thus obtained friction factor is at equivalent level with that obtained on steel sheets with iron coating and with nickel coating. Even with an alloyed hot-dip galvanized steel sheet which has hard coating film, the manufacturing method according to the present invention provides a galvanized steel sheet that shows excellent sliding characteristics. Furthermore, the centerline waviness Wca after blasting solid particles is as low as 0.5 μm, which indicates favorable image sharpness after coating.

Embodiment 3

The Embodiment 3-1 deals with a galvanized steel sheet having dimple-pattern surface texture, providing excellent press-formability.

The term "dimple-pattern" referred herein designates a texture that the surface profile valley portion is formed mainly by a curved face, for example, that large number of concavities in a shape of crater is created when spherical objects collide against the surface. With the large number of dimple-shape concavities, the concavities play a role of pockets for oil of press-forming, thus improving the oil-retainability between the mold and the steel sheet.

Figure 56:
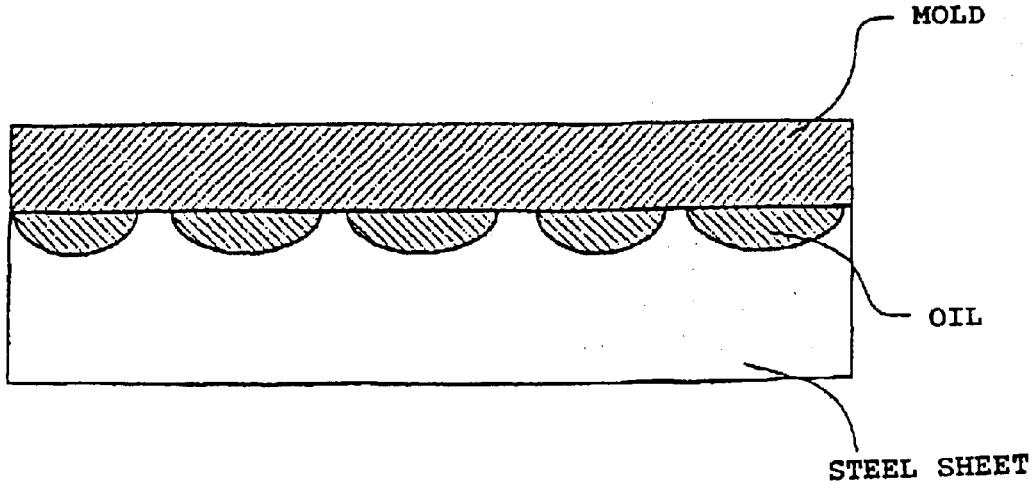
FIG. 56 shows the first schematic drawing illustrating the contact state during the press-forming stage of a galvanized steel sheet in the Embodiment 3.
Figure 59:
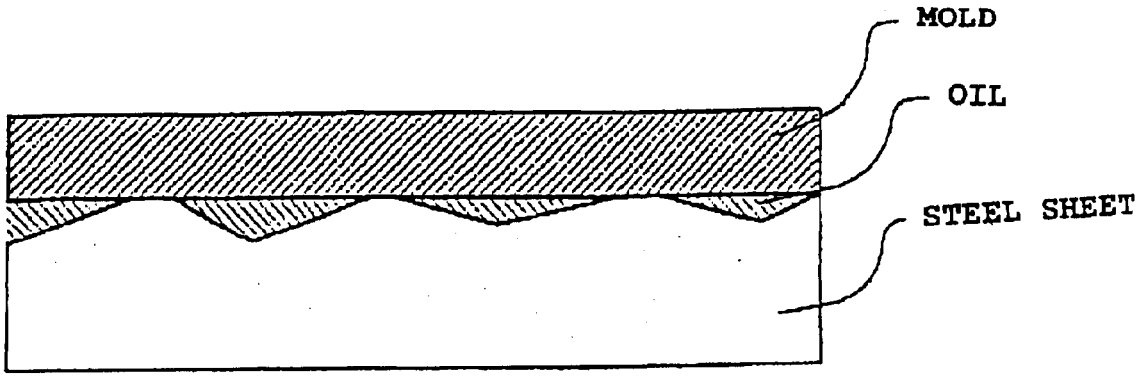
FIG. 59 shows a schematic drawing illustrating the contact state during the press-forming stage of a galvanized steel sheet with a surface roughness given by the related art.

FIG. 56 illustrates the state of contact with the mold during the press-forming stage. For comparison, FIG. 59 illustrates the state of contact with a galvanized steel sheet having a surface roughness given by the related art. For the case of dimple-pattern surface texture, the oil in individual dimples is not easily released even if the coating layer deforms during sliding step, and the oil surely remains in each of the dispersed dimples, thus the mold can slide on the coated steel sheet without breaking the oil film. To the contrary, for the surface texture on the coated steel sheet according to the related art, on which the texture on the rolling roll was transferred, the concavity is not necessarily in a closed circle shape which is observed in dimple, so the oil is difficult to be retained therein, thus likely causes breaking of oil film.

The Embodiment 3-2 is a modification of the Embodiment 3-1, in which the mean roughness Ra of the surface is in a range of from 0.5 to 5.0 μm.

If the mean roughness Ra of surface is smaller than 0.3 μm, the oil retainability between the steel sheet and the mold cannot fully be assured, so the die-galling is likely generated during the press-forming stage. The phenomenon becomes significant particularly when the zinc coating is soft. Therefore, the present invention specifies the mean roughness Ra of the surface to 0.3 μm or more.

On the other hand, larger mean roughness Ra improves more the oil retainability between the steel sheet and the mold, thus the contact load concentrates on the large profile peak portions on the surface, which likely generates break of oil film caused by the friction heat generated at the contact portion, though the quantity of oil introduced to the interface therebetween increases. As a result, local die-galling occurs, which cancels the effect obtained by increased oil retainability. Accordingly, the present invention specifies the upper limit of mean roughness Ra as 3 μm as the range not to induce die-galling originated from large profile peak portions.

The Embodiment 3-3 is a modification of the Embodiment 3-1 or the Embodiment 3-2, in which the peak count PPI on the surface is within a range of the formula:

$$-50\times Ra(\mu m)+300<PPI$$

The term "peak count PPI" referred herein signifies, as defined by SAE911 Standard, the number of peaks of roughness profile per one inch length. The above-given peak count PPI is expressed by the value at ±0.635 μm of count level.

Figure 57:
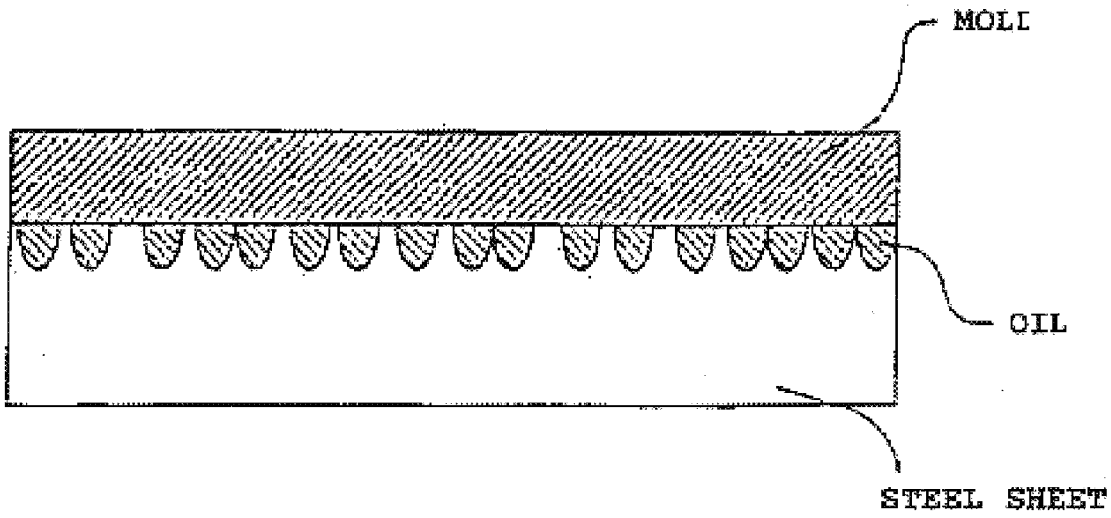
FIG. 57 shows the second schematic drawing illustrating the contact state during the press-forming stage of a galvanized steel sheet in the Embodiment 3.

For the case of large peak count, the contact state between the galvanized steel sheet and the mold during press-forming stage differs from the case of simply increasing the mean roughness, as illustrated in FIG. 57. That is, larger peak count gives larger number of profile peak portions contacting with the mold, under the same mean pressure, and the deformation of individual profile peak portions decreases. In other words, contact of large number of profile peak portions with the mold degreases the load burdened by individual profile peak portions. Since the friction heat generated at contact portions between the profile peak portions and the mold is dispersed compared with the case of large profile peak portions, the temperature increase at each contact interface is suppressed.

Since the temperature rise at the contact portions leads to microscopic break of oil film existing at interface, the friction factor increases to further increase the friction heat at contact portions, which is a vicious cycle. To the contrary, the press-formability can be improved by forming short pitch of peaks and valleys of roughness profile on the surface of galvanized steel sheet, even with the same mean roughness. Furthermore, even when the mean roughness is small, equivalent or superior press-formability is attained, so the mean roughness is not a variable to degrade the image sharpness after coating.

The Embodiment 3-3 specifies the lower limit of peak count PPI on galvanized steel sheet on the concept described above. As for the upper limit of the peak count PPI, larger value expectedly gives better result. At present, however, the range that can be realized economically is not higher than 600. In the future, if a method to increase the PPI is developed, the method becomes applicable. Therefore, the upper limit according to the present invention is not specified.

The Embodiment 3-4 is a modification of either one of the Embodiment 3-1 through the Embodiment 3-3, in which the waviness Wca of the surface is 0.8 μm or less.

The galvanized steel sheets for automobile use or the like need to assure the image sharpness after coating as well as the press-formability. Regarding the image sharpness after coating, the short-period roughness profile on the surface is buried during the undercoating step or the like to give no bad influence on the image sharpness after coating, but the long-period roughness profile remains after the coating to degrade the image sharpness. In this case, the waviness Wca has a close relation with the image sharpness after coating. The term "waviness Wca" referred herein signifies the centerline waviness specified in JIS B0610, and represents the mean height of roughness profile after treated by high-pass cutoff.

For improving the image sharpness after coating, the long-period peak portions and valley portions are requested to be reduced. By regulating the waviness Wca to 0.8 μm or less, the image sharpness after coating is assured. Consequently, increased mean roughness creates large roughness profile on the surface of steel sheet, which solves the problem of degrading the image sharpness after coating.

The Embodiment 3-5 is a modification of either one of the Embodiment 3-1 through the Embodiment 3-4, in which the coating film consists mainly of η phase.

For the case that the coating film consists mainly of η phase, the coating film itself is soft and the melting point is low compared with that of alloyed hot-dip galvanized steel sheet, so the adhesion likely occurs during press-forming stage. Therefore, the mean roughness to be formed on the surface is requested to be large, thus providing stronger effect than that of the related art.

Examples of the mode for carrying out the present invention are described below. The first method for manufacturing a galvanized steel sheet according to the Embodiment 3-5 is to form roughness profile on the surface of steel sheet on which a zinc coating is formed by blasting fine solid particles. The zinc coating is generally hot-dip galvanizing or electro-zinc plating. However, a plated steel sheet prepared by mechanically forming a zinc film thereon may be applied. Alternatively, temper rolling may be applied to adjust the mechanical properties on the steel sheet, or a non-temper-rolled steel sheet may be used. Furthermore, a steel sheet subjected to a post-treatment such as chromate treatment may be used.

The solid particles to be blasted against the galvanized steel sheet are preferably steel balls or ceramics-base particles having 1 to 300 μm of particle size, more preferably 25 to 100 μm thereof. Applicable blasting unit includes air-drive shot blasting unit which accelerates the solid particles by compressed air or mechanical acceleration unit which accelerates the solid particles by centrifugal force. By blasting those kinds of solid particles at blasting speeds of from 30 to 300 m/s against the galvanized steel sheet for a specified period, fine roughness profile on the surface can be formed on the galvanized steel sheet.

When spherical solid particles are blasted, dimple-shape concavities are formed on the surface of galvanized steel sheet. The solid particles may be, however, polyhedron, not completely spherical shape. Smaller the solid particles to be blasted provide shorter pitch of peaks and valleys of surface roughness profile and larger peak count. As for the quantity of basting solid particles, preferable range thereof is from 0.1 to 40 kg/m$^2$, which range assures the blasting of particles over the whole surface of the galvanized steel sheet while avoiding peeling of the zinc coating film. Furthermore, by ejecting compressed air against the steel sheet having thus formed surface roughness profile, the solid particles can easily be removed from the surface.

The second method for manufacturing a galvanized steel sheet according to the Embodiment 3-5 is to blast slid particles against the steel sheet which was worked to a certain sheet thickness by hot-rolling or cold-rolling, thus forming surface roughness profile, similar with the method described above, followed by galvanizing thereon. The substrate steel sheet is generally the one which was treated by rolling followed by annealing, or by temper rolling. To increase the strength, a not-annealed steel sheet may also be applied.

To that type of steel sheet, similar method as described above can be applied to give surface roughness profile. When the steel sheet uses not-annealed material or hard material, the surface roughness profile is adjusted by increasing the blasting speed of solid particles compared with the above-given condition. The zinc coating applied to thus obtained steel sheet is preferably electro-zinc plating. Hot-dip galvanization may, however, also be applicable.

The methods for preparing the surface of galvanized steel sheet, disclosed in the related art, are to transfer the surface roughness by temper rolling. In these cases, it is practically difficult to attain 250 or higher peak count PPI. For example, the pitch of peaks and valleys of roughness profile on the surface of a galvanized steel sheet, disclosed in JP-A-11-302816, is around 0.11 mm. Therefore, also in this case, the number of peaks and valleys of roughness profile per one inch length is estimated as around 230.

According to the method for manufacturing galvanized steel sheet in the related art, when the roughness profile is formed on the surface of rolling roll, the shot-blasting method and the electrical discharge machining form mainly profile valley portions on the surface thereof, thus, mainly the profile peak portions are transferred onto the steel sheet. With the laser machining and the electron beam machining, the area where laser beam irradiated fuse to form profile valley portions, and the profile peak portions appear at the surrounding area. When the texture is transferred onto the steel sheet, the profile valley portions appear centering on the individual profile peak portions, to give donut shape pattern. Accordingly, the texture on the surface of galvanized steel sheet formed by temper rolling differs from the dimple-pattern concavity texture described in the present invention.

EXAMPLE 1

The first example of the Embodiment 3 describes a galvanized steel sheet using a hot-dip galvanized steel sheet with a cold-rolled steel sheet having 0.8 mm in thickness as the substrate sheet, provided with 0.8% of extension by temper rolling, and giving a surface roughness by the above-described method.

Figure 51:
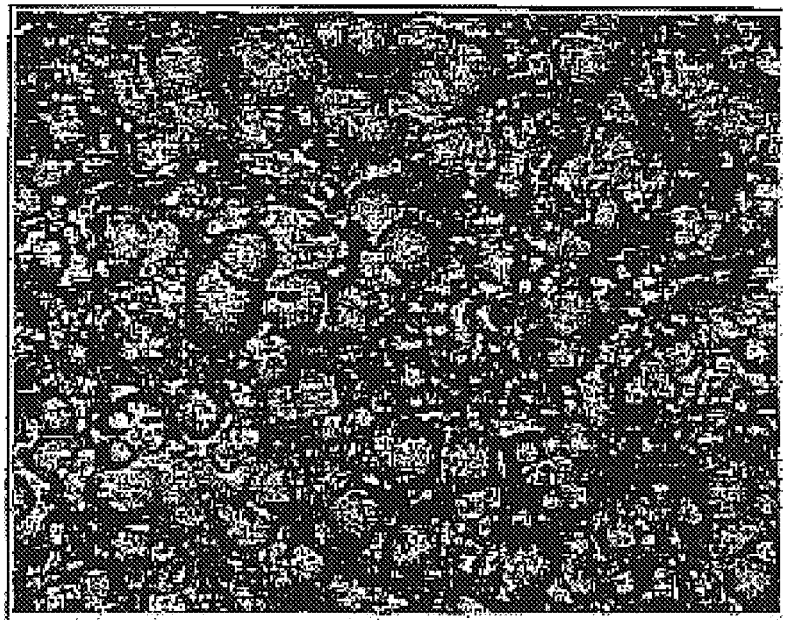
FIG. 51 shows a photograph of the surface of the first galvanized steel sheet as an example of the Embodiment 3.
Figure 52:
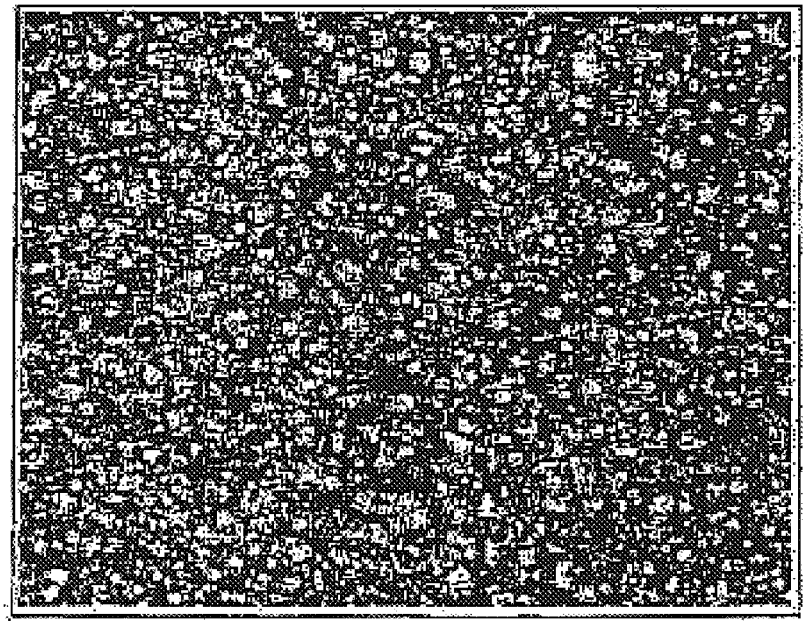
FIG. 52 shows a photograph of the surface of the second galvanized steel sheet as an example of the Embodiment 3.
Figure 58:
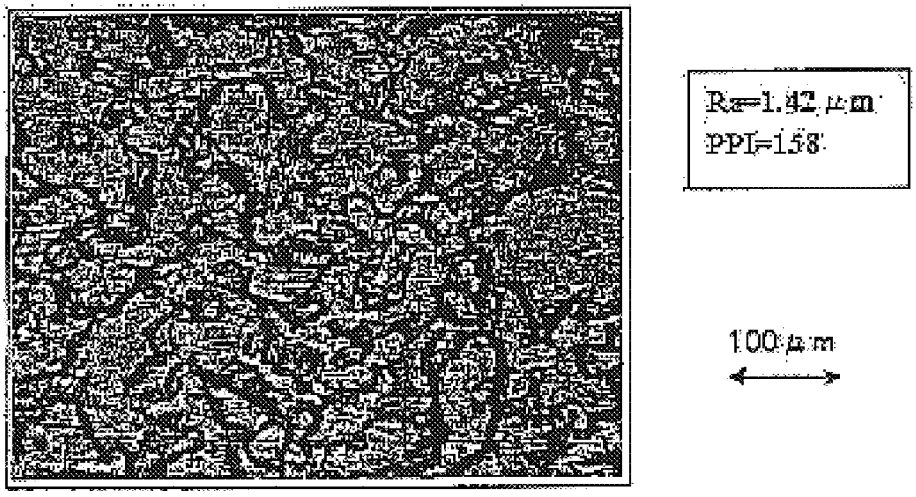
FIG. 58 shows a photograph of the surface of galvanized steel sheet with a surface roughness given by the related art.

According to the first example, the surface roughness was created on a steel sheet having a coating film consisting mainly of η phase, by blasting alumina particles having mean particle size of 128 μm and 55 μm, separately, against the surface thereof. FIG. 51 and FIG. 52 show photographs of galvanized steel sheets according to the present invention. These photographs were taken under the blast of solid particles having the size of 128 μm and 55 μm, respectively. By colliding the solid particles, many concavities are formed on the surface, providing fine dimple-pattern texture. As a comparative example, FIG. 58 shows a photograph of surface of a steel sheet on which the surface roughness was adjusted by temper rolling using a rolling roll to which the surface working was given by electric discharge machining. The surface shows a texture of series of relatively large insular convex portions.

Among thus prepared galvanized steel sheets according to the present invention and those of comparative example, steel sheets having 1.3 to 1.6 μm of mean roughness Ra were selected, and their friction factor was determined by the flat sheet sliding test. That is, the galvanized steel sheet was clamped between sliding tools, and the galvanized steel sheet was withdrawn at a speed of 1,000 mm/min under a contact face pressure of 7 MPa, thus determining the friction factor. A lubrication oil of NOX-RUST 550HN (trade name, manufactured by Nihon Parkerizing Co., Ltd.) was applied to the surface of the galvanized steel sheet, in advance.

Figure 53:
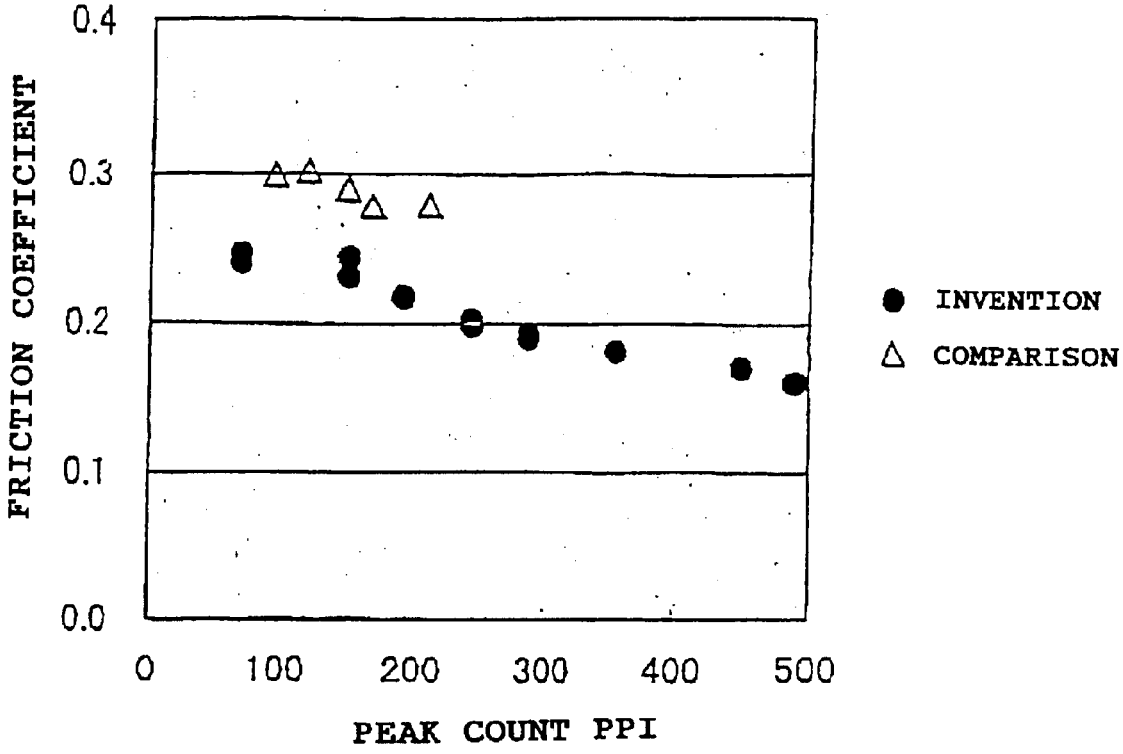
FIG. 53 shows the relation between the peak count PPI and the friction factor in an example and a comparative example of the Embodiment 3.

FIG. 53 shows the friction factor obtained by the sliding test. The galvanized steel sheets according to the present invention, given as the example, show smaller friction factor, even with the same mean roughness, than that of conventional galvanized steel sheet given as the comparative example. That is, the oil retainability between the steel sheet and the sliding tool improves to increase the oil volume introduced in the interface.

FIG. 53 also shows the decrease in friction factor with increase in the peak count PPI. This is because the number of contact points with the profile peak portions on the surface of steel sheet increases, and the contact area between individual profile valley portions and the tool narrows, thus decreasing the heat of friction at the contact points to prevent the break of the oil film.

The above-described findings show that the friction factor decreases by making the surface texture of the galvanized steel sheet the dimple-shape texture, further by increasing the peak count, thus preventing the die-galling.

EXAMPLE 2

Figure 54:
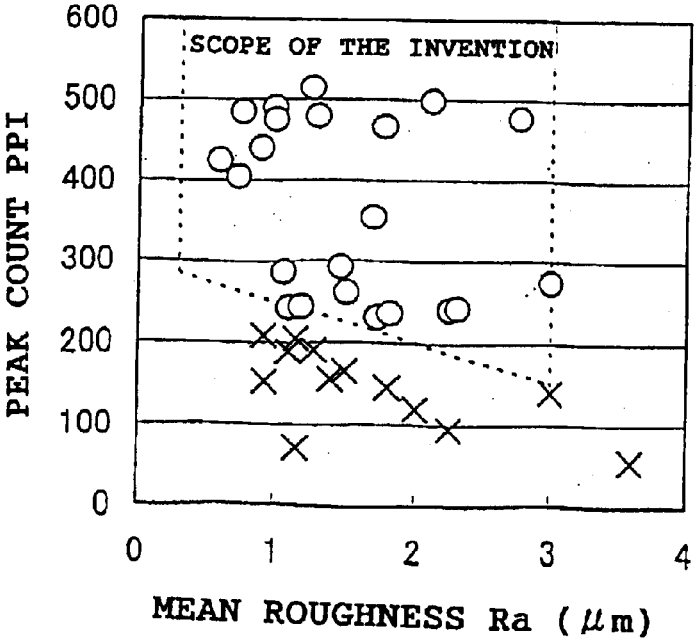
FIG. 54 shows the relation between the mean roughness, the peak count PPI, and the good/bad state of friction factor in the Embodiment 3.

By applying the method described in the mode for carrying out the present invention, galvanized steel sheets having various levels of mean roughness and peak count were prepared by varying the particle size of blasting solid particles, the blasting speed, and the kind of particles. To those kinds of galvanized steel sheets, the sliding test was given under the same condition as described above. In FIG. 54, the mark (o) signifies the friction factor of not more than 0.2, and the mark (x) signifies the friction factor above 0.2. The applied galvanized steel sheet was a hot-dip galvanized steel sheet having a coating film consisting mainly of η phase.

The zone shown by broken line in FIG. 54 is the zone having mean roughness Ra and peak count PPI specified by the present invention, or the zone providing favorable sliding characteristics giving 0.2 or smaller friction factor.

FIG. 54 suggests that the galvanized steel sheet according to the present invention shows small friction factor determined by the sliding test, thus giving small friction heat during press-forming stage, so that the die-galling is prevented.

Figure 55:
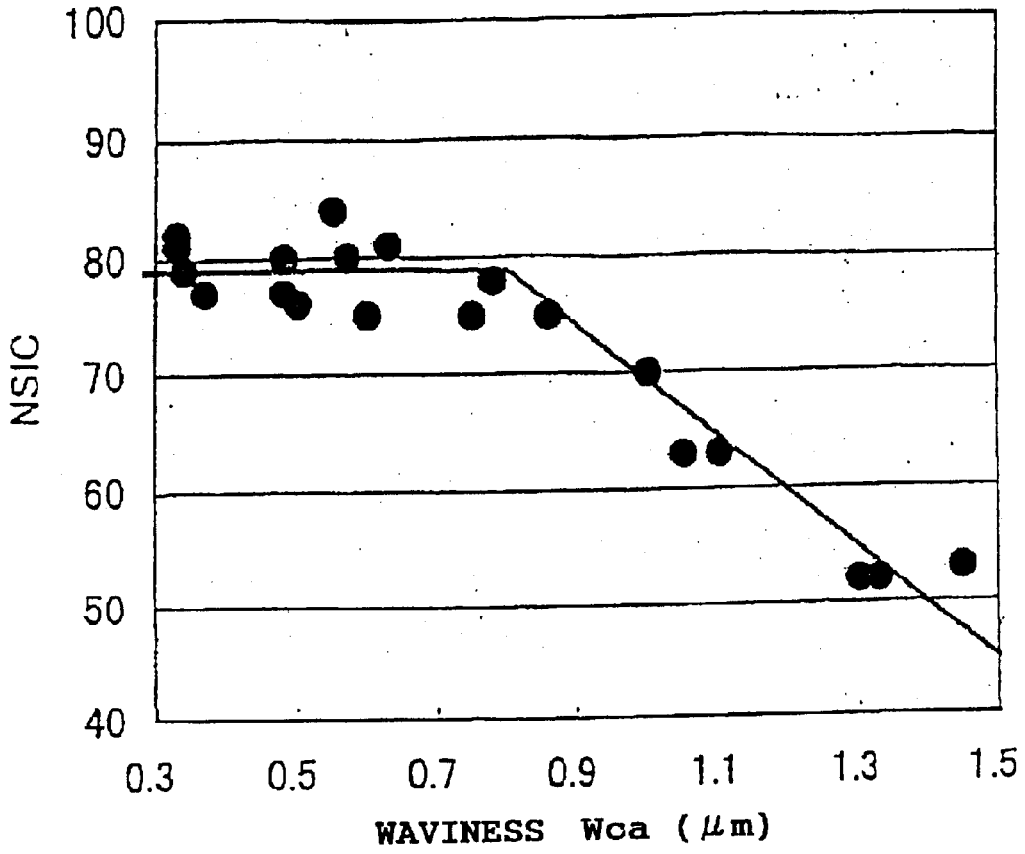
FIG. 55 shows the relation between the image sharpness after coating and the waviness in the Embodiment 3.

FIG. 55 shows the relation between the waviness Wca and the image sharpness after coating on a galvanized steel sheet obtained by the second example. The image sharpness after coating was evaluated as follows. To determine the image sharpness after coating on the steel sheet, "PB-L3080" manufactured by Nihon Parkerizing Co., Ltd. was applied to give chemical conversion treatment to a samples, followed by applying three-layer coating: ED coating, intermediate coating, and top coating, using "EL-2000", "TP-37 gray", and "TM-13(RC)", (all of them are trademarks), manufactured by Kansai Paint Co., Ltd., respectively.

The "Image Sharpness Tester NSIC Model" manufactured by Suga Test Instrument Co., Ltd. was used to evaluate the image sharpness after coating. The NISC value has an index of 100 on a black polished glass plate, and the value nearer to 100 means more preferable image sharpness. As seen in the figure, smaller waviness Wca improves more the image sharpness after coating, and, favorable image sharpness after coating is available at or below 0.8 ìm of waviness Wca.

Accordingly, by adjusting the mean roughness Ra and the peak count PPI of steel sheet to the range of the present invention, favorable press-formability is provided, and by regulating the waviness Wca to 0.8 $\mu$m or less, both the press-formability and the image sharpness after coating are assured.

Embodiment 4

The inventors of the present invention conducted extensive study on the method to maximize the lubrication effect and the adhesion-preventive effect of oil film by preventing microscopic contact between the mold and the surface of steel sheet. The study revealed that excellent press-formability is attained even for galvanized steel sheets without degrading the image sharpness after coating by optimizing the surface texture thereof. The Embodiment 4 was established on the basis of the finding. The essence of the Embodiment 4 is described below.

(1) A galvanized steel sheet providing excellent press-formability, having large number of concavities on the surface thereof, wherein the number density of the concavities is $3.1\times10^2$ counts/mm$^2$ or more at the depth level corresponding to the 80% bearing area ratio. (Embodiment 4-1)

(2) The galvanized steel sheet providing excellent press-formability according to (1), wherein the surface texture has core fluid retention index Sci of 1.2 or more. (Embodiment 4-2)

(3) The galvanized steel sheet providing excellent press-formability and image sharpness after coating according to (1) or (2), wherein the filtered centerline waviness Wca is 0.8 $\mu$m or less. (Embodiment 4-3)

According to the study of the inventors of the present invention, achieving excellent press-formability needs to emphasize the prevention of microscopic contact between the mold and the surface of steel sheet by letting the concavities which are the places to retain lubrication oil disperse on the surface of the steel sheet at a density as high as possible, rather than to emphasize the increased volume of retained lubrication oil. That is, it is more important to attain high density dispersion of oil pockets to avoid break of oil film. Detail description of the point is given below.

As described before, to provide oil-retainability to the surface of steel sheet and to prevent degradation of image sharpness after coating, the surface texture is required to have a Ra within an adequate range. For those purposes, generally Ra is adjusted to a range of from 0.3 to 3.0 $\mu$m. Within that range of Ra, however, the friction factor practically shows no systematic differences. The Ra which is an index of average height of surface roughness profile reflects the volume of lubrication oil that can be retained at interface between the press-mold and the steel sheet. This means that the major variable that governs the friction factor within the above-given range of Ra is not the volume of lubrication oil.

When the above-discussed phenomena are considered, the most important action to improve the press-formability is to maximize the lubrication effect of oil film and the adhesion-prevention effect by preventing break of oil film at interface between the press-mold and the steel sheet, rather than to keep volume of lubrication oil. For surface textures each having the same volume of lubrication oil at interface between the press-mold and the steel sheet, it is easily expected that the friction factor differs between the type that the lubrication oil is held at a single position in the interface and the type that the lubrication oil is held uniformly over the whole interface area. Therefore, to prevent break of oil film, it is most effective to increase the number density of the concavities which are the oil pockets on the surface texture of steel sheet as large as possible.

On considering the density of distributed concavities, it is necessary to take into account that the press-forming is a process accompanied by wear on the surface of the steel sheet, and that shallower concavities are more readily worn, or that deeper concavities give larger effect as the oil pockets. Nevertheless, since the degree of wear on the surface of steel sheet varies with the kind of mold and the cushion force, further with the portion of the mold being contacted with the steel sheet, during the press-forming stage, generally it is difficult to estimate and determine the depth of concavities to be emphasized. Although there is a method to define the number density of concavities by PPI (specified by SAE911), or the number of peaks and valleys of roughness profile per one inch length, it is difficult to adequately apply PPI in this state because the PPI cannot be calculated unless the depth of the concavities to be emphasized is determined. Furthermore, the PPI which is a two-dimensional parameter so that the PPI depends also on the direction of observation within a plane, thus the PPI may not represent actual three-dimensional surface texture.

Based on the above-discussed matter, the present invention defined the number density of deep concavities as follows. Considering the fact that most part of the surface area of galvanized steel sheet is demolished even in a flat sheet sliding test under low face pressures, the concavities which are identified as those left at a depth level corresponding to 80% bearing area ratio are defined as the deep dents. The term "bearing area ratio" referred herein is a concept used in the three-dimensional analysis of surface texture, and the detail is described in, for example, K. J. Stout, W. P. Dong, L. Blunt, E. Mainsah, and P. J. Sullivan, "3D Surface Topography; Measurement Interpretation and Applications, A survey and bibliography" edited by K. J. Stout, published by Penton Press, (1994), "Development of Methods for the Characterization of Roughness in Three Dimensions" edited by K. J. Stout, published by Penton Press, (2000). The concept is an extension of the concept of bearing length ratio, described in JIS B0660 and the like, to three-dimension, and the definition is given as the ratio of the total contacting area, (called the bearing area), obtained by truncating the surface summits by a plane parallel to the mean plane at a given truncation level over the sampling area. That is, the depth level corresponding to the 80% bearing area ratio means the corresponding truncation level that gives appearance of an area that is 80% of the evaluation area, (called the 80% bearing level).

According to a study carried out by the inventors of the present invention, favorable press-formability is attained at or higher than $3.1\times10^2$ counts/mm$^2$ of the number density of the concavities at the 80% bearing level. This is the reason why the Embodiment 5-1 specifies the number density of the concavities at the depth level corresponding to the 80% bearing area ratio.

Press-formability is also influenced by the effect of oil film area at the interface between the press-mold and the steel sheet. As described before, the effect of the volume of lubrication oil on the friction factor is not significant within a Ra range of from 0.3 to 3.0 $\mu$m. If, however, the number density of the deep concavities is the same, the effect of the oil film area at the interface appears on the friction factor. According to a study of the inventors of the present invention, the oil film area is represented by the core fluid retaining index Sci, described below, and, if the Embodiment 4-1 is satisfied, the friction factor can further be decreased at 1.2 or higher value of Sci. This is the reason that the Embodiment 4-2 limits the value of Sci. The term "core fluid retention index Sci" referred herein is defined by the ratio of the void volume of the unit sampling area, which can retain fluid (lubrication oil in this case), at a depth range of from 5% bearing level to 80% bearing level, (this range is called the "core zone"), over the root mean square deviation Sq. The Sq is the standard deviation of the surface height distribution, corresponding to an extension of the root mean square deviation Rq (defined in JIS B0660) to three-dimensional expression. The Sci and Sq are the three dimensional roughness parameters used in three-dimensional analysis of above-described surface texture, and the detail of them is described in the above-given literature published by Penton Press. The definition tells that Sq is, similar with Ra, an index of average height of roughness profile on the surface texture, so Sci responds to the oil film area. That is, the reduction in friction factor along with the increase in Sci, at almost the same number density of the concavities, suggests that, even with the same number density of the concavities, the break of oil film hardly occurs when the lubrication oil held in the concavities widely spread over the interface. The influence of Sci that reflects the oil film area on the friction factor is less than the influence of the number density of the deep concavities. The phenomenon is presumably because the continuation of oil film cannot be assured solely by the oil film area and because Sci includes the contribution of shallow concavities which are easily worn, or which give small effect of oil pockets.

The Sci is known to have a close correlation with other three-dimensional roughness parameters such as skewness Ssk and kurtosis Sku of representing the height distribution of surface roughness profile. Accordingly, the definition using Sci may be expressed by these parameters. That is, Sci not less than 1.2 corresponds to Ssk of about −0.9 or more, and to Sku of about 4.6 or less. Instead of these three-dimensional parameters, corresponding two-dimensional parameters defined in JIS B0601(2001) are expected to give almost equal values with those given above.

Galvanized steel sheets for automobile use are requested to have both the press-formability and the image sharpness after coating. As described before, the relation between the image sharpness after coating and the microscopic texture on the surface of steel sheet before coating is disclosed in JP-B-6-75728. According to the patent publication, the coating film itself acts as a low-pass filter to microscopic surface roughness profile, so the short-period roughness profile is buried by the coating film, which does not give influence on the image sharpness after coating. However, the long-period surface roughness profile of 100 ìm or longer wavelength is not covered-up by the coating, thus degrades the image sharpness. That kind of roughness component and waviness component, long-period components can be expressed by the filtered centerline waviness Wca defined in JIS B0610 (1987) and the like. According to a study of the inventors of the present invention, when the cut-off value of high-pass filter, for classifying is set to 0.8 mm, the value of Wca at 0.8 μm or less can assure favorable image sharpness after coating. This is the reason why the Embodiment 4-3 limits the value of Wca.

First, the description is given on the method for manufacturing galvanized steel sheet according to the present invention. Most suitable method for manufacturing galvanized steel sheet according to the present invention is to give high number density of concavities on the surface thereof by blasting fine solid particle against the surface of a galvanized steel sheet. The galvanizing is generally given by hot-dip galvanizing or electro-zinc plating. A plated steel sheet prepared by mechanically forming a zinc film thereon may also be applicable. Alternatively, a steel sheet subjected by temper rolling for adjusting mechanical properties or a steel sheet without treated by temper rolling may be applied. Furthermore, a steel sheet subjected to post-treatment such as chromate treatment may be applied.

Preferable solid particles being blasted against the surface of above-described steel sheet are steel balls or ceramics-base particles having particle sizes of from 1 to 300 μm, more preferably from 25 to 100 ìm. Applicable blasting unit includes an air shot-blasting unit that accelerates the blasting speed of solid particles using compressed air, and a mechanical accelerator that accelerates the blasting solid particles by centrifugal force. By blasting those solid particles against the surface of galvanized steel sheet at 30 to 300 m of blasting speed for a specified time, fine concavities are created on the surface of galvanized steel sheet at high number density thereof.

To attain high number density of concavities, it is ideal to create dimple-shaped concavities. The above-described blasting methods readily create dimple-shaped concavities on the surface of steel sheet. In this case, the solid particles are not necessarily in complete sphere.

Smaller solid particles form larger number density of concavities. Preferable range of blasting density of solid particles is from 0.1 to 40 kg/m$^2$ to assure blasting over the whole area of the galvanized steel sheet and to prevent peeling of zinc coating film. Furthermore, by ejecting compressed air against the steel sheet after creating the surface concavities, the solid particles are easily removed from the surface thereof.

The methods for adjusting surface texture of galvanized steel sheets disclosed in the related art are to apply temper rolling to transfer the surface roughness profile of the rolling roll onto the surface of steel sheets. The current technology of temper rolling, however, is difficult to attain the number density of concavities of $3.1\times10^2$ counts/mm$^2$ or more at the depth level corresponding to the 80% bearing area ratio, which is specified in the Embodiment 4-1. For example, the pitch of peaks and valleys of surface roughness profile on a galvanized steel sheet formed by temper rolling, disclosed in JP-A-11-302816, is around 0.11 mm. In this case, even when all of these concavities are those having the depth corresponding to the 80% bearing area ratio, the number density of the concavities is only at $8.3\times10$ counts/mm$^2$ level.

The method applying temper rolling to transfer the surface roughness of the rolling roll often adopts shot-blasting and electric discharge machining to the process for creating roughness on the roll. In this case, mainly profile valley portions are formed on the roll surface, and mainly profile peak portions are transferred to the surface of steel sheets. That type of difference in the transferred texture becomes a cause of failing in increasing the number density of deep concavities. The formation of roughness on the roll surface by laser and by electron beam also results in failing to drastically increase the number density of concavities, though the transferred texture slightly differs from that of above-described case. However, there is a possibility for those technologies to be improved in the future to attain the number density of the concavities satisfying the present invention even by the temper rolling.

The above-described methods are only a part of means to manufacture galvanized steel sheets that satisfy the present invention, and the manufacturing methods are not limited to those as far as the feature of the surface texture of the prepared steel sheets satisfy the present invention.

To evaluate the number density of the concavities, the three-dimensional profile on the sample surface has to be determined. The absolute value of the number density of concavities is, however, strongly influenced by the sampling intervals of the three-dimensional measurement, as is described in the above-given literature published by Penton Press. In addition, there has not been established standard methodology to define the sampling intervals. Furthermore, the absolute value of the number density of concavities is strongly influenced also by the mathematical method for identifying the concavities and by the method for treating noise emitted on determining the shape of the concavities. To eliminate those kinds of uncertainties, the detail of method for evaluating the number density of the concavities, herein given, is described in the following.

An electron beam three-dimensional roughness analyzer ERA-8800FE (manufactured by Elionix) was applied to determine the three-dimensional texture of the sample surface. The analyzer uses a principle in which four secondary electron detectors to detect the secondary electrons emitted from individual points in the observation area to compute the tilt angle at each observation point, thus reproducing the three-dimensional texture of the surface by integrating the obtained information about the tilt angle at each observation point. Considering that the analyzer detects secondary electrons, the surface of the sample was coated by several nanometers of thickness of gold by sputtering as the preliminary treatment to avoid accidental change in emissions of secondary electrons caused by local composition changes on the sample surface. To avoid disturbance of intensity distribution of secondary electrons caused by the magnetic field of the sample, the sample was demagnetized immediately before being set to the analyzer. On operating the analyzer, the acceleration voltage was set to 5 kV, the irradiation current to the sample was set to about 8 pA, the working distance was set to 15 mm, the randomly selected observation area on the sample surface was determined under the magnification of 250, determining total 270 thousand measuring points, including 600 points in X direction and 450 points in Y direction, thus conducted the three-dimensional measurement. The sampling interval under this condition was about 0.80 $\mu$m. For the calibration in height direction under the condition, there was applied the SHS thin film step standard (with four steps: 18, 88, 450, and 940 nm): standards manufactured by VLSI Standard Inc. for contact stylus and optical surface roughness analyzer, having traceable performance to the National Institute of Standards and Technology in the U.S.

The data obtained were analyzed by using "SUMMIT", the software for three-dimensional surface texture analysis, developed by Yanagi Laboratory of Nagaoka University of Technology. It is known that the electron beam three-dimensional roughness analyzer induces parabolic strain in the three-dimensional texture data collected in low magnification up to about X1000, which is caused by the electron beam scanning method. To this point, the data analysis was conducted by applying the quadrics regression to the gathered data, and by eliminating the strain left after the regression processing using a Spline high-pass filter having 240 $\mu$m of cutoff wavelength, then by computing the number density of the concavities and the core fluid retaining index Sci. For computing the number density of the concavities, first the influence of noise emitted during the measurement of three-dimensional surface texture was eliminated using a Spline low-pass filter having 10 $\mu$m of cutoff wavelength, then the depth corresponding to the 80% bearing area ratio was computed. As of the data in deeper zone than the depth level corresponding to the 80% bearing area ratio, a region of 31×31 points, or of 24×24 ìm square, was selected as the concavities identification region, and the number density was determined from the identified number of concavities and the total evaluation area. This region of concavity identification was selected to avoid over-evaluation.

From the point of determining representative values for a sample, the values of Sci and the number density of the concavities at 80% bearing level were determined by averaging the observed values of five areas randomly selected on each sample.

EXAMPLE 1

Cold-rolled steel sheets having 0.8 mm in thickness were treated by hot-dip galvanizing, and then were treated by temper rolling at 0.8% of extension. Thus these prepared galvanized steel sheets were used as the substrates. The blasting method described before was applied to the galvanized steel sheets to create the surface texture thereon.

The condition to create the surface texture according to the present invention is the following. The blasted solid particles were stainless steel particles having mean particle sizes of 55 $\mu$m and 110 $\mu$m, respectively, and high-speed steel particles having a mean particle size of 55 ìm. For the stainless steel particles, two blasting conditions were applied: (1) fixing the blasting density to 5.7 kg/m$^2$ for both mean particle sizes, while varying the blasting pressure in 3 steps, 0.1, 0.3, and 0.7 MPa, (hereinafter referred to as the First series); and (2) fixing the blasting pressure to 0.4 MPa, while varying the blasting density in 4 steps, 0.8, 2.4, 4.0, and 8.0 kg/m$^2$, (hereinafter referred to as the Second series). For the high-speed steel particles, only the Second series was applied.

Figure 60:
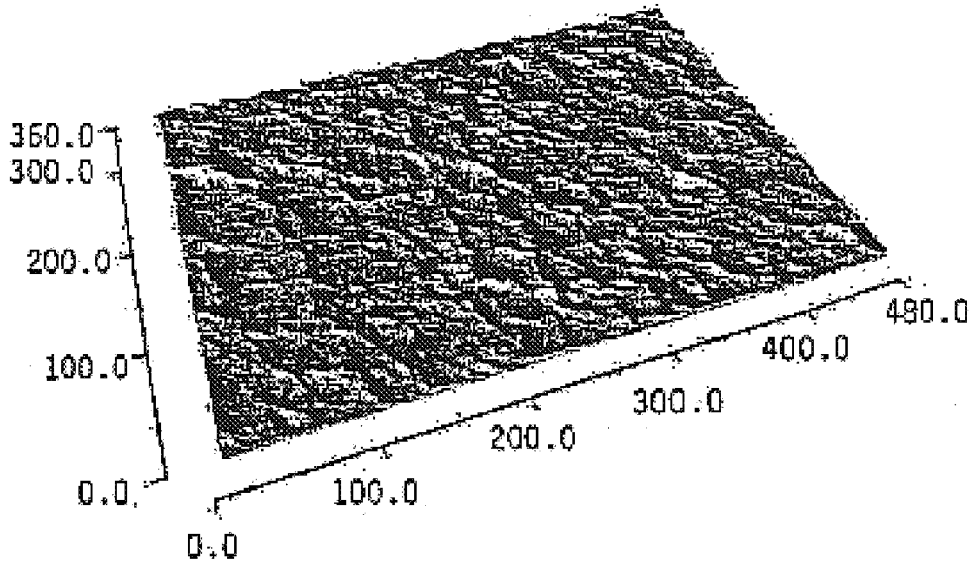
FIG. 60 shows the three-dimensional surface texture of galvanized steel sheet in the Embodiment 4.
Figure 61:
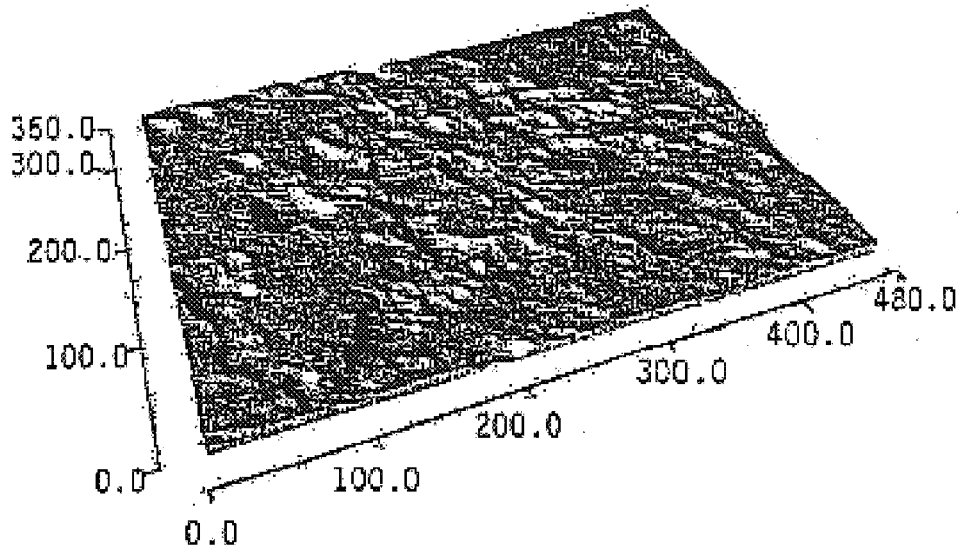
FIG. 61 shows the three-dimensional surface texture of galvanized steel sheet tempered by electrical discharge textured roll, as a comparative material, in the Embodiment 4.

FIG. 60 shows an example of the surface texture according to the present invention. This is a perspective view of the surface texture determined by the above-described electron beam three-dimensional roughness analyzer. The surface texture was created by blasting stainless steel particles, having a mean particle size of 55 ìm, at 0.4 MPa of blasting pressure and blasting density of 2.4 kg/m$^2$ against the above-described temper-rolled galvanized steel sheet. Large number of fine dimple-shaped concavities are formed on the surface of the galvanized steel sheet by collision of the solid particles. As a comparative example, FIG. 61 shows a perspective view of surface texture created on a galvanized steel sheet which was tempered by electrical discharge textured rolls. This surface shows a characteristic shape of a series of relatively wide flat-portions.

For investigating the sliding characteristics on thus prepared surface texture according to the present invention, friction factor was measured by the flat sheet sliding test on the above-described galvanized steel sheets, as well as four galvanized steel sheets textured by the conventional temper rolling method. The measuring device and condition are described below.

Figure 62:
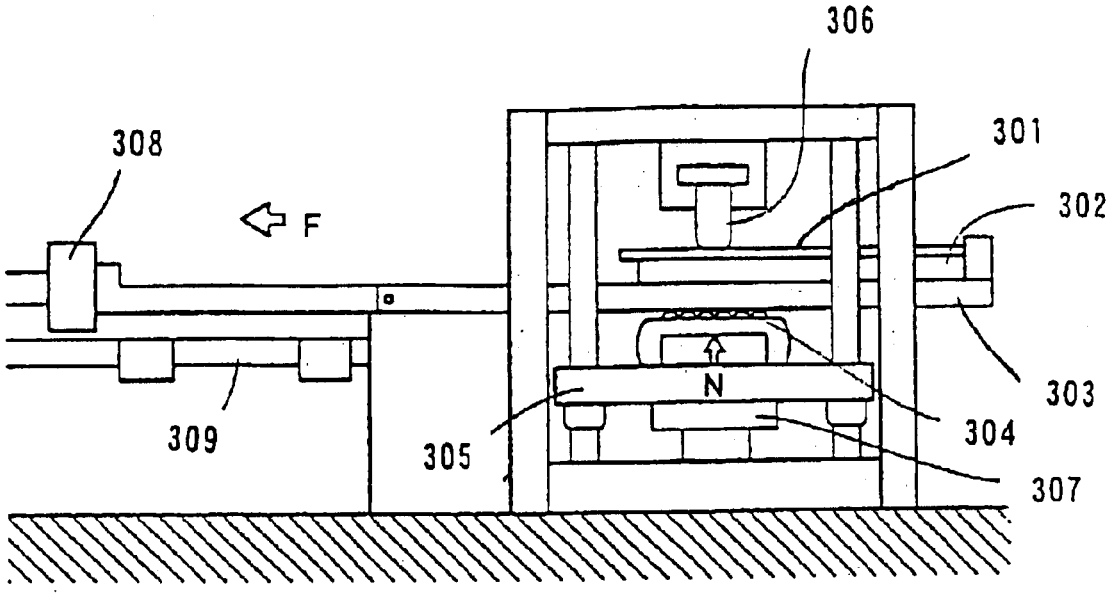
FIG. 62 shows front view of the friction factor tester.

FIG. 62 shows a front view of the friction factor tester. A sample 301 for determining the friction factor is fixed on a sample table 302. The sample table 302 is fixed on a slide table 303 which is movable in horizontal direction. A slide table holder 305 which is movable in vertical direction is positioned beneath the slide table 303, and has a roller 304 which contacts with the slide table 303. The slide table 305 is equipped with a first load cell 307 which determines the pressing load N generated when the slide table holder 305 is ascended to make a bead 306 press the sample 301 for determining the friction factor. The slide table 305 is also equipped with a second load cell 308 which is attached to an end of the slide table 303 to determine the slide resistance force F that drives the slide table 303 in horizontal direction in a state that the above-described pressing force is applied. The test was conducted after applying cleaning oil (PRETON R352L, manufactured by Sugimura Chemical Co., Ltd.) on the surface of the sample 301.

Figure 63:
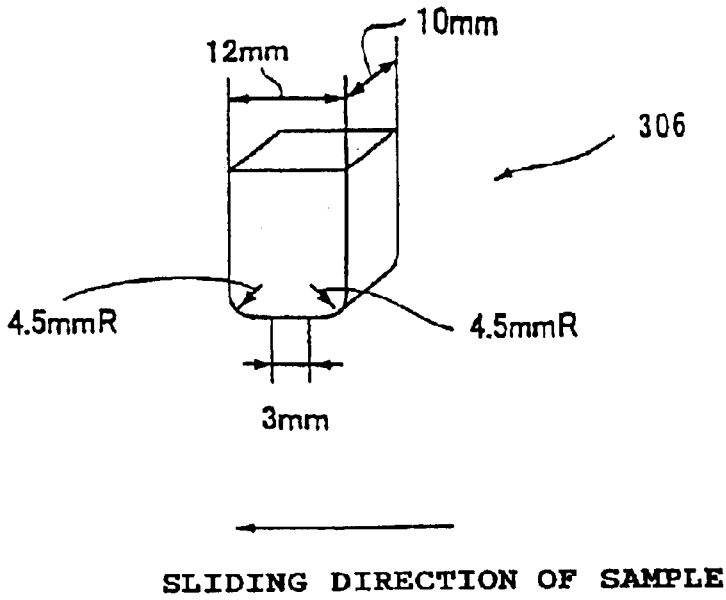
FIG. 63 shows the shape and the dimensions of a bead used for determining the friction factor under "A" condition (high speed and high face pressure condition).
Figure 64:
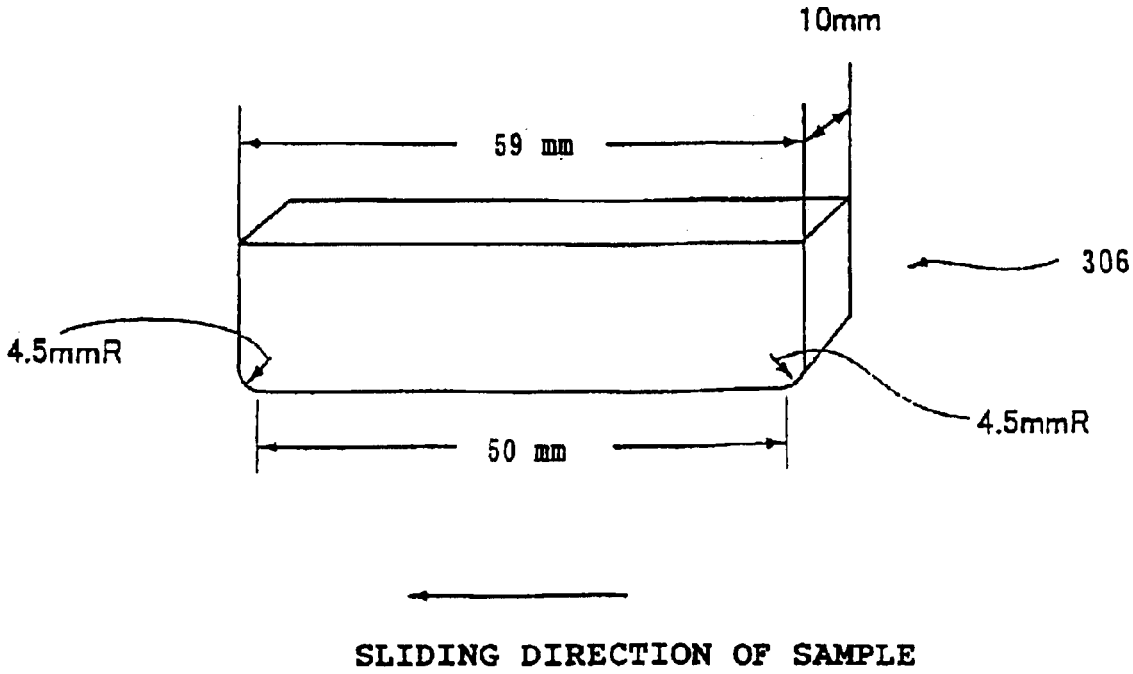
FIG. 64 shows the shape and the dimensions of a bead used for determining the friction factor under "B" condition (low speed and low face pressure condition).

FIG. 63 and FIG. 64 show rough perspective views of the applied beads, giving shape and dimensions thereof. The bead 306 slides in a state of pressing the bottom face thereof against the surface of the sample 301. The bead 306 shown in FIG. 63 has 10 mm of width, 12 mm of length in the sliding direction of the sample, and 4.5 mm of radius of curvature at the bottom portion of both ends in the sliding direction. The bottom face of the bead, which is pressed against the sample is in flat face having 10 mm of width and 3 mm of length in the sliding direction. The bead 306 shown in FIG. 64 has 10 mm of width, 59 mm of length in the sliding direction of the sample, and 4.5 mm of radius of curvature at the bottom portion of both ends in the sliding direction. The bottom face of the bead, which is pressed against the sample is in flat face having 10 mm of width and 50 mm of length in the sliding direction.

The test for determining friction factor was conducted under two conditions given below.

("A" Condition)

The bead given in FIG. 63 was applied under the condition of 400 kgf of pressing load N and 100 cm/min of sample withdrawal speed (horizontal speed of the slide table 303). This high speed and high face pressure condition was adopted to grasp the sliding characteristics at peripheral area of bead section under pressing action.

("B" Condition)

The bead given in FIG. 64 was applied under the condition of 400 kgf of pressing load N and 20 cm/min of sample withdrawal speed (horizontal speed of the slide table 303). This low speed and low face pressure condition was adopted to grasp the sliding characteristics at punch face and at crease-holding section under pressing action, and to grasp the influence of adhesion.

The friction factor $\mu$ between the sample and the bead was calculated using the formula:

$$\mu = F/N$$

Figure 65:
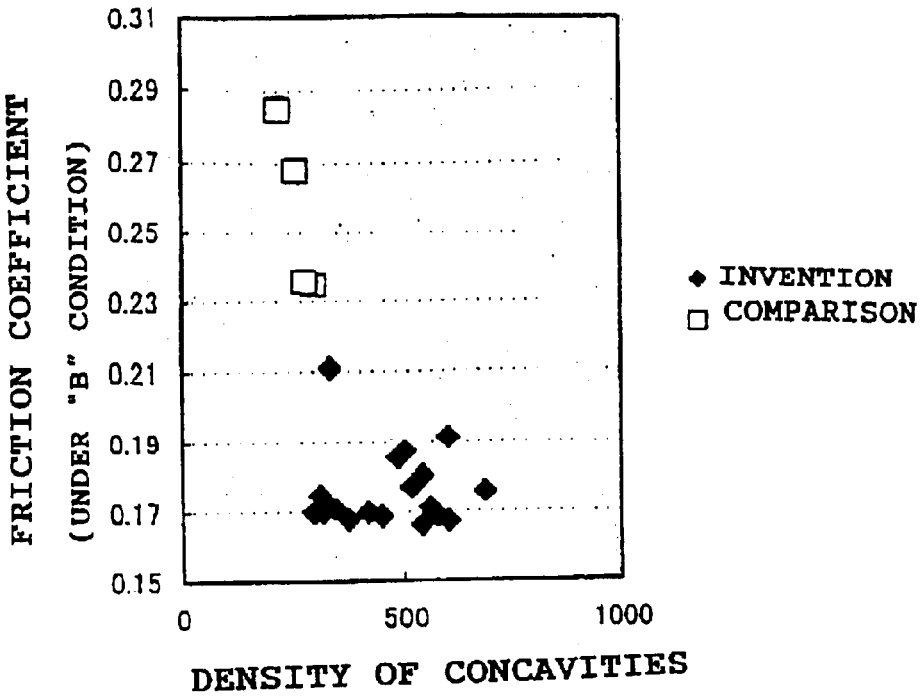
FIG. 65 shows the relation between the number density of concavities at 80% bearing level and the friction factor under the "B" condition on an example material and a comparative material in the Embodiment 4.
Figure 66:
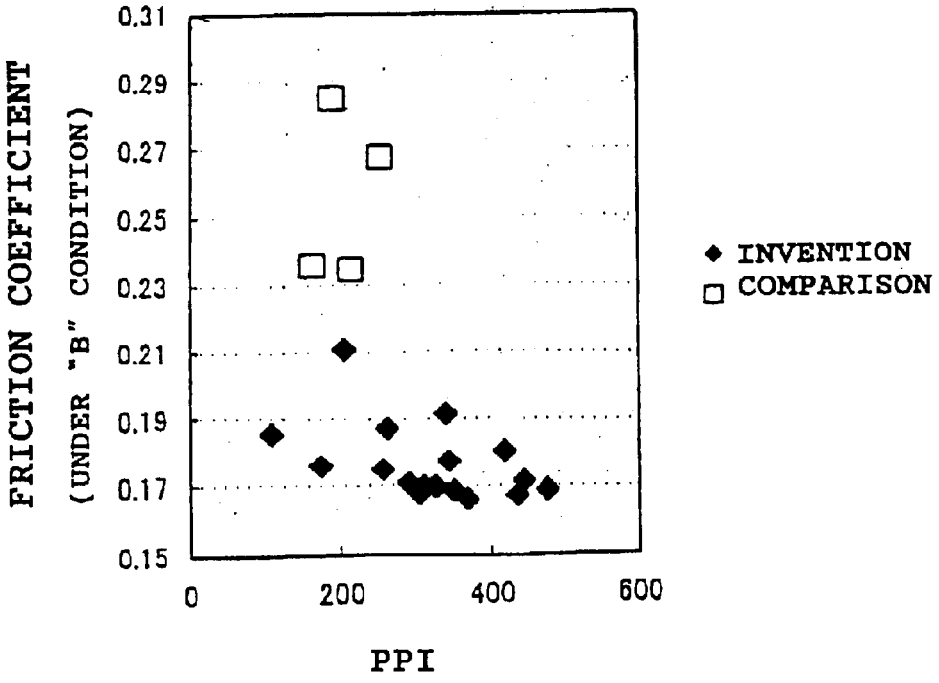
FIG. 66 shows the relation between the PPI and the friction factor under the "B" condition on an example material and a comparative material in the Embodiment 4.

FIG. 65 shows the relation between the number density of the concavities at 80% bearing level (hereinafter referred to as the number density of concavities) and the friction factor under the "B" condition. Independent of the material according to the present invention and that of comparative example, the friction factor under the "B" condition significantly depends on the number density of the concavities, and decreases to almost critical level at around 300 counts/mm$^2$. FIG. 66 shows another correlation between the PPI values, measured by conventional contact stylus roughness meter at count level of ±0.635 $\mu$m, and the same friction factor. The overall tendency is close to that of FIG. 65. However, in a low PPI range, the difference of friction factor between the material according to the present invention and that of comparative example cannot be explained. This difference in the dependency between the number density of the concavities and the PPI is described before.

Figure 67:
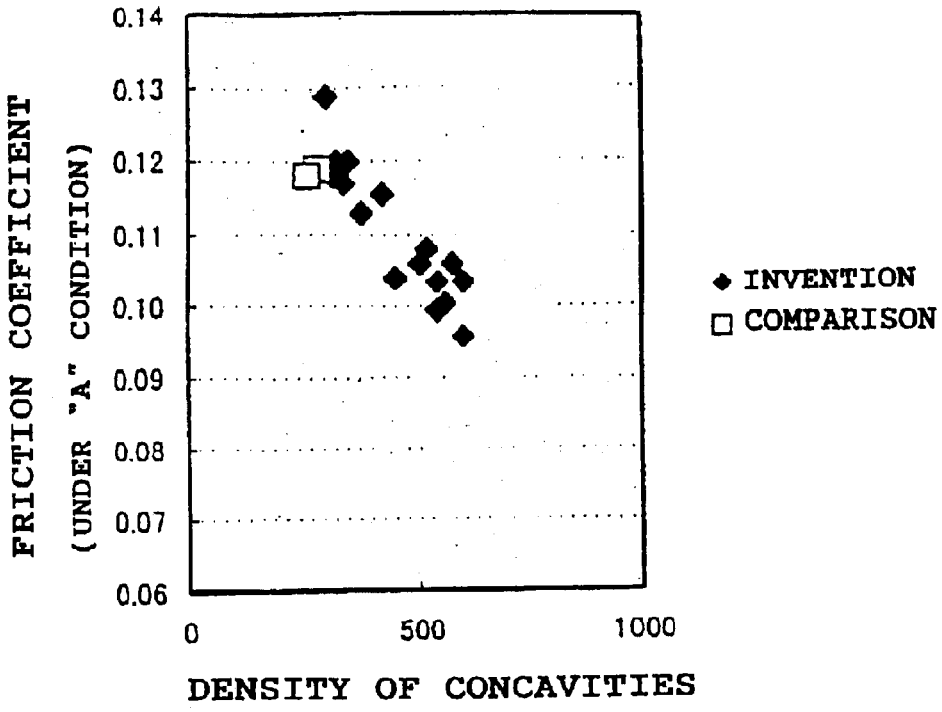
FIG. 67 shows the relation between the number density of concavities at 80% bearing level and the friction factor under the "A" condition on an example material and a comparative material in the Embodiment 4.
Figure 68:
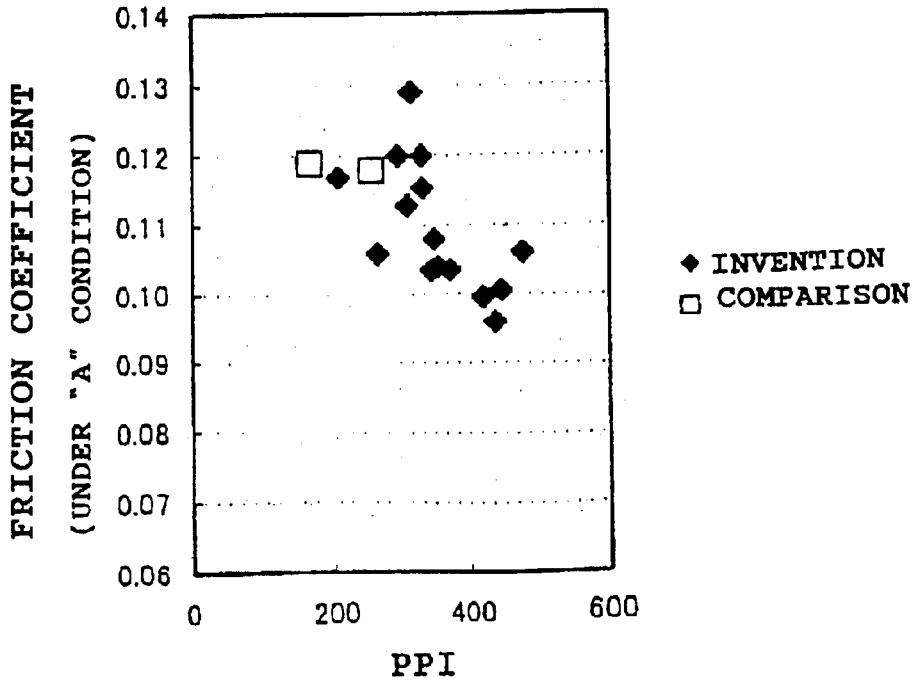
FIG. 68 shows the relation between the PPI and the friction factor under the "A" condition on an example material and a comparative material in the Embodiment 4.

FIG. 67 shows the relation between the number density of the concavities and the friction factor under the "A" condition. The figure shows distinct dependency on the number density. Generally, under the "A" condition, a high speed and high face pressure condition, the influence of surface texture of sample hardly appears. This is presumably because the surface texture is significantly damaged during the sliding test. For the case of material according to the invention, however, the given result is attained presumably because the fluid friction region is maintained even in that severe sliding process. FIG. 68 shows the PPI expression of the same friction factor. Even in the PPI expression, similar tendency with that in the expression by the number density observed. At 300 or lower PPI, however, the difference between the material according to the present invention and that of comparative example becomes unclear.

Figure 69:
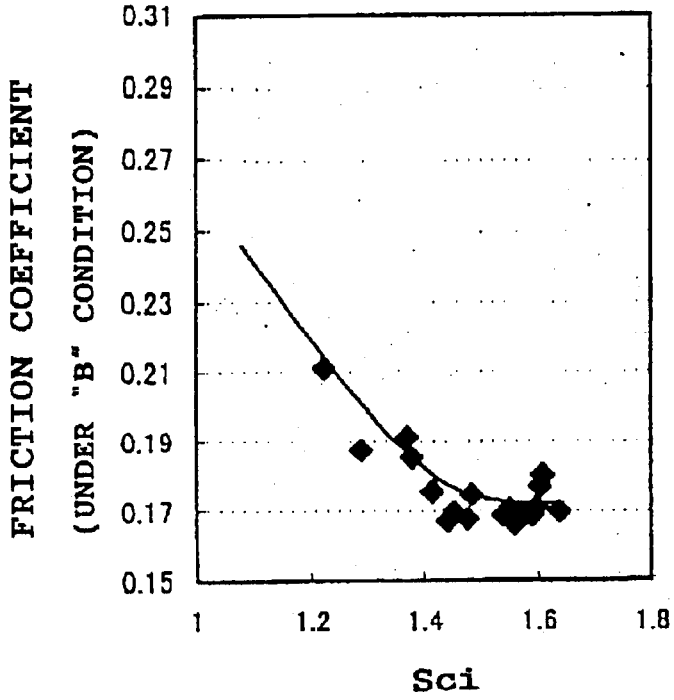
FIG. 69 shows the relation between the friction factor under the "B" condition and the core fluid retention index Sci at core in the Embodiment 4.

FIG. 69 shows the relation between the friction factor and the core fluid retaining index Sci under the "B" condition for the material according to the present invention. In a state that the improving effect of the number density of the concavities nearly saturates, observed in FIG. 65, there appears a tendency of reduction in friction factor with the increase in Sci value. The tendency is presumably caused by the existence of the correlation between the oil film area and the friction factor, which was described before.

Figure 70:
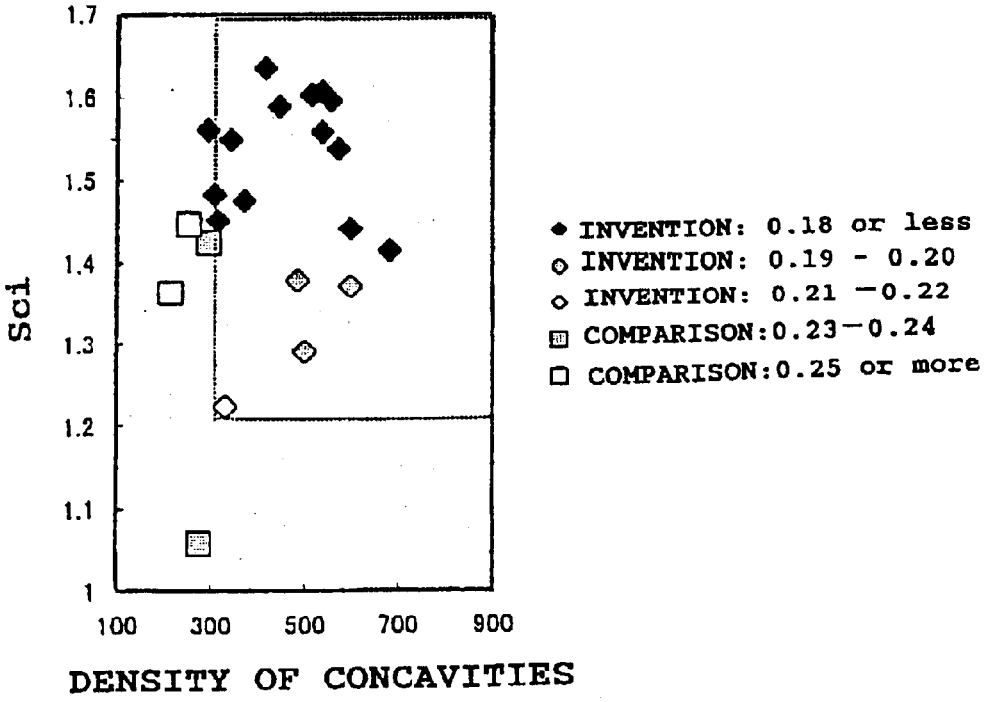
FIG. 70 is a graph showing the friction factor under the "B" condition in relation with the number density of the concavities and the Sci for an example material and a comparative material in the Embodiment 4.

FIG. 70 is a graph showing the friction factor in relation with the number density of the concavities and the Sci under the "B" condition for the material according to the present invention and that of comparative example. As seen in the figure, both the material according to the present invention and that of comparative example have strong dependency of the friction factor on the number density of the concavities. However, at the same level of the number density, increased Sci value decreases the friction factor, and, particularly within the domain enclosed by the rectangle in the figure, the friction factor can be maintained to 0.22 or smaller level, which level cannot be attained either by galvanized steel sheets on which the surface texture was formed by the temper rolling method or by ordinary galvaneal steel sheets. Consequently, the material according to the present invention provides galvanized steel sheets that have drastically superior sliding characteristics to those of conventional galvanized steel sheets.

EXAMPLE 2

Galvanized steel sheets were prepared applying the method described in the Embodiment 4, while varying the kind, particle size and blasting speed of the blasting particles. The relation between the image sharpness after coating and the waviness of sample was investigated.

As for the evaluation method of image sharpness, PB-L3080 manufactured by Nihon Parkerizing Co., Ltd. was used to give chemical conversion treatment to the sample, then three layer coating was applied: ED coating, intermediate coating, and top coating, using "EI-2000", "TP-37 Gray", and "TM-13(RC)", manufactured by Kansai Paint Co., Ltd., respectively. The NSIC value of thus coated specimen was measured by the "Image Sharpness Tester NSIC Model" manufactured by Suga Test Instrument Co., Ltd. to evaluate the image sharpness after coating. The NISC value has an index of 100 on a black polished glass plate, and the value nearer to 100 means more preferable image sharpness.

Figure 71:
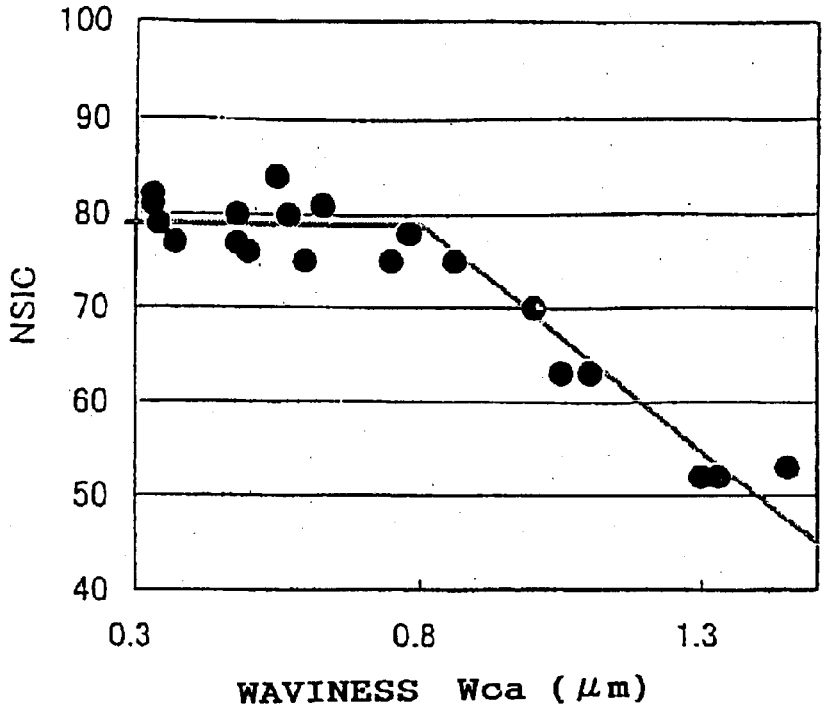
FIG. 71 shows the relation between the filtered centerline waviness Wca and the image sharpness after coating on galvanized steel sheets of the present invention in the Embodiment 4.

FIG. 71 shows the relation between the filtered centerline waviness Wca and the image sharpness after coating on the galvanized steel sheets prepared from the material according to the present invention. As shown in the figure, decrease in Wca value improves the image sharpness. If the Wca value is at or smaller than 0.8 $\mu$m, favorable image sharpness is attained.

Consequently, if the waviness Wca is at or smaller than 0.8 $\mu$m, the image sharpness after coating is improved while maintaining the favorable press-formability.

Embodiment 5

The galvanized steel sheet according to the Embodiment 5 has the features of:

(1) a galvanized steel sheet having excellent press-formability, wherein the surface of the galvanized steel sheet has a solid lubrication film having mean thickness ranging from 0.001 to 2 μm, and the solid lubrication film is made of either one of an inorganic solid lubrication film, an organic solid lubrication film, and a composite film of organic-inorganic solid lubrication film, the surface texture of the solid lubrication film has dimple-pattern texture;

(2) a galvanized steel sheet of (1), having excellent press-formability, wherein the mean roughness Ra of the surface thereof is in a range of from 0.3 to 3 μm;

(3) a galvanized steel sheet of (1) or (2), having excellent press-formability, wherein the peak count PPI is in a range given by the formula of $$-50\times Ra(\mu m)+300<PPI<600$$

(4) a galvanized steel sheet of either one of (1) through (3), having excellent press-formability, wherein the waviness Wca of the galvanized steel sheet is 0.8 μm or less;

(5) a galvanized steel sheet of either one of (1) through (4), having excellent press-formability, wherein the coating film consists mainly of η phase;

(6) a galvanized steel sheet of either one of (1) through (5), having excellent press-formability, wherein the solid lubrication film of (1) is a phosphorus-base oxide film prepared by applying and drying an aqueous solution containing phosphoric acid and at least one cationic component selected from the group consisting of Fe, Al, Mn, Ni, and $NH_4^+$;

(7) a galvanized steel sheet of either one of (1) through (6), having excellent press-formability, wherein the aqueous solution further contains oxycarboxylic acid; and (8) a method for manufacturing a galvanized steel sheet of either one of (1) through (7), having excellent press-formability, containing the steps of: blasting solid particles against the surface of steel sheet and/or galvanized steel; and applying a solid lubrication film having mean thickness ranging from 0.001 to 2 μm, being made of either one of an inorganic solid lubrication film, an organic solid lubrication film, and a composite film of organic-inorganic solid lubrication film.

The first feature of the Embodiment 5 is that the surface of galvanized steel sheet has dimple-pattern texture and that the galvanized steel sheet has a solid lubrication coating film having mean thickness ranging from 0.001 to 2 μm, being made of either one of an inorganic solid lubrication film, an organic solid lubrication film, and a composite film of organic-inorganic solid lubrication film. The term "dimple-pattern" referred herein designates a texture that the surface profile valley portion is formed mainly by a curved face, and that large number of concavities in a shape of crater are created when spherical objects collide against the surface. With the large number of dimple-shape concavities, the concavities play a role of pockets for oil of press-forming, thus improving the oil-retainability between the mold and the steel sheet.

Furthermore, for the case of dimple-pattern surface texture, even if the coating layer deforms during sliding action of the sheet, the oil within a dimple becomes hardly leave therefrom, and the oil surely remains in each of dispersed dimples, so the oil film does not break to allow for the mold to slide on the coated steel sheet. To the contrary, with the surface texture of conventional coated steel sheet prepared by transferring the texture of rolling roll surface, each of the concavities is not necessarily in a closed circle shape, so the oil is hardly retained, and the break of oil film likely occurs.

Adding to the above-described specific film texture of dimple-pattern, the steel sheet according to the present invention has a solid lubrication film having mean thickness ranging from 0.001 to 2 μm, being made of either one of an inorganic solid lubrication film, an organic solid lubrication film, and a composite film of organic-inorganic solid lubrication film.

At a portion giving high face pressure and long sliding distance, the deformation of coating film caused by sliding increases, which results in difficulty to attain the effect of oil reservoir under the control of surface texture. To this point, in the case that the coating film having lubrication performance, according to the present invention, for example, the adhesion between the mold and the coating layer is suppressed, thus suppressing the coating layer deformation induced by the adhesion. As a result, the high oil-retaining effect owing to the dimple-pattern surface texture specified by the present invention sustains also under the severe press-forming condition such as high mold face pressure or long sliding distance, thus the excellent lubrication characteristics are attained. Thus attained level of the lubrication is far superior to the case of solely giving a solid lubrication film or solely giving a surface texture controlling.

A presumable reason is that the effect of adhesion prevention owing to the lubrication film sustains the high oil-retaining effect by keeping the dimple-pattern surface texture, which further suppresses the adhesion, or the synergy effect of both of them.

The applied coating film is preferably covers the surface uniformly to a degree not to change the controlled surface roughness. The surface texture which is specified by the present invention is the one existing after applying the solid lubrication film, so the lubrication film is not required to uniformly cover the surface. If the lubrication film is coated not-uniformly, the surface of galvanized steel sheet or the surface texture of the substrate sheet for coating may be controlled to assure the surface texture after coating at a specified level.

As for the thickness of solid lubrication film, 0.001 to 2 μm of mean thickness is preferred. If the thickness is less than 0.001 μm, the effect of solid lubrication film is not satisfactory, and the effect on the press-formability cannot be attained. If the thickness exceeds 2 μm, the lubrication film becomes excessively thick, which results in difficulty to attain the surface texture specified by the present invention, such as dimple-pattern surface texture, to assure sufficient effect, and the effect to the press-formability also degrades.

The term "mean thickness" referred herein signifies the thickness calculated from the weight of film per 1 $m^2$ area using a specific gravity, when the specific gravity of the solid lubrication film is known. If the specific gravity of the film is unknown, cross section of the film is observed using a scanning electron microscope (SEM), a transmission electron microscope (TEM), or the like to select 10 points at equal intervals and to directly determine the film thickness at these 10 points, then averaging these observed thicknesses to define the mean thickness. For an oxide layer, Auger Electron Spectroscopy or the like is applied to determine the depth directional oxide components and the depth directional profile of the coating film components such as zinc. The interface between the oxide layer and the coating layer is defined at the place where the coating film components such as zinc become half that of the bulk material. The relation between the sputtering time and the thickness is determined in advance. Then, the film thickness is calculated from the sputtering time. In this case, similar with above, 10 points are selected at an equal interval in a specified length (100 mm), and the film thickness of each point is determined by Auger Electron Spectroscopy, then the average of these 10 data is defined as the mean thickness.

The method for forming the solid lubrication film is not specifically limited. A steel sheet is brought into contact with a treatment solution containing a film-forming component by immersing, spraying, or other method, then is washed with water or without washed to dry thereof, thus forming the solid lubrication film. Alternatively, a treatment solution containing a film-forming component is directly applied to the steel sheet, and dried or baked without washing water to form the solid lubrication film. Further washing with water after applied the solution may be added. Other than those treatments, the film may be formed by electrolytic treatment in a treatment solution containing a film-forming component using zinc-base coated steel sheet as an anode or a cathode.

The solid lubrication film formed in the Embodiment 5 may be either one of inorganic-base, organic-base, and organic-inorganic composite-base film. Applicable inorganic-base film includes silicon oxide-base film, phosphate-base film, chromate-base film, borate-base film, and metal oxide film such as that of Zn, Mg, Al, Ca, Ti, V, Mn, Fe, Co, Ni, Zr, Mo, and W. These films may further contain Zn which is an ingredient of zinc-base coating layer. Applicable Si oxide-base film contains silicate film prepared by applying and drying silica sol, lithium silicate, or water glass. Phosphoric acid-base film is formed by bring the coated steel sheet contact with an aqueous solution containing phosphoric acid, zinc nitrate, nitrate or carbonate of fluoric acid, nickel, or manganese, at a specified amount, by immersing, spraying, or other method, followed by washing with water. Alternatively, the film may be formed by directly applying the aqueous solution onto the coated steel sheet, followed by drying. The chromate film may be the one prepared by applying a treatment solution containing an aqueous solution consisting mainly of chromic acid and further containing additives such as phosphoric acid, silica sol, and water-soluble resin, onto the coated steel sheet, and then drying the applied film, or, the coated steel sheet is brought into contact with the treatment solution by immersing, spraying, or other method, followed by washing with water. Applicable boric acid-base film includes a film prepared by applying aqueous solution of sodium tetraborate onto the coated steel sheet, followed by drying. Applicable metal oxide film includes a film structured by a composite of metal and oxide of nickel and iron oxide, and a film containing manganese oxide and phosphoric acid. These films are prepared by immersing a coated steel sheet in an aqueous solution of a mixture of metallic ingredients such as nickel, iron, and manganese, and oxidizing agent component such as nitric acid and permanganate, followed by washing with water, or, by applying electrolysis in the aqueous solution using the coated steel sheet as the anode.

Applicable organic film includes a film containing matrix resin of organic polymer having OH-group and/or COOH-group, which matrix resin further contains a solid lubrication agent. Examples of the organic polymer resin containing matrix resin with OH-group and/or COOH-group are epoxy resin, polyhydroxy-polyether resin, acrylic-base copolymer resin, ethylene-acrylic acid copolymer resin, alkyd resin, polybutadiene resin, phenol resin, polyurethane resin, polyamine resin, polyphenylene resin, and mixture or addition polymerization product of two or more of these resins. Examples of solid lubrication agent compositing to the matrix resin are polyolefin wax, paraffin wax (for example, polyethylene wax, synthesized paraffin, natural paraffin, micro-wax, and chlorinated hydrocarbon), fine particles of fluororesin (for example, polyfluoroethylene resin (such as polytetrafluoroethylene resin), polyvinylfluoride resin, polyvinylidene fluoride resin). Further applicable solid lubrication agent includes fatty acid amide-base compound (for example, stearic acid amide, palmitic acid amide, methylene-bis-stearoamide, ethylene-bis-stearoamide, oleic acid amide, and alkylene-bis-fatty acid amide), metallic soap (for example, calcium stearate, lead stearate, calcium laurate, and calcium palmitate), metal sulfide (such as molybdenum disulfide and tungsten disulfide), graphite, graphite fluoride, boron nitride, polyalkyleneglycol, and sulfate of alkali metal. As of these solid lubrication agents, polyethylene wax and fine particles of fluororesin are most preferable.

The solid lubrication film may be an organic-inorganic composite film in which the above-described organic film further contains inorganic ingredient such as silica and phosphoric acid.

Particularly high press-formability is attained with a solid lubrication film of phosphorus-base oxide, which film is prepared by applying an aqueous solution containing phosphoric acid and one or more of cationic ingredient selected from the group consisting of Fe, Al, Mn, Ni, and $NH_4$, followed by drying. The reason of attaining that high press-formability is that the phosphoric acid forms a superior inorganic network film and that the cationic ingredient such as Fe, Al, Mn, Ni, and $NH_4$ exists in the applying aqueous solution, so that the reactivity of the aqueous solution becomes small compared with the case of sole phosphoric acid. Owing to the advantage, excessive crystalline component formation caused by the reaction between the phosphoric acid ingredient and zinc is suppressed during the applying stage, thus allowing forming a uniform thin film. As a result, the film can uniformly cover the zinc-coated layer, which is particularly effective in suppressing the adhesion of zinc and mold.

The press-formability and the performance of chemical conversion treatment applied as surface treatment before coating are further improved when the above-described aqueous solution to form solid lubrication film further contains an organic component such as oxycarboxylic acid. Generally, manufacturing process of automobiles and the like includes degreasing step, coating step, and the like after the press-forming step. The presence of solid lubrication film may give bad influence in the coating step after the press-forming step. Although the chemical conversion treatment given in the treatment before coating needs the reaction between the zinc-coating and the chemical conversion solution, the presence of solid lubrication film prevents the reaction. Accordingly, when an organic component such as oxycarboxylic acid exists, the solid lubrication film is likely separated in the degreasing step, so the film remains very little in succeeding steps and gives no bad influence. As of the oxycarboxylic acids, citric acid is particularly effective.

Even when the film-separation is not sufficient, existence of Fe as the cationic component is particularly preferred because the chemical conversion performance is improved.

Applicable aqueous solution used for forming the solid film may be an aqueous solution containing normal orthophosphoric acid and various kinds of metallic cations, an aqueous solution of dihydrogen phosphate, and an aqueous solution of mixture of orthophosphoric acid and metallic salt such as sulfate.

Further detail description of the process to form solid lubrication film is given below.

Galvanized steel sheet is controlled in the surface texture thereof by blasting solid particles. Then, a solid lubrication film is formed on the surface thereof by immersion treatment, spray treatment, coating treatment, or the like. Before forming the solid lubrication film, other treatment such as activation treatment may be given. Applicable activation treatment includes immersion in and spray of alkaline aqueous solution or acidic aqueous solution.

Applicable method for coating on a zinc-base plated steel sheet is arbitrarily selected, such as applying method, immersing method, and spraying method. The coating method may be roll coater method (3-roll type, 2-roll type, and the like), squeeze coater method, or die coater method. The coating treatment using a squeeze coater or the like, the immersion treatment or the spray treatment may further be given by air-knife method or roll-squeeze method to adjust the coating weight, to uniformize the appearance, and to uniformize the film thickness. After applied the treatment solution, normally heating to dry is given without washing with water. Nevertheless, washing with water after coating may be given to remove water-soluble components from the film. Heating to dry treatment may be conducted by a drier, a hot-air furnace, a high frequency induction heating furnace, an infrared furnace, and the like. The heating treatment is preferably conducted at ultimate sheet temperatures of from 50 to 200° C., more preferably from 50 to 140° C. If the heating temperature is below 50° C., the soluble components in the film are left at large quantity, which likely induces stain on the surface. If the heating temperature exceeds 140° C., the treatment becomes not economical.

The temperature of film-forming solution is not specifically limited. However, the temperature is preferably in a range of from 20 to 70° C. If the temperature of film-forming solution is below 20° C., the stability of the solution degrades. If the temperature exceeds 70° C., the facility and the thermal energy for holding the film-forming solution at a high temperature level increase, which increases the production cost.

The second feature of the Embodiment 5 is to specify the mean roughness Ra on the galvanized steel sheet to a range of from 0.3 to 3 μm. If the mean roughness Ra is less than 0.3 μm, the oil-retainability between the steel sheet and the mold becomes insufficient, which likely induces die-galling during the press-forming stage. The phenomenon becomes significant when the zinc coating film is soft. If the mean roughness Ra is large, the oil-retainability between the steel sheet and the mold increases to increase the volume of oil introduced to interface. In that case, however, contact load is concentrated on the profile peak portions of the surface roughness texture, thus the break of oil film likely occurs caused by the friction heat at the contact portions. As a result, local die-galling is generated to cancel the improvement in oil-retainability. Therefore, the Embodiment 6 specifies the upper limit of mean roughness Ra to 3 μm as a range not to induce die-galling originated from large peak portions of surface roughness texture. The term "mean roughness" referred herein designates the Ra defined in JIS B0601.

The third feature of the Embodiment 6 is that the peak count PPI satisfies the formula:

$$-50\times Ra(\mu m)+300<PPI<600$$

The term "peak count" referred herein signifies the number of peaks of roughness profile per 1 inch length, which is defined in SAE911. The above-given peak count PPI is expressed by the value at ±0.635 μm of count level.

For the case of large peak count, the contact state between the galvanized steel sheet and the mold during press-forming stage differs from the case of simply increasing the mean roughness. That is, larger peak count gives larger number of profile peak portions contacting with the mold, under the same mean pressure, and the deformation of individual profile peak portions decreases. In other words, contact of large number of profile peak portions with the mold degreases the load burdened by individual profile peak portions. Since the friction heat generated at contact portions between the profile peak portions and the mold is dispersed compared with the case of large profile peak portions, the temperature increase at each contact interface is suppressed. Since the temperature rise at the contact portions leads to microscopic break of oil film existing at interface, the friction factor increases to further increase the friction heat at contact portions, which is a vicious cycle.

Consequently, the press-formability can be improved by forming short pitch of peaks and valleys of roughness profile on the surface of galvanized steel sheet, even with the same mean roughness. Furthermore, even when the mean roughness is small, equivalent or superior press-formability is attained, so the mean roughness is not a variable to degrade the image sharpness after coating.

The Embodiment 5 specifies the lower limit of peak count PPI on galvanized steel sheet on the concept described above. On the other hand, the Embodiment 5 specifies the upper limit of peak count PPI to 600. The maximum value of peak count observed during carrying out the present invention is 600. Thus, it is expected that higher value of peak count may provide more preferable result. Nevertheless, the upper limit of 600 is adopted because there is no economical means to realize above 600 of peak count PPI.

The fourth galvanized steel sheet according to the Embodiment 5 has a feature of 0.8 μm or lower waviness Wca. The galvanized steel sheets for automobile use or the like need to assure the image sharpness after coating as well as the press-formability. Regarding the image sharpness after coating, the short-period roughness profile on the surface is buried during the undercoating step or the like to give no bad influence on the image sharpness after coating, but the long-period roughness profile remains after the coating to degrade the image sharpness. In this case, the waviness Wca has a close relation with the image sharpness after coating. The term "waviness Wca" referred herein signifies the centerline waviness specified in JIS B0610, and represents the mean height of roughness profile after treated by high-pass cutoff. For improving the image sharpness after coating, the long-period roughness profile components are requested to be reduced. By regulating the waviness Wca to 0.8 μm or less, the image sharpness after coating is assured. Consequently, increased mean roughness creates large roughness profile on the surface of steel sheet, which solves the problem of degrading the image sharpness after coating.

The fifth galvanized steel sheet according to the Embodiment 5 is the one having a coating film consisting mainly of η phase. For the case that the coating film consists mainly of η phase, the coating film itself is soft and the melting point is low compared with that of alloyed hot-dip galvanized steel sheet, so the adhesion likely occurs during press-forming stage. Therefore, the mean roughness to be formed on the surface is requested to be large, thus providing stronger effect than that of the related art.

The control method of surface texture of galvanized steel sheet according to the Embodiment 5 is described below. The first method for manufacturing the galvanized steel sheet according to the Embodiment 5 is preferably to form roughness profile on the surface of a steel sheet which was prepared by galvanizing on a substrate steel sheet, by blasting fine solid particles against the surface thereof, followed by forming a solid lubricant film thereon, or to form roughness profile on the surface thereof after forming the solid lubrication film. For the case that the surface roughness profile is created by blasting solid particles against the surface of steel sheet before forming the solid lubrication film, the blasting condition and other variables may be controlled to obtain specified surface texture on the lubrication film succeedingly formed.

The zinc coating is generally hot-dip galvanizing or electro-zinc plating. However, a plated steel sheet prepared by mechanically forming a zinc film may be applied. Alternatively, temper rolling may be applied to adjust the mechanical properties on the steel sheet, or a non-temper-rolled steel sheet may be used. Furthermore, a steel sheet subjected to a post-treatment such as chromate treatment may be used.

The solid particles to be blasted against the galvanized steel sheet are preferably steel balls or ceramics-base particles having 1 to 300 $\mu$m of particle size, more preferably 25 to 100 $\mu$m thereof. Applicable blasting unit includes air-drive shot blasting unit which accelerates the solid particles by compressed air or mechanical acceleration unit which accelerates the solid particles by centrifugal force. By blasting those kinds of solid particles at blasting speeds of from 30 to 300 m/s against the galvanized steel sheet for a specified period, fine roughness profile on the surface can be formed on the surface of the galvanized steel sheet.

The solid particles are not required to be in complete sphere, and may be of polyhedron. When spherical solid particles are blasted, dimple-shape concavities are formed on the surface of galvanized steel sheet. Smaller the solid particles to be blasted provide shorter pitch of peaks and valleys o surface roughness profile and larger peak count. As for the quantity of basting solid particles, preferable range thereof is from 0.1 to 40 kg/m$^2$, which range assures the blasting of particles over the whole surface of the galvanized steel sheet while avoiding peeling of the zinc coating film. Furthermore, by ejecting compressed air against the steel sheet having thus formed surface roughness profile, the solid particles can easily be removed from the surface.

The second method for manufacturing a galvanized steel sheet according to the Embodiment 5 is to blast slid particles against the steel sheet which was worked to a certain sheet thickness by hot-rolling or cold-rolling, thus forming surface roughness profile, similar with the method described above, followed by galvanizing thereon. The substrate steel sheet is generally the one which was treated by rolling followed by annealing, or by temper rolling. To increase the strength, a not annealed steel sheet may also be applied. To that type of steel sheet, similar method as described above can be applied to give surface roughness profile. When the steel sheet uses not-annealed material or hard material, the surface roughness profile is adjusted by increasing the blasting speed of solid particles compared with the above-given condition. The zinc coating applied to thus obtained steel sheet is preferably electro-zinc plating. Hot-dip galvanization may, however, also be applicable.

The methods for preparing the surface of galvanized steel sheet, disclosed in the related art, are to transfer the surface roughness by temper rolling. In these cases, it is practically difficult to attain 250 or higher peak count PPI. For example, the pitch of peaks and valleys of roughness profile on the surface of a galvanized steel sheet, disclosed in JP-A-11-302816, is around 0.11 mm. Therefore, also in this case, the number of peaks and valleys of roughness profile per one inch length is estimated as around 230.

According to the method for manufacturing galvanized steel sheet in the related art, when the roughness profile is created on the surface of rolling roll, the shot-blasting method and the electrical discharge machining create mainly profile valley portions on the surface thereof, thus, mainly the profile peak portions are transferred onto the steel sheet. With the laser machining and the electron beam machining, the area where laser beam irradiated fuses to form profile valley portions, and the profile peak portions appear at the surrounding area. When the texture is transferred onto the steel sheet, the profile peak portions appear centering on individual profile peak portions, to give donut shape pattern. Accordingly, the texture on the surface of galvanized steel sheet formed by temper rolling differs from the dimple-pattern concavity texture described in the present invention.

EXAMPLE 1

1. Creation of Dimple-Pattern Surface Texture

A hot-dip galvanized steel sheet with a substrate cold-rolled steel sheet having 0.8 mm of thickness was subjected to temper rolling to give 0.8% of extension. Using a rolling roll of bright roll having 0.25 $\mu$m of mean roughness surface roughness. After that, a mechanical blasting unit was applied to create dimple-pattern surface texture, under the condition of 280 mm of blasting distance, 7 kg/m$^2$ of mean blasting density, 92 m/s of blasting speed, and a specified blasting time (0.5 to 5 seconds), using high-speed steel particles having 10 to 250 $\mu$m of mean particle size, respectively.

2. Forming Solid Lubrication Film

An aqueous solution of aluminum phosphate (3 Al/P mole ratio=0.8, solid content 30%, supplied from Taihei Chemical Ltd.) was diluted by distilled water to 5% of solid content.

Thus prepared aqueous solution was applied on the galvanized steel sheet having dimple-pattern surface texture prepared by the step (1) using a roll coater. The coating was dried using an induction heater under a condition of 80° C. drying temperature (ultimate sheet temperature). The formed coating film was observed by cross section SEM to give 0.1 to 0.2 $\mu$m of mean film thickness.

The surface texture of the galvanized steel sheet having solid lubrication film was analyzed by a contact stylus roughness meter. Furthermore, the sliding characteristics were determined by measuring the friction factor. The applied bead had 10 mm of width, 59 mm of length in the sliding direction of the sample, and 4.5 mm of radius of curvature at the bottom portion of both ends in the sliding direction. The bottom face of the bead, which was pressed against the sample, was in flat face having 10 mm of width and 50 mm of length in the sliding direction.

Figure 72:
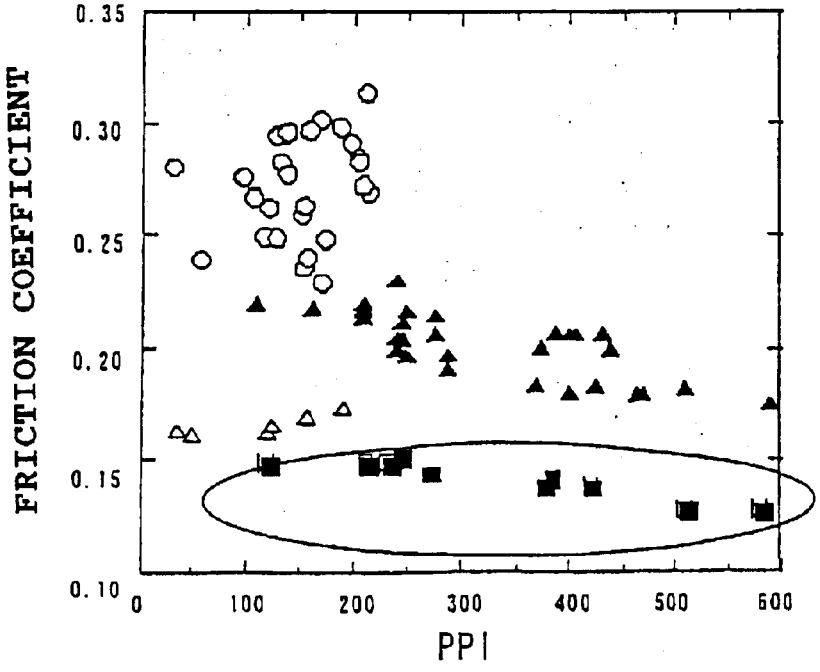
FIG. 72 shows the relation between the peak count PPI and the friction factor in an example and a comparative example of the Embodiment 5.

FIG. 72 shows the relation between the PPI and the friction factor of the films, (symbol ■). The mean roughness Ra of these films was in a range of from 0.5 to 3 $\mu$m.

For reference, FIG. 72 also gives the plots of PPI and friction factor for each of:

1) a steel sheet which was treated by controlling the surface texture using a rolling roll to create only a surface texture without having dimple-pattern, and not forming solid lubrication film, (symbol ○):
2) a steel sheet which was treated by controlling the surface texture using a rolling roll to give a surface texture without having dimple-pattern, similar with 1), and then forming a solid lubrication film by applying the aqueous solution of aluminum phosphate which was same as the example, (symbol Δ); and 3) a steel sheet which was treated solely by controlling the surface texture, without forming solid lubrication film, (symbol ▲).

The rolling roll used for preparing the comparative material having no dimple-pattern surface texture, given in 1), was the one having the surface roughness created by electrical discharge machining. The electrical discharge machining is known as a means to increase the peak count, and has been used in the related art for improving the image sharpness after coating. The example used several rolling rolls each having mean roughness Ra within a range of from 2.4 to 3.6 μm prepared by changing the condition of electrical discharge machining. The extension of temper rolling was set to 1.0%. Thus, the mean roughness Ra and the peak count PPI of the galvanized steel sheet after temper rolling were determined. The mean roughness Ra on the steel sheet created by the roll, in the comparative example, was in a range of from 0.5 to 2 μm.

The comparative material of 2) was prepared by forming a solid lubrication film of aluminum phosphate using a roll coater onto a steel sheet having roughness created by a rolling roll. The method for forming the solid lubrication film was the same as in the example. The formed solid lubrication film had approximate thicknesses of from 0.1 to 0.5 μm.

FIG. 72 shows the far excellent sliding characteristics of steel sheet according to the present invention.

Furthermore, the surface texture of galvanized steel sheet obtained by the method according to the present invention is the one appeared after forming the solid lubrication film, giving 1.5 ìm of mean roughness Ra, 0.44 μm of Wca, and 373 of PPI. The surface texture is in dimple-pattern roughness profile.

EXAMPLE 2

To a hot-dip galvanized steel sheet prepared from a cold-rolled steel sheet having 0.8 mm of thickness, temper rolling was applied to give 0.8% of extension using a bright roll having mean surface roughness of 0.25 μm as the rolling roll. After that, a mechanical blasting unit was used to create a dimple-pattern surface texture on the hot-dip galvanized steel sheet by blasting high-speed steel particles having 65 μm of mean particle size under the condition of 280 mm of blasting distance, 6 kg/m$^2$ of mean blasting density, 92 m/s of blasting speed, and 1 second of blasting.

On the film having the dimple-pattern surface texture described above, the following-given respective solid lubrication films were formed.

A) Aqueous solution of dihydrogen ammonium phosphate (supplied by Taihei Chemicals Ltd., 20% solid content) and iron citrate (supplied by Kanto Kagaku Co., Ltd.) were mixed to a molar ratio of phosphorus to iron of 1:1 to prepare an aqueous solution. Thus prepared solution was diluted by pure water to 5% solid content. Thus prepared aqueous solution was applied on the steel sheet using a roll coater, which was then dried at 80° C. of ultimate sheet temperature to form the solid lubrication film. The mean thickness of the solid lubrication film was 0.3 μm.

B) Iron (II) sulfate and orthophosphoric acid were mixed to a molar ratio of Fe to orthophosphoric acid ($H_3PO_4$) to 1:5 to obtain an aqueous solution of iron phosphate containing sulfuric acid ion, containing 20% of solid matter. The mixture was diluted by pure water to 3% of solid matter. Thus prepared aqueous solution was applied to the steel sheet using a roll coater, which was then dried at 80° C. of ultimate sheet temperature to form the solid lubrication film. The mean thickness of the solid lubrication film was 0.1 μm.

With the similar method as in Example 1, the friction factor, the waviness, and the peak count PPI were determined to give the result of:

the friction factor for A) of 0.140, showing favorable sliding characteristics, with mean roughness Ra of 1.34, Wca of 0.44, and PPI of 370: and the friction factor for B) of 0.141, showing favorable sliding characteristics, with mean roughness Ra of 1.32, Wca of 0.42, and PPI of 365.

Onto the galvanized steel sheet, NOX-RUST 550HN supplied by Parker Industries, Inc. was applied to 2.0 g/m$^2$ of coating weight. The steel sheet was degreased by immersing thereof in the alkali degreasing liquid FC-4480 manufactured by Nihon Parkerizing Co., Ltd. under a condition of 43° C. for 120 seconds, followed by chemical conversion treatment by immersing the steel sheet in Preparen Z and chemical conversion treatment solution PB-L3080, manufactured by Nihon Parkerizing Co., Ltd., under a condition of 43° C. for 60 seconds.

Visual observation on the appearance of steel sheet after chemical conversion treatment confirmed the formation of favorable chemical conversion film without lack of hiding. Observation of phosphate crystals by SEM confirmed the growth of dense crystals, proving favorable chemical conversion treatment performance.

Embodiment 6

The Embodiment 6 relates to a method for manufacturing press-formed product, containing the first step of preparing a member of galvanized steel sheet having dimple-pattern surface texture, and the second step of applying press-forming to the member to obtain designed shape of press-formed product.

The galvanized steel sheet according to the Embodiment 6 shows high oil-retainability at interface between the press-mold and the steel sheet and induces less die-galling, so the press-formability is high and the image sharpness after coating is favorable. Accordingly, when the galvanized steel sheet or a member fabricated therefrom is press-formed, favorable quality is maintained and the image sharpness after coating is also high. Detail of the method for processing the galvanized steel sheet according to the Embodiment 6, or the method for manufacturing press-formed product, is given in the following. The term "press-formed product" referred herein includes members for automobile body.

Figure 73:
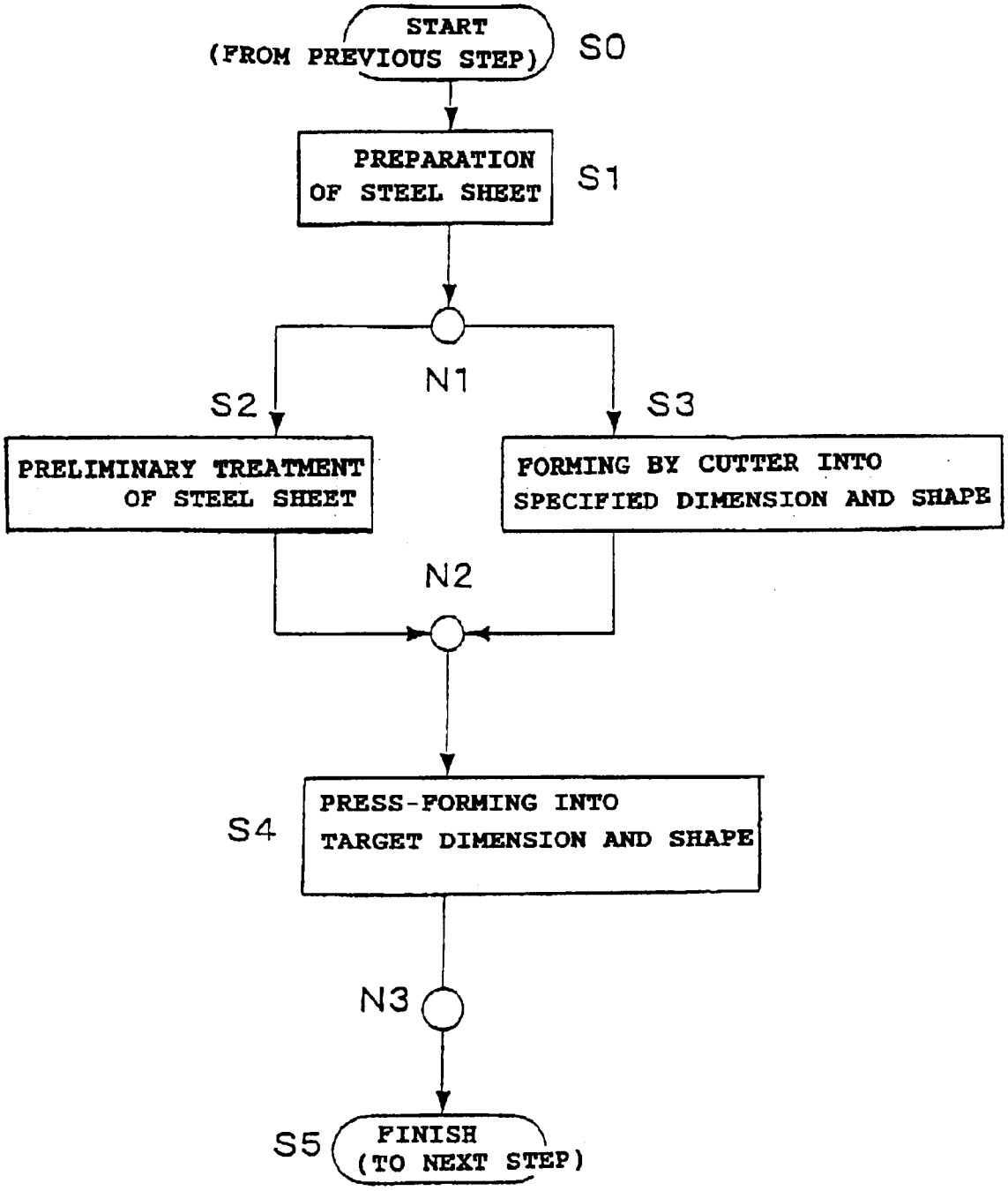
FIG. 73 illustrates the work flow of the method for manufacturing a press-formed product in the Embodiment 6.

FIG. 73 illustrates the work flow of the method for manufacturing a press-formed product according to the Embodiment 6. The method generally follows a step for manufacturing the steel sheet according to the Embodiment 6 or a step for transferring thus manufactured steel sheet to a specified site by, for example, coiling the steel sheet. Accordingly, the manufacturing flow begins with the preparation of steel sheet according to the Embodiment 6, (S0, S1). Before applying press-forming to the steel sheet, a preliminary treatment may be applied to the steel sheet, (S2), or a cutter is applied thereto to form specified dimensions and shape, (S3). During the Step S2, for example, cutting and piercing at specified positions in the width direction of the steel sheet, and the steel sheet is prepared for readily cut-off after or during the succeeding press-forming step in a form of press-formed product or a member for press-forming. During the Step S3, the steel sheet is processed (cut) in a steel sheet member having specified dimensions and shape taking into account of the dimensions and shape of the final press-formed product. The member treated by the Step 2 and the Step 3 is then subjected to press-forming to manufacture the final press-formed product having target dimensions and shape, (S4). Normally the press-forming is given in multi-stage operation, or often in 3 to 7 stages.

The Step 4 may include the cutting of the member passed through the Step 2 and the Step 3 into the one having specified dimensions and shape. The term "cutting" referred herein may, for example, be a work for cutting off unnecessary portions for the final press-formed product, such as edges of the member, from the member that passed the Step 2 and the Step 3, or may be a work for cutting off the member for press-forming along the series of notches or pierced holes given in the width direction of the steel sheet.

N1 through N3 include the cases that the steel sheet, member, or press-formed product is mechanically (automated system using robots in many cases) or manually transferred.

Thus manufactured press-formed product is sent to a succeeding step, at need. Examples of the succeeding step are a step for further applying machining to the press-formed product to adjust the dimensions and shape thereof, a step for transferring the press-formed product to a specified site and storing thereof thereat, a step for applying surface treatment to the press-formed product, and a step for assembling a target product such as automobile using the press-formed product.

Figure 74:
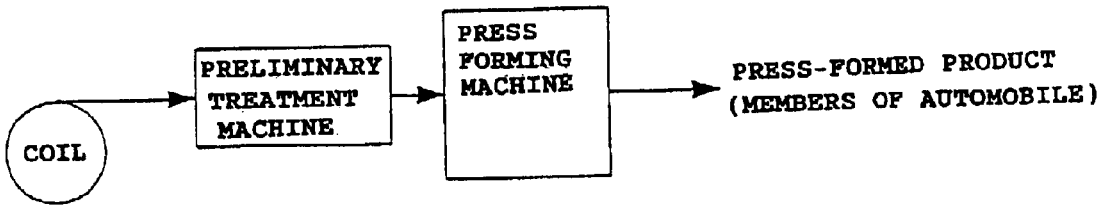
FIG. 74(*a*) and FIG. 74(*b*) show, respectively, apparatuses for carrying out the work shown in FIG. 73 and a block flow diagram illustrating the flow of the steel sheet, the members, and the press-formed product.
Figure 74:
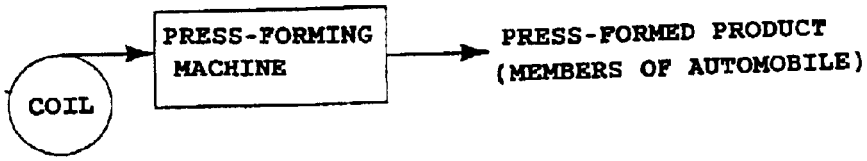

FIG. 74 shows a block flow diagram illustrating the relation of apparatuses that conduct the works shown in FIG. 73 and steel sheet, member, and press-formed product. Referring to the figure, the steel sheet according to the Embodiment 6 is prepared in a coil form, and the press-formed product is manufactured by a press-forming machine. The press-forming machine is a type for conducting multi-stage pressing. Nevertheless, the Embodiment 6 does not limit the type of the press-forming machine to that multi-stage one.

Before the press-forming machine, cutter or other pretreatment unit may be or may not be located. If a cutter is located before the press-forming machine, members having necessary dimensions and shape are cut from a long steel sheet according to the Embodiment 6 supplied from a coil, and the members are press-formed in the press-forming machine to become specified press-formed product. When a pretreatment unit that gives notches and pierced holes in the width direction of the steel sheet, cutting may be done by the press-forming machine along the line of notches and pierced holes. If no pretreatment unit is located, the press-forming machine conducts cutting the steel sheet during the press-forming stage, thus manufacturing a press-formed product having final specified dimensions and shape.

The term "cutting" referred in FIG. 74 is the same with that in FIG. 73.

The press-formed product thus manufactured uses the galvanized steel sheet according to the Embodiment 6 as the starting material, so the favorable quality is maintained and the image sharpness after coating is high even after the press-forming. Those advantages are particularly useful for the case that the press-formed product is the members of automobile, more specifically the members for automobile body.

What is claimed is:

1. A method for manufacturing galvanized steel sheet, comprising the step of adjusting a surface texture of a galvanized steel sheet by blasting solid particles against a surface of the galvanized steel sheet;

the surface texture being at least one selected from the group consisting of a mean roughness Ra on the surface of the steel sheet, a peak count PPI on the surface of the steel sheet, and a filtered centerline waviness Wca on the surface of the steel sheet;

the step of adjusting the surface texture comprising at least one step selected from the group consisting of:

(a) adjusting the mean roughness Ra on the surface of the steel sheet to a range of from 0.3 to 3 $\mu$m;

(b) adjusting the peak count PPI on the surface of the steel sheet to 250 or more; and (c) adjusting the filtered centerline waviness Wca on the surface of the steel sheet to 0.8 $\mu$m or less, and wherein the step of adjusting the surface texture includes adjusting the surface texture of the galvanized steel sheet by blasting solid particles against the surface of the galvanized steel sheet at a blasting density of from 0.2 to 40 kg/m$^2$, the solid particles having average particle sizes of from 10 to 300 $\mu$m.

2. The method according to claim 1, wherein the step of adjusting the surface texture comprises;

adjusting the mean roughness Ra on the surface of the steel sheet to a range of from 0.3 to 3 $\mu$m; and adjusting the peak count PPI on the surface of the steel sheet to 250 or more.

3. The method according to claim 1, wherein the step of adjusting the surface texture comprises:

adjusting the mean roughness, Ra on the surface of the steel sheet to a range of from 0.3 to 3 $\mu$m; and adjusting the filtered centerline waviness Wca on the surface of the steel sheet to 0.8 $\mu$m or less.

4. The method according to 1, wherein the step of adjusting the surface texture comprises:

adjusting the peak count PPI on the surface of the steel sheet to 250 or more; and adjusting the filtered centerline waviness Wca on the surface of the steel sheet to 0.8 $\mu$m or less.

5. The method according to claim 1, wherein the step of adjusting the surface texture comprises:

adjusting the mean roughness Ra on the surface of the steel sheet to a range of from 0.3 to 3 $\mu$m;

adjusting the peak count PPI on the surface of the steel sheet to 250 or more; and adjusting the filtered centerline waviness Wca on the surface of the steel sheet to 0.8 $\mu$m or less.

6. The method according to claim 1, wherein the solid particles have average particle sizes of from 10 to 200 $\mu$m.

7. The method according to claim 1, wherein the solid particles are metallic particles.

8. The method according to claim 1, wherein the solid particles are in near-spherical shape.

9. The method according to claim 1, wherein the step of adjusting the surface texture comprises adjusting the surface texture of the galvanized steel sheet by blasting solid particles against the surface of the galvanized steel sheet at blasting speeds of from 30 to 300 m/sec.

10. The method according to claim 1, wherein the blasting density is of from 0.2 to 20 kg/m$^2$.

11. The method according to claim 1, wherein the galvanized steel sheet has a coating film consisting essentially of n phase.

12. A method for manufacturing galvanized steel sheet, comprising the step of:

temper rolling a galvanize steel sheet to adjust the filtered centerline waviness Wca to 0.7 $\mu$m or less;

adjusting a surface texture of the temper-rolled galvanized steel sheet by blasting solid particles against a surface of the galvanized steel sheet;

the surface texture being at least one selected from the group consisting of a mean roughness Ra on the surf ace of the steel sheet, a peak count PPI on the surface of the steel sheet, and a filtered centerline waviness Wca on the surface of the steel sheet;

the step of adjusting the surface texture comprising:

(a) adjusting the mean roughness Ra on the surface of the steel sheet to a range of from 0.3 to 3 $\mu$m;

(b) adjusting the peak count PPI on the surface of the steel sheet to 250 or more; and (c) adjusting the filtered centerline waviness Wca on the surface of the steel sheet to 0.8 $\mu$m or less.

13. A method for manufacturing galvanized steel sheet comprising the step of adjusting a surface texture of a galvanized steel sheet by blasting solid particles against the surface of the galvanized steel sheet;

the surface texture being at least one selected from the group consisting of a mean roughness Ra on the surface of the steel sheet, a peak count PPI on the surface of the steel sheet, and a filtered centerline waviness Wca on the surface of the steel sheet;

the step of adjusting the surface texture comprising at least one step selected from the group consisting of:

(a) adjusting the mean roughness Ra on the surface of the steel sheet to a range of from 0.3 to 3 $\mu$m;

(b) adjusting the peak count PPI on the surface of the steel sheet to 250 or more; and (c) adjusting the filtered centerline waviness Wca on the surface of the steel sheet to 0.8 $\mu$m or less, wherein the step of adjusting the surface texture comprises blasting solid particles having average particle sizes of from 30 to 300 $\mu$m against the surface of the galvanized steel sheet at a blasting density of from 0.2 to 40 kg/m$^2$, using a wheel blast machine having a distance of 700 mm or less between a rotational center of a wheel thereof and a steel strip.

14. The method according to claim 13, wherein the solid particles have 85% or more weight percentage of the solid particles having size thereof within a range of from 0.5d to 2d to the total weight of the solid particles, where d designates the mean particle size.

15. The method according to claim 13, wherein the solid particles have density of 2 g/cm$^3$ or more.

16. A galvanized steel sheet having a dimple-pattern surface, the dimple-pattern surface having a mean roughness Ra of 0.3 to 3 $\mu$m, and a peak count PPI expressed by the formula: $-50\times Ra\ (\mu m)+300<PPI<600$, which is manufactured by the method according to claim 1.

17. The galvanized steel sheet according to claim 16, wherein the surface has peak count PPI of at least 250.

18. The galvanized steel sheet according to claim 16, wherein the surface has filtered centerline waviness Wca of 0.8 $\mu$m or less.

19. The galvanized steel sheet according to claim 16, wherein the galvanized steel sheet has a coating film consisting essentially of $\eta$ phase.

20. The galvanized steel sheet according to claim 16, wherein the galvanized steel sheet has number densities of concavities of $3.1\times10^2$ counts/mm$^2$ or more at a depth level corresponding to 80% bearing area ratio.

21. The galvanized steel sheet according to claim 16, wherein the surface has a texture giving core fluid holding indexes Sci of 1.2 or more.

22. The galvanized steel sheet according to claim 16, further comprising a solid lubrication film having average thickness ranging from 0.001 to 2 ìm on the surface of the galvanized steel sheet, the solid lubrication film being at least one film selected from the group consisting of an inorganic solid lubrication film, an organic solid lubrication film, and an organic-inorganic composite solid-lubrication film.

23. The galvanized steel sheet according to claim 22, wherein the solid lubrication film is a phosphorus-base oxide film obtained by applying and drying an aqueous solution containing phosphoric acid and at least one cationic component selected from the group consisting of Fe, Al, Mn, Ni, and $NH_4^-$.

24. The galvanized steel sheet according to claim 23, wherein the solid lubrication film contains a P component and an N component, and at least one component selected from the group consisting of Fe, Al, Mn, and Ni;

the solid lubrication film has a molar ratio (a)/(b) in a range of from 0.2 to 6, where (b) designates the amount of P component, and (a) designates the total amount of N component, Fe, Al, Mn, and Ni;

the amount of P component is expressed by a $P_2O_5$ converted value, and the amount of N component is expressed by an ammonium converted value.

25. The galvanized steel sheet according to claim 23, wherein the solid lubrication film contains the P component and the N component as the solid lubrication film components in a form of chemical compound selected from the group consisting of a nitrogen compound, a phosphorus-base compound, and a nitrogen-phosphorus-base compound.

26. The galvanized steel sheet according to claim 23, wherein the solid lubrication film contains at least Fe as the solid lubrication film component.

27. A method for manufacturing galvanized steel sheet of claim 23, comprising the steps of:

applying an aqueous solution containing a cationic component ($\alpha$) and a phosphoric acid component ($\beta$) on the surface of plated layer of a galvanized steel sheet, and drying the applied film without washing thereof with water, thus forming a coating film;

wherein the cationic component ($\alpha$) consists essentially of at least one metallic ion or cation selected from the group consisting of Mg, Al, Ca, Ti, Fe, Co, Ni, Cu, Mo, and $NH_4^-$; and the aqueous solution has a molar concentration ratio ($\alpha$)/($\beta$) ranging from 0.2 to 6, where ($\alpha$) designates the total amount of cations, and ($\beta$) designates the amount of phosphoric acid component; the phosphoric acid is expressed by the value converted to $P_2O_5$ molar concentration.

28. A method for manufacturing press-formed product, comprising:

a first step of preparing a galvanized steel sheet member having a dimple-pattern surface, the dimple-pattern surface having a mean roughness Ra of 0.3 to 3 $\mu$m, and a peak count PPI expressed by the formula: $-50\times Ra\ (\mu m)+300<PPI<600$; and a second step of applying press-forming to the member to obtain designed shape of press-formed product, the first step of preparing a galvanized steel sheet member comprising adjusting a surface texture of a galvanized steel sheet by blasting solid particles having average particle sizes of from 10 to 300 $\mu$m against a surface of the galvanized steel sheet at a blasting density of from 0.2 to 40 kg/m$^2$.

29. The method according to claim 28, wherein the surface has peak count PPI of at least 250.

30. The method according to claim 28, wherein the surface has filtered centerline waviness Wca of 0.8 $\mu$m or less.

31. The method according to claim 10, wherein the blasting density is of from 1 to 20 kg/m$^2$.

32. The method according to claim 12, wherein the step of temper rolling comprises temper rolling a galvanized steel sheet to adjust the filtered centerline waviness Wca to 0.3 $\mu$m or less by using a bright roll.

33. A method according to claim 13, wherein the distance of the wheel blast machine is about 250 to about 500 mm.

34. The method according to claim 1, wherein the blasting density is of from 5 to 20 kg/m$^2$.

* * * * *